US011614292B2

(12) United States Patent
Cook et al.

(10) Patent No.: US 11,614,292 B2
(45) Date of Patent: Mar. 28, 2023

(54) DETACHABLE FIREARM RECEIVER

(71) Applicant: BROWNING, Morgan, UT (US)

(72) Inventors: Ryan D. Cook, Morgan, UT (US); Richard F. Korth, Morgan, UT (US)

(73) Assignee: BROWNING, Morgan, UT (US)

( * ) Notice: Subject to any disclaimer, the term of this patent is extended or adjusted under 35 U.S.C. 154(b) by 149 days.

(21) Appl. No.: 17/143,022

(22) Filed: Jan. 6, 2021

(65) Prior Publication Data

US 2021/0318087 A1 Oct. 14, 2021

Related U.S. Application Data

(63) Continuation of application No. 16/405,711, filed on May 7, 2019, now Pat. No. 10,921,078, which is a continuation of application No. 15/710,600, filed on Sep. 20, 2017, now Pat. No. 10,371,475.

(60) Provisional application No. 62/397,737, filed on Sep. 21, 2016.

(51) Int. Cl.

| | |
|---|---|
| ***F41A 17/36*** | (2006.01) |
| ***F41A 19/15*** | (2006.01) |
| ***F41A 9/26*** | (2006.01) |
| ***F41A 9/73*** | (2006.01) |

(52) U.S. Cl.

CPC ..... *F41A 17/36* (2013.01); *F41A 9/26* (2013.01); *F41A 9/73* (2013.01); *F41A 19/15* (2013.01)

(58) Field of Classification Search

CPC ..... F41A 19/15; F41A 112/02; F41A 19/00

See application file for complete search history.

(56) References Cited

U.S. PATENT DOCUMENTS

| | | | | |
|---|---|---|---|---|
| 1,008,162 | A | 11/1911 | Krnka | |
| 1,042,837 | A | 10/1912 | Tatarek | |
| 1,083,384 | A | 1/1914 | Browning | |
| 1,281,497 | A | 10/1918 | Brauning | |
| 1,306,972 | A | 6/1919 | Nelson | |
| 1,833,431 | A | 11/1931 | Mccormick et al. | |
| 1,898,291 | A | 2/1933 | Browning | |
| 1,898,670 | A * | 2/1933 | Laudensack | F41A 9/55 42/49.02 |
| 2,007,774 | A | 7/1935 | Sedgley et al. | |
| 2,030,149 | A * | 2/1936 | Mossberg | F41A 3/22 42/16 |
| 2,064,888 | A | 12/1936 | Dickinson | |

(Continued)

OTHER PUBLICATIONS

Czechpointusa, "Sa vz 61 rate reducer evaluation (original slow motion)", Obtained from: https://www.youtube.com/watch?v=AwVK3NtOKgM, published on Sep. 6, 2014.

(Continued)

*Primary Examiner* — Joshua E Freeman

(74) *Attorney, Agent, or Firm* — Dorsey & Whitney LLP

(57) ABSTRACT

A number of embodiments of a firearm are disclosed where the firearm includes a magazine configured to hold the bolt in an open position when the magazine is empty. In one embodiment, the firearm includes a bolt stop mechanism that moves between a first position where it allows the bolt to cycle between an open position and a closed position and a second position where it holds the bolt in the open position. The magazine is configured to actuate the bolt stop mechanism to the first position when the magazine is empty.

17 Claims, 65 Drawing Sheets

(56) References Cited

U.S. PATENT DOCUMENTS 2,066,361 A 1/1937 Nolan
2,113,793 A 4/1938 Alfred et al.
2,114,311 A 4/1938 Nolan
2,130,722 A 9/1938 Kobe
2,131,412 A 9/1938 Ostman
2,311,497 A 2/1943 Van Horn et al.
2,321,720 A 6/1943 Whittaker
2,338,984 A 1/1944 Van Horn et al.
2,341,869 A 2/1944 Johnson, Jr.
2,367,572 A 1/1945 Gazda
2,374,378 A * 4/1945 Rice ..... F41A 17/46 42/70.08
2,394,606 A 2/1946 Gazda
2,506,409 A 5/1950 Baumwart
2,638,694 A 5/1953 Morris
2,642,688 A 6/1953 Johnson, Jr.
2,765,562 A * 10/1956 Roper ..... F41A 19/30 42/69.02
2,819,551 A * 1/1958 Baierl ..... F41A 17/64 42/70.08
3,094,803 A * 6/1963 Green ..... F41A 9/66 42/25
3,239,959 A 3/1966 Sefried et al.
3,257,749 A * 6/1966 Donaldson ..... F41A 3/42 42/16
3,341,963 A * 9/1967 Seiderman ..... F41A 3/20 42/16
3,373,521 A 3/1968 Into
3,390,475 A 7/1968 Badali et al.
3,562,944 A 2/1971 Wagner et al.
3,745,687 A 7/1973 Koon
3,846,928 A 11/1974 Ruger et al.
3,905,142 A * 9/1975 Haskell ..... F41A 9/70 42/50
4,005,540 A * 2/1977 Robinson ..... F41A 19/16 42/69.01
4,027,415 A 6/1977 Stoner
4,314,419 A 2/1982 Koon, Jr.
4,332,097 A 6/1982 Taylor, Jr.
4,366,638 A 1/1983 Ketterer et al.
4,384,508 A 5/1983 Sullivan et al.
4,413,546 A 11/1983 Taylor, Jr.
4,445,418 A 5/1984 Sullivan et al.
4,471,549 A 9/1984 Brint et al.
4,487,103 A 12/1984 Atchisson
4,524,672 A 6/1985 Balsavage
4,524,673 A 6/1985 Golden
4,573,394 A 3/1986 Goff, Jr.
4,658,700 A 4/1987 Sullivan
4,676,137 A 6/1987 Stockton et al.
4,689,907 A 9/1987 Gwinn, Jr.
4,744,164 A 5/1988 Rieger
4,745,842 A 5/1988 Shou-fu
4,766,800 A 8/1988 Miller et al.
D297,661 S 9/1988 Gwinn
4,811,510 A 3/1989 Chesnut
4,888,898 A 12/1989 Miller et al.
4,889,032 A * 12/1989 Major ..... F41A 3/80 89/129.01
4,926,742 A 5/1990 Ma et al.
4,930,400 A 6/1990 Brandl et al.
4,965,951 A 10/1990 Miller et al.
4,970,820 A 11/1990 Miller et al.
4,972,617 A * 11/1990 Major ..... F41A 3/80 89/197
5,027,541 A 7/1991 Velezis
5,285,590 A 2/1994 Howard
5,456,153 A 10/1995 Bentley et al.
5,533,291 A 7/1996 Boland
5,561,258 A 10/1996 Bentley et al.
5,600,083 A 2/1997 Bentley et al.
5,628,137 A 5/1997 Cortese
5,704,148 A 1/1998 Valorose
5,761,841 A 6/1998 Snick
5,771,620 A 6/1998 Crawford et al.
5,816,444 A 10/1998 David
5,970,879 A * 10/1999 Jamison ..... F42B 5/025 102/470
6,032,395 A 3/2000 Bentley et al.
6,109,252 A 8/2000 Stevens
6,279,258 B1 * 8/2001 Hashman ..... F41A 3/20 42/16
6,327,953 B1 12/2001 Andresen
6,367,188 B1 4/2002 Vargas
6,502,495 B1 1/2003 Beary
6,510,778 B1 1/2003 Irwin
6,601,496 B1 8/2003 Kalashnikov et al.
6,837,844 B1 1/2005 Ellard et al.
7,428,899 B2 9/2008 Andresen
7,806,036 B2 10/2010 Cook et al.
7,975,420 B2 7/2011 Pestana
8,359,966 B1 1/2013 Brotherton
8,769,854 B1 * 7/2014 Battaglia ..... F41A 3/66 42/75.01
8,783,158 B2 7/2014 Kerbrat et al.
9,091,505 B1 * 7/2015 Battaglia ..... F41C 23/20
9,429,387 B1 * 8/2016 Barfoot ..... F41C 23/20
9,513,076 B2 12/2016 Kolev et al.
10,371,475 B2 8/2019 Cook et al.
10,921,078 B2 2/2021 Cook et al.
2005/0257682 A1 11/2005 Hajjar et al.
2006/0283431 A1 12/2006 Lee et al.
2007/0079539 A1 * 4/2007 Karagias ..... F41A 19/16 42/69.02
2007/0245615 A1 * 10/2007 Karagias ..... F41A 19/10 42/69.02
2007/0277669 A1 * 12/2007 Tertin ..... F41A 11/02 42/69.02
2010/0083551 A1 * 4/2010 Jamison ..... F41A 21/485 42/75.01
2010/0186581 A1 7/2010 Hajjar et al.
2010/0281733 A1 * 11/2010 Constant ..... F41A 3/22 42/16
2010/0307044 A1 * 12/2010 Crow ..... F41A 21/482 42/75.02
2011/0078937 A1 4/2011 Rich
2012/0102804 A1 * 5/2012 Fesas ..... F41A 3/66 42/90
2013/0014418 A1 * 1/2013 Dextraze ..... F41A 11/02 42/16
2014/0076137 A1 3/2014 Lasichak et al.
2014/0224105 A1 * 8/2014 Menefee, III ..... F41A 1/08 42/1.06
2014/0250752 A1 9/2014 Heath
2014/0317983 A1 * 10/2014 Bush ..... F42B 5/32 42/17
2014/0338649 A1 * 11/2014 Williams ..... F41B 11/62 29/401.1
2015/0219414 A1 8/2015 No
2015/0247688 A1 * 9/2015 Zonshine ..... F41A 3/58 42/8
2015/0276343 A1 10/2015 Zusman
2015/0330727 A1 * 11/2015 Kolev ..... F41A 3/70 42/16
2015/0338180 A1 * 11/2015 Noro ..... F41A 17/36 42/6
2016/0187091 A1 * 6/2016 Moretti ..... F41A 19/42 42/69.01
2016/0252316 A1 9/2016 Garrow
2016/0313079 A1 10/2016 Vickers et al.
2016/0313087 A1 * 10/2016 Leasure ..... F41A 11/00
2017/0016690 A1 * 1/2017 Timmons ..... F41A 3/66
2017/0089654 A1 * 3/2017 Findlay ..... F41A 19/16
2017/0122685 A1 5/2017 Kolev et al.
2017/0356705 A1 12/2017 Lytinas
2018/0003454 A1 1/2018 Muska
2018/0017347 A1 * 1/2018 Chang ..... F41A 17/36
2018/0031343 A1 2/2018 Caudle
2018/0066905 A1 * 3/2018 Battaglia ..... F41C 7/00
2018/0120043 A1 5/2018 Duhon

(56) References Cited

U.S. PATENT DOCUMENTS

| | | | |
|---|---|---|---|
| 2018/0372436 | A1 | 12/2018 | Biran et al. |
| 2019/0033021 | A1 | 1/2019 | Lytinas |

OTHER PUBLICATIONS

ForgottenWeapons.com, vz.61 Skorpion, Obtained from: https://www.forgottenweapons.com/submachine-guns/vz61-skorpion/ [retrieved on Sep. 1, 2020].
International Search Report and Written Opinion of the International Searching Authority for International Patent Application No. PCT/US2017/052551, dated Jan. 18, 2018 (25 pages).
Internet Advertisement of Steyr Mannlicher SSG 69 Rifle (circa 1969).
Photograph Nos. 1 and 2 of Blaser R 93 Magazine (circa 1993).
Sig Arms Product Catalog showing Blaser R93 Rifle (date:2000).
www.HomeGunsmith.com Archive [online], Obtained from <http://www.homegunsmith.com/archive/T15960.html>, published on Oct. 20-21, 2006.
Owner's Manual for 22 Semi-Auto 22 Caliber Rifle, Browning, Jul. 27, 2015.
Savioli, United States Statutory Invention Registration No. H164, Nov. 4, 1986.

* cited by examiner

DETACHABLE FIREARM RECEIVER

RELATED APPLICATIONS

This is a continuation of U.S. patent application Ser. No. 16/405,711, filed on 7 May 2019, now U.S. Pat. No. 10,921,078, which is a continuation of U.S. patent application Ser. No. 15/710,600, filed 20 Sep. 2017, now U.S. Pat. No. 10,371,475, which claims the benefit of U.S. Provisional Application No. 62/397,737, filed 21 Sep. 2016, the disclosures of which are incorporated, in their entireties, by this reference.

BACKGROUND

Rimfire firearms are some of the most popular firearms worldwide. The term rimfire refers to the type of cartridge used by these firearms. The cartridges are referred to as rimfire because the firing pin of a firearm strikes and crushes the base's rim to ignite the primer. This is in contrast to the more common centerfire cartridges where the firing pin strikes the primer cap at the center of the base of the cartridge.

The rim of the rimfire cartridge is essentially an extended and widened percussion cap which contains the priming compound, while the cartridge case itself contains the propellant powder and the projectile (bullet). Once the rim of the cartridge has been struck and the bullet discharged, the cartridge cannot be reloaded, because the head has been deformed by the impact of the firing pin.

Rimfire cartridges are limited to low pressures because they require a thin case so that the firing pin can crush the rim and ignite the primer. Rimfire calibers up to .44 (11 mm) were once common when black powder was used as a propellant. However, modern rimfire cartridges use smokeless powder which generates much higher pressures and tend to be of .22 caliber (5.5 mm) or smaller. The low pressures necessitated by the rimfire design mean that rimfire firearms can be very light and inexpensive, which has helped lead to the continuing popularity of these small-caliber firearms.

SUMMARY

A number of representative embodiments are provided to illustrate the various features, characteristics, and advantages of the disclosed subject matter. The embodiments are provided primarily in the context of a rimfire rifle, specifically a .22 caliber rimfire rifle. It should be understood, however, that many of the concepts can be used in a variety of other settings, situations, and configurations such as rimfire handguns, centerfire rifles, centerfire handguns, and the like. It should also be understood that the features, characteristics, advantages, etc., of one embodiment can be used alone or in various combinations and sub-combinations with one another.

A number of embodiments are disclosed of a firearm having a variety of innovative features. The firearm can be a rifle, handgun, long gun, and the like. It can use rimfire or centerfire ammunition. It can have a wide variety of actions including various types of manual and automatic actions. The firearm can use any type of magazine including a rotary magazine. A few of the embodiments of the firearm are summarized below.

A preferred embodiment of the firearm is a rimfire rifle having a rotary magazine that fits in a cavity on the underside of the firearm. The rimfire rifle includes a housing, a stock, a barrel, and a receiver. The barrel is coupled to and extends forward from a front end of the housing. The stock is coupled to and extends backward from the housing. The receiver is also coupled to the housing. Together these components form a highly functional and versatile firearm.

In some embodiments, the firearm includes a receiver that can be readily and easily coupled to and uncoupled from the rest of the firearm. This provides a number of advantages. For example, it makes it possible to quickly and effortlessly swap the receiver with other stock/barrel combinations to provide different shooting experiences. A user can quickly remove the receiver from a target shooting stock/barrel combination (e.g., a semi-grip stock and a relatively long barrel) and inset it into a military stock/barrel combination (e.g., separate full-grip stock with a telescopic butt and a relatively short barrel).

The receiver can be coupled to the firearm in a variety of ways that make it easy to remove. One way is to use a readily releasable fastener such as a push-button fastener to couple the receiver to the rest of the firearm. The user can push the button to release the receiver from the firearm. In this way, the receiver can be released without using any tools or releasing any other fasteners.

In some embodiments, the receiver can be removed or separated from the firearm without moving or detaching any of the other components. For example, the receiver can be removed without moving or detaching the stock and/or barrel from each other or from the housing. This makes it easy to swap receivers with various stock/barrel combinations as explained above.

In some embodiments, the receiver is a self-contained unit that is detachable from the rest of the firearm. Self-contained means that it constitutes a complete and independent unit in and of itself—i.e., the parts of the receiver are captured and remain in an assembled state after the receiver is removed. In contrast, removing the receiver from most other firearms produces a collection of individual parts. The self-contained receiver can include one or more of a trigger mechanism, a slide assembly, a bolt, a magazine port, and the like.

In some embodiments, the firearm includes a self-contained slide assembly. The self-contained slide assembly can be used with various receiver configurations including the self-contained receiver mentioned previously. The self-contained slide assembly can include one or more of a bolt, a spring that biases the bolt forward, a guide rod that guides reciprocal movement of the bolt, a slide base, and the like.

In some embodiments, the housing is configured to receive and hold the receiver. The housing includes an opening and the receiver includes a cocking handle that extends through the opening when the receiver is coupled to the housing. The cocking handle rotates relative to the receiver as the receiver is uncoupled from the housing to allow the cocking handle to pass through the opening in the housing.

In some embodiments, the cocking handle is a captive component of the slide assembly. A captive component is a component that is held, restrained, controlled, or confined by a dominant component or assembly. The cocking handle is held and controlled by the slide assembly, especially when the slide assembly is a self-contained unit.

In some embodiments, the firearm includes a bolt manufactured by metal injection molding. This process significantly reduces the cost of the bolt while still producing a high-quality part. The firearm includes a bolt having a variety of shapes and configurations that make it suitable for metal injection molding.

In some embodiments, the bolt is metal injection molded and then one or more cuts are made using a machining process. In general, it is preferable to reduce the number of machine cuts to no more than three and ideally to none at all. A machine cut is a feature on the component that is cut using a machine cutting tool.

In some embodiments, the bolt includes two or more separate components that are coupled together. The components can be molded separately to reduce the complexity of the molds/process versus molding the bolt as a single piece.

In some embodiments, the bolt includes a separate bolt body and bolt face coupled together to form the bolt. The bolt body and the bolt face only move relative to each other when they are first assembled. They do not move relative to each other during normal operation of the firearm including chambering and extracting cartridges from the breech. Instead, they function the same as a bolt that is an integral unit.

In some embodiments, the bolt body and the bolt face are coupled together by rotating relative to each other from an unlocked position to a locked position. For example, the bolt face can include one or more lugs that rotate into recesses in the bolt body to hold the two components together. This type of fastening arrangement ensures that the bolt body and the bolt face won't become disconnected during operation of the firearm.

In some embodiments, the firearm includes a separate striker and firing pin arrangement that corresponds to the separate components of the bolt. For example, the striker extends longitudinally through the interior of the bolt body and the firing pin extends longitudinally through the interior of the bolt face. When the bolt body and the bolt face are coupled together, the striker and the firing pin are aligned so that the striker contacts the firing pin when the trigger is pulled.

In some embodiments, the firearm includes a slide assembly that is operatively coupled to a trigger disconnector. The trigger disconnector is connected to the sear when the slide assembly is properly positioned in the firearm and the trigger disconnector is disconnected from the sear when the slide assembly is not properly positioned.

In some embodiments, the firearm includes a magazine held in position by a magazine coupling mechanism. The magazine coupling mechanism moves between a first position where the magazine is held in place and a second position where the magazine is released. A spring biases the magazine coupling mechanism to the first position and biases the magazine outward from the firearm when the magazine coupling mechanism is in the second position.

In some embodiments, the magazine coupling mechanism is accessible from the side of the firearm. A user can grip the magazine coupling mechanism on the side of the firearm and move it from the first position to the second position. The magazine coupling mechanism is also accessible from the bottom of the firearm. The user can push the magazine coupling mechanism from the first position to the second position on the bottom of the firearm.

In some embodiments, the firearm is configured to minimize the width in the area adjacent to the sides of the magazine. This is especially desirable when the magazine is a rotary magazine that is already relatively wide. Reducing the width in this area reduces the overall width of the firearm. One way this can be accomplished is by leaving the stock open in this area to eliminate the extra width it provides. In these areas, the stock doesn't cover the receiver. The receiver is exposed on the side of the firearm. In some embodiments, the magazine coupling mechanism is positioned in this area.

In some embodiments, the firearm includes a bolt stop mechanism and a rotary magazine that actuates the bolt stop mechanism. The magazine actuates the bolt stop mechanism after the last cartridge is ejected to hold the bolt open. In some embodiments, the magazine includes a rotor that pushes a tab upward to actuate the bolt stop mechanism after the last cartridge exits the magazine and the firearm fires and ejects the last empty cartridge case.

In some embodiments, the firearm includes a rotary magazine that can be disassembled without releasing the mechanical biasing force that pushes the cartridges out of the magazine. For example, the rotary magazine can include a housing and a rotor positioned in the housing. The rotor is subject to a biasing force that pushes cartridges into the feeding position. The rotary magazine is configured to allow the rotor to be separated from the housing without releasing the biasing force.

In some embodiments, the rotary magazine includes an interior cavity having ridges on the surface that contact the cartridges as they move through the magazine. The ridges prevent the cartridges from scraping along the interior of the cavity, which can cause residue and other debris to build up inside the magazine.

In some embodiments, the ridges are positioned to contact the shell casing portions of the cartridges. This prevents the bullets from coming into contact with anything inside the cavity of the magazine. The ridges are especially useful in connection with rimfire cartridges where the bullets are typically lubricated and the rim protrudes from the base. Without the ridges, the rimfire cartridges would not move as smoothly through the magazine and the lubricant on the bullets would be deposited on the interior of the cavity.

In some embodiments, the rotary magazine can be disassembled without using tools. This makes is easy to field strip the magazine to remove debris or otherwise service the magazine. The magazine can be held together using one or more readily releasable fasteners. In some embodiments, the magazine includes openings that allow debris to exit. The openings can be in any suitable location such as the bottom of the housing. Also, the openings can be configured to only be accessible through a winding passageway to prevent debris from entering through openings.

The Summary is provided to introduce a selection of concepts in a simplified form that are further described below in the Detailed Description. The Summary and the Background are not intended to identify key concepts or essential aspects of the disclosed subject matter, nor should they be used to constrict or limit the scope of the claims. For example, the scope of the claims should not be limited based on whether the recited subject matter includes any or all aspects noted in the Summary and/or addresses any of the issues noted in the Background.

DRAWINGS

The preferred and other embodiments are disclosed in association with the accompanying drawings in which:

FIGS. 97-98 show views from the right side of the frame, and FIGS. 99-100 show views from the left side of the receiver frame.

FIGS. 109-110 show views are from the left side of the receiver, and FIGS. 111-112 show views from the right side of the receiver.

DETAILED DESCRIPTION

Overview

Figure 1:
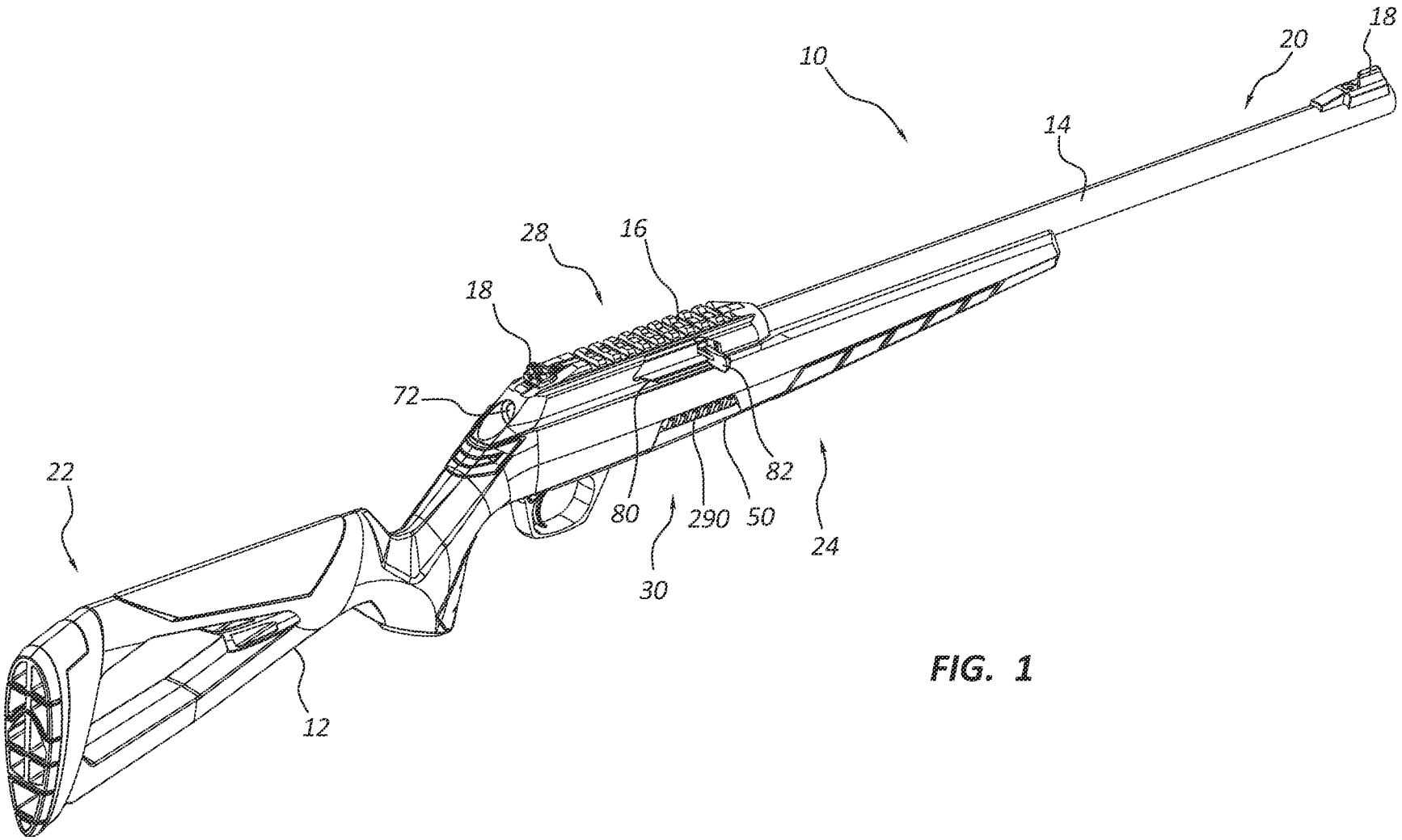
FIGS. 1-2 are perspective views of a firearm from the right side and the left side, respectively.
Figure 2:
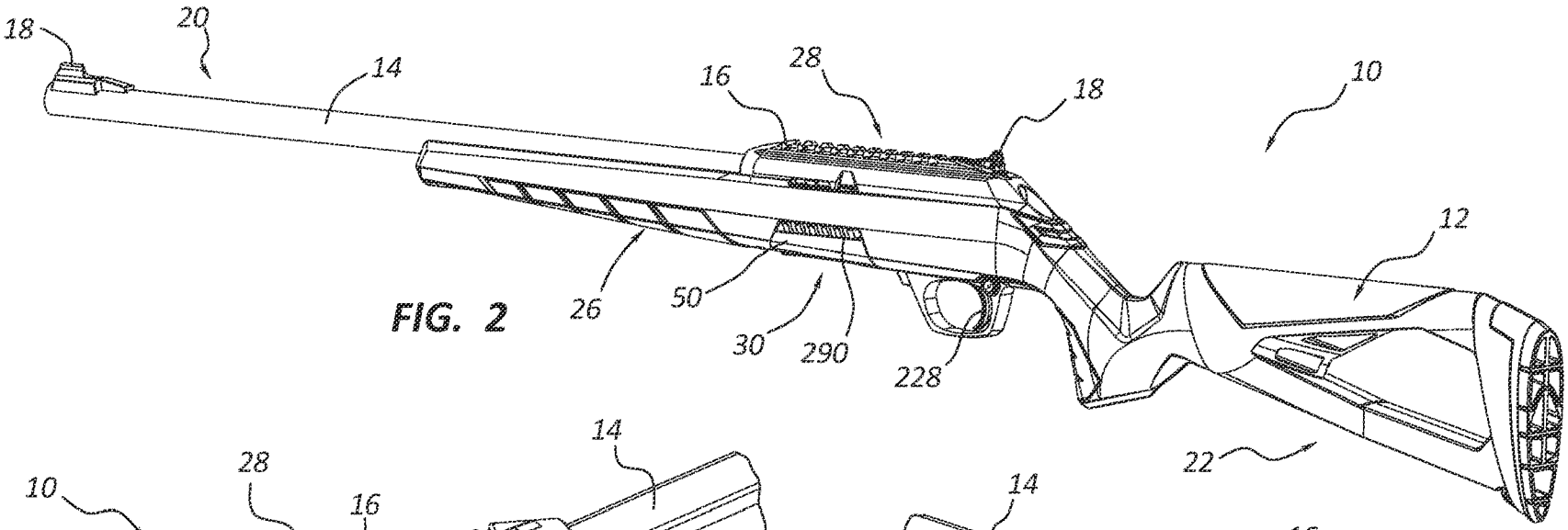
Figure 4:
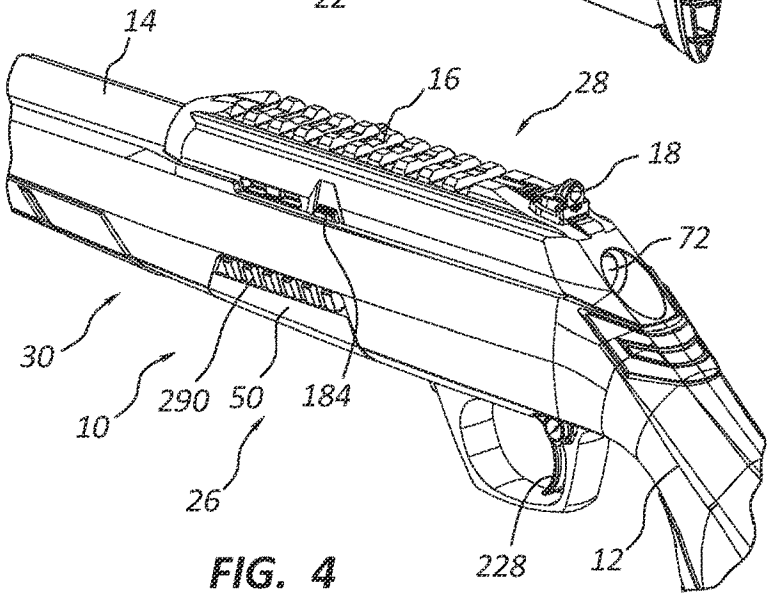
FIGS. 3-6 are perspective views of the action of the firearm from the top right side, top left side, bottom right side, and bottom left side, respectively.
Figure 3:
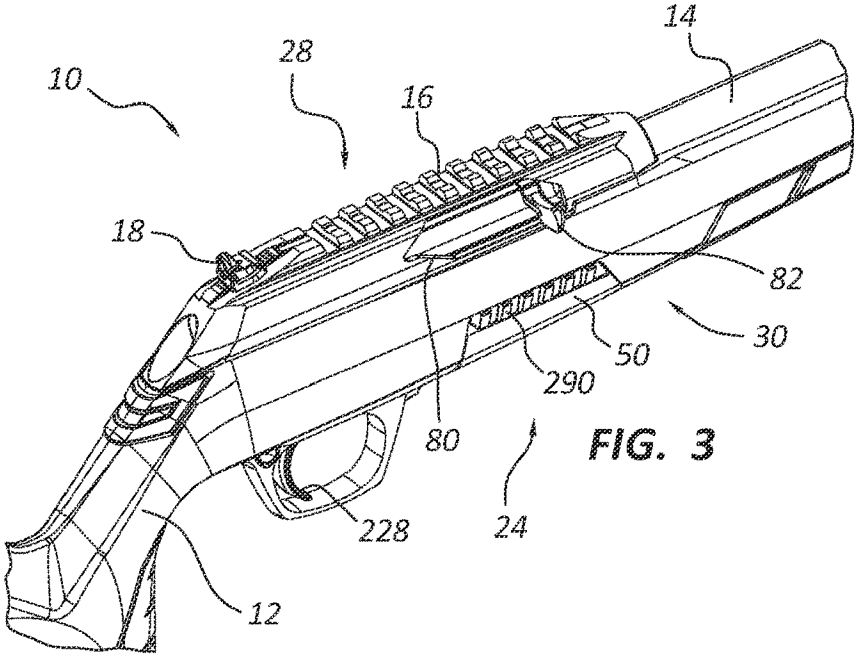
Figure 5:
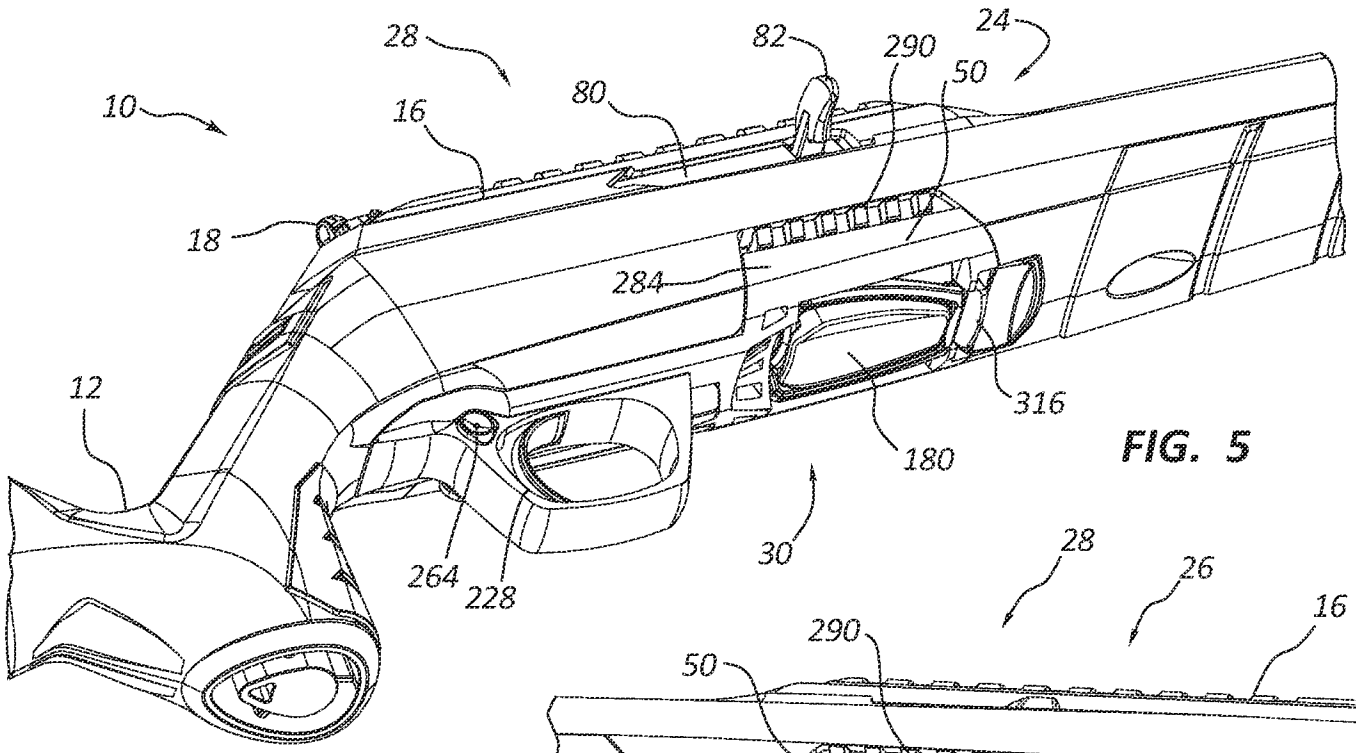
Figure 6:
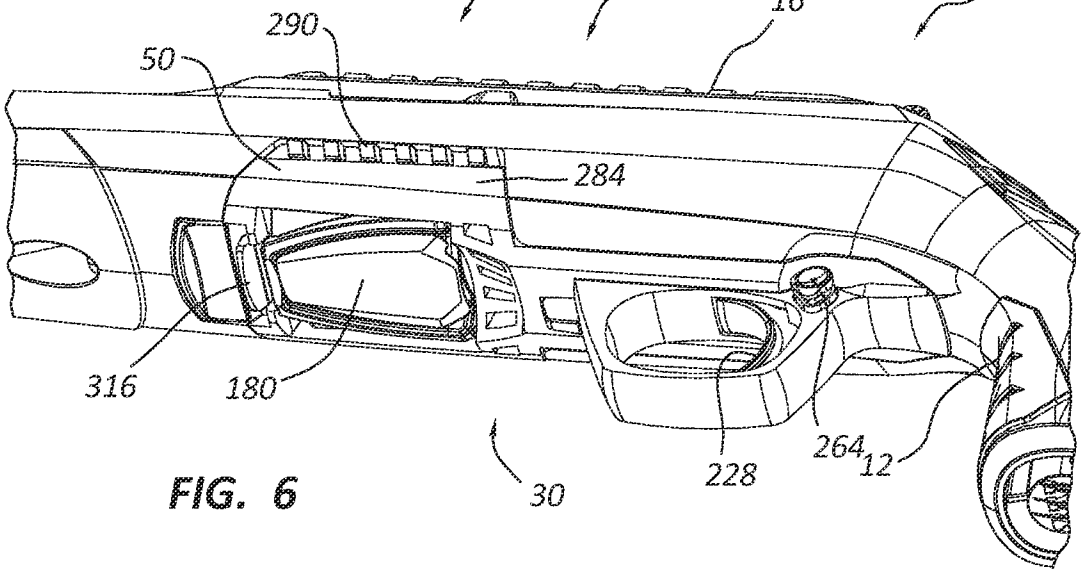

A firearm is a portable weapon that fires a projectile using an explosive charge as a propellant. The following description and corresponding drawings illustrate one embodiment of a firearm 10 having multiple innovative features. Although the features are described in connection with the embodiment shown in the figures, it should be appreciated that most, if not all, of the features can be used with various other types and styles of firearms.

The firearm 10 is a .22 caliber, semi-automatic, rimfire rifle designed primarily for hunting small game, recreational shooting, plinking, and the like. The firearm 10 includes a stock 12, a barrel 14, a housing or frame 16, and a sighting or aiming device 18. These components are coupled together to form a functional firearm 10 as shown in FIGS. 1-6.

The firearm 10 includes a front or first end 20, a back or second end 22, a right or first side 24, a left or second side 26, a top 28, and a bottom 30. The housing 16 also includes a front or first end 32, a back or second end 34, a right or first side 36, a left or second side 38, a top 40, and a bottom 42. The housing 16 is best shown in FIGS. 10-13.

The stock 12 is coupled to the front end 32 and the back end 34 of the housing 16 with fasteners 44 (FIGS. 9-13). The fasteners 44 can be any suitable fasteners including bolts, screws, and the like. In one embodiment, the fasteners 44 are threaded and are received by corresponding threaded holes in the housing 16.

It should be appreciated that the stock 12 can have a variety of configurations. In general, the stock is the part of a firearm into which the barrel and firing mechanism are set. The stock is used to firmly support the firearm and aim it. The stock also transmits recoil into the shooter's body. The stock 12 can sometimes be referred to as a shoulder stock.

The stock 12 is shown in FIGS. 1-6 as a one-piece, semi-grip stock. This configuration is especially suitable for the caliber and style of the firearm 10. It should be appreciated, however, that the stock 12 can include any number of separate pieces and have a variety of grip configurations. For example, the stock 12 can be a one-piece stock, two-piece stock, three-piece stock or the like. Also, the stock 12 can have a straight-grip that proceeds smoothly from the toe to the trigger, a full-grip where the grip is a separate piece that extends downward (common for military firearms), or a thumbhole-grip.

The firearm 10 can also omit the stock depending on its configuration. For example, as discussed below, the firearm 10 can be a handgun in certain embodiments. A handgun generally doesn't include a stock. Instead, it includes a hand grip coupled to a housing or frame.

Returning to FIGS. 10-13, the barrel 14 is coupled to the front end 32 of the housing 16. The back end of the barrel 14 extends through an opening or hole 46 in the front end 32 of the housing 16 and is held in place by a fastener 48. The fastener 48 extends through opposite sides 36, 38 of the housing 16 so that when the fastener 48 is tightened, the sides 36, 38 clamp down on the barrel 14.

It should be appreciated that the barrel 14 can be coupled to the housing 16 in a variety of other ways. Also, the fastener 48 can be any of the fasteners disclosed in this document. In some embodiments, the fastener 48 includes a threaded fastener such as a bolt and nut or a bolt received by a threaded opening in the housing 16.

It should also be appreciated that the barrel 14 can have any of a number of configurations. In general, the barrel 14 is a tube, usually made of metal, through which a projectile is propelled out of the firearm 10 at a high velocity. The barrel 14 is typically rifled to provide increased accuracy but in some embodiments it can be smooth. The barrel 14 can have any suitable length. In some embodiments, the length of the barrel 14 is 18 to 36 inches, 20 to 32 inches, or 24 to 30 inches.

The housing 16 is the central hub of the firearm 10. The other major components of the firearm 10 are coupled to the housing 16. In some embodiments, the other components are coupled to the housing 16 in a manner that allows the action to be removed from the firearm 10 while the other components (stock 12, barrel 14, etc.) remain in place. The housing 16 can have any suitable configuration and be made of any suitable material such as metal and/or composites.

The sighting device 18 can have a variety of configurations. In general, the sighting device is used to aim the firearm 10. The sighting device 18 in the figures is one type of open sights. A rear sight is coupled to the top 40 of the housing 16 and a front sight is coupled to the barrel 14 at the front end 20 of the firearm 10. The firearm 10 is aimed by aligning the front and rear sights with the target.

The sighting device 18 can include other devices besides open sights. For example, the sighting device 18 can include an optical sight that provides the user an image of an aligned aiming point or a pattern superimposed at the same focus as the target. The optical sight can be a telescopic sight, reflector sight, collimator sight, and the like.

It should be appreciated that the firearm 10 can be modified in a variety of different ways to produce an assortment of different embodiments. A few of these embodiments are described in the following. It should be appreciated, however, that the following embodiments are presented as being representative of the many embodiments that are possible and not as an exhaustive list of the embodiments.

Broadly speaking, the firearm 10 can be any caliber, fire any type of cartridge, use any type of action, and take any form. The caliber of a firearm is the diameter of the bore and is commonly given in units of mm or inches—e.g., 7 mm, 0.357 inches. The caliber of a shotgun is given as its gauge—e.g., 12 gauge.

The firearm 10 can be any of a number of suitable calibers. In some embodiments, the caliber of the firearm ranges from .17 to .50. Common calibers for the firearm 10 include .17 Hornady Magnum Rimfire, .22 Long Rifle, .223 Remington, 5.56×45 mm NATO, .243 Winchester, .270 Winchester, .280 Remington, .30-06 Springfield, .308 Winchester, .357 Magnum, 9 mm, .40 S&W, .44 Magnum, .45 ACP, and the like.

The firearm 10 can fire any suitable type of cartridge including rimfire and centerfire cartridges. In some embodiments, the firearm shoots rimfire cartridges. For example, the firearm 10 can be configured to fire any of the following rimfire cartridges: .22 Short, .22 Long, .22 Long Rifle, .22 Winchester Magnum Rimfire, .17 Hornady Magnum Rimfire, .17 Hornady Mach 2, .17 Winchester Super Magnum, and the like. In some other embodiments, the firearm shoots centerfire cartridges. For example, the firearm 10 can be configured to fire any of the centerfire cartridges described above.

The firearm 10 can have any type of known action. In some embodiments, the firearm 10 includes a manual action such as a bolt action, lever action, pump action, revolver, break action, and the like. In other embodiments, the firearm 10 includes an automatic action such as a semi-automatic action or fully automatic action that relies on blowback operation, recoil operation, gas operation, and the like.

The firearm 10 can take any suitable form. In some embodiments, the firearm 10 is a rifle. In other embodiments, the firearm 10 is a handgun. Regardless of the form of the firearm 10, it can have any of the calibers, shoot any of the cartridges, or use of any of the actions described above.

The firearm 10 can be designed for a variety of purposes. As mentioned above, the firearm 10 shown in the figures is designed more for recreational shooting and small game hunting. In other embodiments, the firearm 10 can be designed for military, law enforcement, and the like. In yet other embodiments, the firearm 10 can be configured for big game hunting and the like. Numerous configurations are possible.

Receiver

The firearm 10 includes a receiver 50, which is, generally, the assembly that houses the operating parts of the firearm 10. The receiver 50 can include a variety of components. In some embodiments, particularly those having a bolt action or semi-automatic action, the receiver 50 includes a frame or body 52, a slide assembly or bolt carrier group 54, a trigger mechanism or trigger group 56, a magazine cavity or magazine port 58, and/or a delay mechanism 400.

It should be appreciated that the receiver 50 can have other configurations that include more or fewer components. In those embodiments where the firearm 10 is a rifle, the receiver 50 typically includes a frame and at least one of a slide assembly or a trigger mechanism. In those embodiments where the firearm 10 is a handgun, the receiver 50 typically includes a frame and at least one of a trigger mechanism or a magazine cavity.

The frame 52 includes a front or first end 60, a back or second end 62, a right or first side 64, a left or second side 66, a top 68, and a bottom 70. It should be appreciated that the ends 60, 62, sides 66, 68, top 68, and bottom 70 can also be used to refer to the receiver 50—i.e., the receiver 50 includes a front end 60, etc.

The slide assembly 54 is coupled to the top 68 of the frame 52. The trigger mechanism 56 is coupled to the bottom 70 of the frame 52 near the back end 62. The magazine cavity 58 is located on the bottom 70 of the frame 52 near the front end 60. The barrel 14 extends through an opening or hole 104 in the front end 60 of the frame 52 and is flush with the bolt 96.

The frame 52 can be made of any suitable material using any suitable process. In some embodiments, the frame 52 is made of forged, machined, or stamped steel or aluminum. In some other embodiments, the frame 52 is made of polymeric materials or sintered metal powder.

In some embodiments, the receiver 50 is a self-contained unit that can be detached from the rest of the firearm 10. Self-contained means that it constitutes a complete and independent unit in and of itself—i.e., the parts of the receiver 50 are captured and remain in an assembled state after the receiver 50 is removed.

A self-contained receiver 50 provides a number of advantages. One is that the components of the receiver 50 stay together when it is removed from the firearm 10. This makes it easier to handle and reduces the likelihood of parts being lost. It also makes it easy to use the receiver 50 with various combinations of stocks/barrels. The receiver 50 can be removed as a unit from one stock/barrel combination and inserted into another stock/barrel combination with ease.

In the U.S., the receiver 50 is considered the firearm for legal purposes. The user can purchase a single receiver 50 and use it with a variety of stock/barrel combinations to create different shooting experiences without owning multiple firearms that may be subject to different regulations.

The receiver 50 can be used with any of the stocks 12 and barrels 14 described above. For example, the receiver 50 can be used with one stock/barrel combination that is designed for accuracy. It can include a semi-grip stock 12 and a 32 inch barrel 14. The receiver 50 can be removed from this stock/barrel combination and inserted into another one that is designed for tactical purposes. This stock/barrel combination can include a full-grip folding stock 12 and a 22 inch barrel 14. Numerous other stock/barrel combinations are possible. Switching between the different stock/barrel combinations is simply a matter of removing the receiver 50 from one combination and inserting it into another combination.

It should be appreciated that the receiver 50 can also be in other forms besides a self-contained unit. For example, the receiver 50 can be configured so that the individual components do not stay coupled together when they are removed from the rest of the firearm 10.

In some embodiments, the receiver 50 is coupled to the firearm 10 in a manner that makes it easy to remove. This is especially advantageous when the receiver 50 is a self-contained unit. It should be appreciated, however, that the receiver 50 can be easy to remove regardless whether it is a self-contained unit or not.

There are numerous ways the receiver 50 can be coupled to the rest of the firearm 10 to make it easy to remove. In some embodiments, the receiver 50 is coupled to the housing 16 using a readily releasable fastener 72. For example, the fastener 72 can be a push-button fastener as shown in FIGS. 7-14. The user can release the receiver 50 by pushing the fastener 72.

In some embodiments, the receiver 50 can be coupled to and uncoupled from the firearm 10 without using any tools. The receivers on conventional firearms can be removed but they require a tool to unscrew fasteners, remove pins, and the like. The receiver 50 can be easily removed without using any tools.

Figure 13:
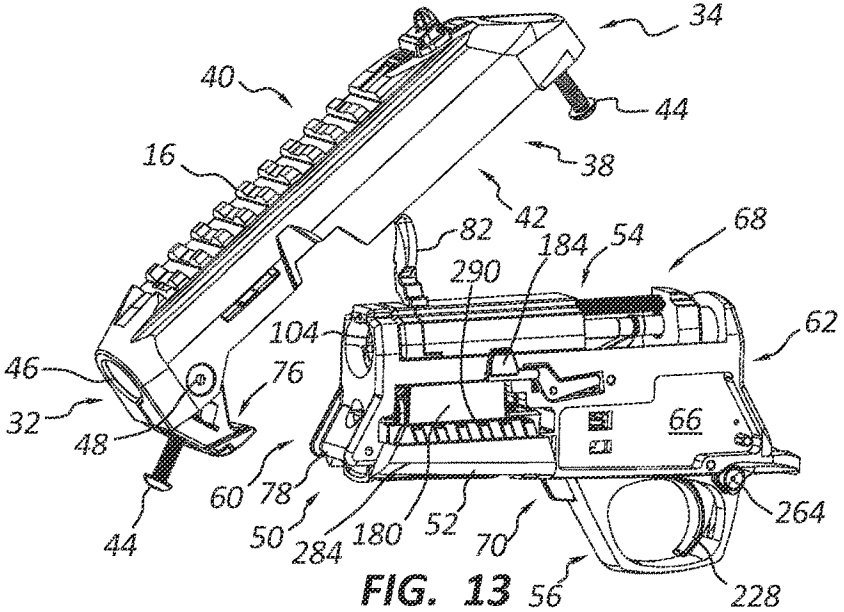
FIGS. 12-13 are perspective view of the receiver completely detached from the housing. The views are from the left side and right side of the receiver, respectively.
Figure 12:
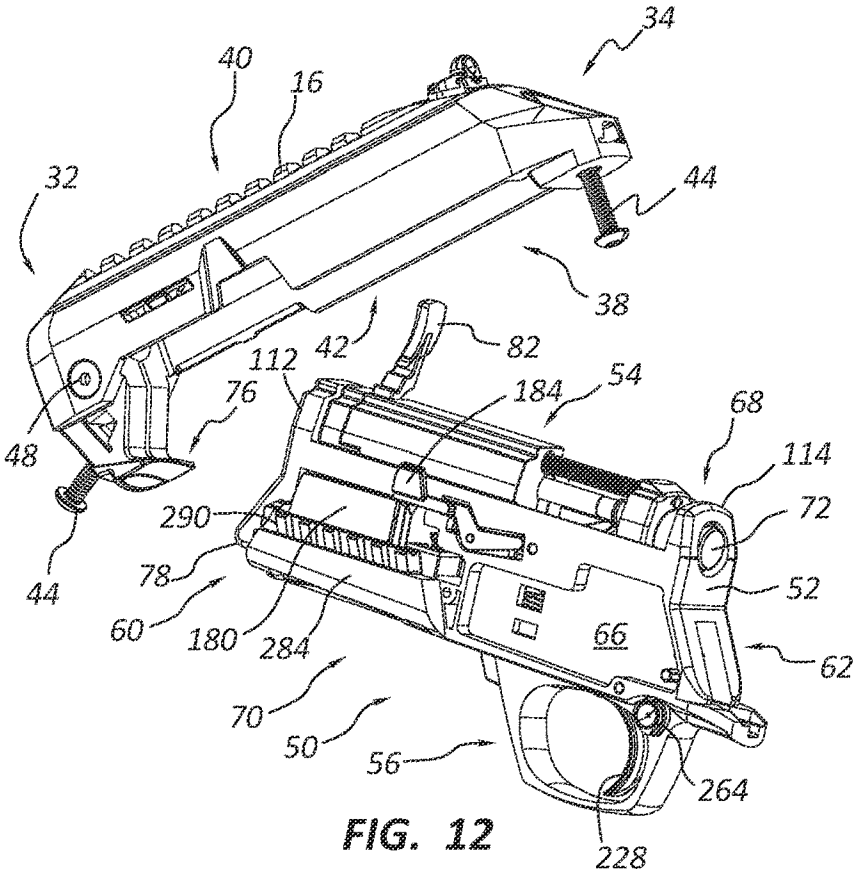
Figure 16:
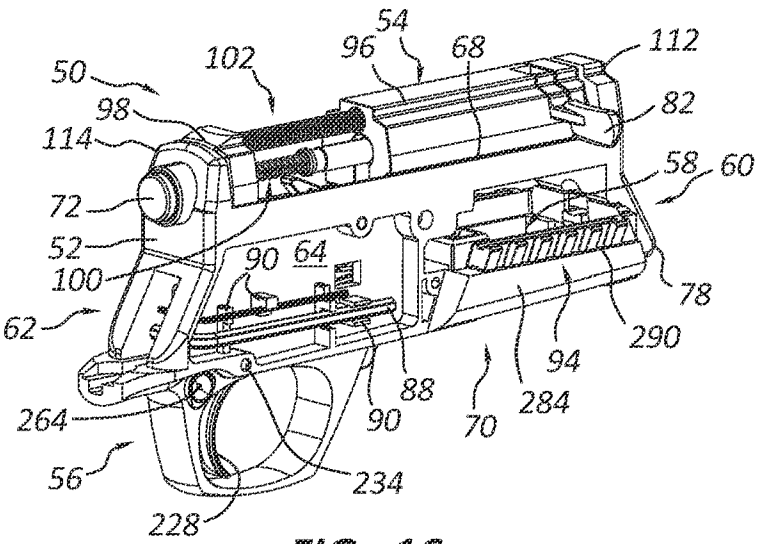
FIGS. 15-18 are perspective views of the receiver from the back left side, back right side, front right side, and front left side, respectively.
Figure 15:
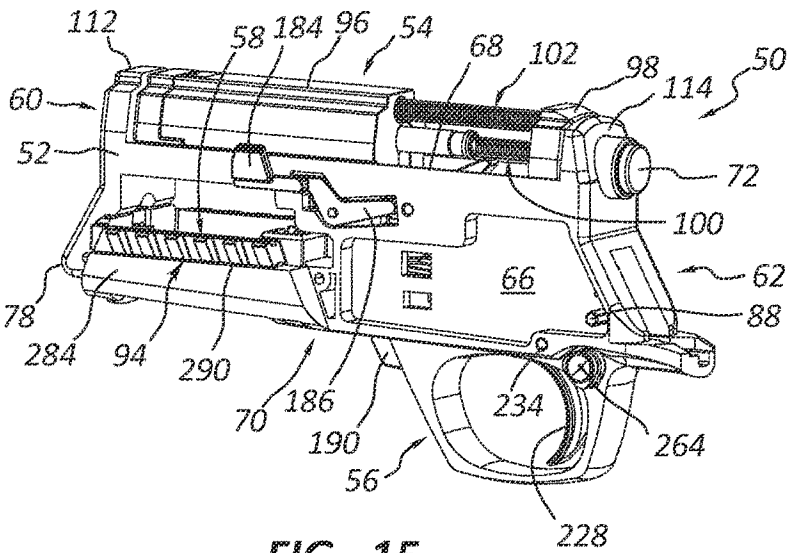
Figure 18:
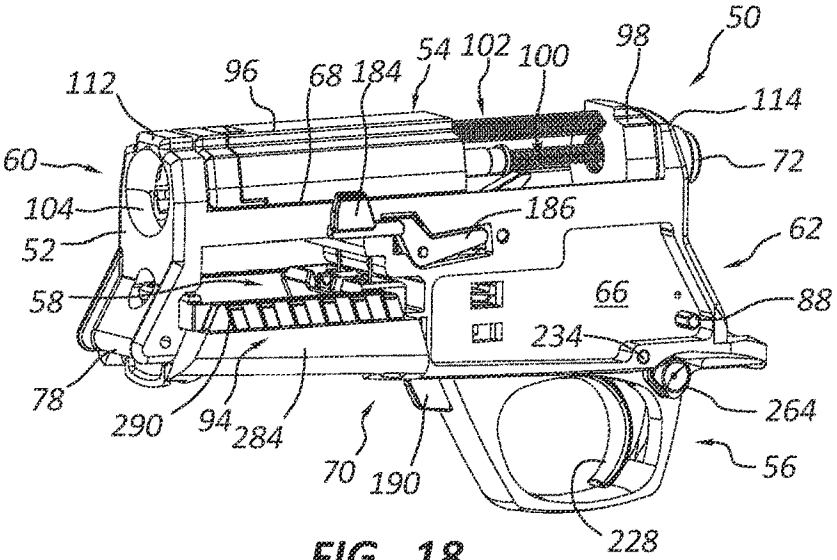
Figure 17:
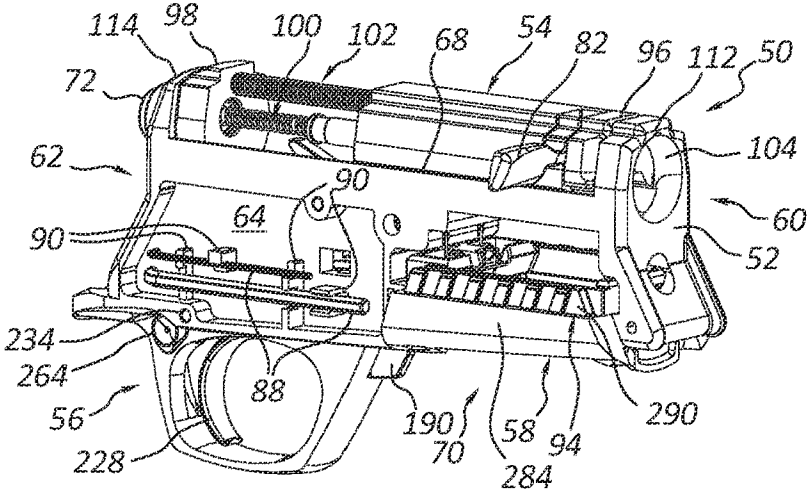
Figure 20:
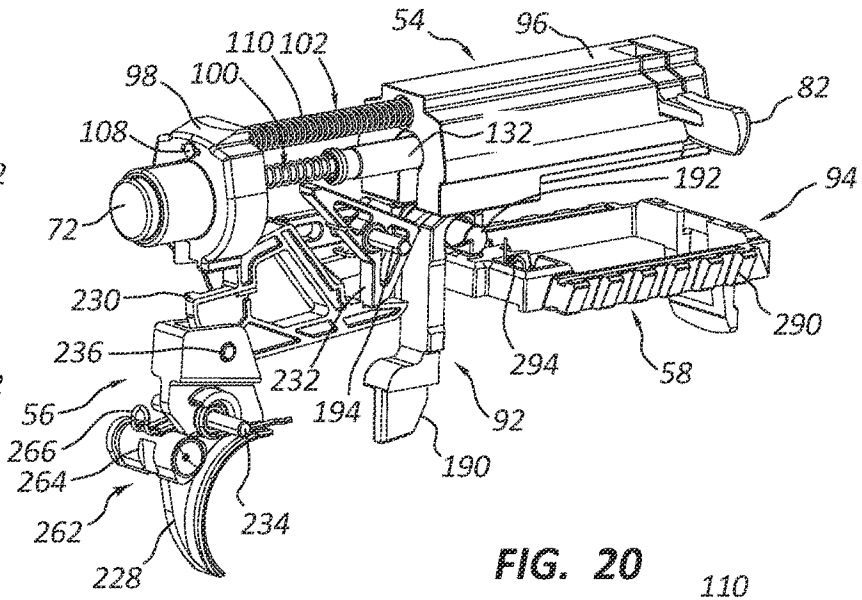
FIGS. 19-22 are perspective views of the receiver with the frame removed to better show the internal components. The views are from the back left side, back right side, front right side, and the front left side, respectively.
Figure 22:
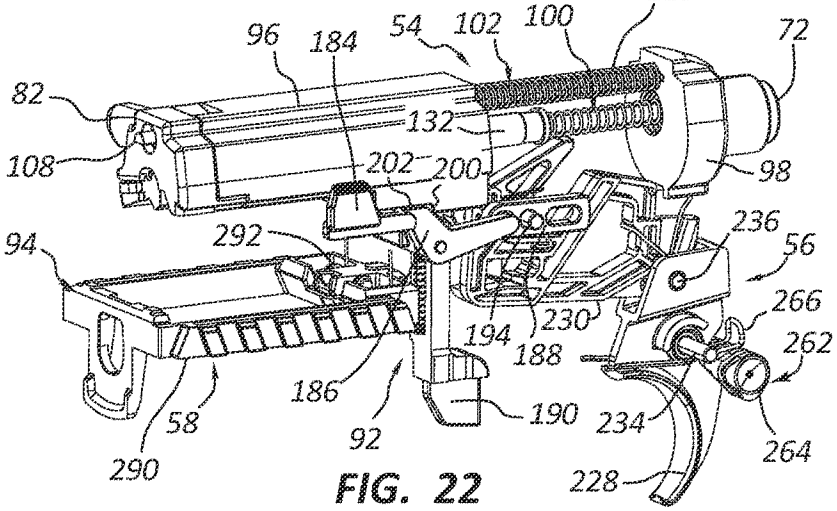

In general, the receiver 50 moves between a first position shown in FIGS. 1-6 where it is coupled to the housing 16 and a second position shown in FIGS. 12-13 where it is uncoupled from the housing 16. The fastener 72 is used to couple the receiver 50 to the housing 16 and uncouple the receiver 50 from the housing 16.

In some embodiments, the fastener 72 moves between an extended or first position shown in FIGS. 1-6 and 14-18 where the receiver 50 is held in the first position and a retracted or second position shown in FIGS. 7-13 where the receiver 50 can move to the second position. With reference to FIGS. 1-6, the fastener 72 moves forward and backward between the extended position and the retracted position. In other words, the fastener 72 moves in a direction that is at least approximately parallel to a lengthwise direction of the housing 16 as it moves between the extended position and the retracted position.

When the fastener 72 is in the extended position, it extends through an opening or hole 74 (FIG. 7) in the back end 34 of the housing 16. The fastener 72 can be pushed forward to move it to the retracted position where it is pushed through the opening 74 and no longer held in position by the housing 16. The fastener 72 can be biased towards the extended position by the spring as explained in greater detail below in connection with the slide assembly 54.

In some embodiments, the fastener 72 is a captive component of the receiver 50. In other words, the fastener 72 is part of the self-contained unit that is the receiver 50. The fastener 72 can be actuated between a fastened state and an unfastened state while being a captive component of the receiver 50. Because it is a captive component, the fastener 72 is much less likely to be lost in the process of coupling or uncoupling the receiver 50 from the firearm 10.

Figure 7:
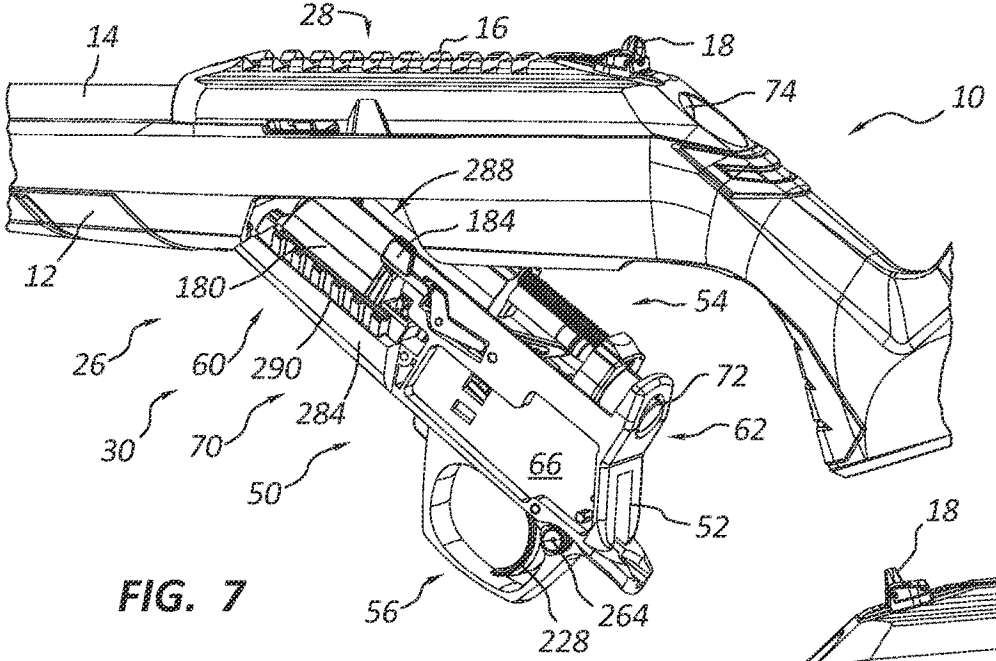
FIGS. 7-9 are perspective views of the action of the firearm with the receiver partially detached. The views are from the left side, right side, and bottom of the firearm, respectively.
Figure 8:
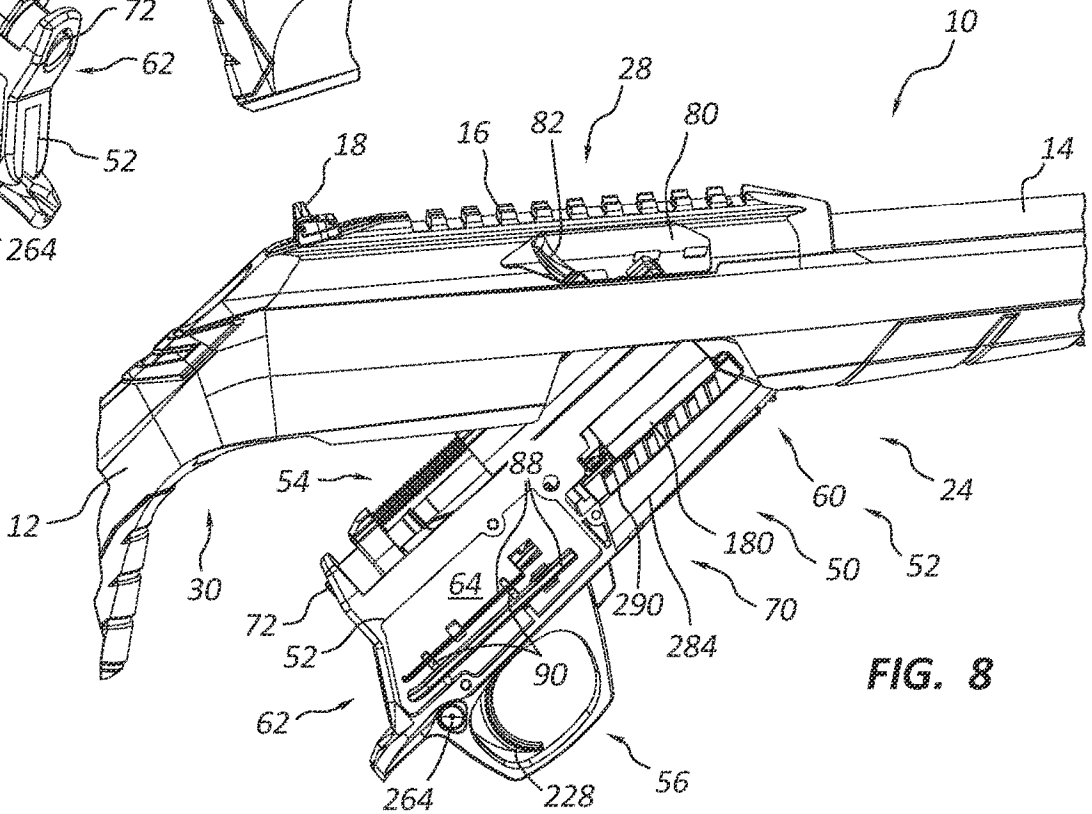
Figure 9:
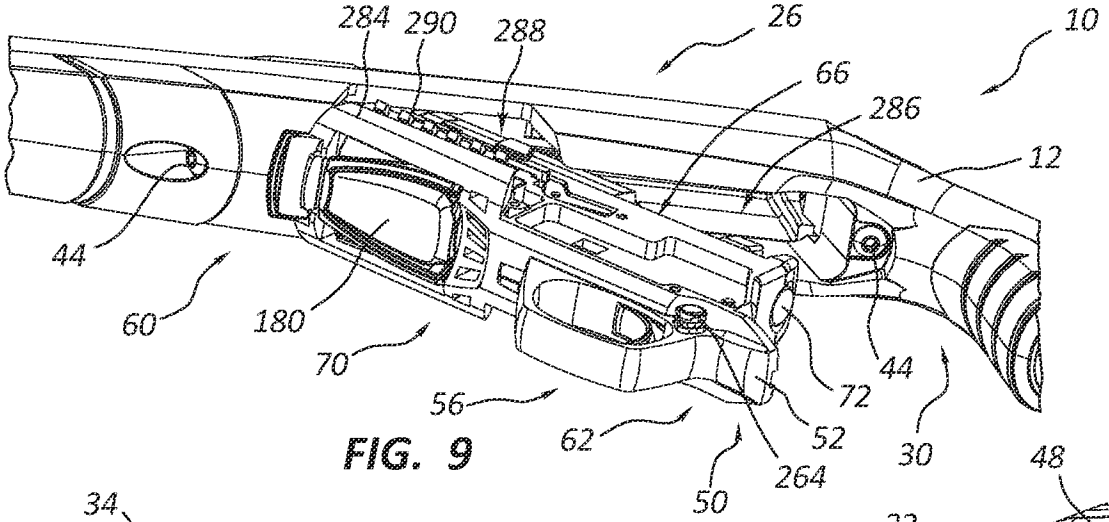
Figure 10:
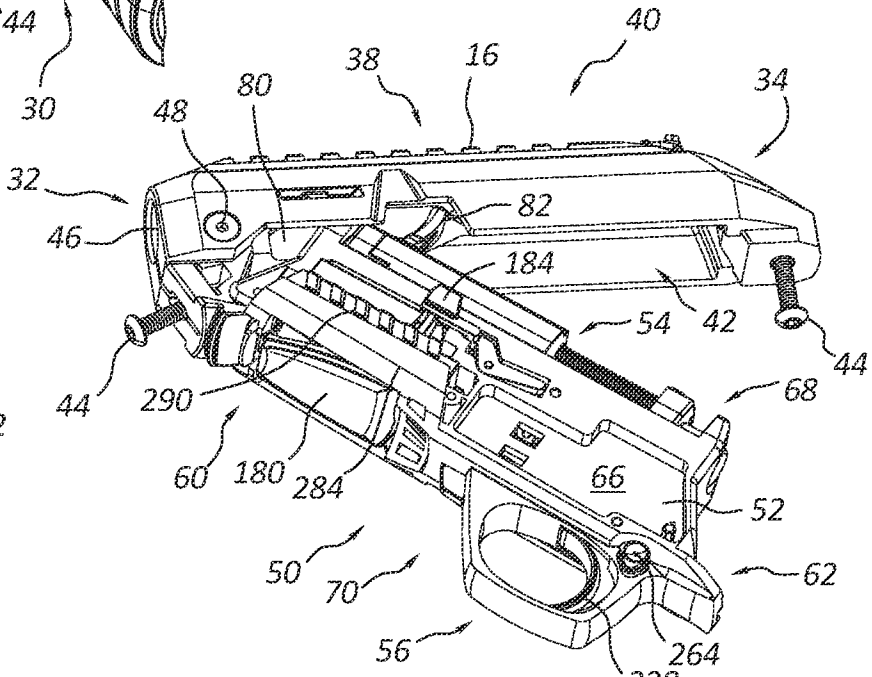
FIGS. 10-11 are perspective views of the receiver in the firearm partially detached from the housing. The views are from the left side and right side of the receiver, respectively.
Figure 11:
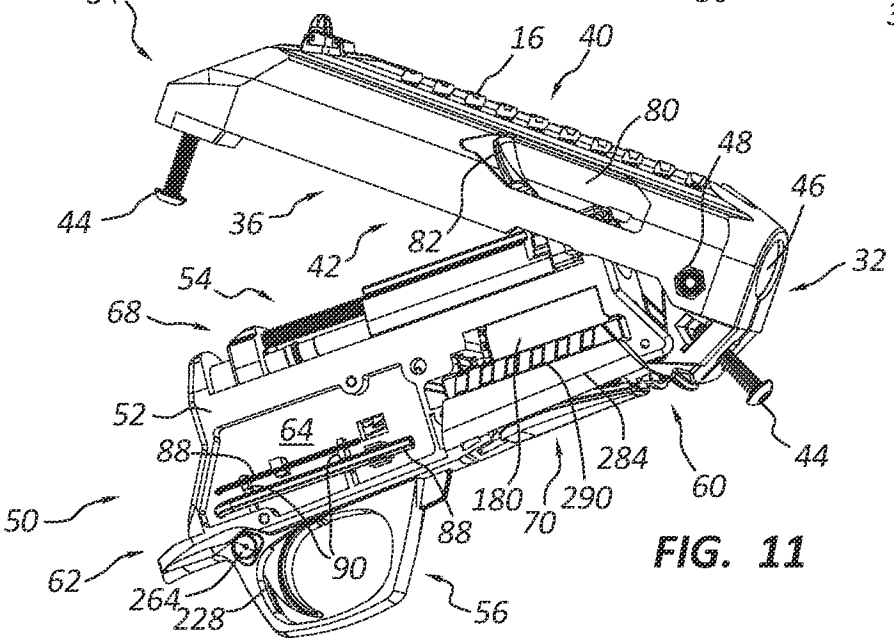

Referring to FIGS. 7-9, the receiver 50 rotates downward from the bottom 30 of the firearm 10 when the fastener 72 is released or depressed. FIGS. 10-11 show how the receiver 50 rotates downward from the bottom 42 of the housing 16. The front end 32 of the housing 16 includes a recess 76 configured to receive a corresponding projection 78 on the front end 60 of the receiver 50. The projection 78 rotates in the recess 76 as the receiver 50 moves between the first position and the second position.

The receiver 50 rotates downward on an axis that extends through the projection 78 at in a direction that is perpendicular to a lengthwise direction of the firearm 10. The axis is at least approximately horizontal when the lengthwise direction of the firearm 10 is oriented horizontally. Also, the axis is positioned in the area where the front end 32 and the bottom 42 of the housing 16 meet. It should be appreciated that the axis need not be fixed. It can move forward or backward a modest amount as the receiver 50 rotates downward.

In some embodiments, the receiver 50 can be coupled to and uncoupled from the rest of the firearm 10, particularly, the housing 16, without detaching, or even moving, the stock 12, barrel 14, housing 16, and/or any other components of the firearm 10. This provides a significant advantage to the firearm 10 in comparison to conventional firearms which often require removal of at least the stock and/or barrel to remove the receiver.

In one embodiment, the receiver 50 can be coupled to and uncoupled from the rest of the firearm 10 without moving the stock 12. In another embodiment, the receiver 50 can be coupled to and uncoupled from the rest of the firearm 10 without moving the barrel 14. In another embodiment, the receiver 50 can be coupled to and uncoupled from the rest of the firearm 10 without moving the housing 16. In another embodiment, the receiver 50 can be coupled to and uncoupled from the rest of the firearm 10 without moving any component of the firearm 10 other than a single fastener 72.

In some embodiments, the housing 16 includes an opening or cartridge ejection port 80 through which cartridges are ejected from the firearm 10. The receiver 50 includes a cocking handle 82 (alternatively referred to as a charging handle or bolt handle) extending outward through the opening 80 when the receiver 50 is coupled to the housing 16. The cocking handle 82 is used to reciprocate the bolt, eject a cartridge, and/or load another cartridge.

The cocking handle 82 can be part of the self-contained unit that is the receiver 50. In other words, the cocking handle 82 is a captive component of the receiver 50 that is removed from the firearm 10 with the receiver 50. The housing 16, the receiver 50, and the cocking handle 82 are all configured so that the cocking handle 82 can be easily removed with the receiver 50.

In some embodiments, the cocking handle 82 is rotatably coupled to the receiver 50. When the receiver 50 is uncoupled from the housing 16, the cocking handle 82 rotates from an at least substantially horizontal orientation shown in FIGS. 1, 3, and 5 to an at least substantially vertical orientation shown in FIGS. 8-13. When the receiver 50 is coupled to the housing 16, the cocking handle 82 rotates from the vertical orientation to the horizontal orientation.

The back end 62 of the receiver 50 rotates downward as the receiver 50 is uncoupled from the housing 16 as shown in FIGS. 8 and 11. The rotational movement of the receiver 50 causes the cocking handle 82 to simultaneously rotate: (1) backward relative to the opening 80 and (2) upward relative to the rest of the receiver 50.

In effect, the cocking handle 82 simultaneously rotates on two perpendicular axes as the receiver 50 is coupled to and uncoupled from the housing 16. The first axis is the transverse axis that the receiver 50 rotates on as it is uncoupled from the housing 16. The second axis is the lengthwise axis of the receiver 50. The rotation on both axes causes the cocking handle 82 to simultaneously move: (1) downward and backward when the receiver 50 is uncoupled from the housing 16 and (2) upward and forward when the receiver 50 is coupled to the housing 16.

The opening 80 is sized and shaped to allow the cocking handle 82 to rotate in the manner shown in FIGS. 7-11. In some embodiments, the back end of the opening 80 is pointed or oblong shaped so that the cocking handle 82 can pass through it as the receiver 50 is coupled to and uncoupled from the housing 16.

The geometries of the housing 16, the receiver 50, and the cocking handle 82 interact to rotate the cocking handle 82 automatically as the receiver 50 is coupled to and uncoupled from the housing 16. The user does not need to manually move the cocking handle 82 at any point in this process.

When the receiver 50 rotates downward out of the housing 16, the bottom of the cocking handle 82 contacts the bottom edge of the opening 80, which pushes the cocking handle 82 upward until it passes cleanly through the back of the opening 80 as shown in FIGS. 10-11. When the receiver 50 rotates upward into the housing 16, the top of the cocking handle 82 contacts the underside of the top 40 of the housing 16, which pushes the cocking handle 82 downward until the receiver 50 is secured to the housing 16.

Figure 14:
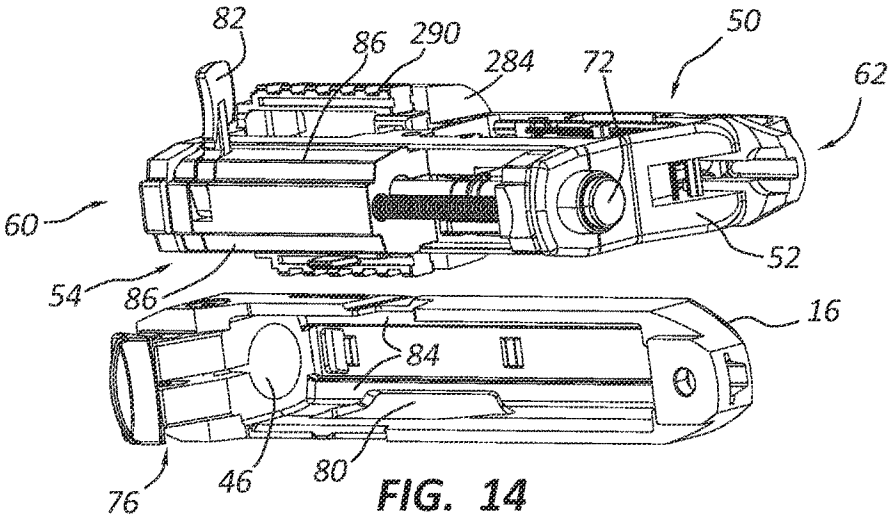
FIG. 14 is a perspective view of the receiver positioned adjacent to the housing. The receiver is shown from the top and the housing is shown from the bottom to illustrate how the receiver is received in the housing.

When the receiver 50 is secured to the housing 16, the top 40 of the housing 16 contacts the top of the cocking handle 82 and prevents the cocking handle 82 from rotating upward. FIG. 14 shows how the top 68 of the receiver 50 fits into and mates with the top 40 of the housing 16. Specifically, the underside of the top 40 of the housing 16 includes grooves 84 that are received by recesses 86 in the top 68 of the receiver 50.

In some embodiments, the receiver 50 includes one or more tools 88 as shown in FIGS. 8, 11, and 16-17. The tools 88 are securely coupled to the frame 52 using fasteners 90. The tools 88 can be used to disassembly various components of the firearm. For example, the tools 88 can be used to tighter or loosen the fasteners 44 and thereby couple or uncouple the stock 12 from the housing 16. The tools 88 can also be used to tighten or loosen the fastener 48 and thereby couple or uncouple the barrel 14 from the housing 16. In one embodiment, the tools 88 include two hex key tools that are sized to correspond to the fasteners 44, 48, respectively.

FIGS. 19-22 show one embodiment of the receiver 50 with the frame 52 removed to better illustrate the various components and subsystems that are part of the receiver 50. In this embodiment, the receiver 50 includes the slide assembly 54, the trigger mechanism 56, the magazine cavity 58, a bolt stop mechanism or slide stop mechanism 92, and a magazine coupling mechanism 94. Each of these components is described in greater detail as follows.

Slide Assembly

The slide assembly 54 generally includes the components for the system of operation for the firearm 10. In the embodiment shown in FIGS. 19-22 and 28-31, the slide assembly 54 includes a bolt or bolt assembly 96, a slide base 98 (alternatively referred to as a recoil spring base or recoil spring plug), a striker mechanism or axial hammer mechanism 100, and a cycling mechanism or recoil cycling mechanism 102.

It should be appreciated that the slide assembly 54 can have other configurations that include more or fewer components than those shown in FIGS. 19-22 and 28-31. Also, the components in the slide assembly 54 can be configured differently than what is shown in the Figs. For example, the striker mechanism 100 can rely on a hammer that rotates on an axis. Numerous other configurations are also possible.

The slide assembly 54 relies on a simple blowback system to cycle cartridges through the action of the firearm 10. A simple blowback system is one where the bolt 96 rests against the rear of the barrel 14 but is not locked in place. When the cartridge is fired, expanding gases push the bullet forward through the barrel 14 while at the same time pushing the cartridge case backward against the bolt 96. The force pushes the bolt 96 backward and the empty case is ejected. As the bolt 96 moves forward a new cartridge is stripped from the magazine and chambered. Simple blowback systems are especially suited for firearms using relatively low power cartridges with lighter weight bullets such as the .22 Long Rifle and other rimfire cartridges.

It should be appreciated that the slide assembly 54 can use any system to complete the cycle of operation. For example, the slide assembly 54 can use a delayed blowback system for more powerful cartridges and/or larger bullets. The slide assembly 54 can also use other systems of operation such as recoil operation, gas operation, blow forward, chain, and the like.

Figure 35:
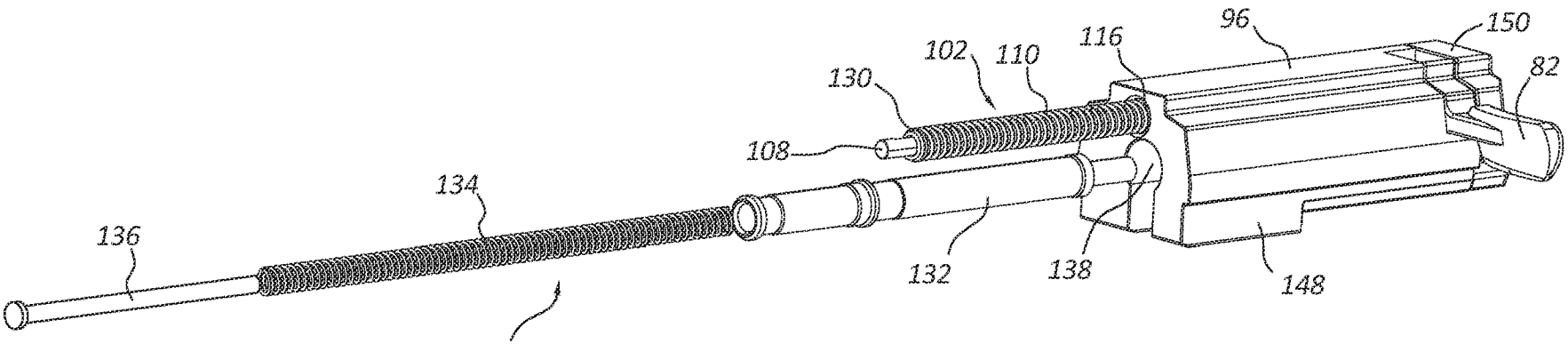
FIG. 35 is a perspective view of the slide assembly with the slide base removed and the striker mechanism exploded. The view is from the back right side.
Figure 36:
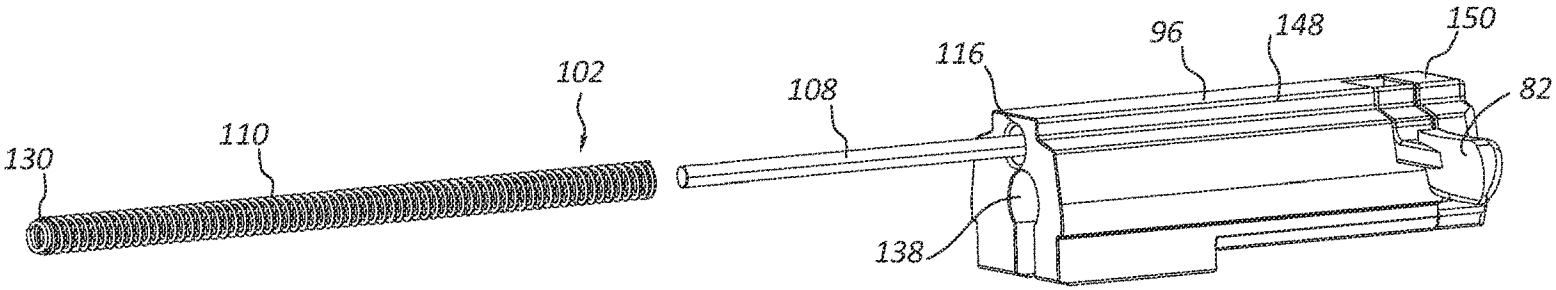
FIG. 36 is a perspective view of the slide assembly with the slide base and striker mechanism removed and the spring exploded. The view is from the back right side.

The bolt 96 is the largest component of the slide assembly 54. The slide base 98 is coupled to the bolt 96 by way of the cycling mechanism 102. The cycling mechanism 102 includes a guide rod 108 positioned inside a spring 110 (FIGS. 35-36). The guide rod 108 holds the bolt 96 and the slide base 98 together, and the spring 110 biases them away from each other. The striker mechanism 100 is sandwiched between the bolt 96 and the slide base 98.

Referring to FIGS. 15-18, the frame 52 includes a front upright 112 at the front end 60 of the frame 52 and a back or rear upright 114 at the back end 62 of the frame 52. The slide assembly 54 is positioned between the uprights 112, 114 with the bolt 96 contacting the front upright 112 and the slide base 98 contacting the back upright 114. The spring 110 in the cycling mechanism 102 is compressed moderately and biases the bolt 96 into the front upright 112 and the slide base 98 into the back upright 114.

During operation, the slide assembly 54 moves between a first or closed position where the bolt 96 is extended forward adjacent to the front upright 112 and the breech is closed and a second or open position where the bolt 96 is retracted backward and the breech is open. The cycling mechanism 102 guides the forward and backward movement of the bolt 96. The guide rod 108 extends through the bolt 96 and guides movement of the bolt 96 as it reciprocates forward and backward. The spring 110 biases the bolt 96 forward towards the first position.

In some embodiments, the slide assembly 54 is a self-contained unit that can be detached from the receiver 50. Self-contained in this context means the same thing as self-contained in the context of the receiver—i.e., the slide assembly 54 constitutes a complete and independent unit where the parts are captured and remain in an assembled state after the slide assembly 54 is removed from the receiver 50.

A self-contained slide assembly 54 provides a number of advantages. One is that the components of the slide assembly 54 stay together when it is removed from the receiver 50. This makes it easier to handle and reduces the likelihood of parts being lost. It should be appreciated that the slide assembly 54 can also have other forms besides being self-contained. For example, the slide assembly 54 can be configured so that the individual components do not stay coupled together when they are removed from the rest of the receiver 50.

In some embodiments, the slide assembly 54 is coupled to the receiver 50 in a manner that makes it easy to remove. This is especially advantageous when the slide assembly 54 is a self-contained unit. It should be appreciated, however, that the slide assembly 54 can be easy to remove regardless whether it is a self-contained unit or not.

There are numerous ways the slide assembly 54 can be coupled to the rest of the receiver 50 to make it easy to remove. In some embodiments, the slide assembly 54 is coupled to the receiver 50 with a readily releasable fastener. In one embodiment, the slide assembly 54 is coupled to the receiver 50 with the same readily releasable fastener 72 used to couple the receiver 50 to the housing 16. The user can release the slide assembly 54 by pushing the fastener 72.

In some embodiments, the slide assembly 54 can be coupled to and uncoupled from the receiver 50 without using any tools. In contrast, most conventional firearms require tools such as screwdrivers, punches, and the like to remove the bolts, pins, etc. that hold the slide components to the receiver. The slide assembly 54 can be removed easily without using any tools.

The slide assembly 54 can move between a first position, shown in FIGS. 15-18, where it is coupled to the frame 52 of the receiver 50 and a second position, shown in FIGS. 28-31, where it is uncoupled from the frame 52. The fastener 72 engages the back upright 114 of the frame 52 when the slide assembly 54 is in the first position and is disengaged from the back upright 114 when the slide assembly 54 is in the second position.

In some embodiments, the back upright 114 includes an opening or hole 106 (FIGS. 24-25) through which the fastener 72 extends when the slide assembly 54 is coupled to the frame 52. When the receiver 50 is coupled to the housing 16, the fastener 72 extends through both the opening 106 in the back upright 114 and the opening 74 in the back end 34 of the housing 16. In one embodiment, the outside surface of the back upright 114 is shaped to correspond to and fit snugly in contact with an interior surface of the back end 34 of the housing 16 when the two are coupled together.

The slide assembly 54 is coupled to and uncoupled from the receiver 50 by moving the fastener 72 between the extended and retracted positions as described above. Specifically, the fastener 72 moves between the extended position (FIGS. 15-18) where the slide assembly 54 is coupled to the frame 52 and the retracted position (FIG. 23) where the slide assembly 54 is uncoupled from the frame 52. The fastener 72 moves forward and backward in a direction that is at least approximately parallel to a lengthwise direction of the frame 52 as it moves between the extended position and the retracted position. The spring 110 biases the fastener 72 to the extended position.

It should be appreciated that the fastener 72 needs to be pushed in further to detach the slide assembly 54 from the frame 52 than to detach the receiver 50 from the housing 16. Also, the opening 74 in the back end 34 of the housing 16 is configured to make it difficult for the user to push the fastener 72 so far in that the slide assembly 54 detaches from the frame 52. The configuration of the housing 16 and the frame 52 are such that the user can push the fastener 72 to detach the receiver 50 from the housing 16 without simultaneously detaching the slide assembly 54 from the frame 52.

In some embodiments, the fastener 72 is part of and moves together with the slide base 98. The fastener 72 is the portion of the slide base 98 that extends backward towards the back end 62 of the frame 52 and fits through the openings 74, 106. In one embodiment, the fastener 72 and the openings 74, 106 are round.

In some embodiments, the fastener 72 is a captive component of the slide assembly 54. In other words, the fastener 72 is part of the self-contained unit that is the slide assembly 54. Because it is a captive component, the fastener 72 is much less likely to be lost in the process of coupling or uncoupling the slide assembly 54 from the frame 52.

Figure 23:
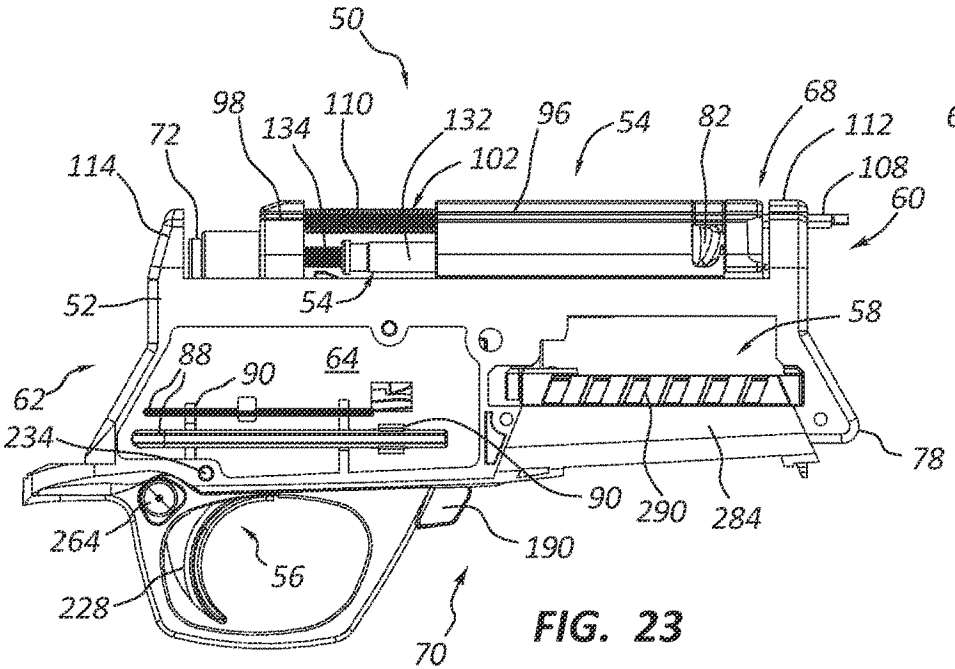
FIG. 23 is a right side view of the receiver with the slide assembly in a retracted position where it can be uncoupled from the receiver.

The process for removing the slide assembly 54 from the receiver 50 is shown in FIGS. 23-27. The first step is to push the fastener 72 through the opening 106 in the frame 52 as shown in FIG. 23. This compresses the spring 110 and pushes the guide rod 108 forward through the opening 104 at the front end 60 of the frame 52. With the guide rod 108 extending through the opening 104, the slide assembly 54 is prevented from detaching from the front end 60 of the frame 52.

Figure 24:
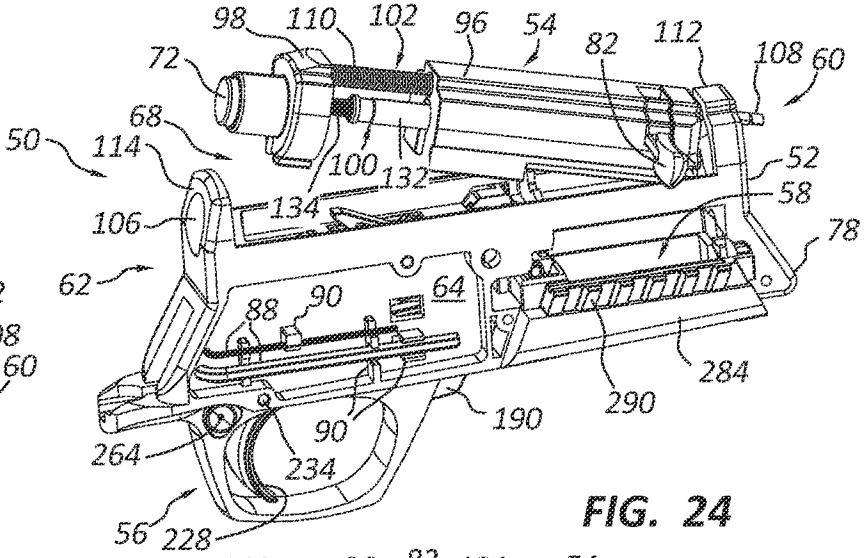
FIGS. 24-25 are perspective views of the receiver with the slide assembly in the retracted position and rotated upward at the back end of the receiver. The views are from the back right side and back left side, respectively.
Figure 25:
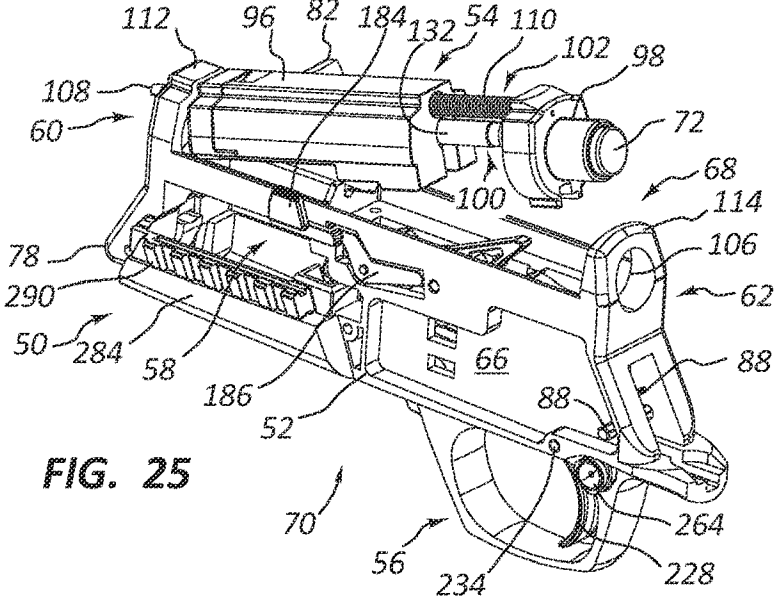
Figure 26:
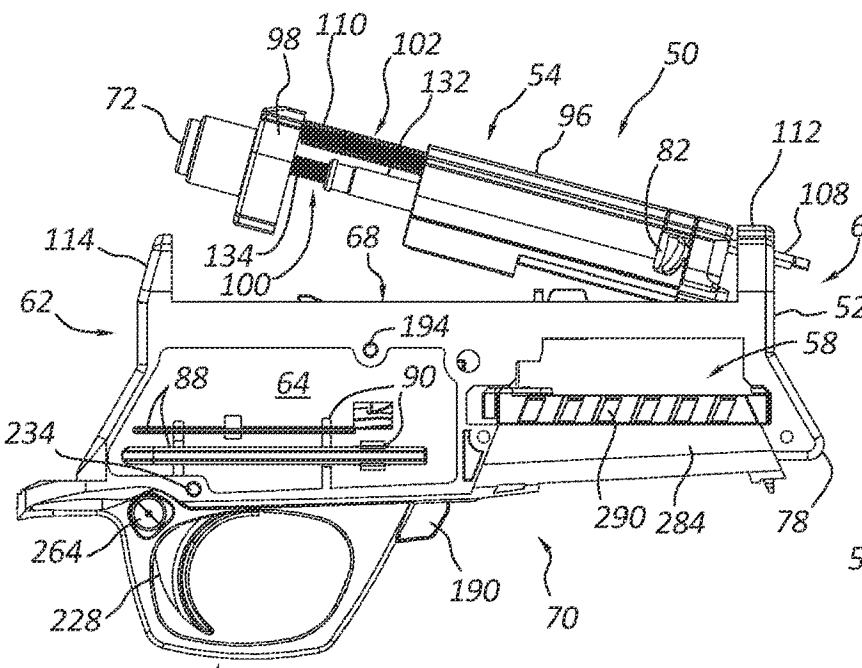

The slide assembly 54 rotates upward at the back end 62 of the frame 52 as shown in FIGS. 24-26. With the fastener 72 in the retracted position, there is nothing preventing the slide assembly 54 from rotating upward at the back end 62 of the frame 52.

Figure 27:
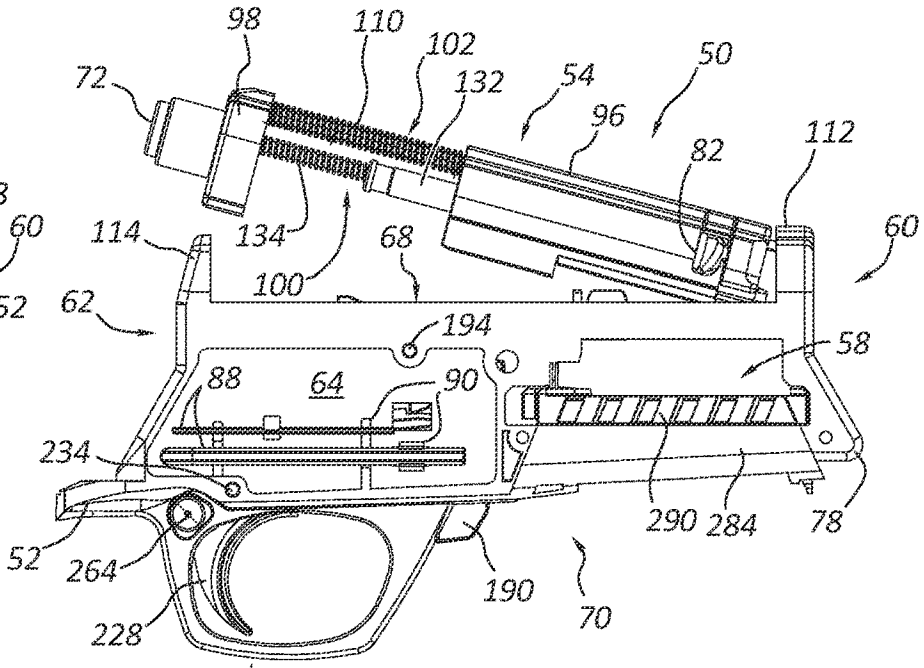
FIGS. 26-27 are right side views of the receiver with the slide assembly in the retracted position and the extended position, respectively. The slide assembly is shown rotated upward at the back end of the receiver in both Figs.

The spring 110 biases the fastener 72/slide base 98 to the extended position as shown in FIG. 27. In this position, the guide rod 108 no longer extends through the opening 104 in the front end 60 of the frame 52 thereby freeing the slide assembly 54 so it can be completely separated from the frame 52. The process is reversed to couple the slide assembly 54 to the frame 52.

It should be appreciated that the slide assembly 54 can be coupled to and uncoupled from the receiver 50 in a number of other ways. For example, if the slide assembly 54 is not a self-contained unit, it can be coupled to the receiver 50 by separately coupling the various components in a step-wise process. Numerous other embodiments are possible.

Figure 29:
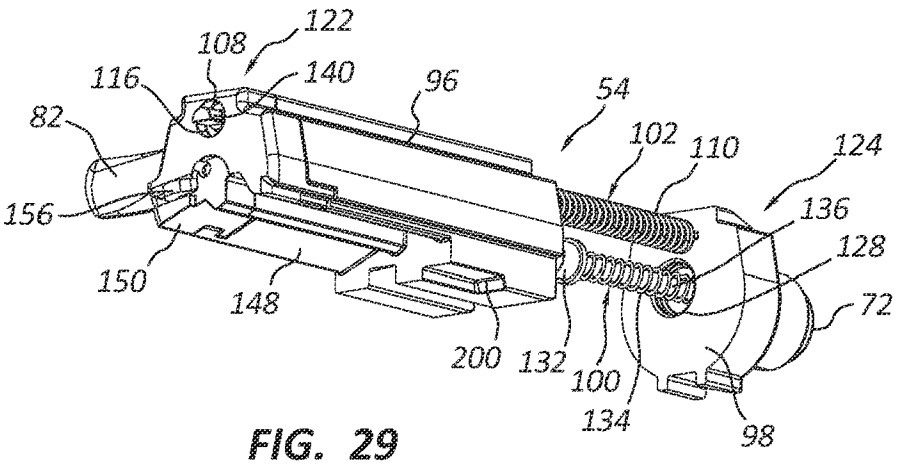
FIGS. 28-29 are perspective views of the slide assembly from the back right side and front left side, respectively.
Figure 28:
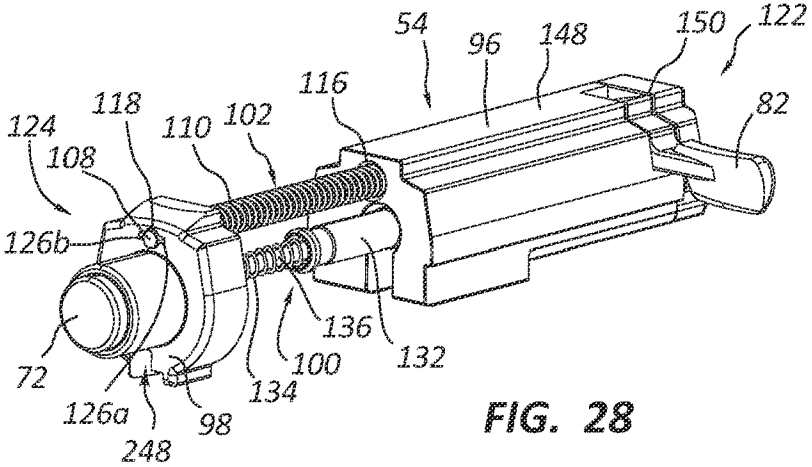

FIGS. 28-29 show perspective views of the slide assembly 54. In this embodiment, the slide assembly 54 is a self-contained unit held together by the guide rod 108. The guide rod 108 moves between a first position where it is coupled to the slide base 98 and a second position where it is uncoupled from the slide base 98. FIGS. 30-38 show how the guide rod 108 holds the slide assembly 54 together and how the slide assembly 54 can be disassembled.

The guide rod 108 extends through a hole or passage 116 in the bolt 96 and an opening or hole 118 in the slide base 98. The guide rod 108 also extends through the spring 110 between the bolt 96 and the slide base 98. The spring 110 extends part of the way into the hole 116 in the bolt 96. The spring 110 contacts the bolt 96 and the slide base 98 and biases them apart.

The slide assembly 54 includes a front or first end 122 and a back or second end 124. In the following discussion, the individual components of the slide assembly 54 may be referred to as having a front end or a back end with the understanding that this is a reference to the portion of the component that most closely corresponds to the front end 122 or the back end 124 of the slide assembly 54. For example, the end of the bolt 96 closest to the back end 124 of the slide assembly 54 can be referred to as the back end of the bolt 96.

Figure 37:
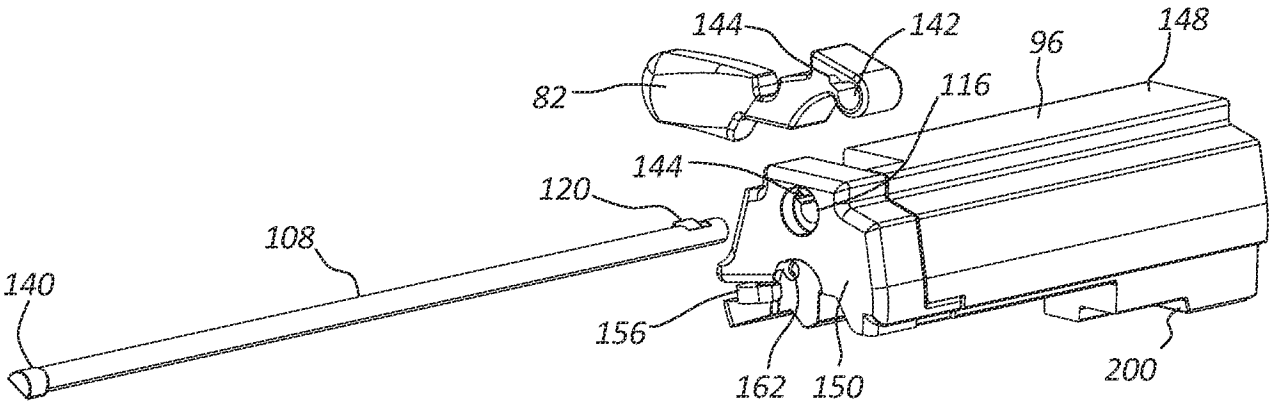
FIG. 37 is a perspective view of the slide assembly with the slide base, striker mechanism, and spring removed and the guide rod and cocking handle exploded from the bolt. The view is from the front left side.

Referring to FIG. 37, the guide rod 108 includes a tab 120 that extends radially outward from the back end of the guide rod 108 and an enlarged portion or boss 140 at the front end that is circumferentially larger than the rest of the guide rod 108. The enlarged portion 140 is larger than the hole 116 in the bolt 96 and prevents the guide rod 108 from passing all the way through the bolt 96.

Figure 31:
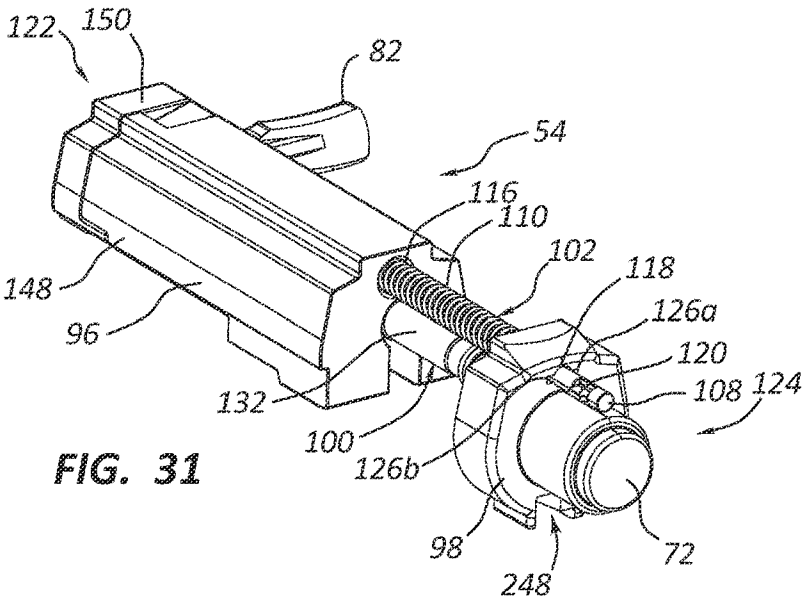
FIGS. 30-31 are perspective views of the slide assembly with the slide base retracted and the guide rod extending out of the back of the slide base. The views are from the back left side and back right side, respectively.
Figure 30:
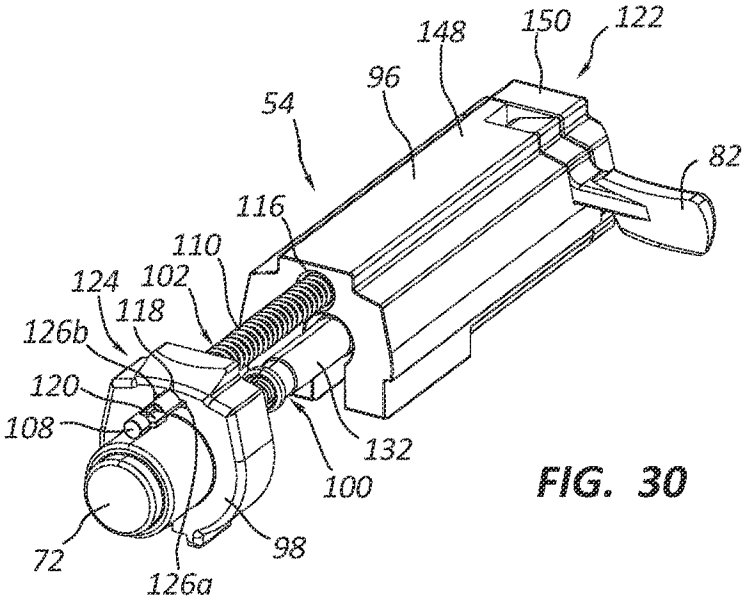
Figure 34:
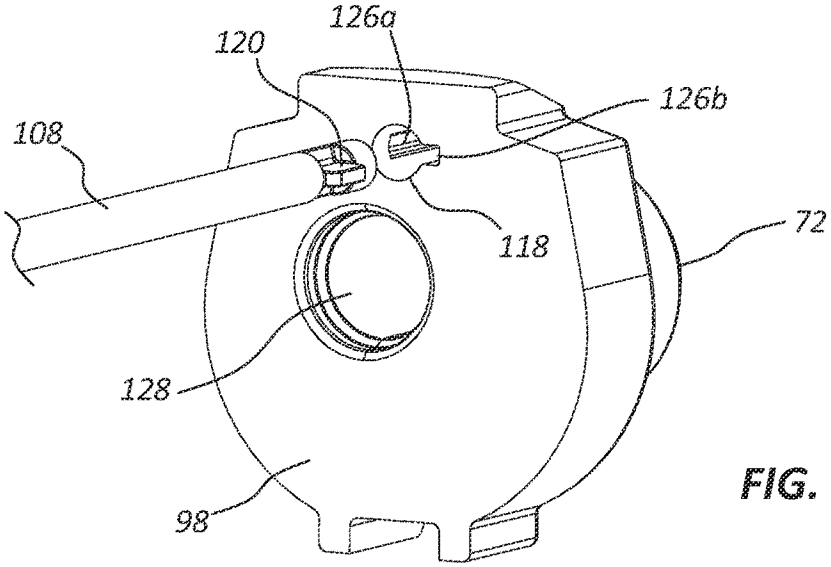
FIG. 34 is a perspective view of the slide base and the guide rod showing how they fit together.

Referring to FIGS. 30-31, the back end of the opening 118 in the slide base 98 includes two slots or grooves 126*a*, 126*b* (collectively referred to as the slots 126) sized to receive the tab 120. As shown in FIG. 34, the slot 126*a* only extends part way through the opening 118 while the slot 126*b* extends all the way through the opening 118.

Figure 75:
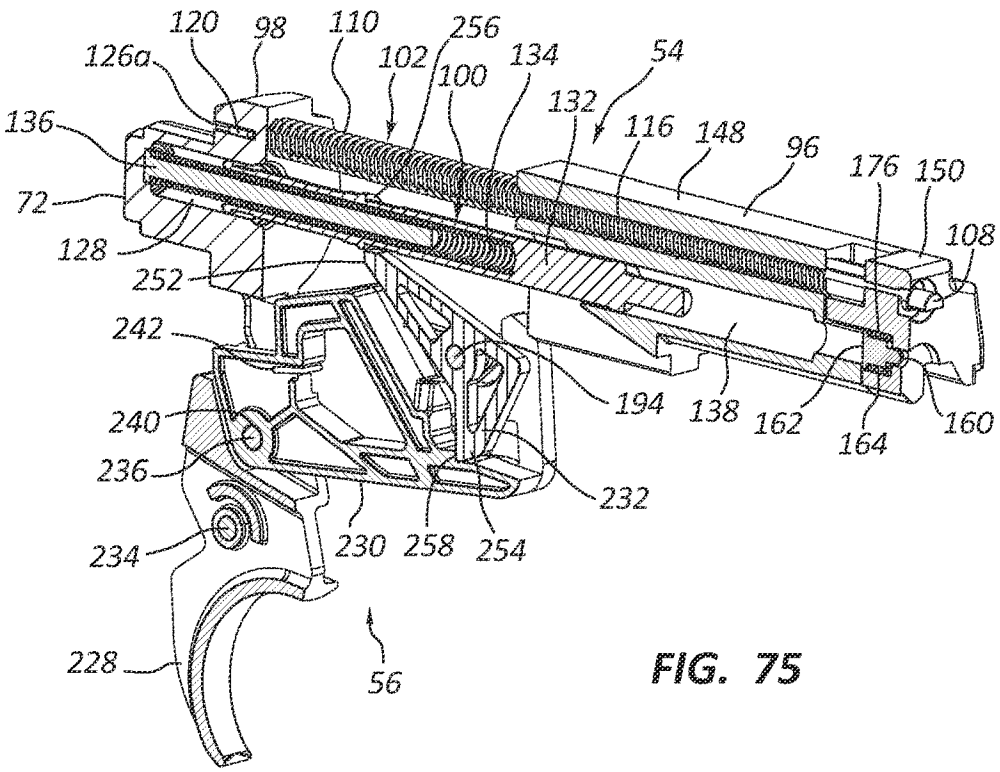
FIG. 75 is a cross sectional perspective view of the trigger mechanism and the slide assembly showing the internal position of the striker mechanism in FIG. 74.

The guide rod 108 holds the slide assembly 54 together when the tab 120 is in the slot 126*a* (FIGS. 28-29). In this configuration, the slot 126*a* prevents the guide rod 108 from passing through the opening 118 (FIG. 75). The guide rod 108 can be decoupled from the slide base 98 by pushing the slide base 98 towards the bolt 96 until the tab 120 is out of the opening 118, rotating the guide rod 108 180° so that the tab 120 is lined up with the slot 126*b*, and sliding the slide base 98 backwards off the guide rod 108.

Figure 33:
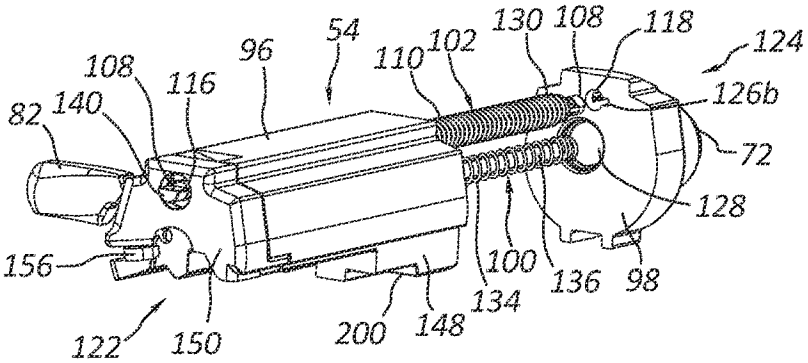
FIGS. 32-33 are perspective views of the slide assembly with the slide base removed. The views are from the front right side and front left side, respectively.
Figure 32:
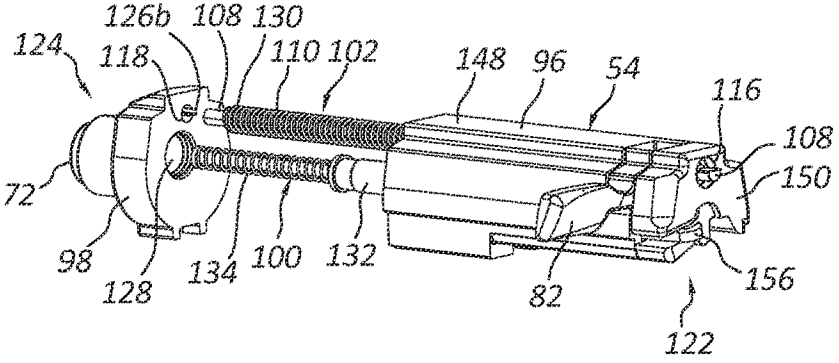

FIG. 30 shows the back end of the guide rod 108 extending out of the back of the slide base 98. The tab 120 is aligned with the slot 126*a*. FIG. 31 shows the guide rod 108 rotated 180° so that the tab 120 is aligned with the slot 126*b*. FIGS. 32-33 show the slide base 98 removed from the guide rod 108. FIG. 34 shows how the tab 120 fits through the opening 118 in the slide base 98. It also shows the slots 126 in greater detail.

In some embodiments, the tab 120 holds the spring 110 on the guide rod 108 when the slide base 98 is removed. This prevents the spring 110 and slide base 98 from coming off with great force, which can result in parts flying off and becoming lost. With the slide base 98 removed, the spring 110 is still under a moderate amount of compression.

The tab 120 can prevent the spring 110 from coming off in a variety of ways. In one embodiment, the last few windings 130 of the spring 110 adjacent to the tab 120 are smaller than the other windings (FIGS. 35-36). The windings 130 catch on the tab 120 with enough force to prevent the spring 110 from coming off. The windings 130 are sized so that they can pass over the tab 120 when the user applies additional force. Thus, the spring 110 can be removed by applying sufficient additional force to push the windings over the tab 120.

Referring to FIGS. 32-35, the striker mechanism 100 includes a striker or axial hammer 132, a spring 134 (alternatively referred to as a striker spring, axial hammer spring, or main spring), and a support rod 136. The support rod 136 fits in the back end of the spring 134 in the manner shown in FIG. 35. The combination of the support rod 136 and the spring 134 fits in a recess or hole 128 in the front side of the slide base 98 as shown in FIGS. 29 and 32-33. The recess 128 holds the back end of the striker mechanism 100 to the slide base 98.

The bolt 96 includes a hole or cavity 138 positioned below the hole 116 and sized to receive the striker 132. The front end of the spring 134 fits inside the striker 132 and biases the striker 132 forward towards the front end of the bolt 96. The operation of the striker 132 is explained in greater detail later.

FIGS. 32-33 show the slide assembly 54 separated from the slide base 98. Once the slide base 98 has been removed, there is nothing holding the striker mechanism 100 in the hole 138. It can be removed by pulling the striker 132 out of the hole 138.

Figure 38:
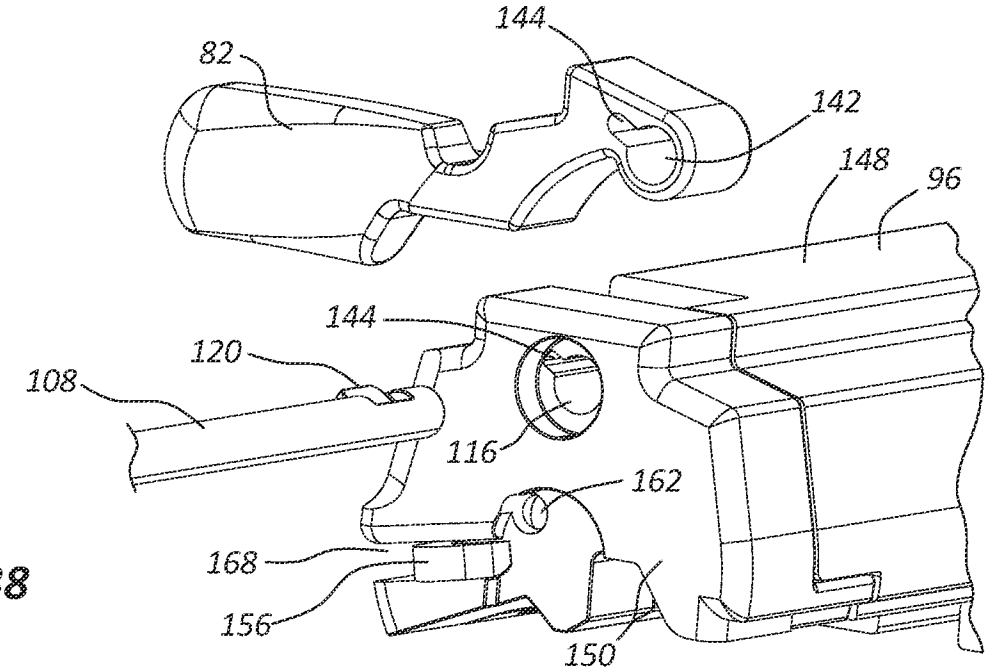
FIG. 38 is a blown up view of the area in FIG. 37 showing how the guide rod and the cocking handle are coupled to the bolt.
Figure 39:
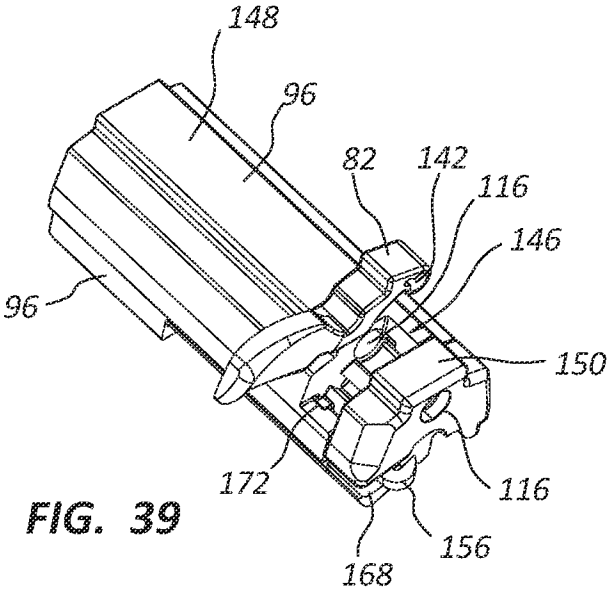
FIG. 39 is a perspective view of the cocking handle and the bolt showing how the cocking handle fits in a recess in the bolt.

Referring to FIGS. 37-39, the cocking handle 82 is coupled to the bolt 96 using the guide rod 108. The cocking handle 82 includes a hole or opening 142 sized to receive the guide rod 108. The cocking handle 82 fits into a recess or opening 146 (FIG. 39) in the top and side of the bolt 96 so that the hole 142 in the cocking handle 82 aligns with the hole 116 in the bolt 96. The guide rod 108 extends through both holes 116, 142 thereby coupling the cocking handle 82 to the bolt 96.

It should be noted that the holes 116, 142 both have a slot 144 in the side for the tab 120 to pass through. This makes it possible to pull the guide rod 108 out the front end of the bolt 96. One thing to note is that the slot 144 in the hole 142 must be aligned with the slot 144 in the hole 116 for the guide rod 108 to come out of the bolt 96. The slots 144 are aligned when the cocking handle 82 is oriented horizontally.

The configuration of the cocking handle 82 and the bolt 96 is such that the cocking handle 82 can rotate approximately 90° around the axis of the guide rod 108. This enables the cocking handle 82 to rotate as part of coupling and uncoupling the receiver 50 from the housing 16.

The components of the slide assembly 54 can be made of any suitable material such as metal, composites, plastics, and the like. In one embodiment, the slide base 98 is made of metal and/or plastic material. In another embodiment, the components in the striker mechanism 100 and the cycling mechanism 102 ae made of metal. Numerous variations are possible.

Bolt

It should be appreciated that the bolt 96 can have any of a number of configurations. In some embodiments, the bolt 96 includes two or more separate components coupled together. The components are coupled together as part of assembling and/or disassembling the bolt 96. Once coupled together, they do not move relative to each other during the normal operation of the assembled firearm 10. For example, the components do not move relative to each other when cycling a cartridge through the action of the firearm 10.

FIGS. 37-54 show one embodiment of the bolt 96 that includes two components: a bolt body 148 and a bolt face 150. The bolt body 148 and the bolt face 150 are coupled together when the bolt 96 is assembled and do not move relative to each other when the bolt 96 is in the assembled firearm 10. For example, they do not move relative to each other when the action of the firearm 10 is cycled and the bolt 96 reciprocates to eject a spent cartridge and load a fresh cartridge.

Figure 54:
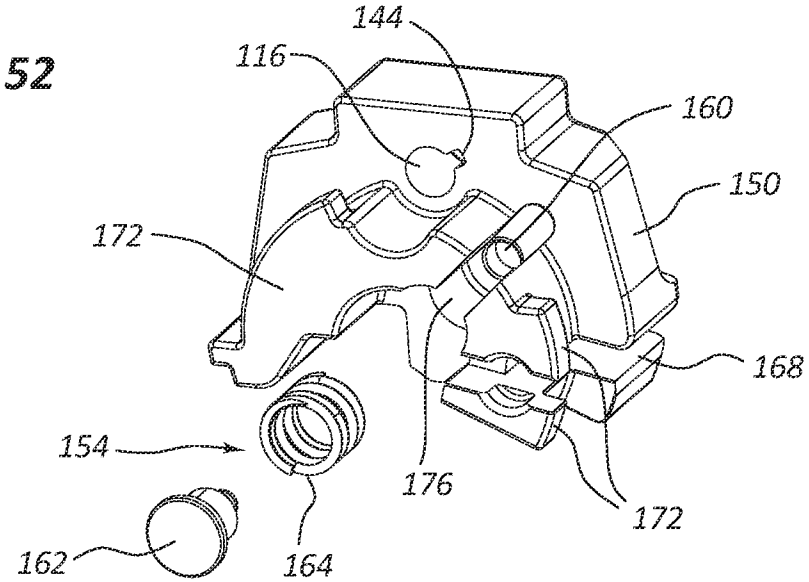
FIG. 54 is a perspective view of the bolt face with the firing pin and firing pin spring exploded.

The front of the bolt face 150 contacts and pushes cartridges into and out of the breech. The bolt 96 includes an extractor mechanism 152 (FIGS. 41-47) and a firing pin mechanism 154 (FIG. 54). The extractor mechanism 152 extends outward from the front of the bolt face 150 and extracts cartridges from the breech when the bolt 96 moves backward. The extractor mechanism 152 includes an extractor 156 and an extractor spring 158.

The firing pin mechanism 154 includes a firing pin 162 and a firing pin spring 164. The firing pin mechanism 154 is positioned inside the bolt face 150. The firing pin 162 moves between a retracted position where the firing pin 162 is flush with or recessed inside a front surface of the bolt face 150 and an extended position where the firing pin 162 extends outward through a hole 160 (FIG. 54) in the bolt face 150 to ignite a cartridge. The firing pin spring 164 biases the firing pin 162 to the retracted position. The firing pin 162 moves to the extended position when the striker 132 hits it.

Figure 41:
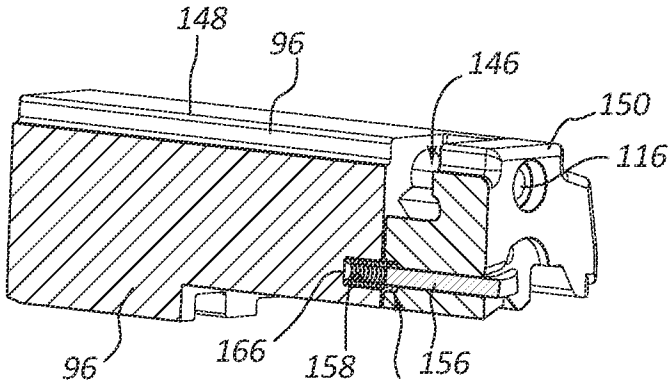
FIG. 41 shows a cross sectional, perspective view of the bolt showing the extractor mechanism.
Figure 42:
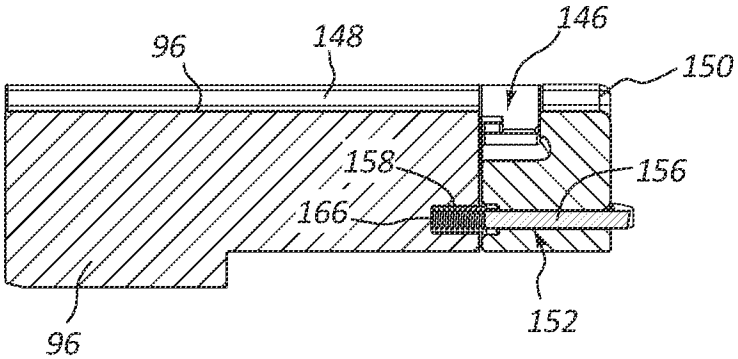
FIG. 42 is a cross sectional view of the bolt showing the extractor mechanism.
Figure 45:
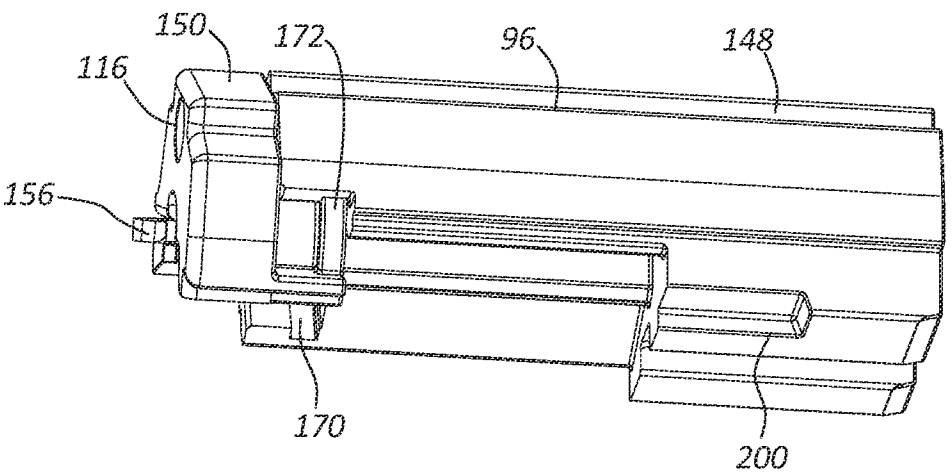
Figure 47:
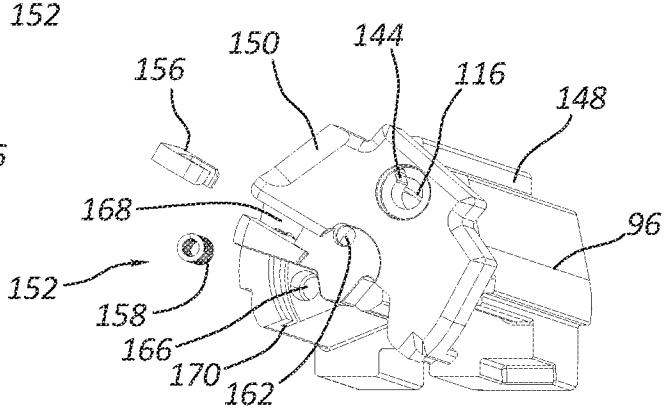
FIGS. 46-47 are perspective views of the bolt with the bolt face rotated relative to the bolt body far enough to release the extractor. The extractor is shown exploded from the bolt.
Figure 46:
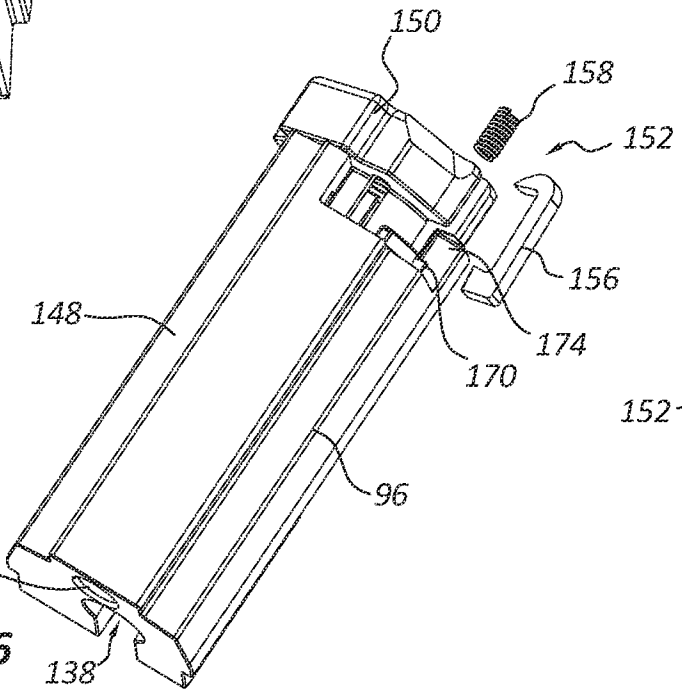

FIGS. 41-42 show cross-sectional views of the bolt 96 through the extractor mechanism 152. The extractor spring 158 is positioned in a hole or recess 166 in the front end of the bolt body 148 and the extractor 156 is positioned in a recess or groove 168 in the side of the bolt face 150. The two components meet at the boundary between the bolt body 148 and the bolt face 150 so that the bolt body 148 and the bolt face 150 can rotate relative to each other.

The extractor spring 158 biases the extractor 156 to the position shown in FIG. 39 so that the extractor 156 engages the base of a cartridge. When the cartridge is fired, the bolt 96 moves backward and the cartridge is pushed away from the bolt face 150 and out of the firearm 10. The movement of the cartridge causes the extractor 156 to pivot away from the center of the bolt face 150, which compresses the extractor spring 158. Once the cartridge has been ejected, the extractor spring 158 biases the extractor 156 back to the position shown in FIG. 39.

In general, the bolt body 148 and the bolt face 150 move between a first orientation where the bolt body 148 and the bolt face 150 are coupled together and a second orientation where the bolt body 148 and the bolt face 150 are uncoupled from each other. It should be appreciated that the bolt body 148 and the bolt face 150 can be coupled together in any suitable manner. In some embodiments, the bolt body 148 and the bolt face 150 are coupled together by rotating the bolt body 148 and/or the bolt face 150 relative to each other. In other embodiments, the bolt body 148 and the bolt face 150 are coupled together using one or more fasteners.

In one embodiment, the bolt body 148 includes recesses 170 and the bolt face 150 includes lugs 172 that correspond to and fit in the recesses 170. FIGS. 43-53 show how the bolt body 148 and the bolt face 150 are coupled together using the recesses 170 and lugs 172. The sequence shown in FIGS. 43-53 illustrate the bolt body 148 and the bolt face 150 being uncoupled from each other. It should be appreciated that the bolt body 148 and the bolt face 150 can be coupled together by reversing the sequence.

Figure 43:
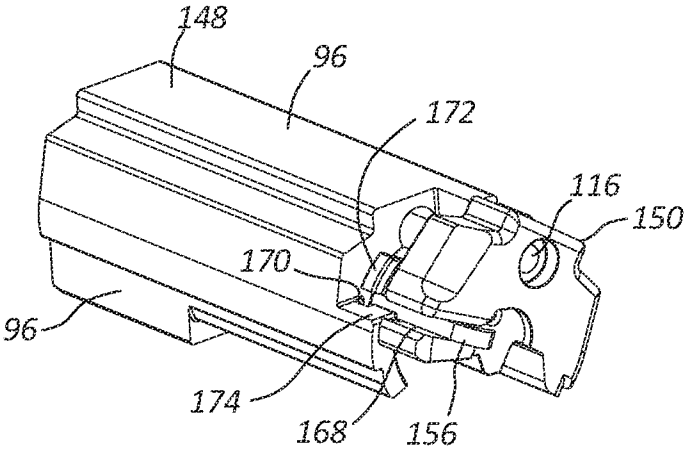
FIGS. 43-45 are perspective views of the bolt with the bolt face partly rotated relative to the bolt body.
Figure 40:
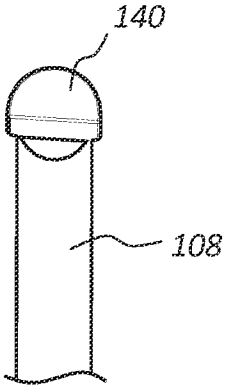
FIG. 40 is a perspective view of the front end of the guide rod.
Figure 44:
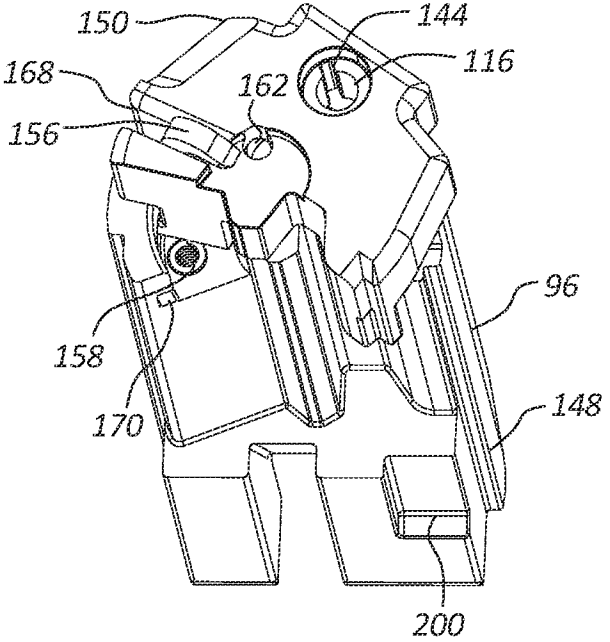

With the guide rod 108 removed, the bolt body 148 and the bolt face 150 can rotate relative to each other. FIGS. 43-44 show the bolt face 150 rotated clockwise relative to the bolt body 148. The bolt face 150 is rotated far enough to expose the extractor spring 158 but not far enough for it come out of the hole 166.

The extractor spring 158 can be removed in a variety of ways. The bolt face 150 compresses it so that rotating the bolt face 150 past the hole 166 releases it, potentially with force. In one embodiment, the extractor spring 158 can be removed by rotating the bolt face 150 to the position shown in FIGS. 43-44, pushing the extractor spring 158 into the hole 166 with a tool such as a screwdriver or the guide rod 108, rotating the bolt face 150 past the hole 166, and slowly releasing the force in the extractor spring 158. In another embodiment, the extractor spring 158 can be removed by rotating the bolt face 150 past the hole 166 with the user's hand covering the bolt face 150 so it can catch the extractor spring 158 when it comes out. Numerous other embodiments are possible as well.

The extractor 156 can be removed at the same time as the extractor spring 158. The extractor 156 can be removed once the bolt face 150 has rotated far enough for the extractor 156 to clear the projection 174 on the bolt body 148. At this point, the extractor 156 can be removed from the recess 168.

Figure 49:
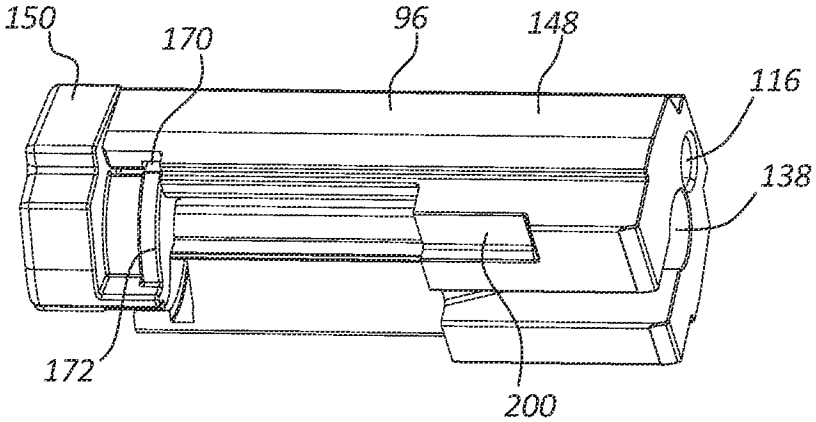
FIGS. 48-49 are perspective views of the bolt with the bolt face fully rotated relative to the bolt body.
Figure 51:
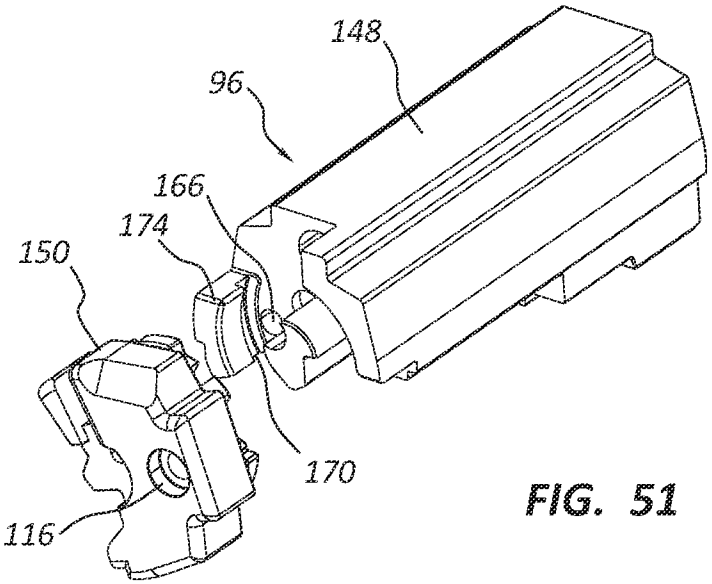
FIGS. 50-53 are perspective views of the bolt with the bolt face exploded from the bolt body.
Figure 48:
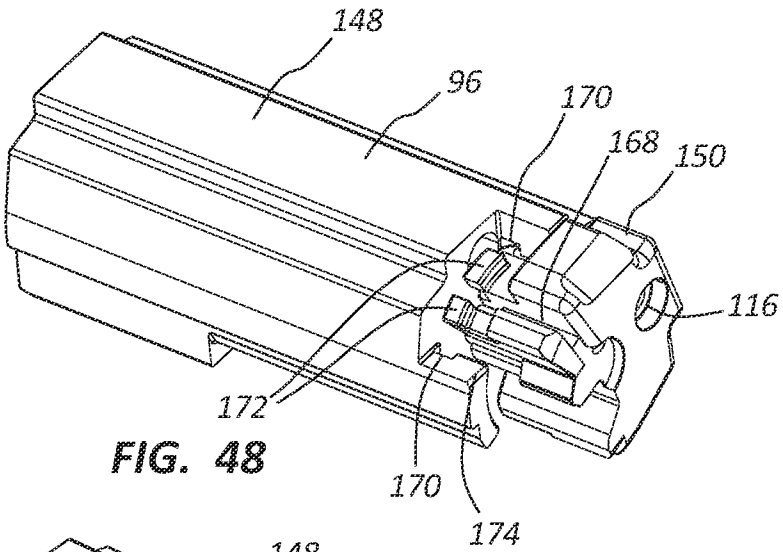

With the extractor mechanism 152 removed, the bolt face 150 continues rotating clockwise until all the lugs 172 are out of the recesses 170 as shown in FIGS. 48-49. The bolt face 150 is separated from the bolt body 148 by moving the bolt face 150 away from the bolt body 148 along a lengthwise axis of the bolt 96. FIGS. 50-53 show the bolt body 148 and the bolt face 150 separated.

The firing pin mechanism 154 is positioned in a recess or hole 176 in the back side of the bolt face 150. The firing pin mechanism 154 can be removed once the bolt face 150 has been separated from the bolt body 148.

It should be appreciated that the bolt 96 can have other configurations. For example, the bolt 96 can be made of a single component or more than two components. Numerous other changes can be made as well.

It should also be appreciated that the bolt 96 can be manufactured in any suitable manner. In some embodiments, the bolt 96 can be machined using convention tools and equipment. In other embodiments, the bolt 96 can be molded using, for example, a metal injection molding process.

One of the advantages of making the bolt body 148 and the bolt face 150 separately and coupling them together is that it makes the design more amenable to being produced by metal injection molding. A one-piece design is difficult to make by metal injection molding because of the many internal recesses and complex geometries that aren't suitable for molding. Splitting the bolt 96 into two or more pieces reduces the complexity of the parts making them easier to manufacture using metal injection molding.

The bolt 96 can be made using any suitable metal injection molding process either alone or in combination with one or more machining steps. In some embodiments, the bolt 96 is made by metal injection molding and includes no more than three machine cuts. In other embodiments, the bolt 96 is made by metal injection molding and includes no more than two machine cuts, no more than one machine cut, or no machine cuts.

Figure 50:
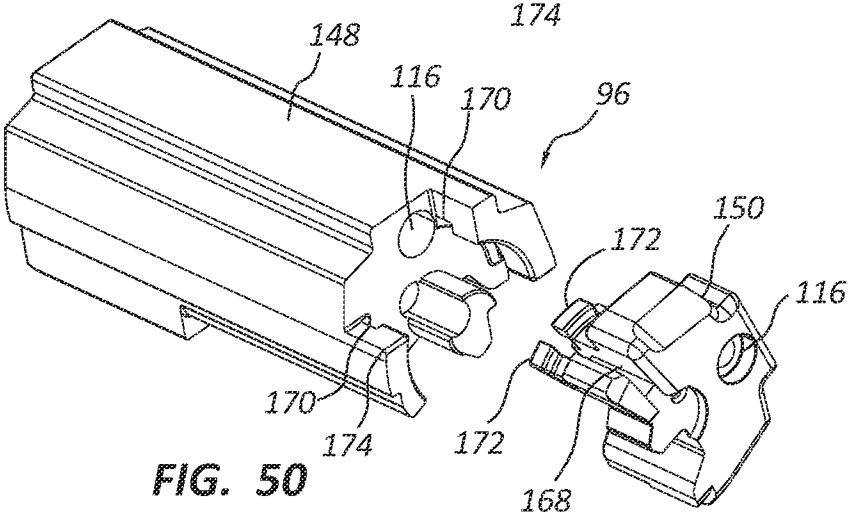
Figure 53:
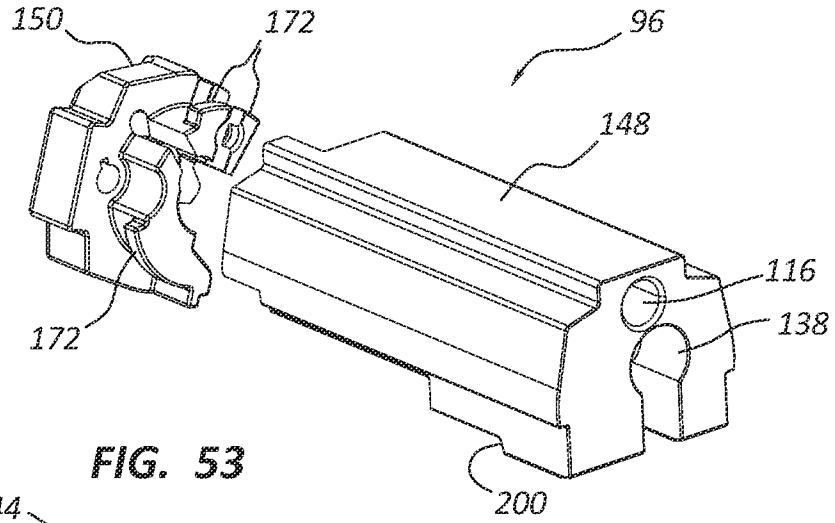
Figure 52:
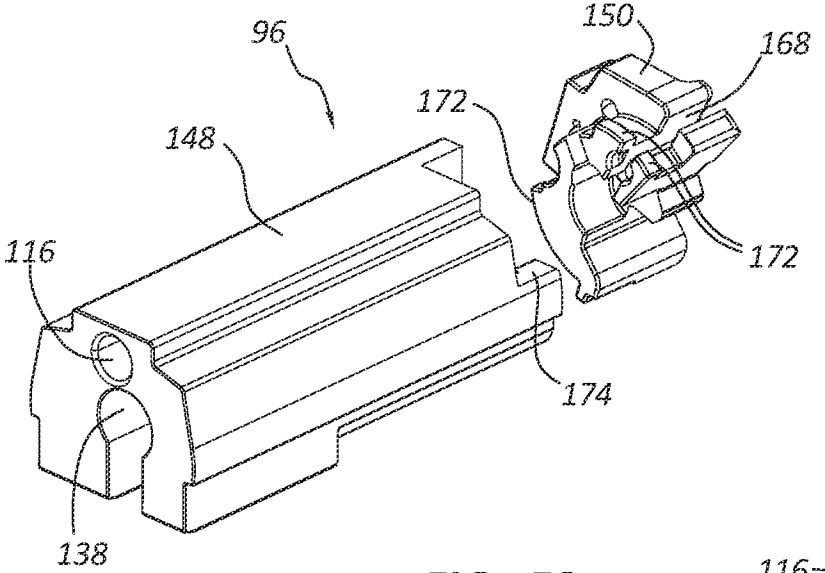

Both the bolt body 148 and the bolt face 150 can be made by metal injection molding. In some embodiments, the bolt body 148 is made by metal injection molding following by a single machine cut to form the larger of the two recesses 170 (FIG. 50). The bolt face 150 is made entirely by metal injection molding without any machine cuts. In other embodiments, the bolt body 148 and the bolt face 150 can be made using more or fewer machine cuts. Numerous variations can be made to the basic manufacturing process.

It should be appreciated that metal injection molding results in a product that has some fundamental differences versus machining metal bar stock. Metal injection molding (MIM) is a metalworking process by which finely-powdered metal is mixed with a measured amount of binder material to form a "feedstock" capable of being handled by plastic processing equipment through a process known as injection mold forming.

The molding process allows complex parts to be shaped in a single operation and in high volume. The rheology of the feedstock is what determines whether each molding "shot" can be distributed into multiple cavities. In general, rheological limitations make metal injection molding especially suitable and cost-effective for small, intricate, high-volume products which would otherwise be quite expensive to produce by alternate or classic methods.

The molding process involves combining metal powders with wax and plastic binders to produce the feedstock mix that is injected as a liquid into a hollow mold using an injection molding machine. The "green part" is cooled and de-molded in the molding machine. Next, a portion of the binder material is removed using solvent, thermal furnaces, catalytic process, or a combination of these methods. The resulting part is referred to as being in the "brown" stage and is relatively fragile and porous (2-4% "air"). The part is finished by sintering it in a furnace.

The part is sintered at temperatures nearly high enough to melt the entire metal part outright (up to 1,450° C.), at which the metal particle surfaces bind together to produce a final, 96-99% solid density. The end-product has comparable mechanical and physical properties with parts made using classic metalworking methods. The part can be treated using the same metal conditioning treatments commonly used with traditional metal parts such as plating, passivating, annealing, carburizing, nitriding, and precipitation hardening.

The metal injection molding feedstock can include a variety of metals including the same alloying constituents found in industry standards for common and exotic metal applications. The molded shape undergoes subsequent conditioning operations to remove the binder and coalesce the metal particles into the desired state for the metal alloy.

The main advantage of metal injection molded parts is that complex, relatively small parts can be produced economically at high volumes. Metal injection molding materials are comparable to metal formed by competing methods. Metal injection molding materials can meet dimensional tolerances of ±0.003 inches and potentially tighter tolerances are possible with expert knowledge of molding and sintering.

Figure 137:
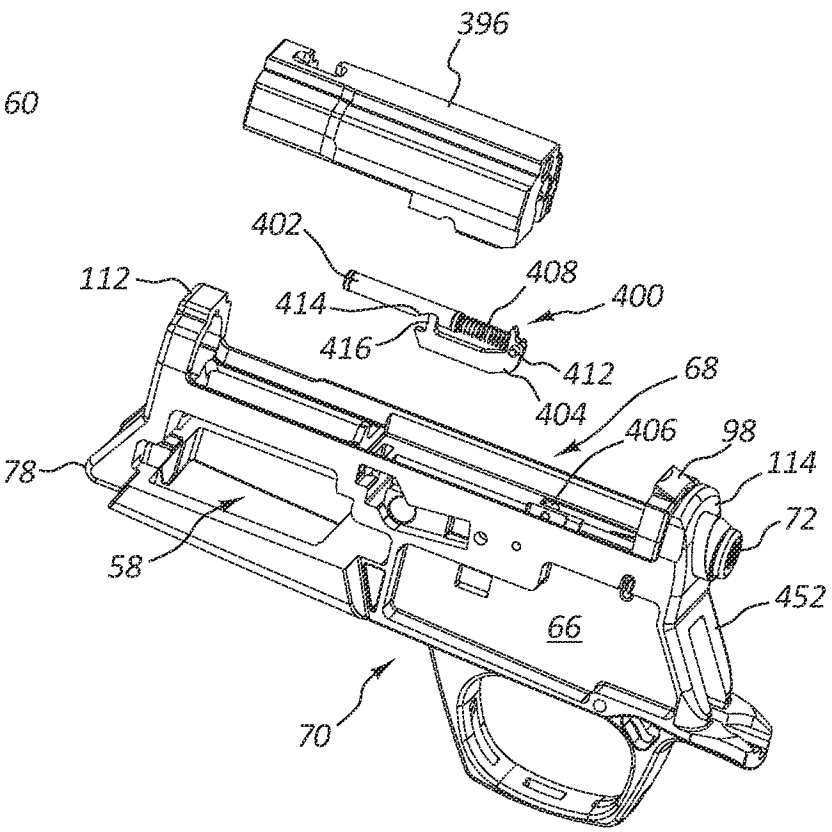
FIGS. 136-137 are perspective views of the receiver with the unitary bolt and a delay mechanism exploded from the receiver.
Figure 136:
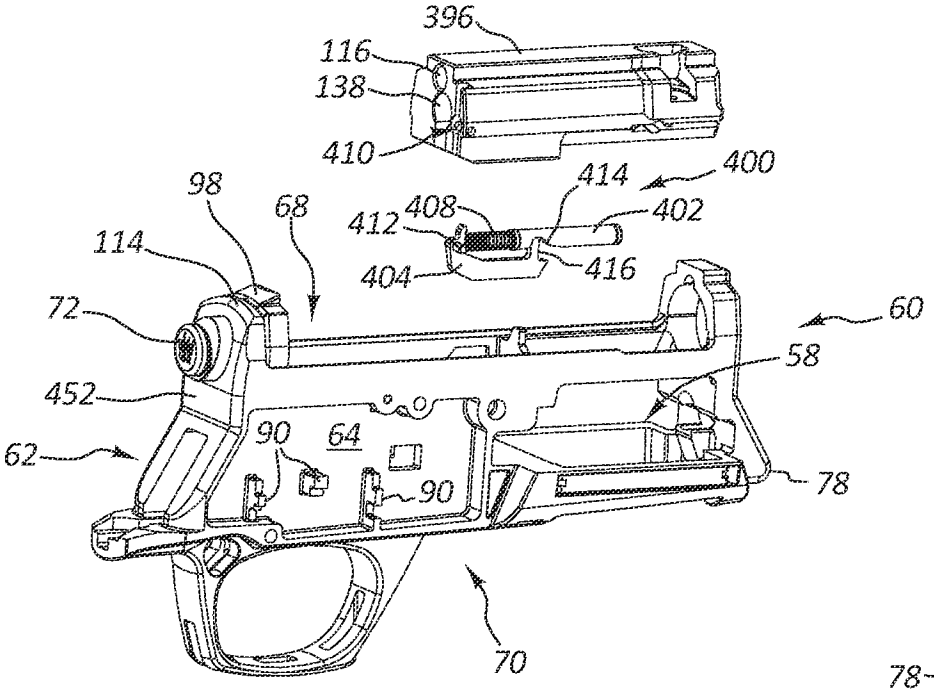
Figure 138:
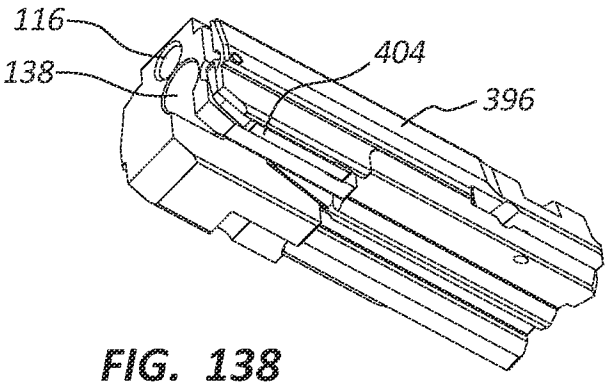
FIG. 138 is a perspective view of the unitary bolt separated from the receiver.

FIGS. 136-138 show an embodiment of a unitary bolt 396. The bolt 396 reciprocates backward and forward and/or otherwise operates the same or similarly to the bolt 96. The other components described in connection with the bolt 96 can also be used with the bolt 396. The bolt 396 may be manufactured using more machined cuts. In some embodiments, the bolt 396 is entirely machined and none of it is metal injection molded.

Delay Mechanism

In some embodiments, the action is so fast that cartridges in high capacity magazines do not have sufficient time to move upward into position before the bolt 96 closes. The bolt 96 may catch the cartridges before they are in position and jam the action. The delay mechanism 400 increases the amount of time it takes for the bolt 96 to reach the cartridge so that the cartridge is correctly positioned to be chambered by the bolt 96.

In one embodiment, the bolt 96 cycles from the closed position to the open position and back to the closed position in approximately 0.0075 seconds, which is too fast for some high capacity magazines. The delay mechanism 400 can be configured to increase the time it takes to cycle the bolt to at least 0.0125 seconds or at least 0.015 seconds to allow sufficient time for the cartridges to move upward in the magazine. In general, it is also desirable not to increase the delay too much or it might become noticeable to the user. Accordingly, the delay mechanism 400 can be configured to increase the time it takes to cycle the bolt 96 to 0.0125 seconds to 0.02 seconds or 0.015 seconds to 0.0175 seconds. The delay mechanism can also be configured to increase the time it takes to cycle the bolt 96 to be no more than 0.02 seconds or no more than 0.0175 seconds.

The amount of delay produced by the delay mechanism 400 can also be expressed as a percentage of the original time it takes for the bolt 96 to complete a cycle. For example, the delay mechanism 400 can be configured to increase the time it takes the bolt 96 to cycle from the closed position to the open position and back to the closed position by at least 20%, at least 30%, at least 40%, at least 50%, at least 60%, at least 70%, at least 80%, at least 90%, or at least 100%. The delay mechanism 400 can also be configured to increase the cycle time of the bolt 96 20% to 100%.

FIGS. 136-143 show one embodiment of the delay mechanism 400 comprising a cam member or delay cam 402, an arm member or delay arm 404, a stop member or delay stop 406, and a spring or biasing member 408. It should be appreciated that the delay mechanism 400 can have any suitable configuration so long as it can delay the time it takes for the bolt to reach the cartridge to allow the cartridge to move all the way upward in the magazine.

The cam member 402 and the spring 408 are positioned in a hole 410 in the back end of the bolt 396. The arm member 404 is rotatably coupled to the back end of the bolt 396 using a pivot pin 412. The arm member 404 blocks the opening of the hole 410 and prevents the cam member 402 and the spring 408 from coming out.

The stop member 406 is coupled to the frame 452 of the firearm 10. The cam member 402 and the stop member 406 work together to rotate the arm member 404 into and out of contact with the stop member 406 as the bolt 396 reciprocates. This slows the speed that the bolt 396 cycles so it can reliably chamber the cartridges from the magazine 180. The stop member 406 is a bushing coupled to the frame 452 in FIGS. 136-143. However, it should be appreciated that the stop member 406 can have any suitable configuration. For example, the stop member 406 can be an integral part of the frame 452.

Figure 140:
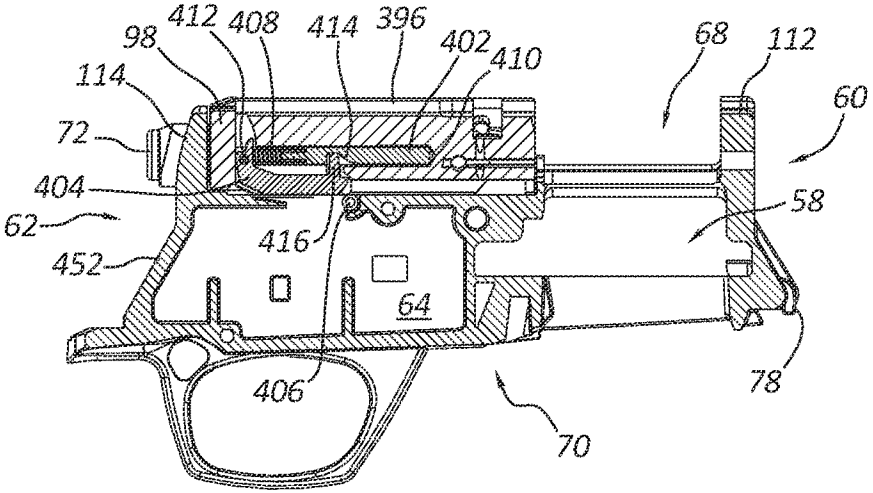
FIG. 140 is a cross sectional right side view of the receiver and the delay mechanism after the cartridge has been fired and the unitary bolt is in a fully open position.
Figure 139:
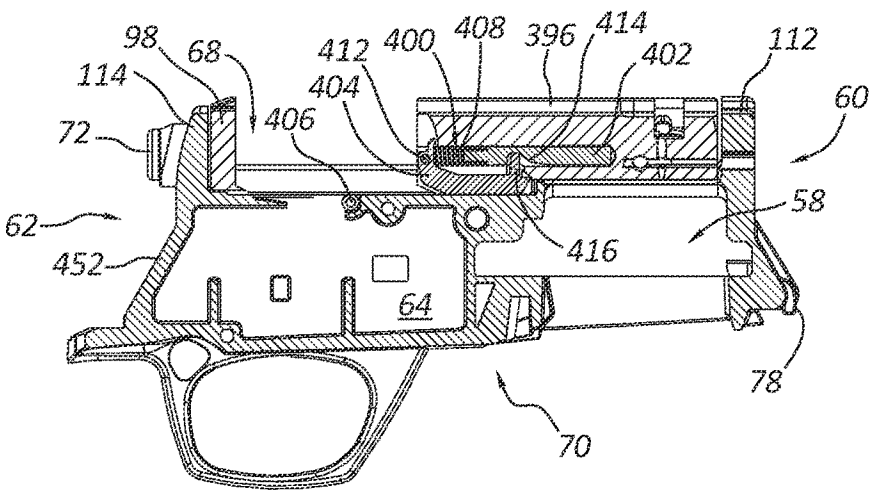
FIG. 139 is a cross sectional right side view of the receiver and the delay mechanism before a cartridge is fired.

The delay mechanism 400 operates in the manner shown in FIGS. 139-143. In FIG. 139, the bolt 396 is all the way forward in the closed position. The cam member 402 is also all the way forward and the arm member 404 is positioned parallel to a lengthwise axis of the bolt 396. This is the state of the action before a cartridge is fired. FIG. 140 shows the action after the cartridge is fired and at the instant the bolt 396 has moved all the way backward to the fully open position. At this moment, the cam member 402, arm member 404, and spring 408 are in the same state shown in FIG. 139—i. e., cam member 402 all the way forward in the hole 410, arm member 404 parallel to the lengthwise axis of the bolt 396, and the spring is in the same state of compression.

Figure 141:
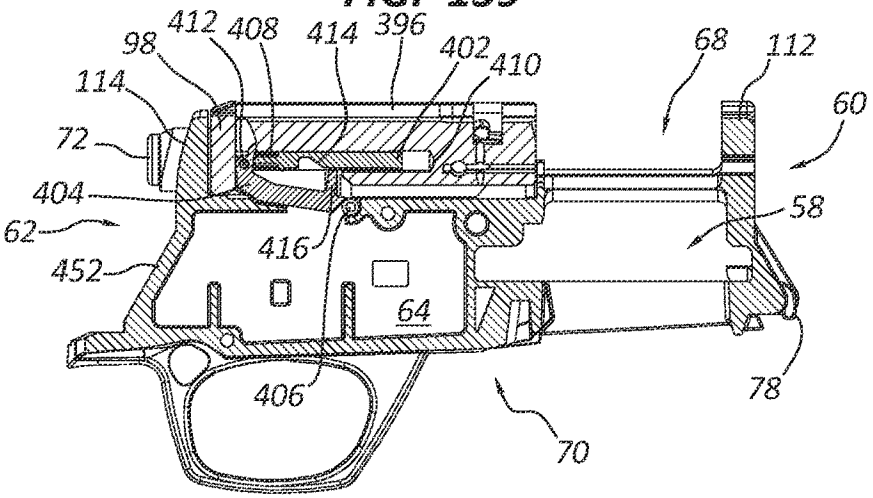
FIG. 141 is a cross sectional right side view of the receiver and the delay mechanism shortly after the unitary bolt has stopped moving backward.

FIG. 141 shows the action shortly after the bolt 396 has stopped moving backward. Inertia causes the cam member 402 to continue moving backward inside the hole 410 until it has fully compressed the spring 408 and pushed the forward end of the arm member 404 downward into the path of the stop member 406. The cam member 402 includes a cam surface 414 that engages a protrusion 416 on the arm member 404, which pushes the forward end of the arm member 404 downward.

Figure 142:
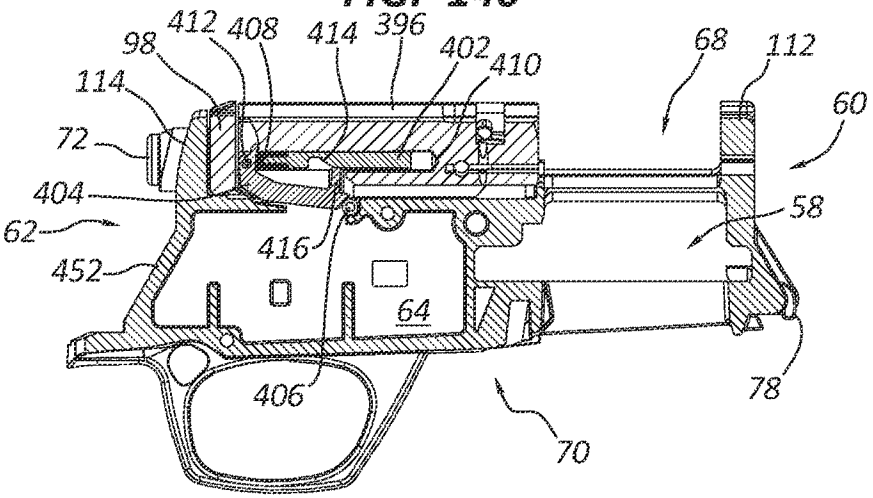
FIG. 142 is a cross sectional right side view of the receiver and the delay mechanism as the unitary bolt begins to move to forward to the closed position.
Figure 143:
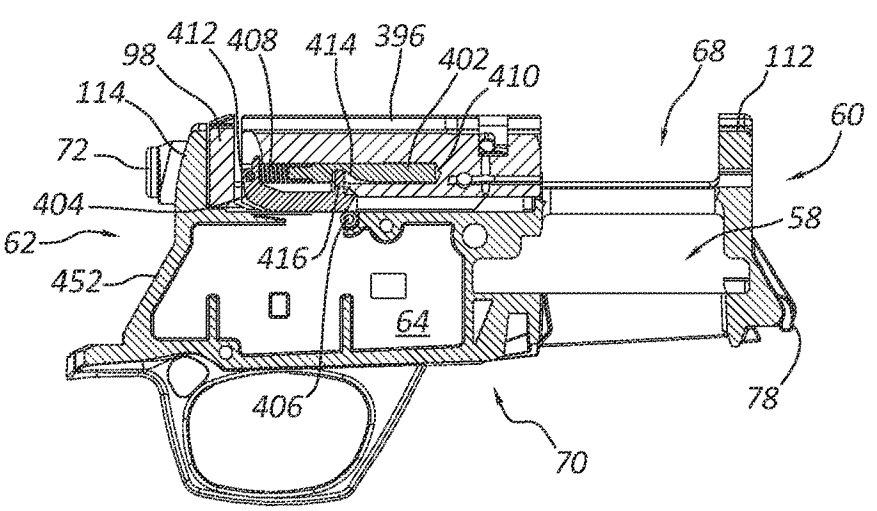
FIG. 143 is a cross sectional right side view of the receiver and the delay mechanism with the unitary bolt in the closed position.

FIG. 142 shows the action as the bolt 396 begins to move forward to the closed position. The cam member 402 is still in the backward or rearward position in the hole 410 biasing the arm member 404 downward where it contacts the stop member 406. This slows forward movement of the bolt 396. The spring 408 pushes the cam member 402 forward in the hole 410 so that the protrusion 416 can move upward into the recess in the underside of the cam member 402 and clear the stop member 406. The stop member 406 pushes the forward end of the arm member 404 upward to its original position where the protrusion 416 is positioned in a recess in the underside of the cam member 402. This is shown in FIG. 143. The bolt 396 can now move forward to the closed position shown in FIG. 139.

Bolt Stop Mechanism

Figure 55:
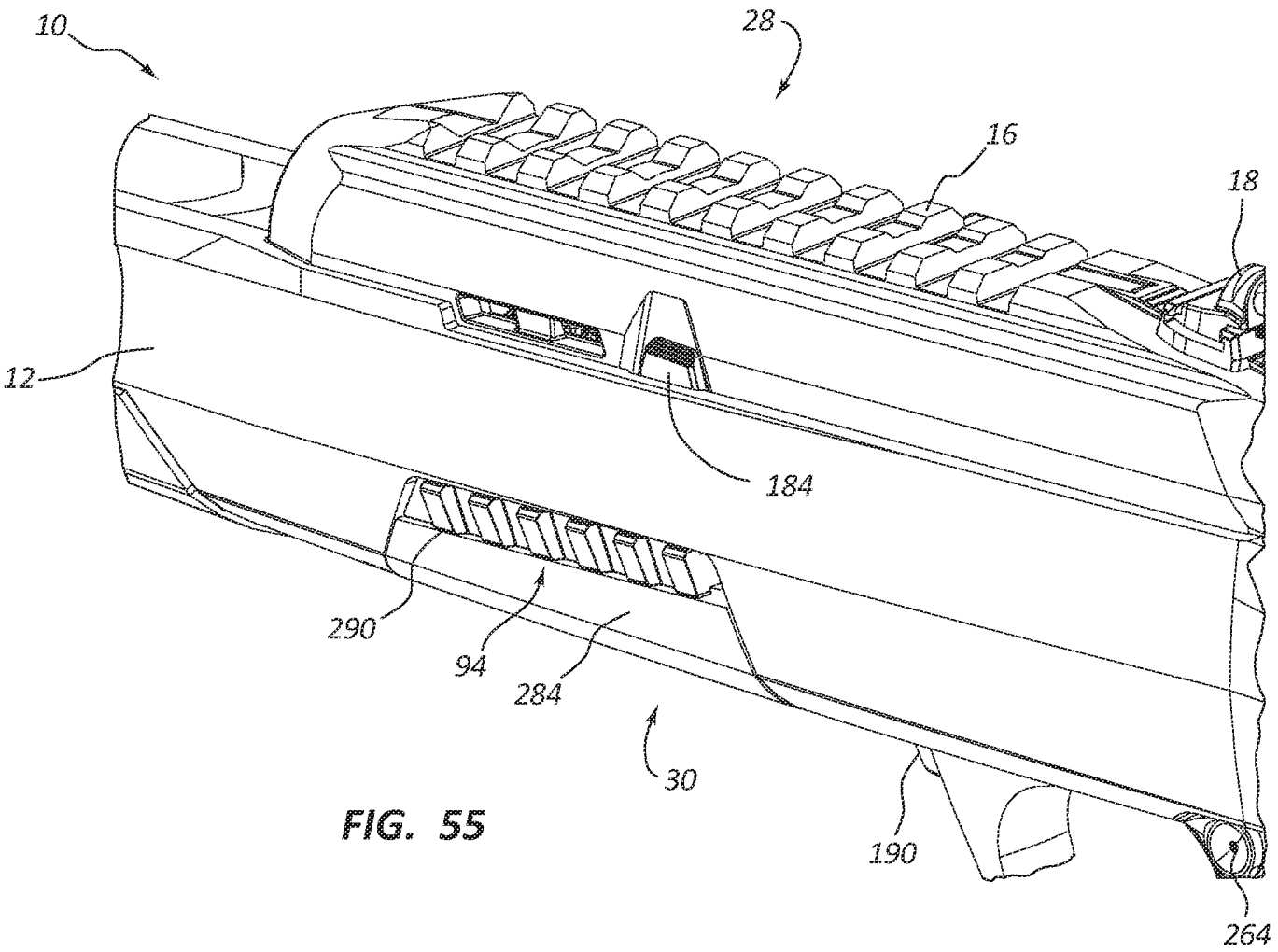
FIG. 55 is a perspective view of a bolt release for the firearm. The view is from the left side of the firearm.
Figure 57:
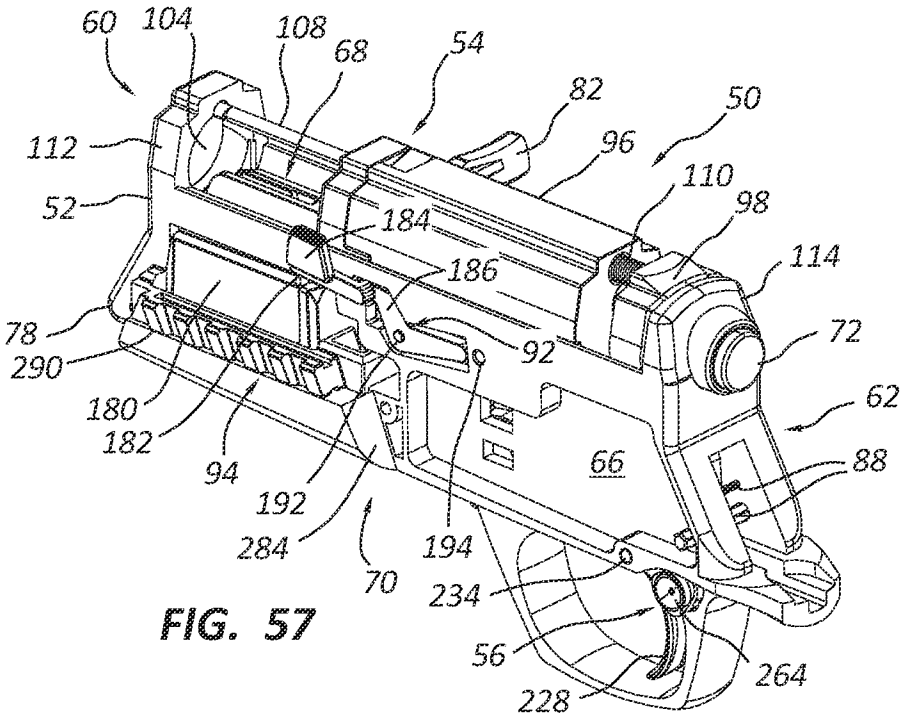
FIGS. 56-57 are perspective views of the receiver with the bolt being held in an open position by a bolt stop mechanism actuated by a rotary magazine. The views are from the left side of the receiver.
Figure 56:
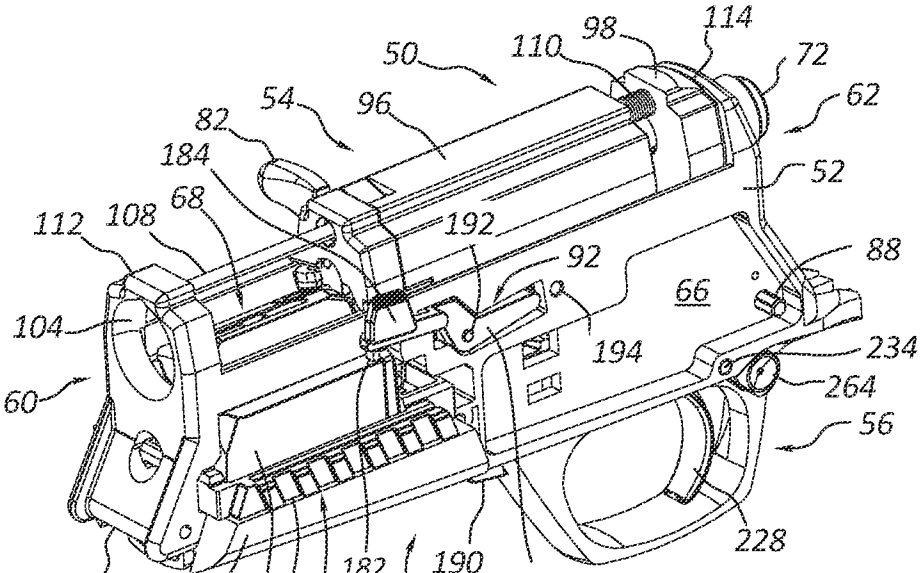

Referring to FIGS. 55-68, the receiver 50 includes the bolt stop mechanism 92 and a magazine 180. The bolt 96 moves between a closed position where the breech of the firearm 10 is closed (FIGS. 15-18) and an open position where the breech of the firearm 10 is open (FIGS. 56-57). The bolt stop mechanism 92 holds the bolt 96 in the open position. Specifically, the bolt stop mechanism 92 moves between a first position where the bolt 96 can move from the open position to the closed position and a second position where the bolt 96 is held in the open position.

The bolt stop mechanism 92 is normally in the first position during operation of the firearm 10 so that the bolt 96 can open and close freely. The bolt stop mechanism 92 moves to the second position when certain conditions are met or when the user takes certain actions. For example, in some embodiments, the bolt stop mechanism 92 moves to the second position when the magazine 180 is empty. In other embodiments, the user can manually move the bolt stop mechanism 92 to the second position regardless whether the magazine 180 is empty. In yet other embodiments, the bolt stop mechanism 92 can move to the second position when the magazine is empty and be moved manually to the second position by the user.

The bolt stop mechanism 92 can be released—i.e., move from the second position to the first position—in a variety of ways. In some embodiments, the bolt stop mechanism 92 is released by removing the magazine 180 and pulling the bolt 96 backwards and releasing it. If the magazine 180 is present, then it may hold the bolt 96 open when the bolt 96 is released. In other embodiments, the user can manually release the bolt stop mechanism 92 by actuating a bolt release 184 positioned on the left side 26 of the firearm 10 (FIG. 55). In yet other embodiments, the bolt stop mechanism 92 can be released both by pulling the bolt 96 backward and releasing it (when the magazine 180 is removed) and by manually operating the bolt release 184.

FIGS. 56-57 show one embodiment of the bolt stop mechanism 92 holding the bolt 96 open when the magazine 180 is empty. The magazine 180 includes a tab or projection 182 that extends upward and outward when the magazine 180 is empty. The tab 182 moves the bolt stop mechanism 92 from the first position where the bolt 96 can reciprocate freely forward and backward to the second position where the bolt stop mechanism 92 holds the bolt 96 open.

The bolt stop mechanism 92 includes a pivot member 186, a bolt catch 188, and a manual actuator 190. The pivot member 186 extends lengthwise along the left side 66 of the frame 52 of the receiver 50. The bolt release 184 is located at the front end of the pivot member 186 and is accessible from the left side 26 of the firearm 10 as shown in FIG. 55. The back end of the pivot member 186 is coupled to the front end of the bolt catch 188. The middle of the pivot member 186 is coupled to a pivot shaft or pivot rod 192 positioned perpendicular to the pivot member 186. The pivot member 186 rotates on the lengthwise axis of the pivot shaft 192.

The bolt catch 188 is coupled to a shaft or pivot pin 194 at a location that is roughly in the middle of the bolt catch 188. The shaft 194 is oriented perpendicular to the bolt catch 188 and the bolt catch 188 rotates around the lengthwise axis of the shaft 194. The bolt catch 188 is coupled to the pivot member 186 by way of a shaft or projection 196 that extends outward from the pivot member 186 and into a hole or opening 198 in the front of the bolt catch 188. The shaft 196 rotates in the hole 198 as the pivot member 186 and bolt catch 188 rotate on the pivot shaft 192 and shaft 194, respectively.

Figure 19:
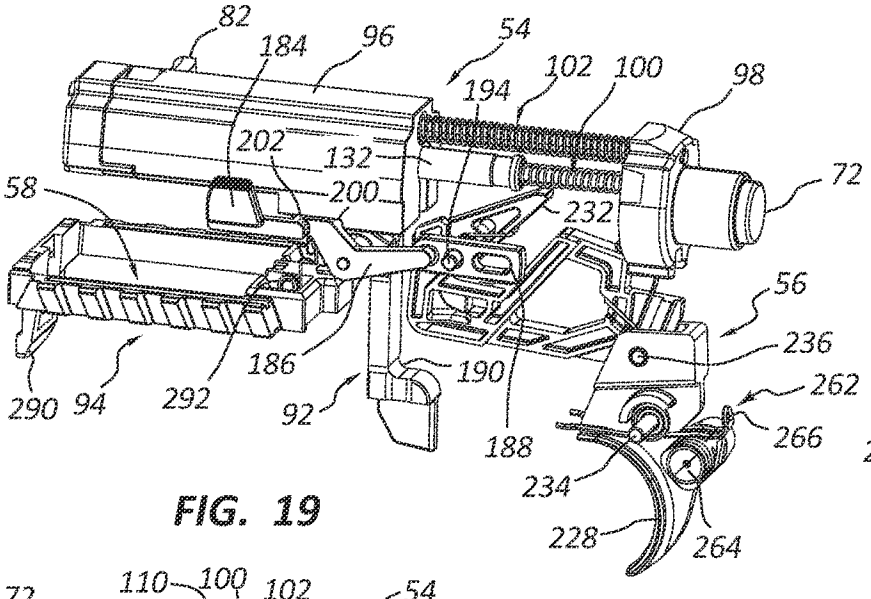
Figure 21:
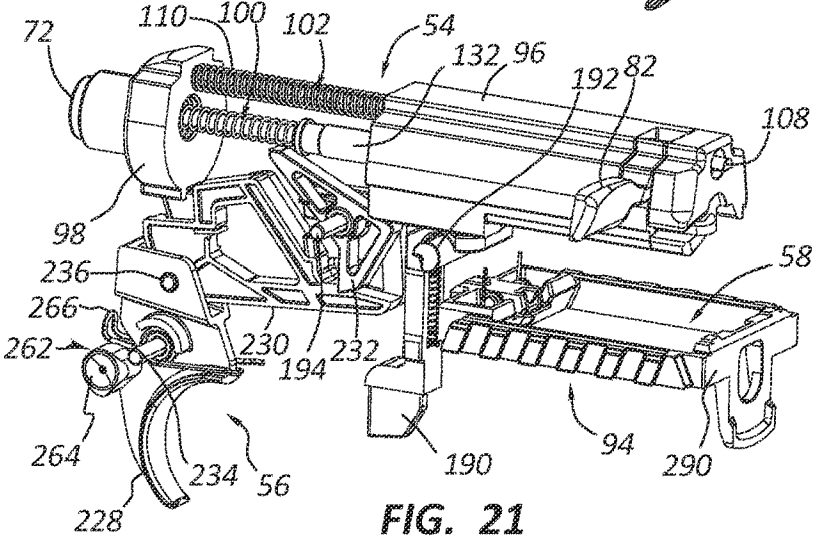

When the last cartridge is chambered from the magazine 180, the tab 182 extends upward against the bottom side of the front end of the pivot member 186. The details about how the tab 182 extends upward can be found in the section describing the operation and structure of the magazine 180. The tab 182 exerts upward force on the front end of the pivot member 186 but the bolt 96 prevents the pivot member 186 from moving upward when the bolt 96 is closed. Specifically, a top surface 202 of the pivot member 186 contacts a recess 200 on the bottom of the bolt 96, which prevents the front end of the pivot member 186 from moving upward. This is shown in FIGS. 19 and 21.

Figure 59:
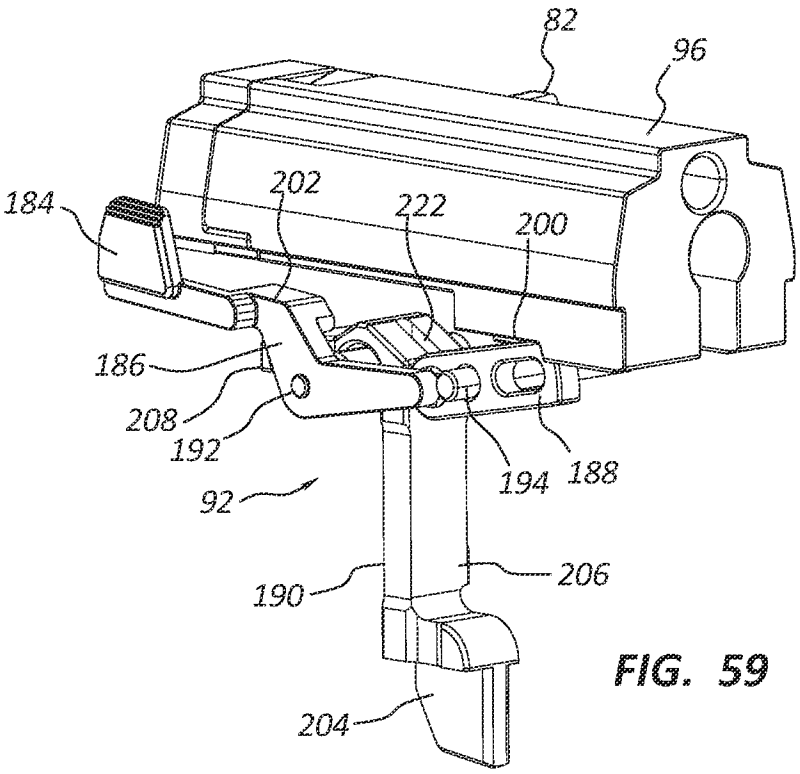
FIGS. 58-59 are perspective views of the bolt stop mechanism in FIGS. 56-57 holding the bolt in the open position. The views are from the left side of the receiver.
Figure 58:
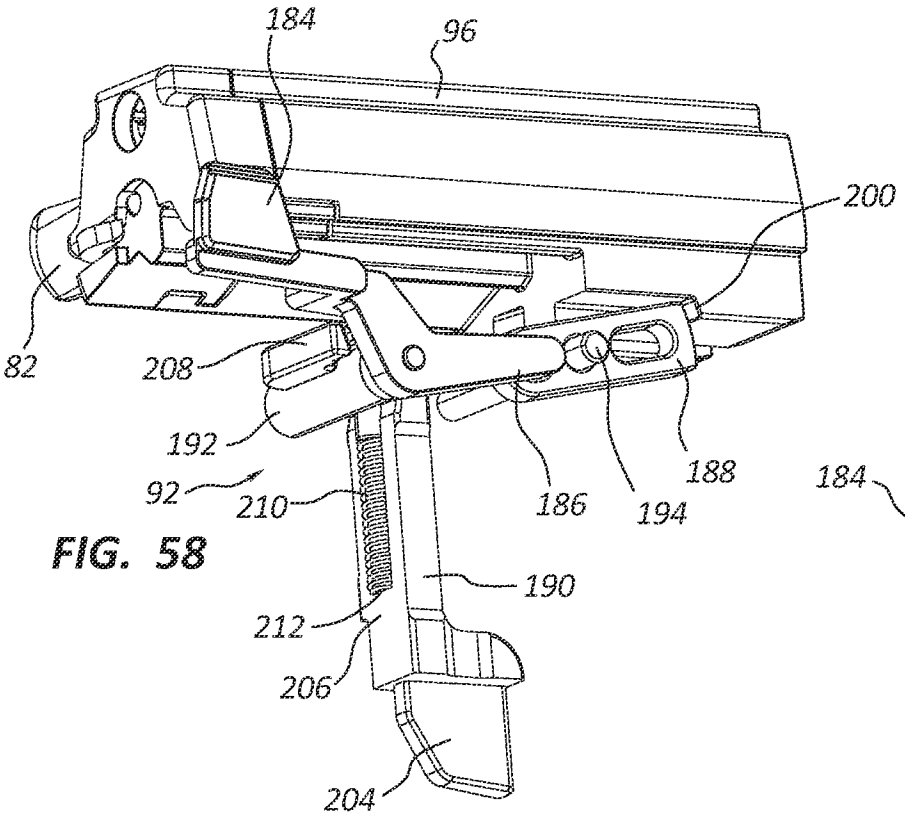
Figure 60:
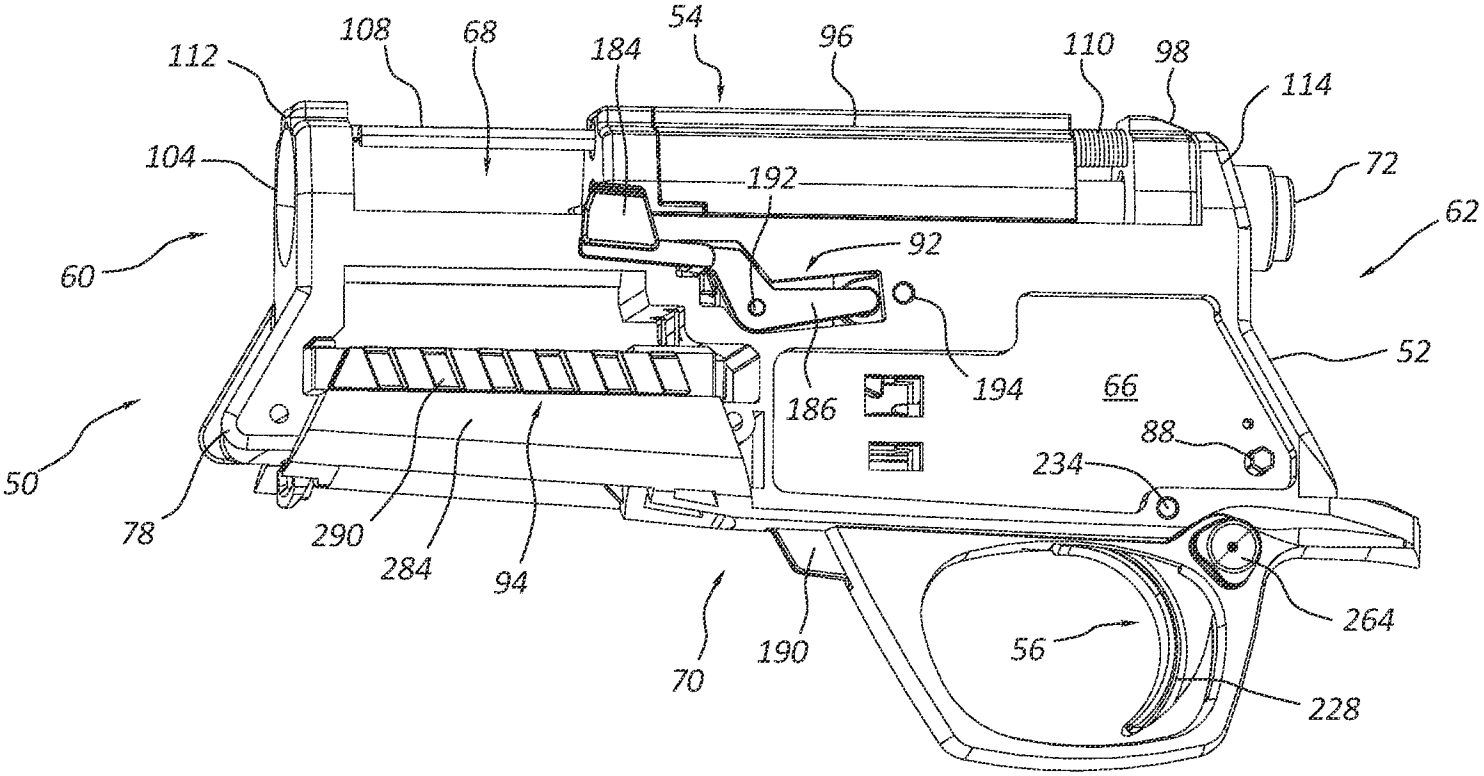
FIGS. 60-61 are perspective views of the receiver with the bolt being held in the open position by the bolt stop mechanism actuated by a manual actuator. The views are from the left side and right side of the receiver, respectively.
Figure 62:
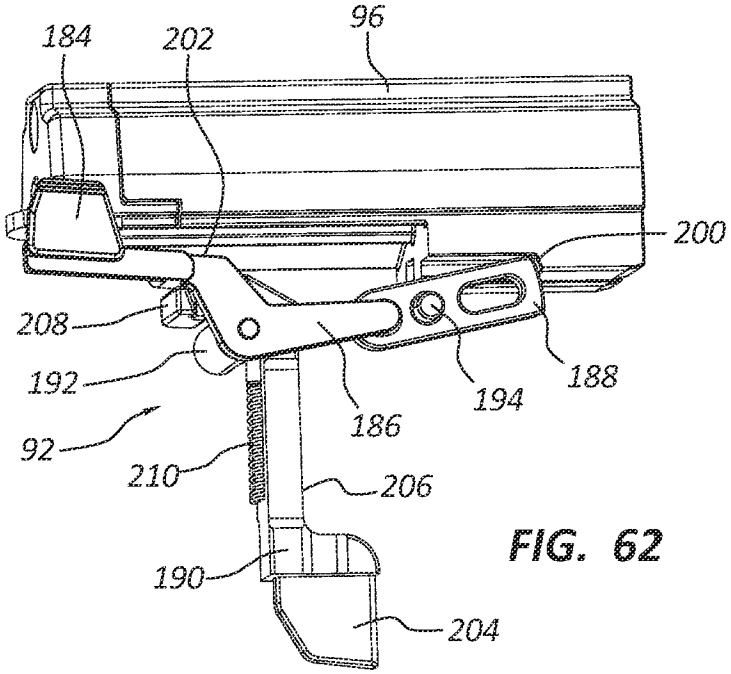
FIGS. 62-63 are perspective views of the bolt stop mechanism in FIGS. 60-61 holding the bolt in the open position. The view is from the right side of the receiver.
Figure 61:
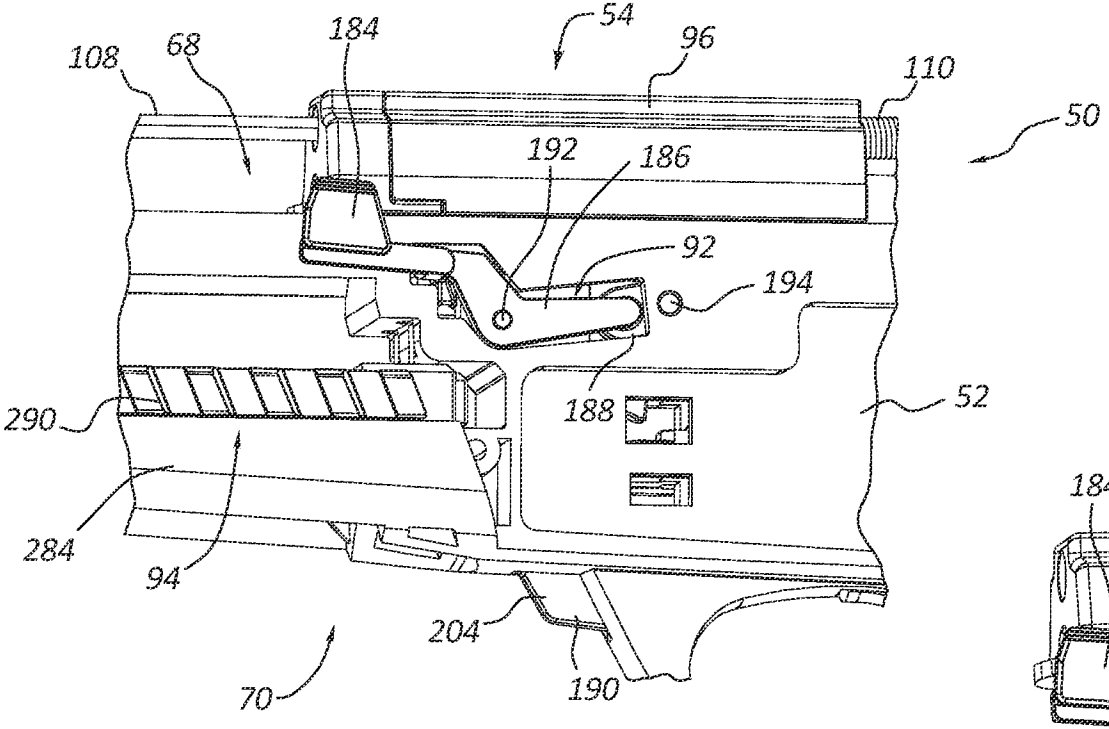
Figure 64:
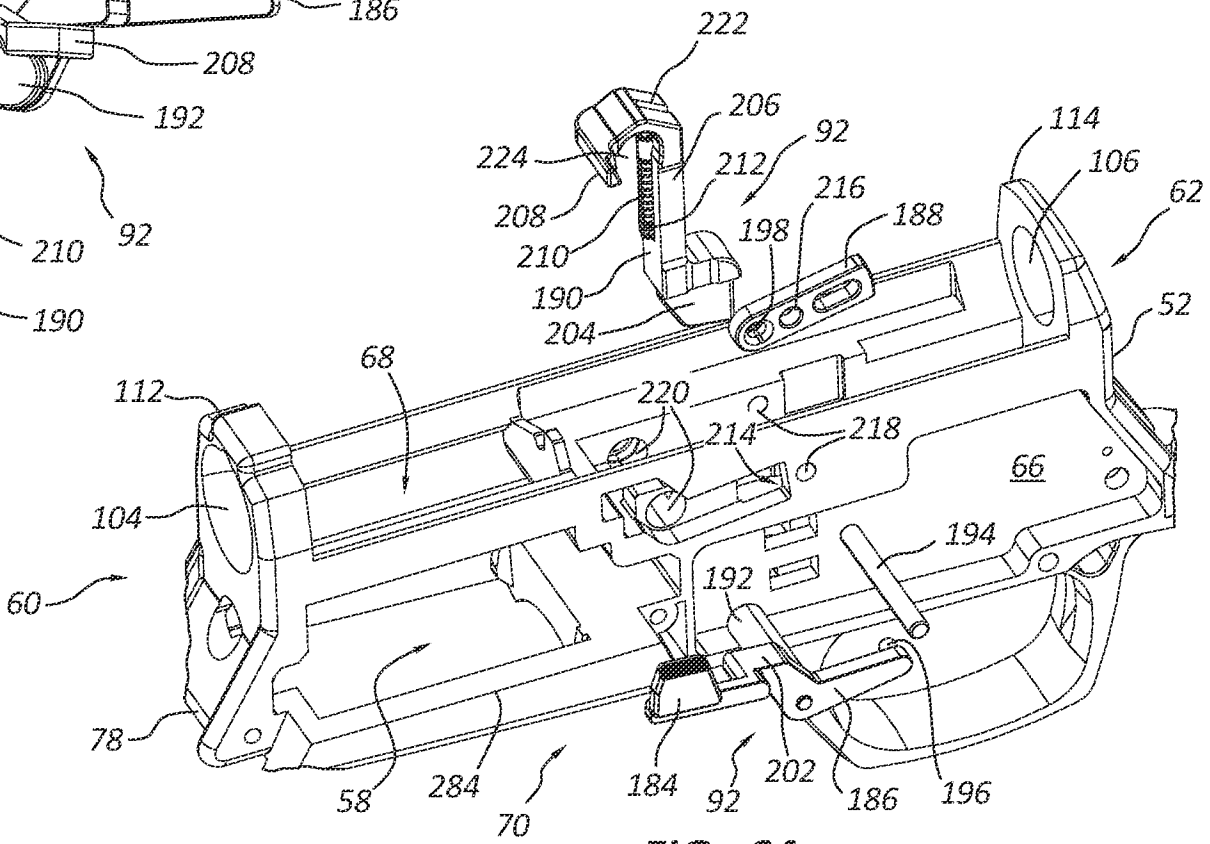
FIGS. 64-65 are exploded perspective views showing how the bolt stop mechanism fits in the frame of the receiver.
Figure 63:
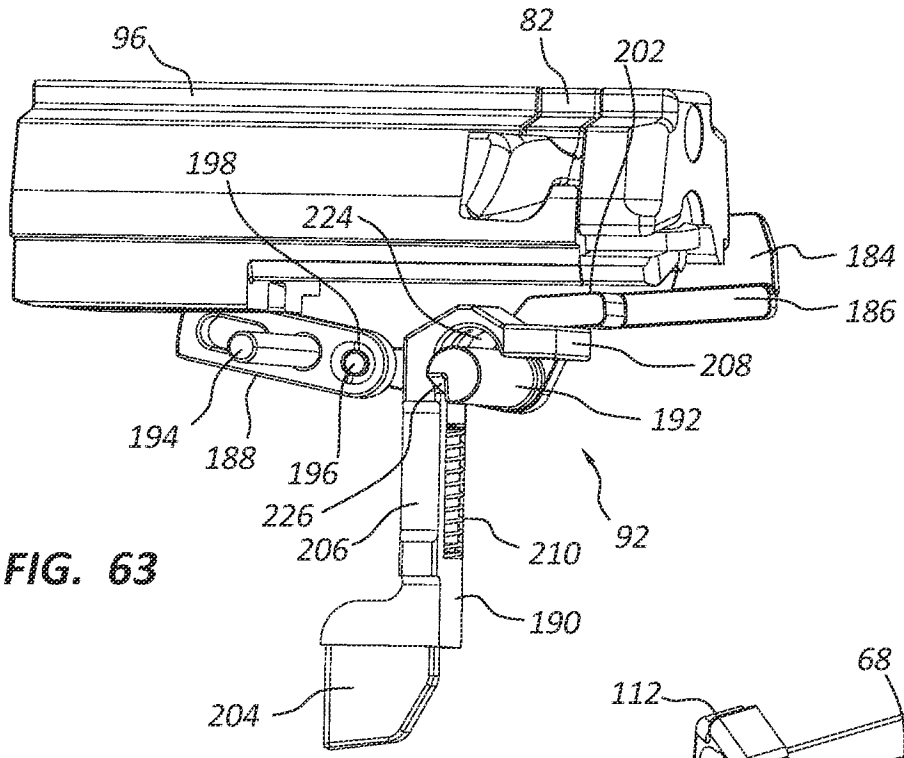

When the bolt 96 moves backward to the position shown in FIGS. 56-59, the pivot member 186 can rotate upward. The top surface 202 is no longer in contact with the bottom of the bolt 96. In this position, the tab 182 pushes the front end of the pivot member 186 upward, which rotates the pivot member 186 around the axis of the pivot shaft 192 and causes the back end of the pivot member 186 to move downward. The front end of the bolt catch 188 moves downward with the back end of the pivot member 186, which rotates the bolt catch 188 on the shaft 194 and causes the back end of the bolt catch 188 to move upward into the recess 200 on the bottom of the bolt 96 as shown in FIGS. 58-59. The bolt 96 cannot move forward to the closed position when the bolt catch 188 is positioned in the recess 200.

FIGS. 60-63 show another embodiment of the bolt stop mechanism 92 holding the bolt 96 open using the manual actuator 190. The manual actuator 190 extends upward through the receiver 50 and includes a tab 204 extending out of the bottom 70 of the receiver 50, a main body 206 extending upward from the tab 204 and wrapping over the top of the pivot shaft 192, and an actuation arm 208 extending outward from the main body 206 underneath the front end of the pivot member 186.

In general, the manual actuator 190 moves between a first position where the manual actuator 190 does not contact or otherwise engage the rest of the bolt stop mechanism 92 and a second position where the manual actuator 190 cause the bolt catch 188 to move into the recess 200 on the bottom of the bolt 96 and hold the bolt 96 open.

The user operates the manual actuator 190 by pushing up on the tab 204 when the bolt 96 is open. This causes the manual actuator 190 to move vertically along its lengthwise axis, which pushes the arm 208 upward against the bottom of the front side of the pivot member 186. This causes the pivot member 186 and the bolt catch 188 to rotate in the manner described above until the bolt catch 188 is positioned in the recess 200 and locks the bolt 96 in the open position.

The manual actuator 190 includes a spring or biasing member 210 positioned in a recess 212 in the main body 206. The spring 210 biases the manual actuator 190 downward to the first position. The top of the spring 210 contacts the bottom of the pivot shaft 192 and the bottom of the spring 210 contacts the bottom of the recess 212. When the user pushes the manual actuator 190 upward to the second position, the spring 210 is compressed. When the user releases the manual actuator 190, the spring 210 pushes the manual actuator 190 downward to the first position.

Figure 68:
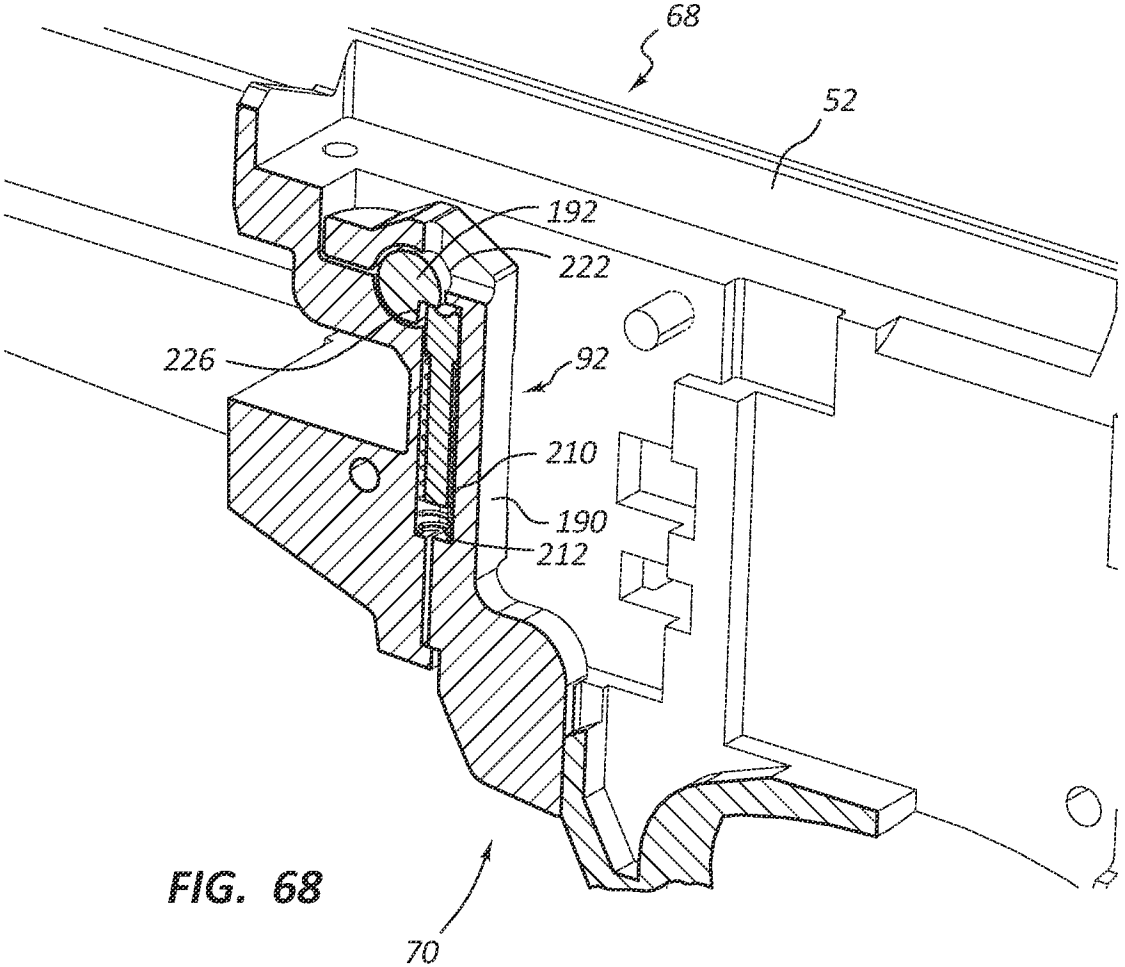
FIG. 68 is a cross sectional perspective view through the manual actuator of the bolt stop mechanism.

In some embodiments, the spring 210 biases the bolt stop mechanism 92 to the first position where the bolt 96 can move freely forward and backward. As shown in FIG. 68, the spring 210 contacts the pivot shaft 192 at a location that is to the side of the lengthwise axis of the pivot shaft 192. The force of the spring 210 torques the pivot shaft 192 in a direction that causes that front end of the pivot member 186 to rotate downward, which disengages the bolt catch 188 from the recess 200 in the bottom of the bolt 96. It should be noted that the pivot member 186 and the pivot shaft 192 are fixed together and do not rotate relative to each other.

It should be appreciated that the bolt stop mechanism 92 can have any suitable configuration capable of holding the bolt 96 open. For example, the position of the tab 182 can be changed along with the position of the pivot member 186. Also, the manual actuator 190 can extend outward from the sides 24, 26 of the firearm 10 instead of the bottom 30.

FIGS. 64-67 show how the components of the bolt stop mechanism 92 fit in the frame 52. The bolt catch 188 is positioned in a slot 214 inside the frame 52. The shaft 194 extends through a hole 216 positioned roughly in the center of the bolt catch 188 and through holes 218 in the right side 64 and the left side 66 of the frame 52.

The manual actuator 190 is inserted down through the top 68 of the frame 52 to its assembled position. The pivot shaft 192 extends through holes 220 in the right side 64 and left side 66 of the frame 52 and through a semi-circular cavity 224 formed by the top of the main body 206 of the manual actuator 190. The spring 210 needs to be initially compressed for the pivot shaft 192 to fit through the cavity 224. This can be done by inserting a paperclip or other small object through a hole 222 in the top of the main body 206 and pushing the spring downward while, at the same time, sliding the pivot shaft 192 into the cavity 224.

Figure 66:
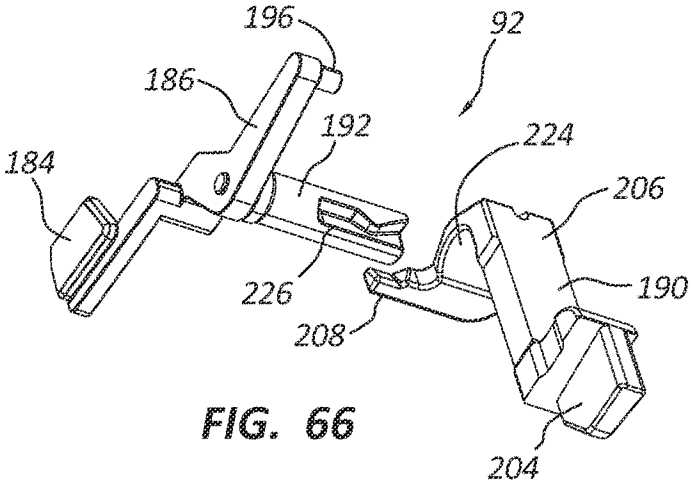
FIGS. 66-67 are exploded perspective views of the pivot member and the manual actuator of the bolt stop mechanism.
Figure 67:
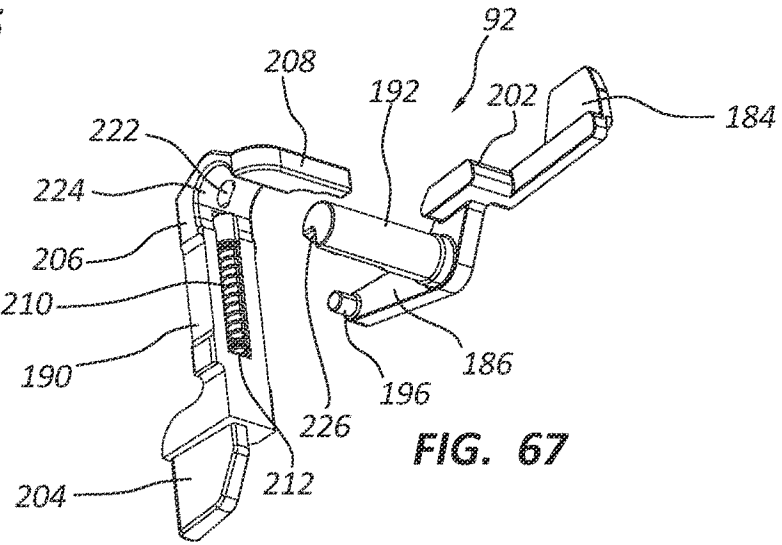
Figure 65:
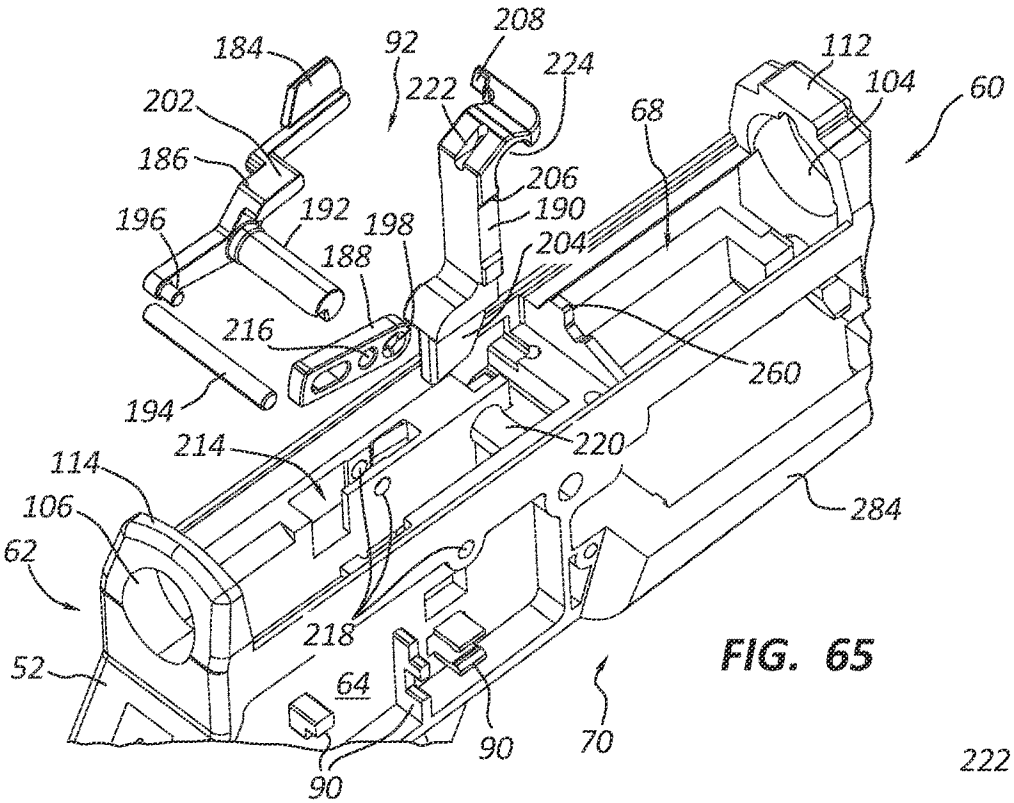

Referring to FIGS. 66-67, the pivot shaft 192 includes a recess or race 226 located on the bottom back portion of the pivot shaft 192. The spring 210 slides along the recess 226 as the pivot shaft 192 passes through the cavity 224. The surface of the recess 226 is curved to form a detent-type locking arrangement with the spring 210 to hold the pivot shaft 192 in position. As the top of the spring 210 moves along the surface it initially pushes the spring 210 further inward before allowing the spring 210 to extend outward into the final assembled position.

Trigger Mechanism

The trigger mechanism 56 generally includes the components that initiate the firing sequence of the firearm 10. In the embodiment shown in the FIGS., the trigger mechanism 56 includes the components that catch and release the striker 132. It should be appreciated that the trigger mechanism 56 can have a variety of configurations depending on the action and system of operation of the firearm 10.

Figure 70:
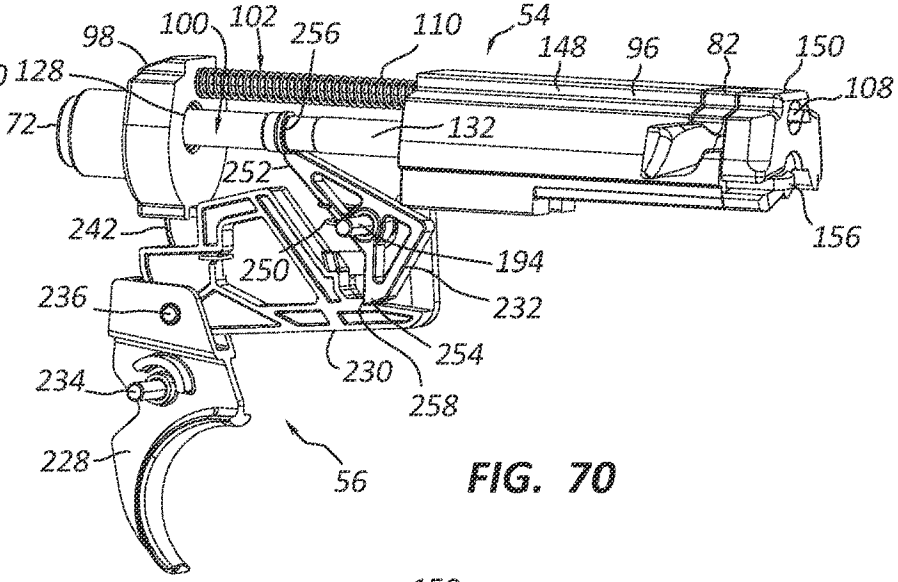
FIGS. 69-70 are perspective views of the trigger mechanism and the slide assembly with the trigger mechanism being ready to fire. The views are from the right side.
Figure 69:
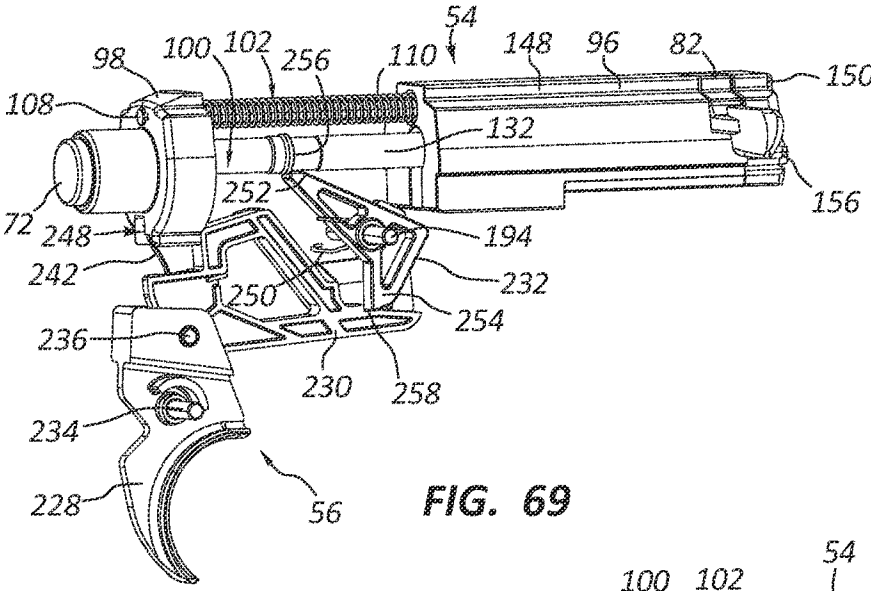

In the embodiment shown in FIGS. 69-70, the trigger mechanism 56 includes a trigger 228, a trigger disconnector 230, a sear 232, and a safety mechanism 262. The trigger 228 is the component the user actuates to fire the firearm 10. The trigger 228 extends outward from the bottom 70 of the receiver 50 and is enclosed and protected by a trigger guard. The trigger 228 is normally in a forward position. The user pulls the trigger 228 backward to actuate the trigger mechanism 56 and fire the firearm 10.

The trigger 228 is rotatably coupled to the frame 52 by a pivot shaft 234, which extends through corresponding holes in the trigger 228 and the frame 52. The trigger 228 rotates on the axis of the pivot shaft 234 when the user pulls it backward to fire the firearm 10.

The trigger 228 is also rotatably coupled to the trigger disconnector 230 by way of a pivot shaft 236, which extends through holes 238 in the trigger 228 and a hole 240 in the trigger disconnector 230 (FIGS. 72 and 105-108). Notably, the shaft 236 is not fixed to the frame 52 and can move forward and backwards inside the frame 52. As shown in FIGS. 69-70, the ends of the shaft 236 are flush with the sides of the trigger 228. Thus, when the trigger 228 is pulled backward, the shaft 236 moves forward as they both rotate around the axis of the shaft 234.

The trigger disconnector 230 selectively connects and disconnects the trigger 228 and the sear 232. In general, the trigger disconnector 230 is used to operatively disconnect the trigger 228 in certain situations so that pulling the trigger 228 has no effect. For example, in some embodiments, the trigger disconnector 230 prevents fully automatic operation of the firearm 10 when the trigger 228 is held down by operatively disconnecting the trigger 228 after the first cartridge is fired. In other embodiments, the trigger disconnector 230 operatively disconnects the trigger 228 when the firearm 10, the receiver 50, and/or other component of the firearm 10 is not fully assembly or improperly assembled.

The trigger disconnector 230 rotates on the shaft 236 between a first or raised position where the trigger 228 is operatively connected to the sear 232 and a second or lowered position where the trigger 228 is operatively disconnected from the sear 232. In the first position, the trigger disconnector 230 does not contact or otherwise engage the sear 232 when the trigger 228 is pulled. In the second position, the trigger disconnector 230 moves the sear 232 when the trigger 228 is pulled.

Figure 73:
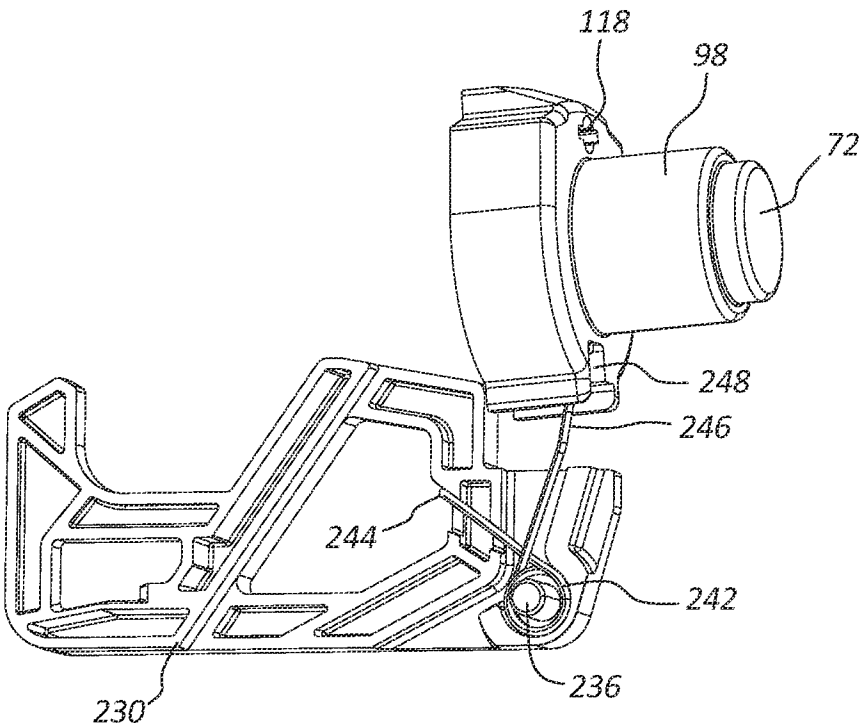
FIGS. 72-73 are perspective views of the slide base coupled to the trigger disconnector. The views are from the right back side and the left side, respectively.
Figure 72:
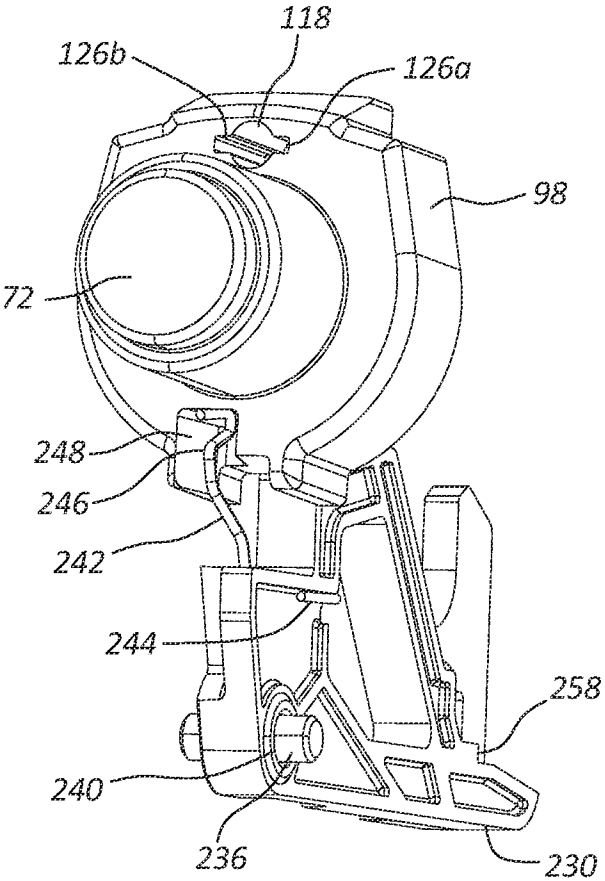

A spring or biasing member 242 biases the front of the trigger disconnector 230 upward to the first position where the trigger disconnector 230 contacts the sear 232. The spring 242 is positioned on the shaft 236 as shown in FIGS. 72-73. The spring 242 includes a first end 244 coupled to the trigger disconnector 230 and a second end 246 coupled to the slide base 98/fastener 72. The first end 244 of the spring 242 is coupled to the back, central portion of the trigger disconnector 230. The second end 246 of the spring 242 is positioned in a cavity or hole 248 at the bottom of the slide base 98/fastener 72.

The sear 232 is the part of the trigger mechanism 56 that holds the striker 132 in a cocked position until the trigger 228 is pulled. In general, the sear 232 moves between a first position where the sear 232 holds the striker 132 in a cocked position and a second position where the striker 132 is released and can move forward to strike the firing pin 162.

In some embodiments, the sear 232 is rotatably coupled to the shaft 194 at a location that is approximately in the middle of the sear 232. A spring or biasing member 250 biases the top end 252 of the sear 232 upward towards the striker 132. One end of the spring 250 is coupled to the frame 52 and the other end of the spring 250 is coupled to the sear 232 in the manner shown in FIG. 101.

The top end 252 of the sear 232 catches a sear stop, protrusion, or ridge 256 on the striker 132 to hold the striker 132 in the cocked position. The bottom end 254 of the sear 232 engages a lip 258 on the bottom front portion of the trigger disconnector 230 when the trigger disconnector 230 is in the first position. When the trigger 228 is pulled, the trigger disconnector 230 moves forward and the lip 258 contacts the bottom end 254 of the sear 232. This rotates the top end 252 of the sear 232 away from the sear stop 256 on the striker 132, thereby releasing the striker 132.

FIGS. 144-148 show another embodiment of a striker 432 comprising a plurality of sear stops 256, 456. The sear stop 256 is a first sear stop 256 and the striker 432 includes a second sear stop 456. The sear stops 256, 456 are spaced apart on the striker 432 with the second sear stop 456 being positioned further forward than the first sear stop 256.

The use of two sear stops 256, 456 provides two main benefits. First, during normal operation of the action, the striker 432 operates with greater force because the sear 232 engages the second sear stop 456 to hold the striker 432 in the cocked position. In this position, the spring 134 is compressed more that it is when the sear 232 engages the first sear stop 256. The increased force makes it possible for the striker 432 to move more reliably through dirt and grime that may build up in the action during long periods of use or in dirty environments.

Figure 144:
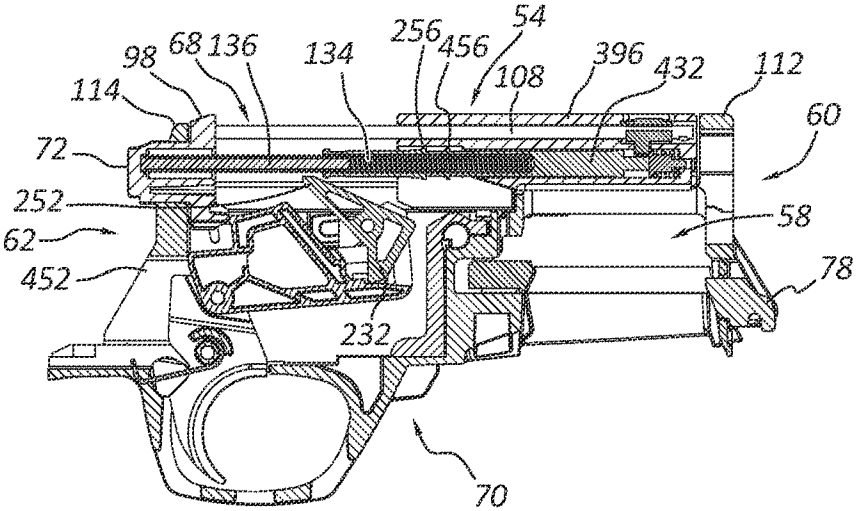
FIGS. 144-146 are right side views of another embodiment of the receiver comprising a striker with at least two sear stops where the sear engages the sear stop that is furthest forward on the striker.
Figure 146:
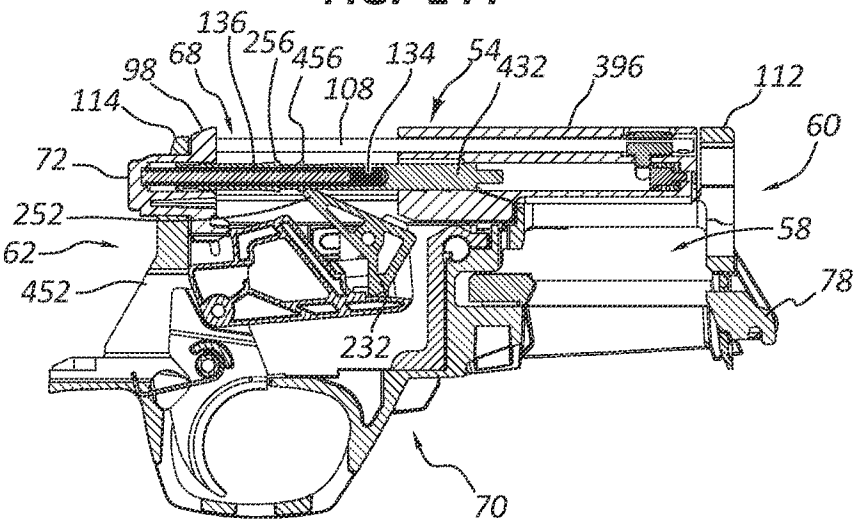
Figure 145:
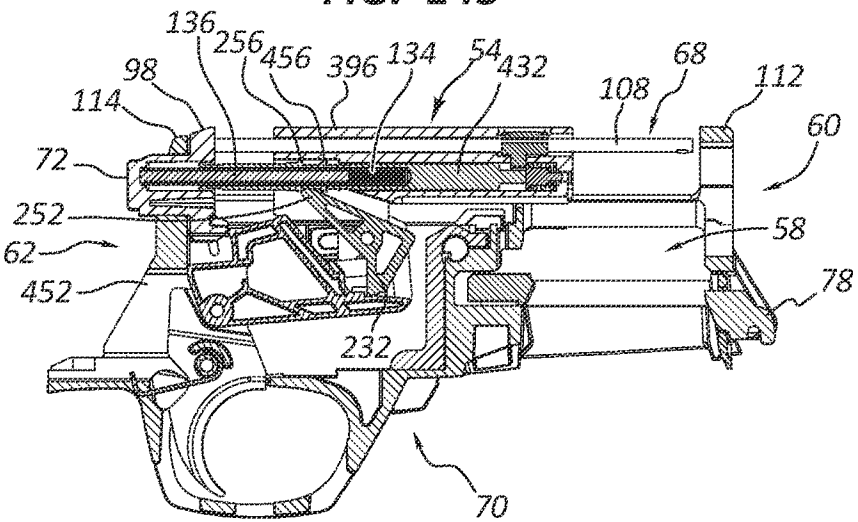

FIGS. 144-146 illustrate how the sear 232 engages the second sear stop 456 during normal operation of the action. FIG. 144 shows the action with the bolt 396 forward in the closed position and the striker 432 in the fire position. The bolt 396 moves backward and pushes the striker 432 along with it until the sear 232 contacts the second sear stop 456 as shown in FIG. 145. The bolt 396 continues to move backward until it is in a fully open position. The bolt 396 then moves forward to the closed position leaving the striker 432 in the cocked position as shown in FIG. 146.

Figure 148:
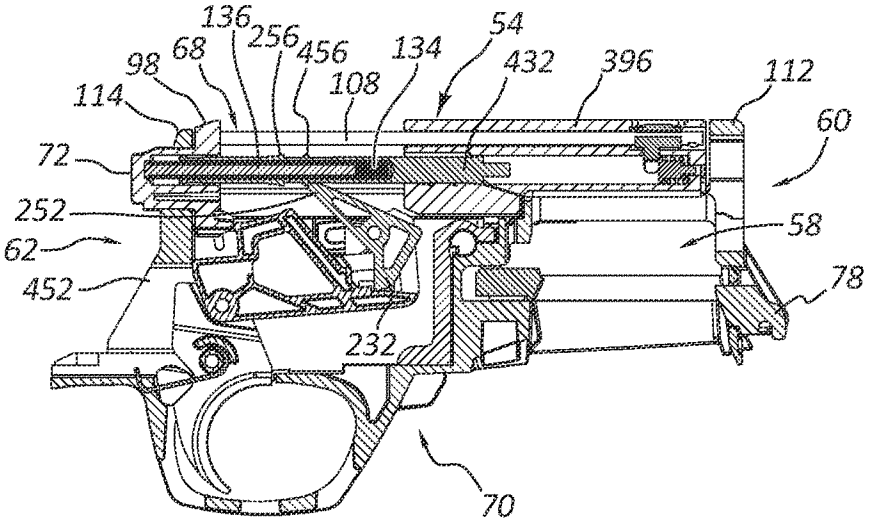
FIGS. 147-148 are right side views of the embodiment of the receiver shown in FIGS. 144-146 where the sear engages the sear stop that is furthest backward on the striker.
Figure 147:
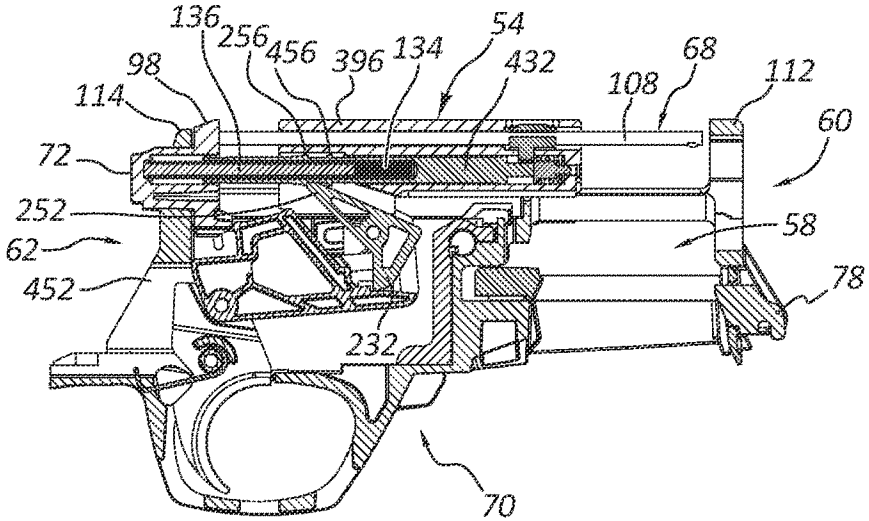

Second, the striker 432 is prevented from moving forward by the first sear stop 256 when the bolt 396 is partially retracted far enough to pick up a cartridge but not far enough for the sear 232 to engage the second sear stop 456. For example, this can happen when a user manually retracts the bolt 396 partially backward far enough to catch a cartridge and then releases the bolt 396. In this situation, the sear 232 engages the first sear stop 256 and prevents the striker 432 from moving forward with the bolt 396, impacting the firing pin 162, and setting off the cartridge. FIGS. 147-148 illustrate how the sear 232 engages the first sear stop 256 when the bolt 396 is retracted just far enough to pick up a cartridge and then released.

Figure 71:
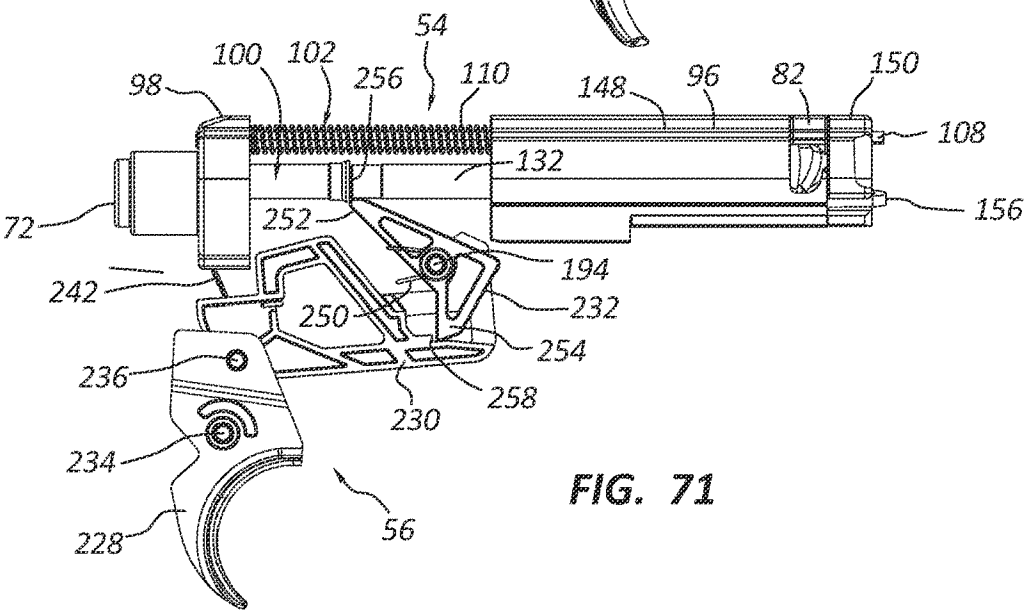
FIG. 71 is a right side view of the trigger mechanism and the slide assembly in FIGS. 69-70.

FIGS. 69-93 show the position of the trigger mechanism 56 and the slide assembly 54, through one complete cycle of the action. FIGS. 69-71 show the trigger mechanism 56 and the striker mechanism 100 in a cocked, ready to fire position. In general, the striker 132 moves between a cocked position where the striker 132 is retracted and spaced apart from the firing pin 162 and a fire position where the striker 132 is propelled forward by the spring 134 into the firing pin 162. The sear 232 is holding the striker 132 in the cocked position in FIGS. 69-71.

Figure 74:
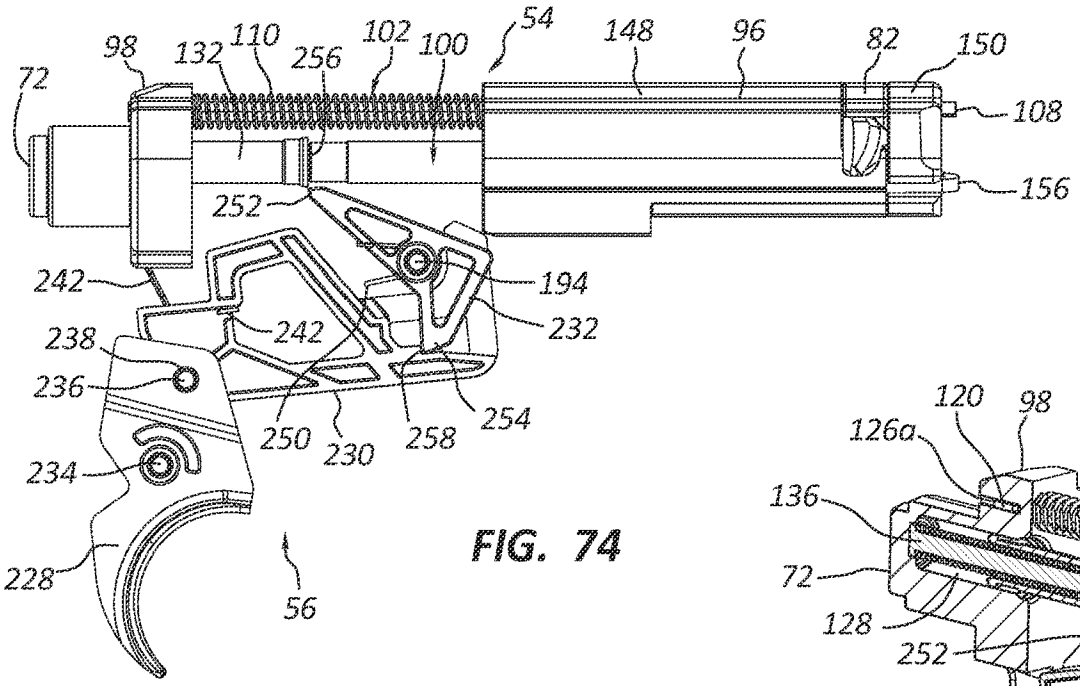
FIG. 74 is a right side view of the trigger mechanism and the slide assembly at the moment the trigger is pulled and the striker mechanism is released.

When the user pulls the trigger 228, the trigger mechanism 56 and the striker mechanism 100 move in the manner shown in FIGS. 74-75. The bottom of the trigger 228 rotates backward and the top of the trigger 228 rotates forward. This moves the trigger disconnector 230 forward so that the lip 258 contacts and rotates the bottom end 254 of the sear 232 forward. This causes the top end 252 of the sear 232 to rotate backwards and downward, which releases the striker 132.

Figure 77:
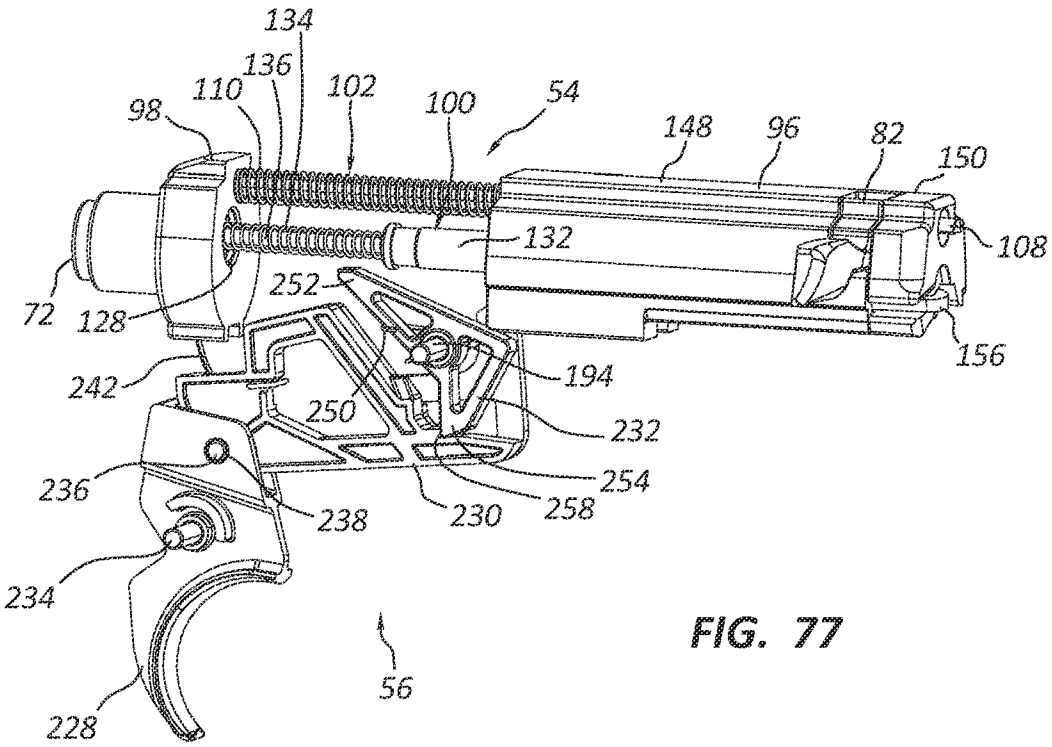
FIGS. 76-77 are perspective views of the trigger mechanism and the slide assembly when the striker mechanism impacts the firing pin and pushes it out the front of the bolt face. The views are from the right side.
Figure 76:
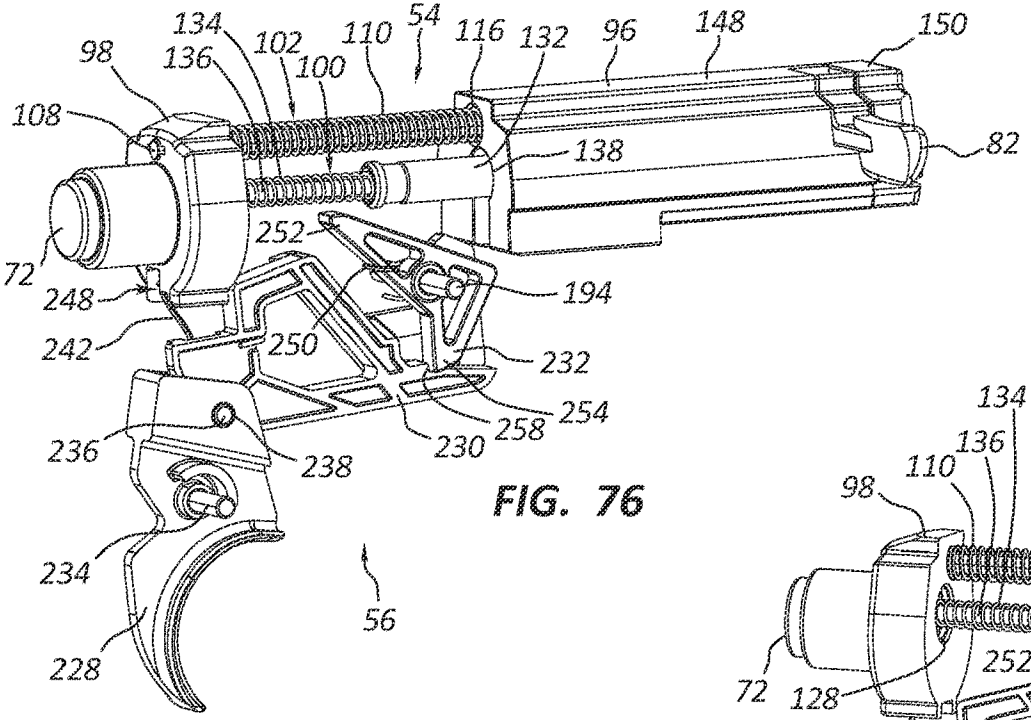
Figure 79:
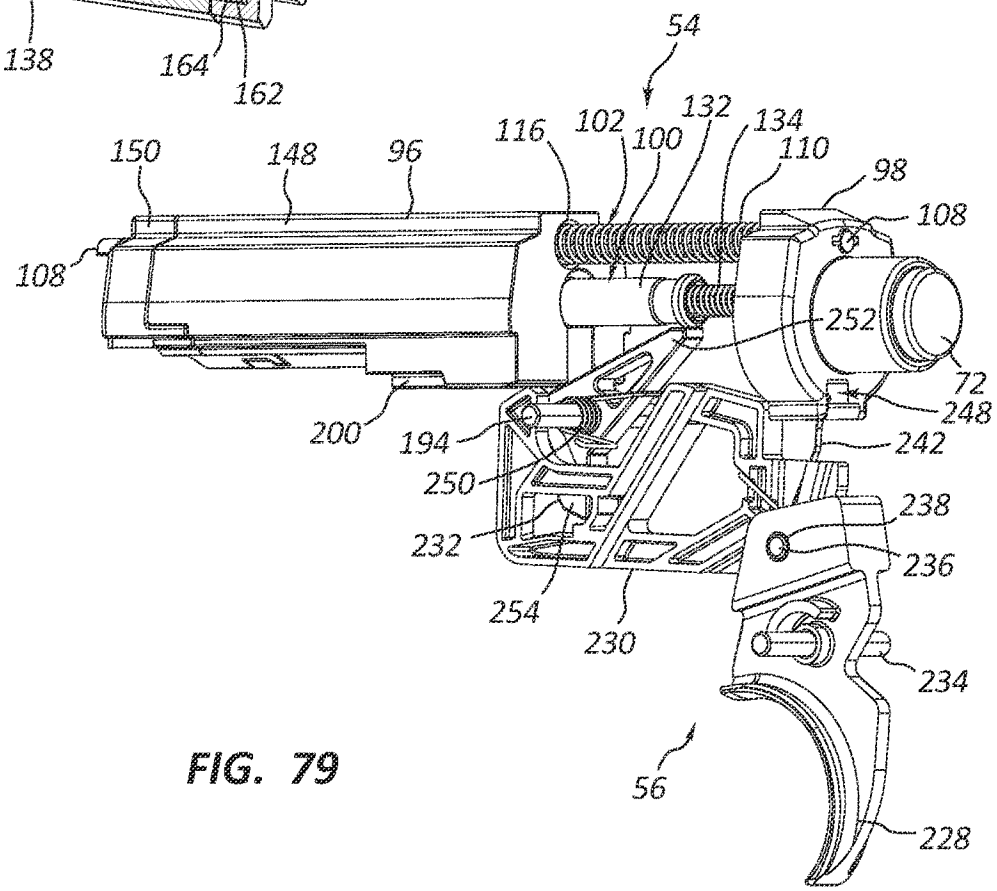
FIGS. 79-80 are perspective views of the trigger mechanism and the slide assembly as the bolt begins to move backward and pushes the trigger disconnect downward. The views are from the left side and the right side, respectively.
Figure 78:
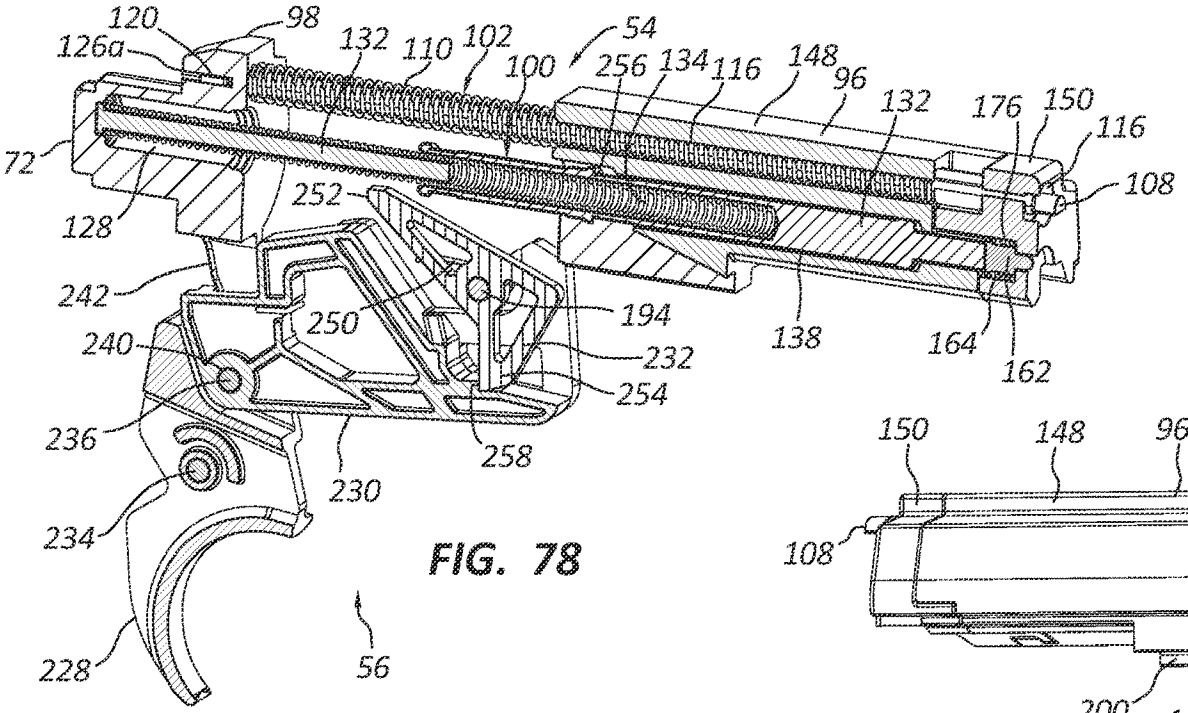
FIG. 78 is a cross sectional perspective view of the trigger mechanism and the slide assembly showing the internal position of the striker mechanism in FIGS. 76-77.
Figures 80, 81:
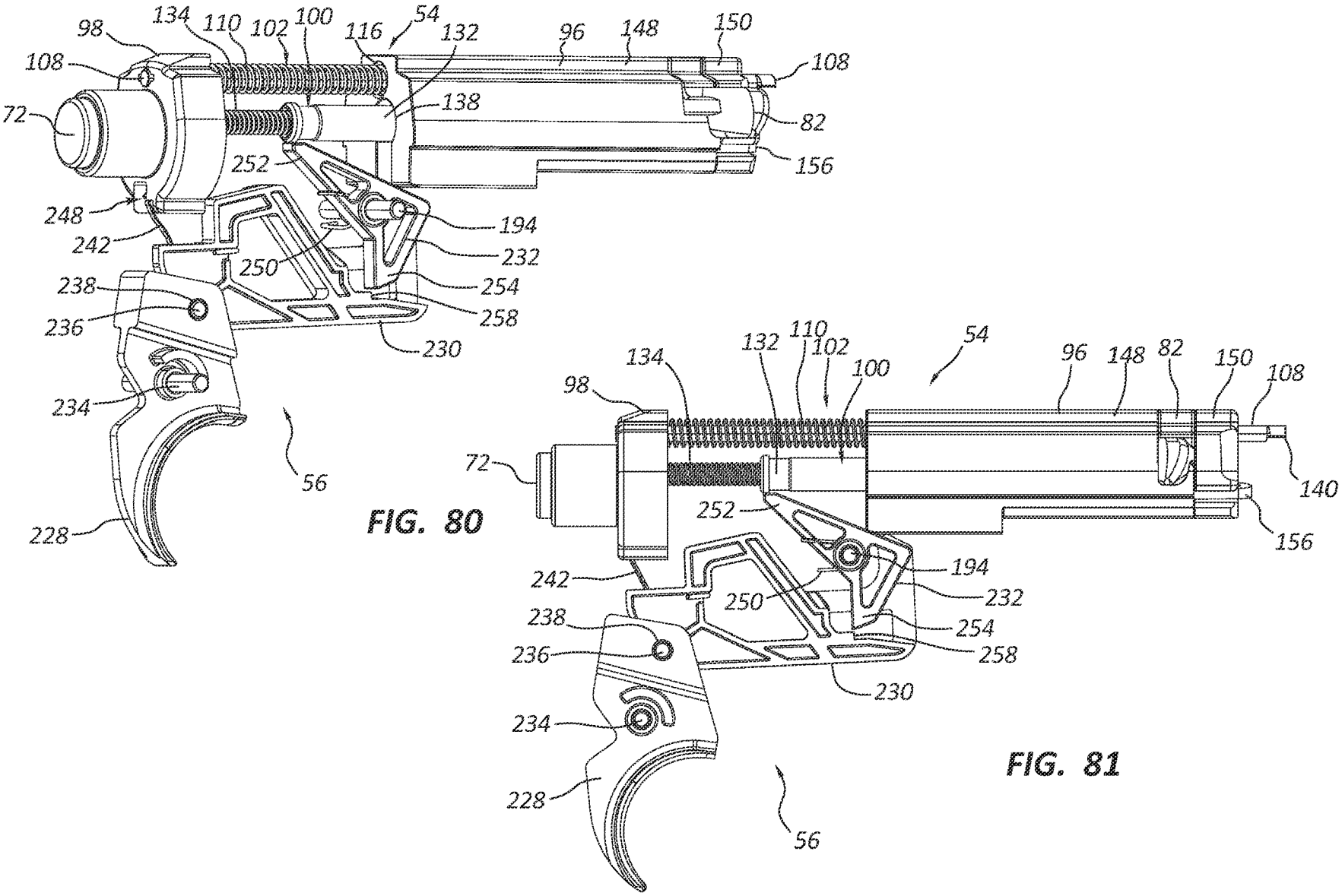
FIG. 81 is a right side view of the trigger mechanism and the slide assembly in FIGS. 79-80.
Figure 83:
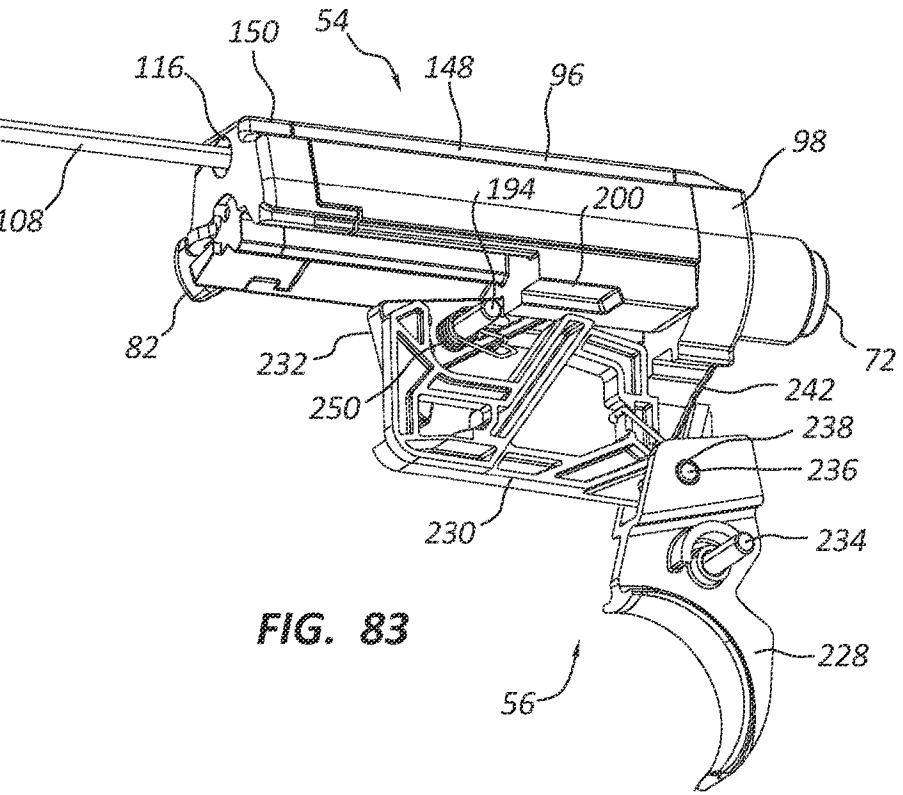
FIGS. 83-84 are perspective views of the trigger mechanism and the slide assembly with the bolt fully retracted. The views are from the left side and the right side, respectively.
Figure 82:
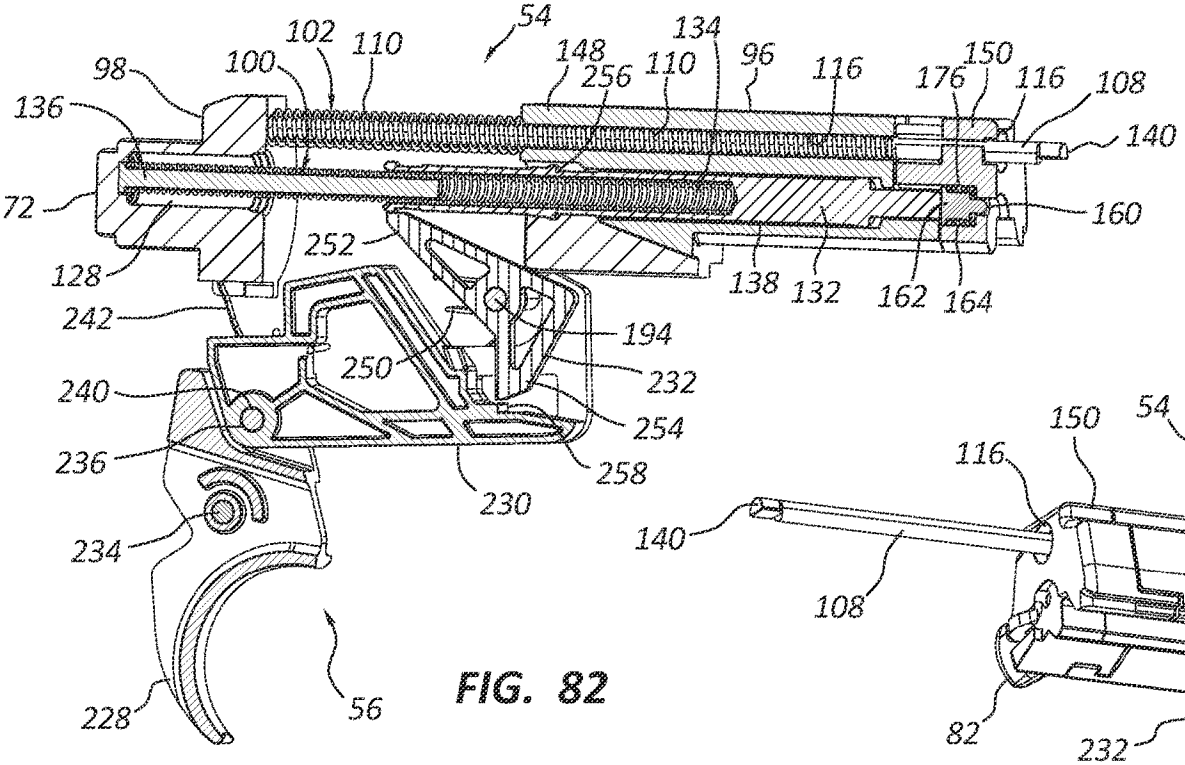
FIG. 82 is a cross sectional perspective view of the trigger mechanism and the slide assembly showing the internal position of the striker mechanism in FIGS. 79-81.
Figure 85:
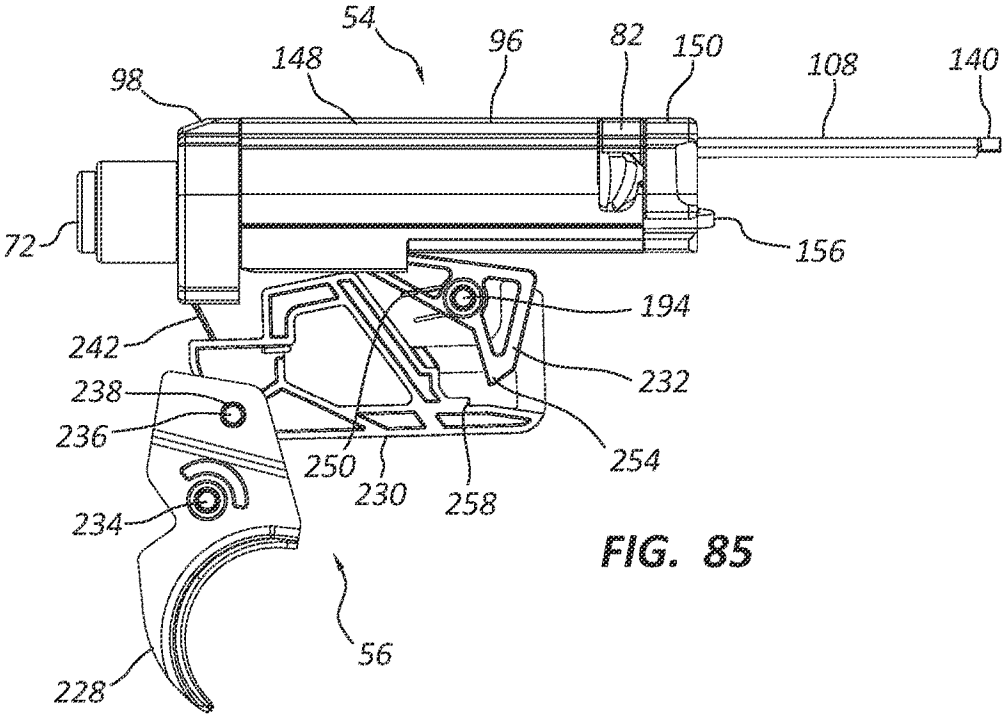
FIG. 85 is a right side view of the trigger mechanism and the slide assembly in FIGS. 83-84.
Figure 84:
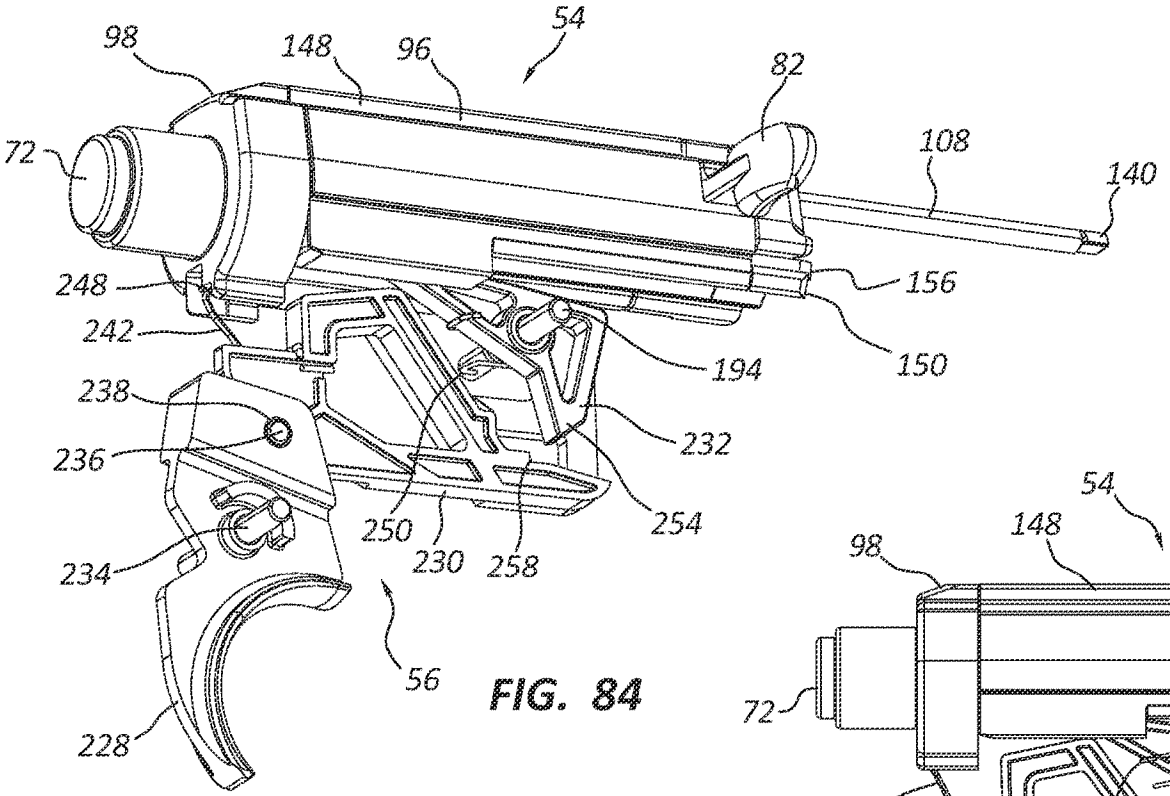

With the sear 232 out of the way, the striker 132 is propelled forward by the spring 134 into the firing pin 162 as shown in FIGS. 76-78. In general, the firing pin 162 moves between a first position where the firing pin 162 is retracted in the hole 160 in the bolt face 150 and a second position where the firing pin 162 extends outward through the hole 160 in the bolt face 150. The striker 132 hits the firing pin 162, compresses the firing pin spring 164, and pushes the firing pin 162 from the first position to the second position as shown in FIG. 78. The firing pin 162 strikes the chambered cartridge and ignites the powder inside. The firing pin spring 164 immediately biases the firing pin 162 back to the first position so that the firing pin 162 does not interfere with the ejection of the cartridge.

The pressure in the cartridge pushes the bolt 96 backward from the closed position, which compresses the spring 110. Immediately after the bolt 96 begins moving backwards, the bottom of the bolt 96 contacts the top of the front of the trigger disconnector 230 and pushes it downward as shown in FIGS. 79-82. In this position, the trigger 228 is operatively disconnected from the sear 232 because the lip 258 on the trigger disconnector 230 is below the bottom end 254 of the sear 232. The trigger disconnector 230 can move forward and backward but the lip 258 cannot contact the bottom end 254 of the sear 232.

The bolt 96 continues to move backward until it is fully open as shown in FIGS. 83-86. In this position, the bottom of the bolt 96 no longer contacts the top of the front of the trigger disconnector 230 but it does contact the top of the middle portion of the trigger disconnector 230. The bottom of the bolt 96 maintains contact with various points on the top of the trigger disconnector 230 as the bolt 96 moves backward to keep the trigger 228 operatively disconnected from the sear 232. The only time the trigger 228 is operatively connected to the sear 232 is when the bolt 96 is closed.

Figures 86, 88:
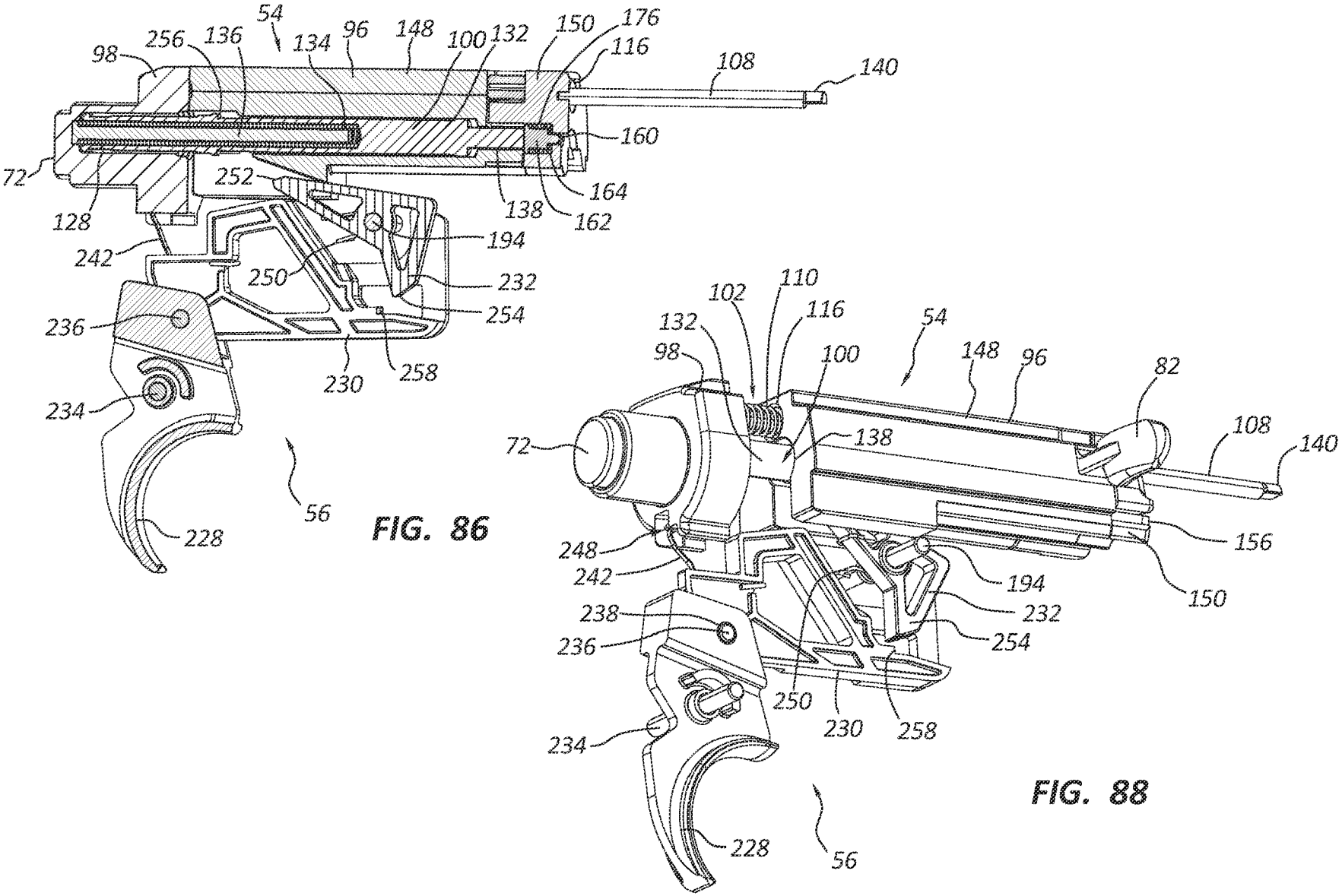
FIG. 86 is a cross sectional perspective view of the trigger mechanism and the slide assembly showing the internal position of the striker mechanism in FIGS. 83-85.
FIGS. 88-89 are perspective views of the trigger mechanism and the slide assembly as the bolt begins moving forward and the sear catches the striker mechanism. The views are from the right side and the left side, respectively.
Figure 87:
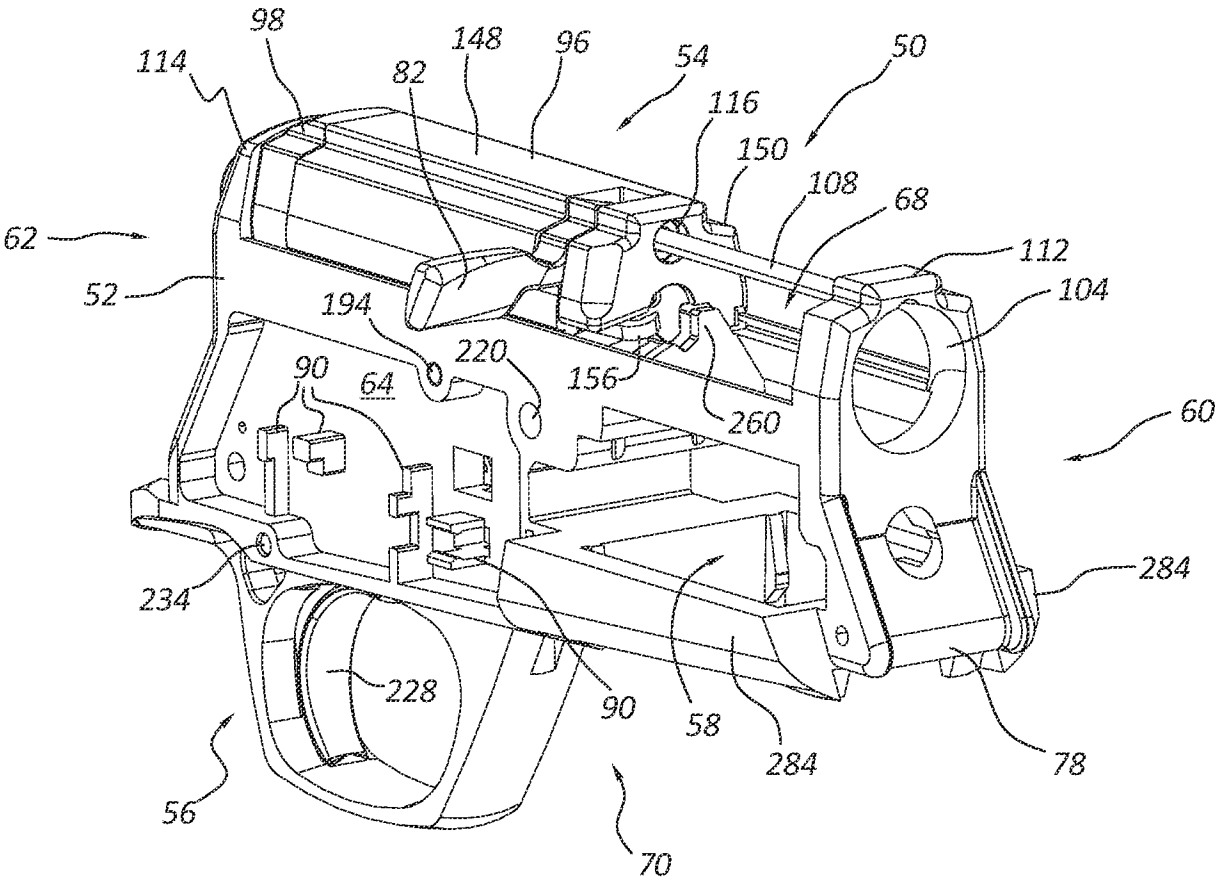
FIG. 87 is a perspective view of the trigger mechanism and the slide assembly in FIGS. 83-86 positioned in the receiver frame. The view is from the front right side of the receiver.
Figure 89:
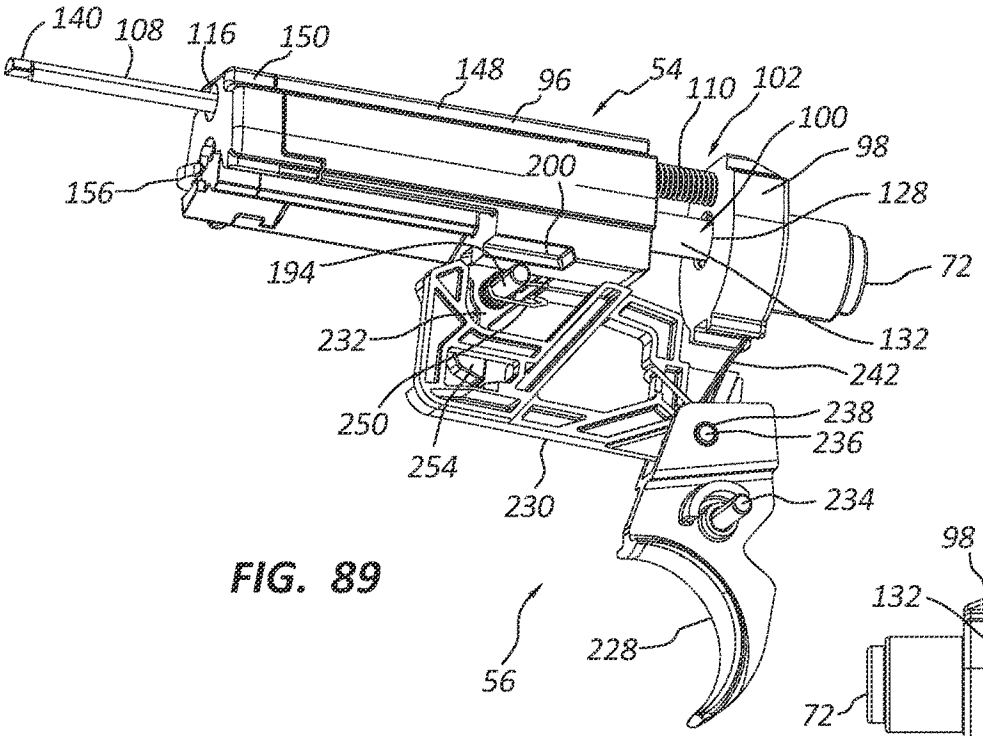
Figure 90:
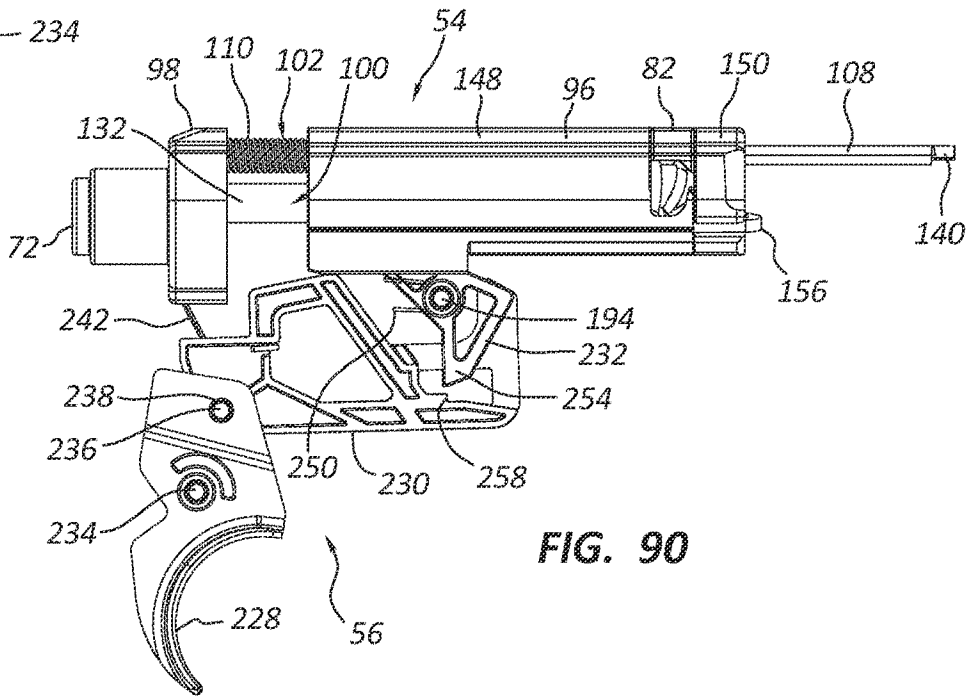
FIG. 90 is a right side view of the trigger mechanism and the slide assembly in FIGS. 88-89.
Figure 91:
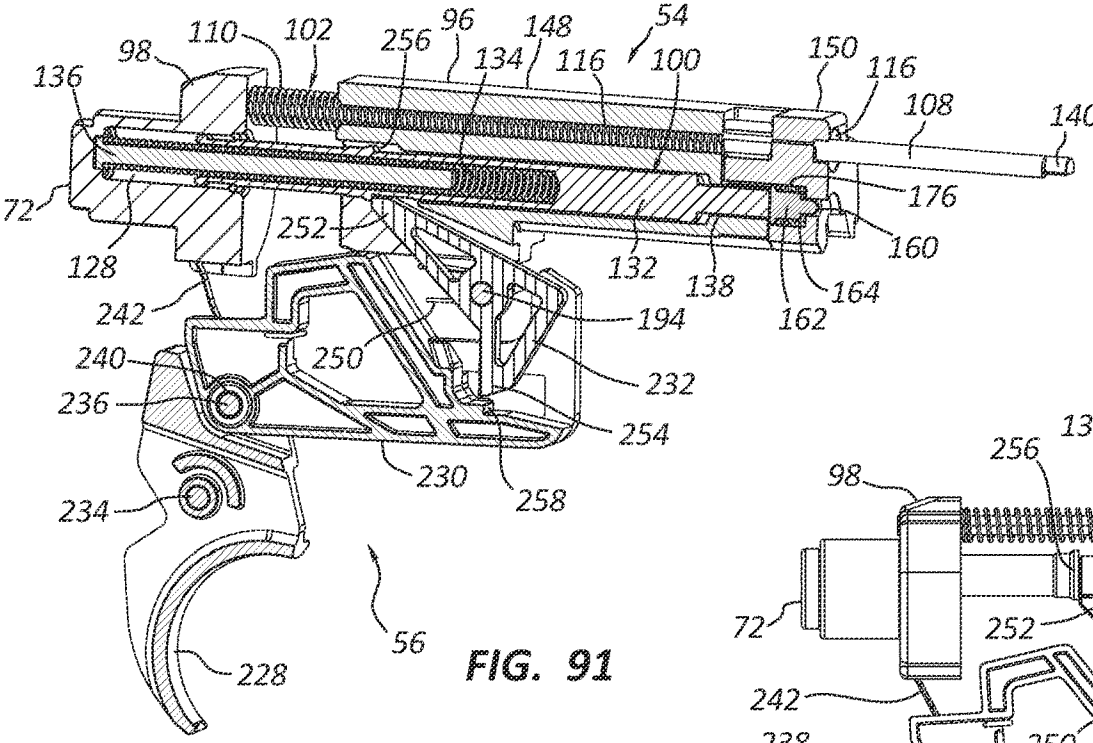
FIG. 91 is a cross sectional perspective view of the trigger mechanism and the slide assembly showing the sear catching the striker mechanism in FIGS. 88-90.

As the bolt 96 moves backward to the open position, it pushes the striker 132 backward and compresses the striker spring 134 as shown in FIG. 86. At the same time, an ejector 260 pushes the spent cartridge out of the action through the cartridge ejection port 80. In some embodiments, the ejector 260 is a protrusion on the frame 52 of the receiver 50 positioned to impact the back of the cartridge as the bolt 96 moves backward (FIG. 87). The protrusion is positioned opposite the ejection port 80 so that it biases the cartridge towards the ejection port 80. It should be appreciated that the ejector 260 can have any of a number of suitable configurations.

The bolt 96 begins to close due to the force of the spring 110, which is fully or almost fully compressed when the bolt 96 is open. As the bolt 96 moves forward, the top end 252 of the sear 232 is biased upward by the spring 250 and catches the sear stop 256 on the striker 132 as shown in FIGS. 88-91. The bottom of the bolt 96 continues to push the trigger disconnector 230 downward so that the trigger 228 is operatively disconnected from the sear 232.

FIGS. 88-91 show the trigger 228 pulled backward as the bolt 96 closes. This is the position the trigger 228 would be in if the user holds the trigger 228 down as the bolt 96 cycles. In this position, the trigger disconnector 230 is moved forward so that the lip 258 is beyond the bottom end 254 of the sear 232. The lip 258 cannot contact the bottom end 254 of the sear 232 because the bottom of the bolt 96 is still pushing the trigger disconnector 230 downward.

Figure 92:
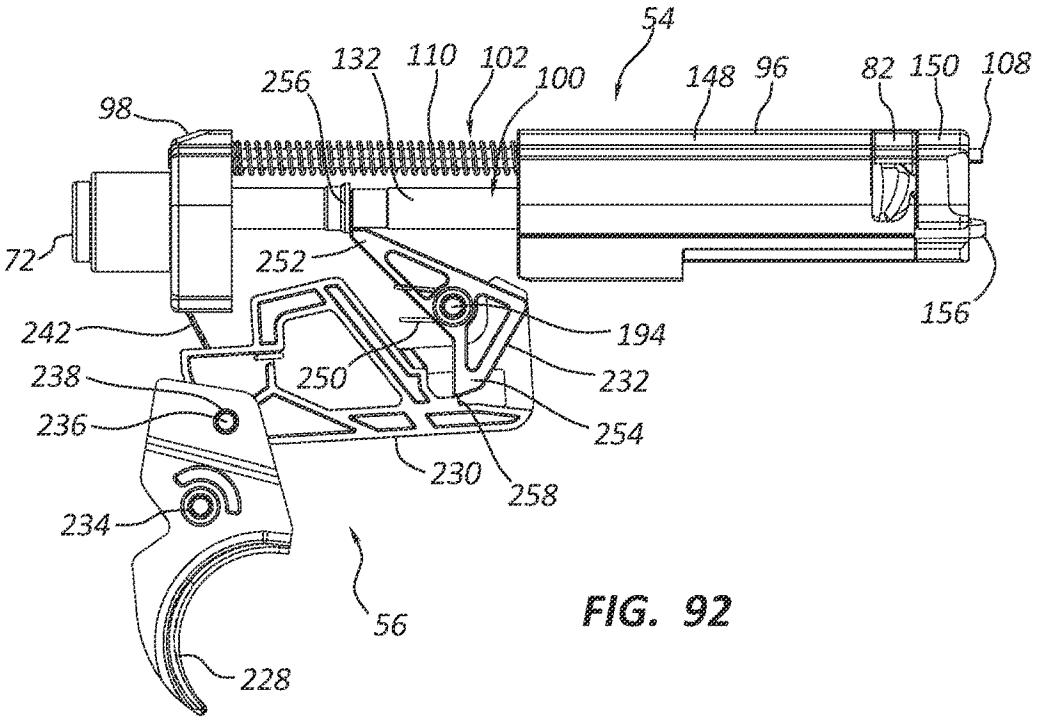
FIG. 92 is a right side view of the trigger mechanism and the slide assembly as the bolt closes while the trigger is pulled.
Figure 93:
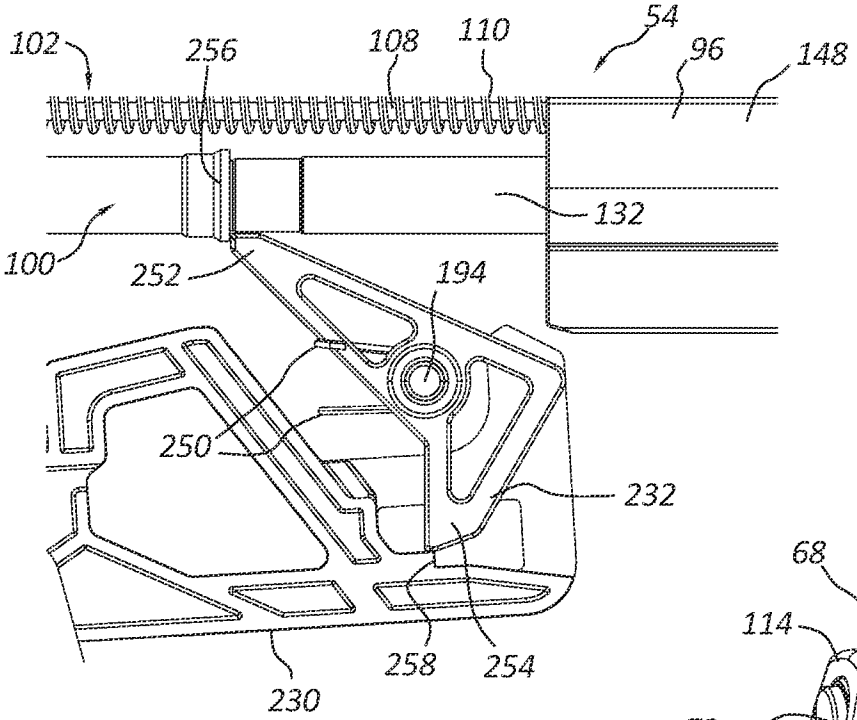
FIG. 93 is a right side view of the trigger mechanism and the slide assembly in FIG. 92 zoomed in to show the position of the trigger disconnector, sear, and striker.

FIGS. 92-93 show the position of the trigger disconnector 230 when the bolt 96 closes with the trigger 228 pulled. When the bolt 96 closes, the front end of the trigger disconnector 230 is free to move upward because it is no longer being held down by the bottom of the bolt 96. However, with the trigger 228 pulled, the trigger disconnector 230 is positioned too far forward for the lip 258 to actuate the sear 232. Instead, the bottom end 254 of the sear 232 rests on the surface above the lip 258. The user cannot fire the firearm 10 again until the user releases the trigger 228, which moves the trigger disconnector 230 backward and upward so that the lip 258 and the bottom end 254 of the sear 232 are in the position shown in FIGS. 69-71.

As mentioned above, the trigger disconnector 230 can operatively disconnect the trigger 228 from the sear 232 when the firearm 10, the receiver 50, and/or other component of the firearm 10 is not fully assembly or improperly assembled. In some embodiments, the trigger disconnector 230 operatively disconnects the trigger 228 when the receiver 50 is not properly seated in the housing 16 and/or the slide assembly 54 is not properly seated in the frame 52 of the receiver 50.

Figure 94:
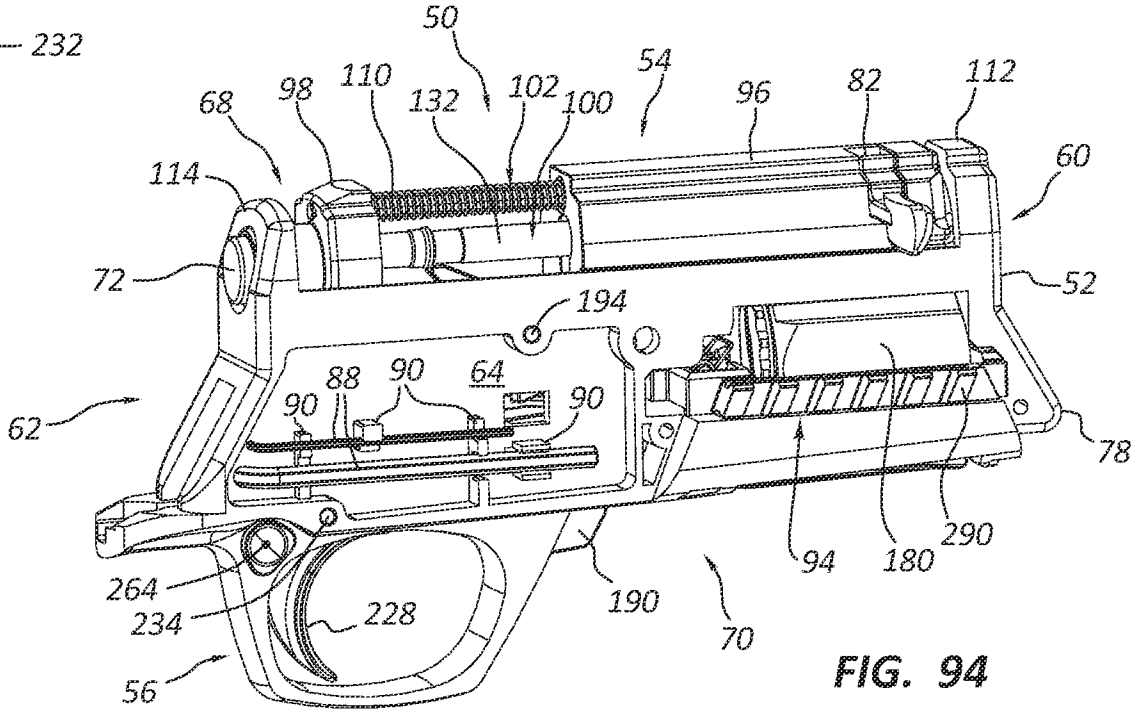
FIG. 94 is a perspective view of the right side of the receiver showing the slide base not fully seated in the receiver frame.

FIG. 94 shows one example of a situation where the slide assembly 54 is not properly seated in the frame 52 of the receiver 50. Specifically, the slide base 98/fastener 72 is not fully extended through the opening 106 in the back upright 114 of the frame 52. This is a situation that can occur, for example, when the receiver 50 is not fully seated in the housing 16. In this situation, the fastener 72 does not extend through the opening 74 in the back end 34 of the housing 16. Instead, it is partially retracted in the manner shown in FIG. 94.

Figure 96:
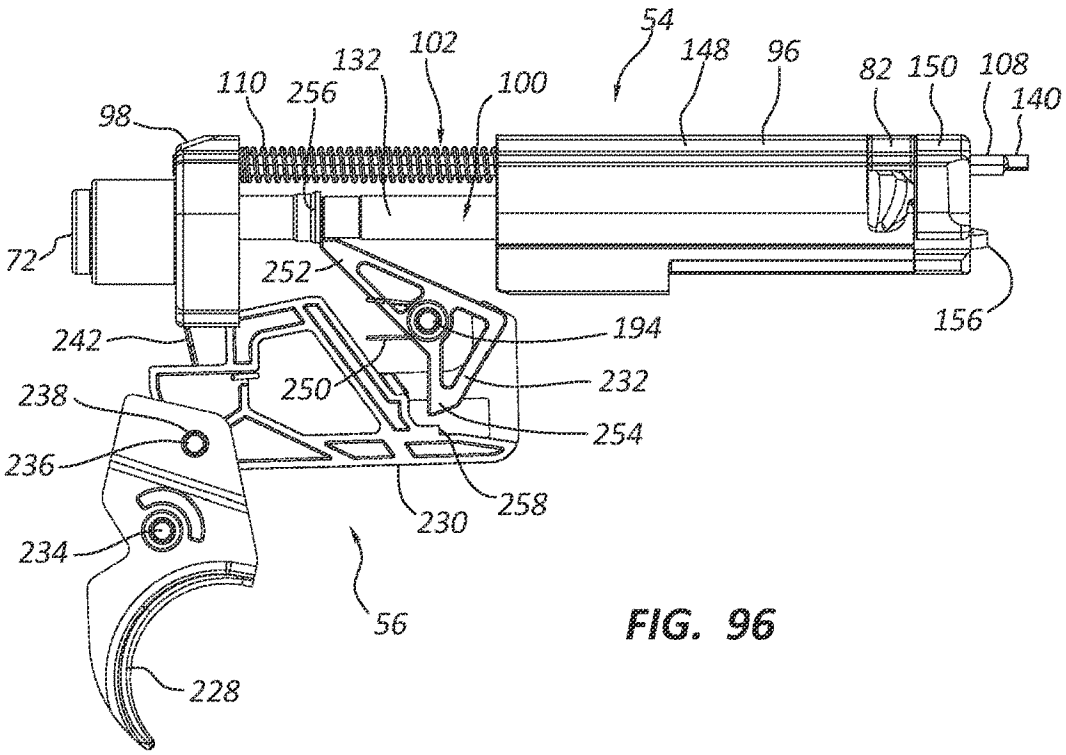
FIG. 96 is a right side view of the trigger mechanism and the slide assembly in FIG. 94 with the slide base partially retracted (i.e., not fully seated) and the trigger pulled.
Figure 95:
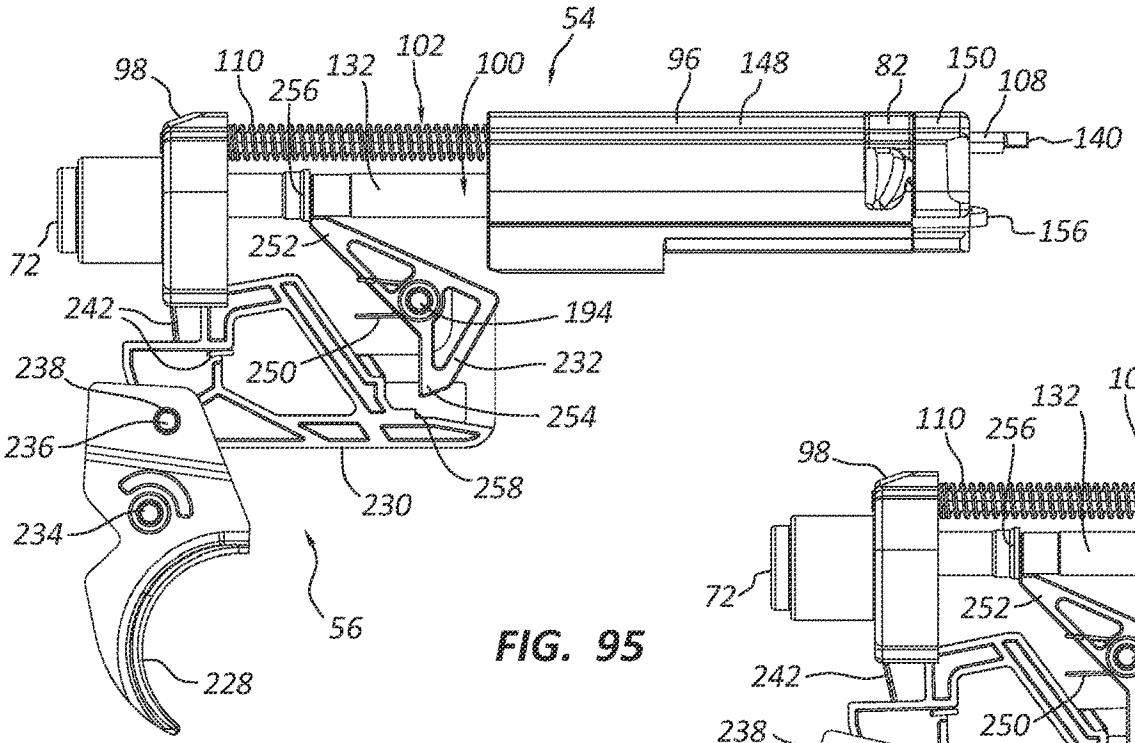
FIG. 95 is a right side view of the trigger mechanism and the slide assembly in FIG. 94 with the slide base partially retracted (i.e., not fully seated) and the trigger forward.
Figure 98:
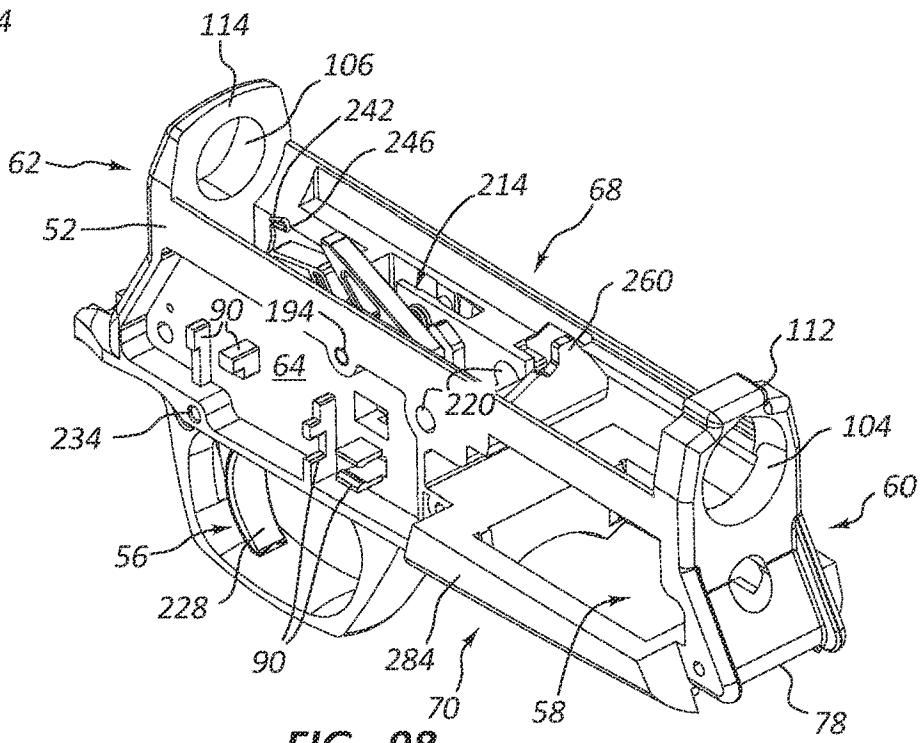
FIGS. 97-100 are perspective views of the trigger mechanism positioned in the receiver frame.
Figure 97:
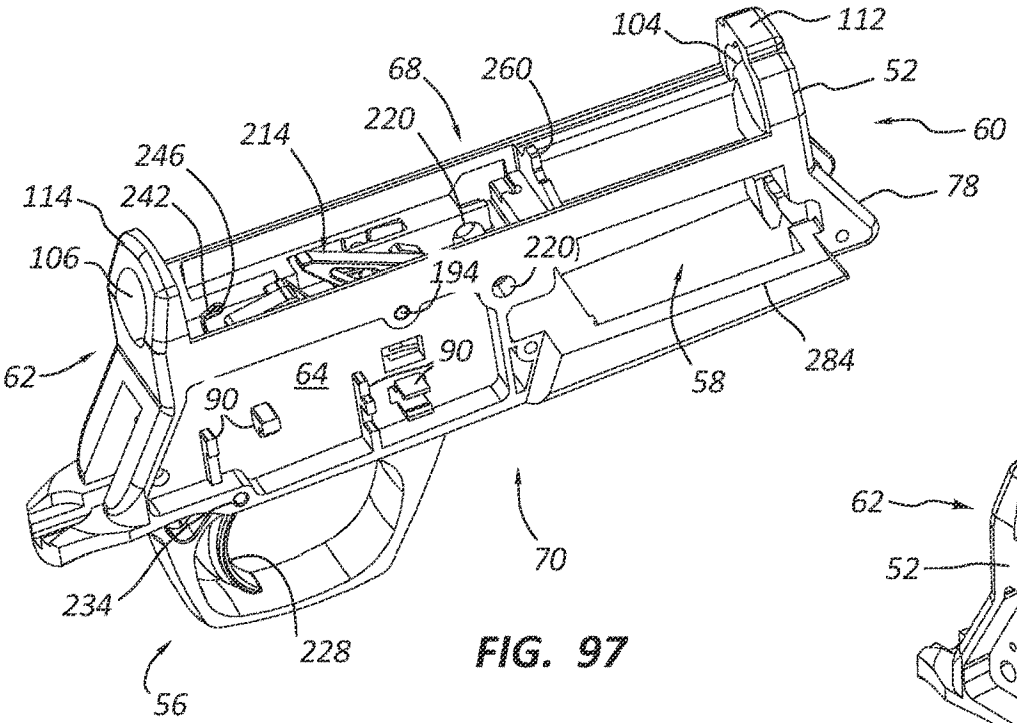
Figure 100:
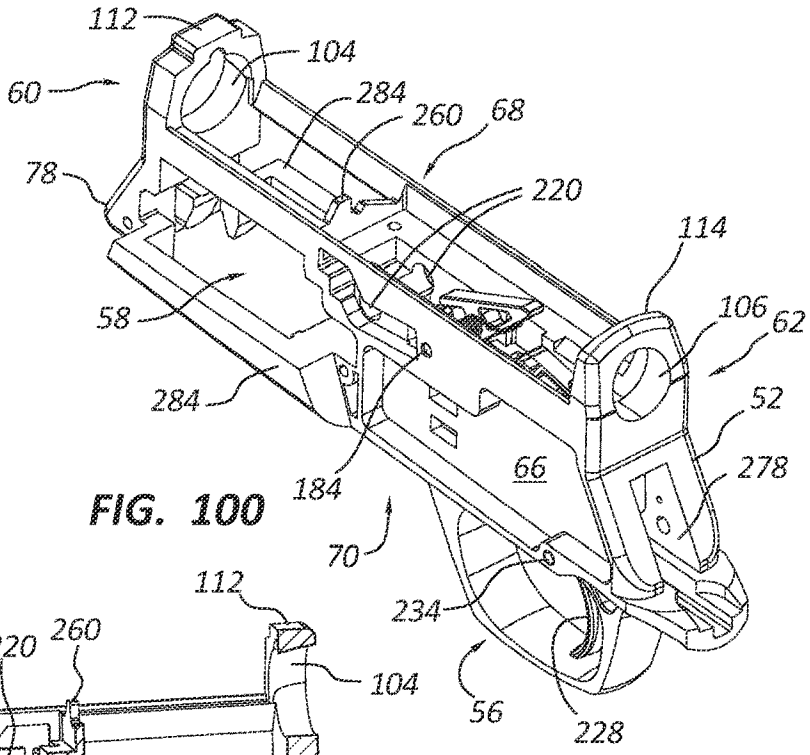

FIGS. 95-96 are the same as FIG. 94 except the frame 52 is removed to better show the trigger mechanism 56. When the slide base 98/fastener 72 is not properly seated (i.e., fully extended), the trigger disconnector 230 operatively disconnects the trigger 228 from the sear 232. This happens because the second end 246 of the spring 242 that biases the trigger disconnector 230 upward is coupled to the slide base 98/fastener 72. The slide base 98/fastener 72 doesn't provide enough force to the spring 242 unless it is properly seated in the opening 106 of the frame 52.

FIG. 95 shows the trigger mechanism 56 before the trigger 228 is pulled, and FIG. 96 shows the trigger mechanism 56 after the trigger 228 is pulled. Before the trigger 228 is pulled, the trigger disconnector 230 is in the second position where the lip 258 is not horizontally aligned with the bottom end 254 of the sear 232 as shown in FIG. 95. When the trigger 228 is pulled, the lip 258 passes underneath the bottom end 254 of the sear 232 as shown in FIG. 96.

The slide assembly 54 can be coupled to the trigger disconnector 230 in any number of ways. In one embodiment, the slide base 98 is coupled to the second end 246 of the spring 242 as the slide assembly 54 is coupled to the frame 52. The second end 246 of the spring 242 extends upward through the frame 52 in the manner shown in FIGS. 97-100.

The bolt 96 is coupled to the front 60 of the frame 52. The slide base 98 is retracted towards the bolt 96 and then pivoted downward onto the top 68 of the frame 52. The slide base 98 is released so that the fastener 72 can extend backward through the opening 106. As the slide base 98 extends backward, the cavity 248 catches the second end 246 of the spring 242 and pushes it backward. When the slide base 98 is fully extended, it provides sufficient force to bias the front of the trigger disconnector 230 upward. Thus, the slide assembly 54 is configured to move the trigger disconnector 230 between the raised and lowered positions.

The safety mechanism 262 is used to help prevent the accidental discharge of the firearm 10. In some embodiments, the safety mechanism 262 is a manual, external safety that the user can move between an "on" and an "off" position. It should be appreciated that the safety mechanism 262 can have any suitable configuration.

Figure 101:
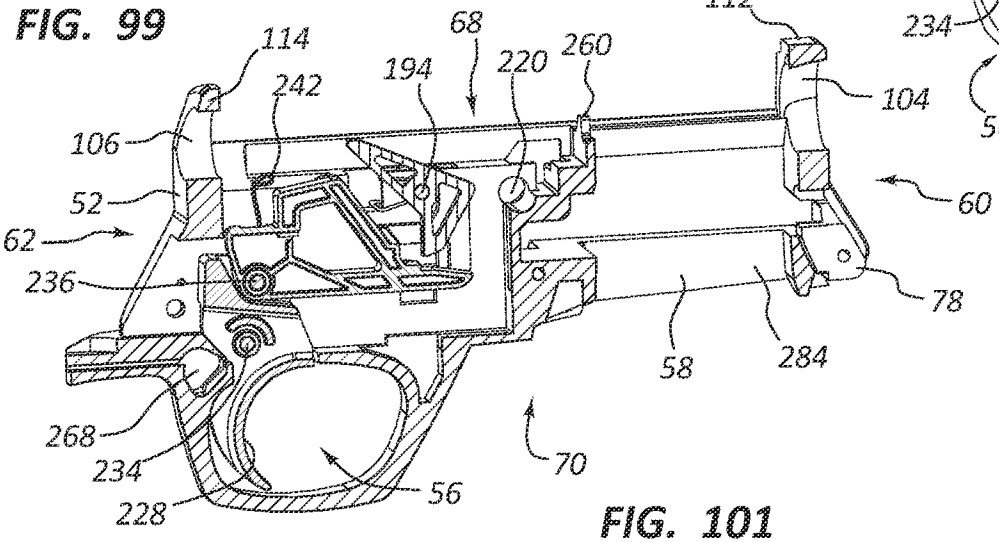
FIG. 101 is a cross sectional side view of the trigger mechanism positioned in the receiver frame. The view is from the right side of the receiver frame.
Figure 99:
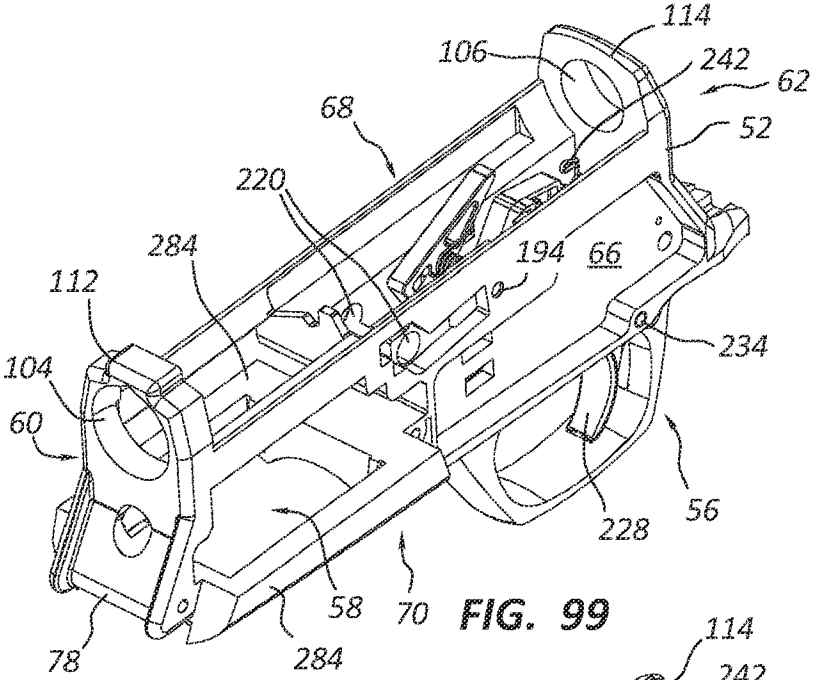
Figure 103:
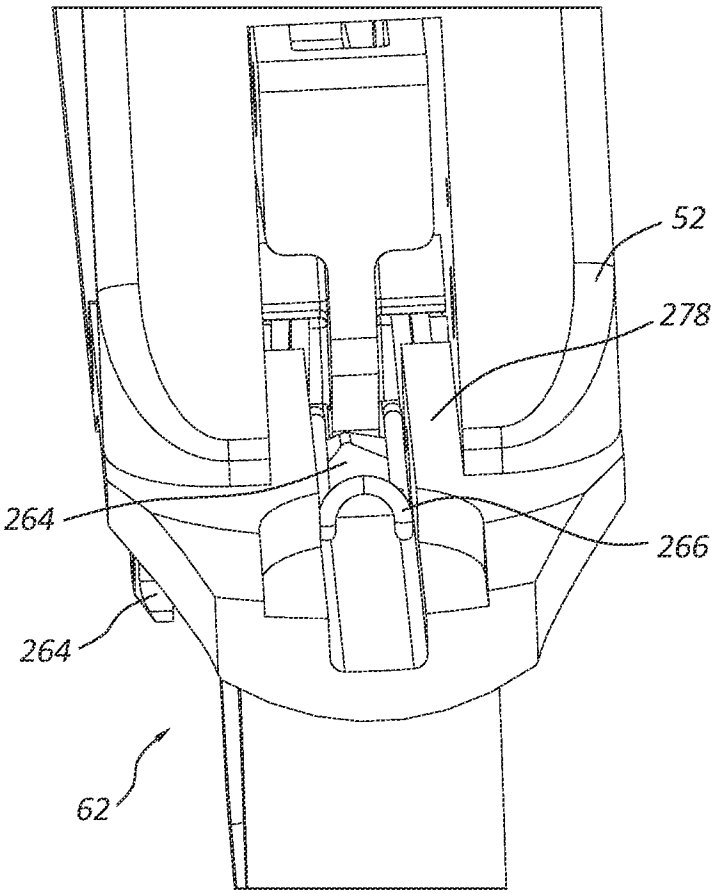
FIGS. 102-103 are perspective views of a safety mechanism positioned in the receiver frame. The views are from the left side and the back, respectively.
Figure 102:
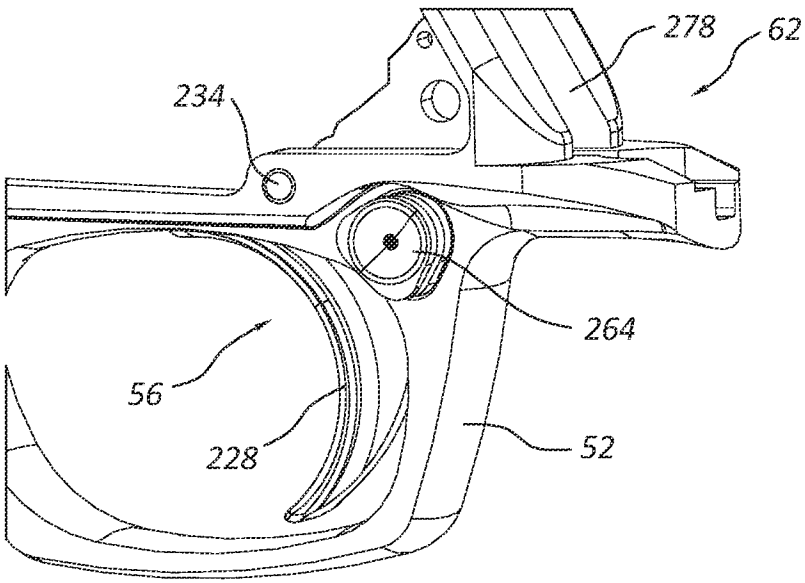
Figure 104:
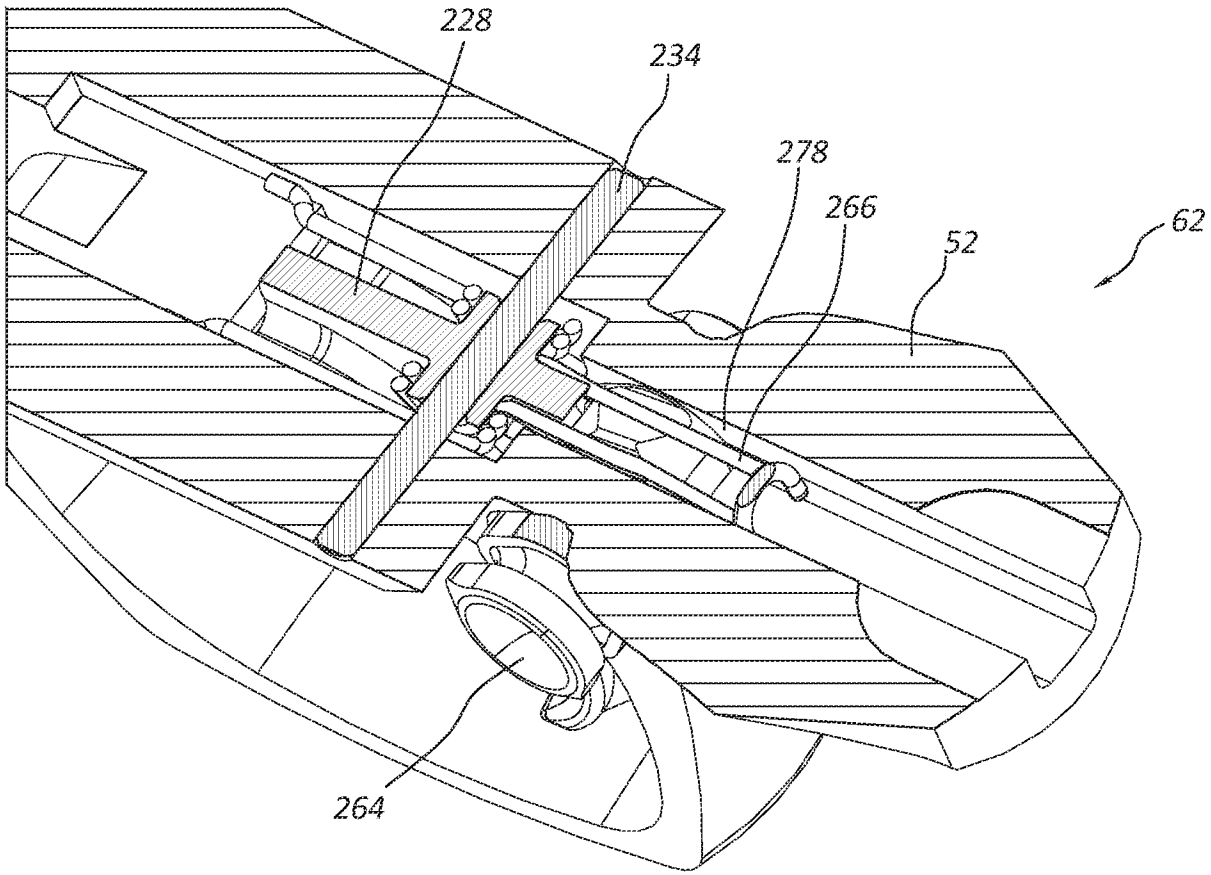
FIG. 104 is a cross sectional perspective view of the safety mechanism in FIGS. 102-103.

In some embodiments, the safety mechanism 262 is positioned above and behind the trigger 228 as shown in FIGS. 102-104. The safety mechanism 262 includes a safety 264 and a spring 266 that holds the safety 264 in position. The safety 264 is positioned in a hole 268 that extends crosswise through the frame 52 (FIG. 101).

The spring 266 wraps around the shaft 234 on both sides of the trigger 228. One end of the spring 266 is U-shaped and biased to selectively engage a recess 270 or a projection 272 on the safety 264. The recess 270 and the projection 272 are positioned adjacent to each other on one side of the safety 264.

The safety 264 can be pushed longitudinally from one position where the U-shaped end of the spring 266 is positioned over the projection 272 and another position where the U-shaped end of the spring 266 is positioned in the recess 270. These positions correspond to the safety 264 being in the on and off positions.

In some embodiments, the recess 270 and the projection 272 are shaped to allow the U-shaped end of the spring 266 to move from one to the other by applying a moderate amount of force to the safety 264. The recess 270 and the projection 272 can also shaped to prevent the safety 264 from being manually pushed completely out of the hole 268.

The safety 264 can include visual and/or tactile indicators that allow the user to quickly determine the position of the safety 264. In some embodiments, the safety 264 is red on a first side 274 and black or dark colored on a second side 276. The first side 274 and the second side 276 are positioned opposite each other. The safety 264 can move between an off position where the red on the first side 274 is showing and an on position where the red on the first side 274 is hidden and the black on the second side 276 is showing.

In some embodiments, the first side 274 of the safety 264 is shaped differently than the second side 276. The user can touch the sides 274, 276 and tell which side is protruding outward and, consequently, whether the safety 264 is on or off. For example, the first side 274 can have a concave face and a circular channel around the outside and the second side 276 can have a flat face and no channel. It should be appreciated that any suitable configuration can be used for the sides 274, 276.

In some embodiments, the safety 264 is reversible so that the first side 274 can extend outward from either the right side 24 or the left side 26 of the firearm 10. For example, it may be desirable for the first side 274 of the safety 264 to extend outward from one side 24, 26 of the firearm 10 when the shooter is right handed and extend outward from the other side 24, 26 of the firearm 10 when the shooter is left handed.

The safety 264 can be reversed by removing the receiver 50 from the firearm 10 in the manner described above. A tool is inserted through a slot 278 in the back 62 of the frame 52 to lift the U-shaped end of the spring 266 and release the safety 264 (FIGS. 103-104). The safety 264 is pushed out of the hole 268, flipped around, and reinserted into the hole 268. The outer edges of the sides 274, 276 are slightly beveled so that they lift the U-shaped end of the spring 266 as the safety 264 is pushing into the hole 268.

Figure 106:
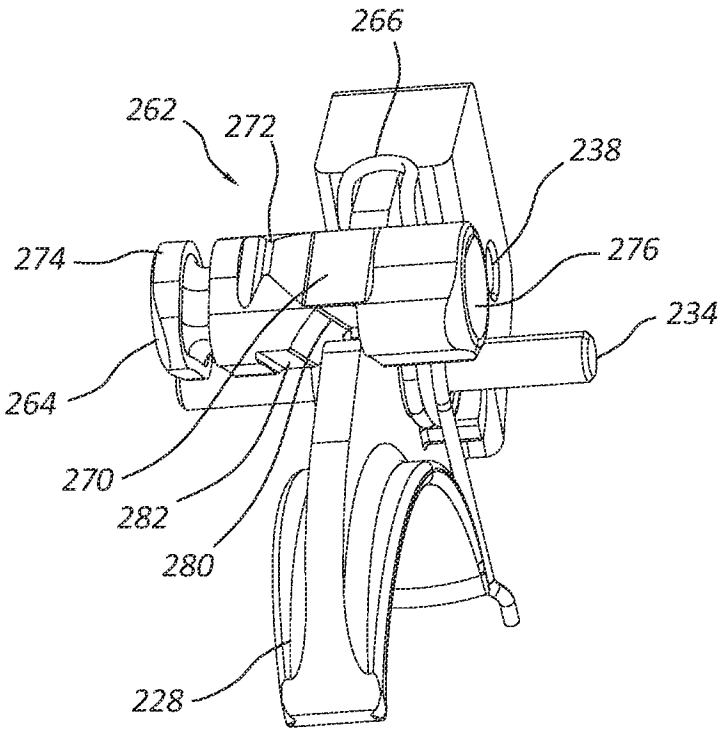
FIGS. 105-106 are perspective views of the safety mechanism oriented in one direction—i.e., red portion of safety faces the left side of the firearm.
Figure 105:
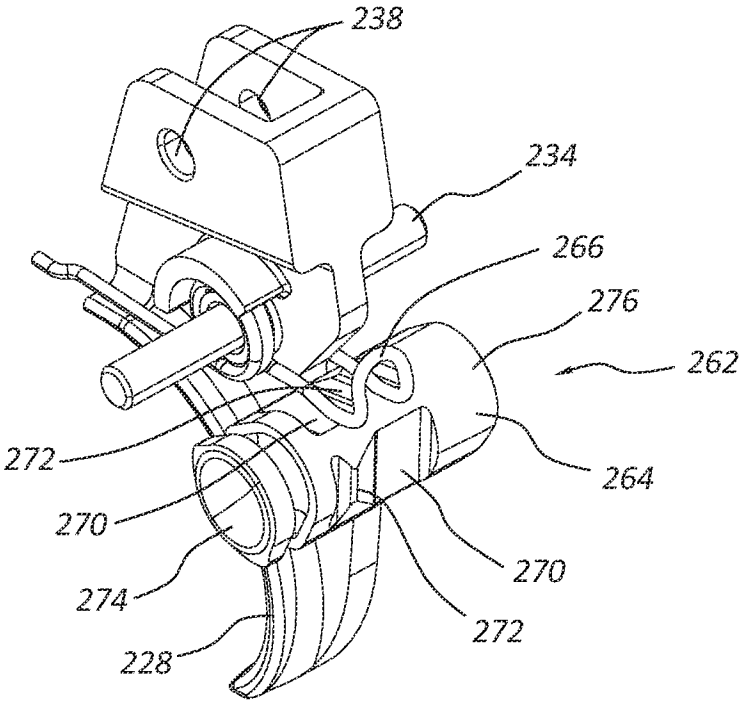
Figure 108:
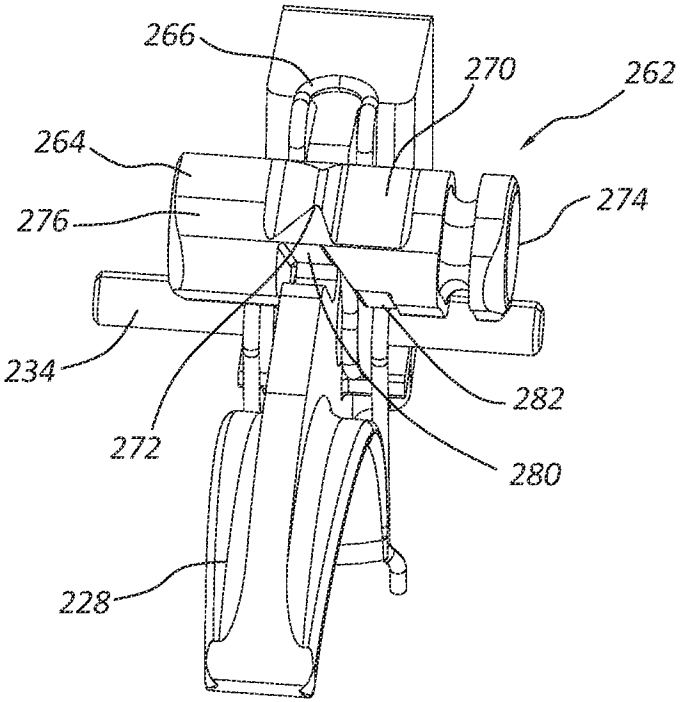
FIGS. 107-108 are perspective views of the safety mechanism oriented in an opposite direction—i.e., red portion of the safety faces the right side of the firearm.
Figure 107:
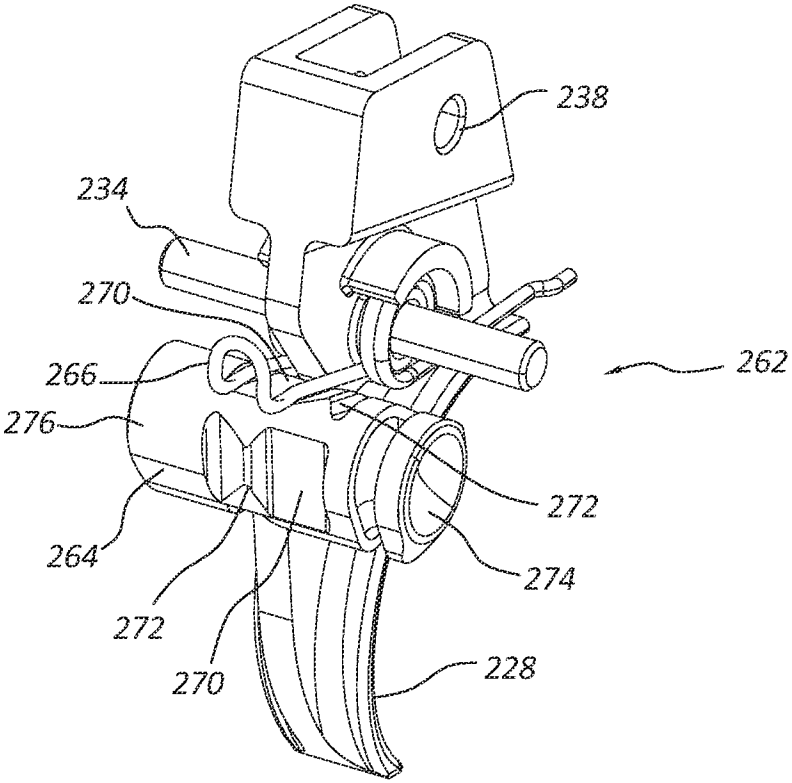
Figure 109:
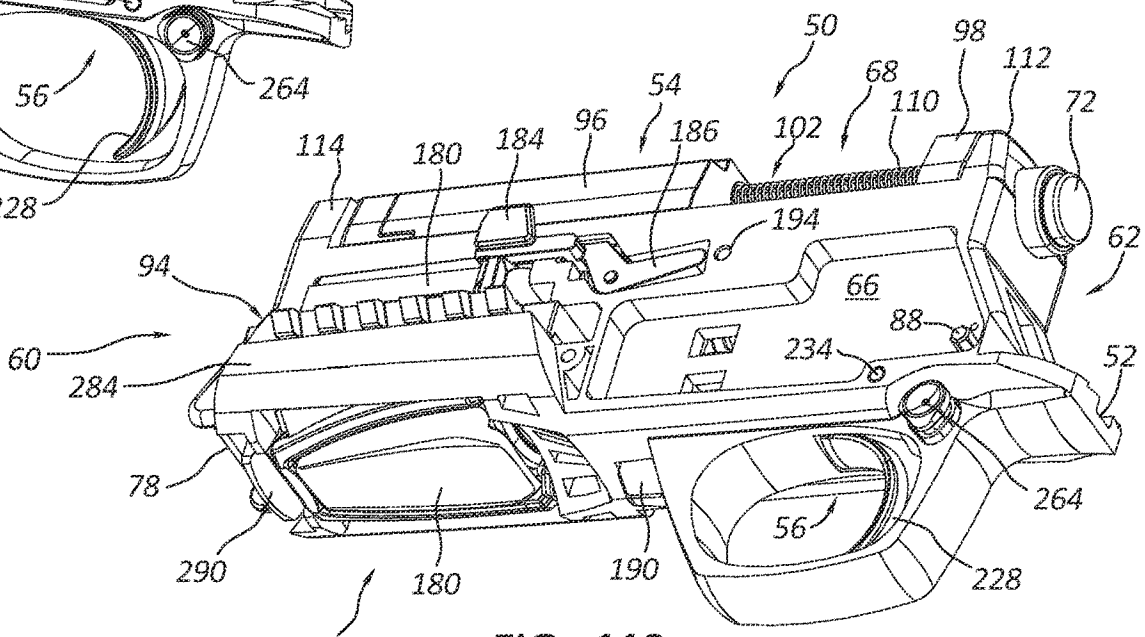
FIGS. 109-112 are perspective views of a rotary magazine coupled to the receiver.
Figure 110:
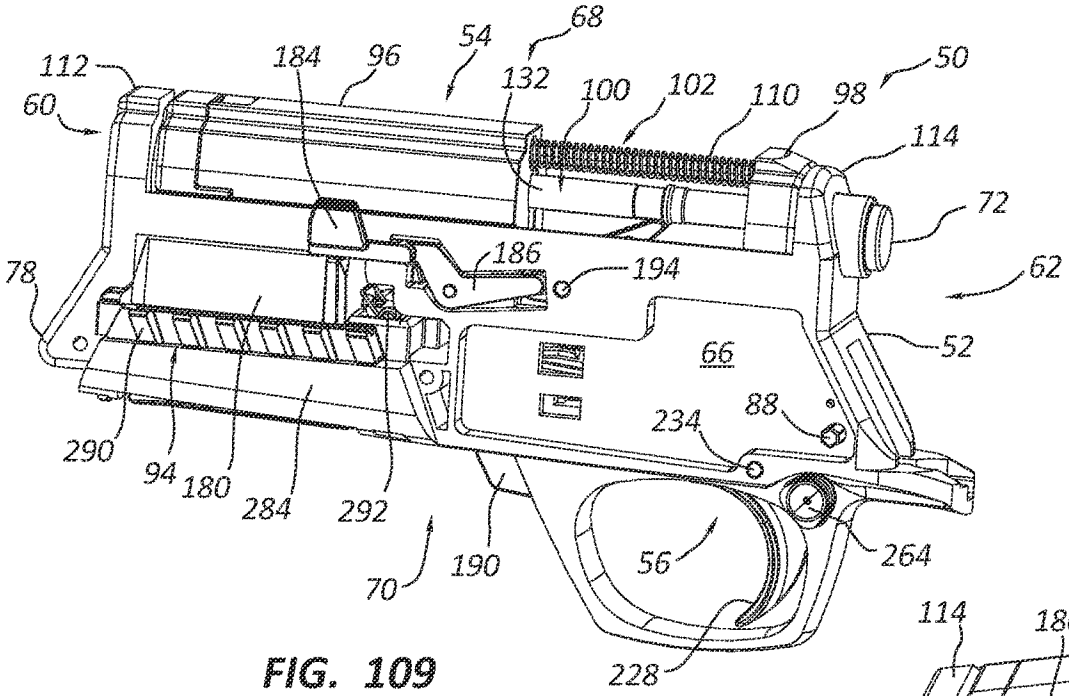
Figures 111, 112:
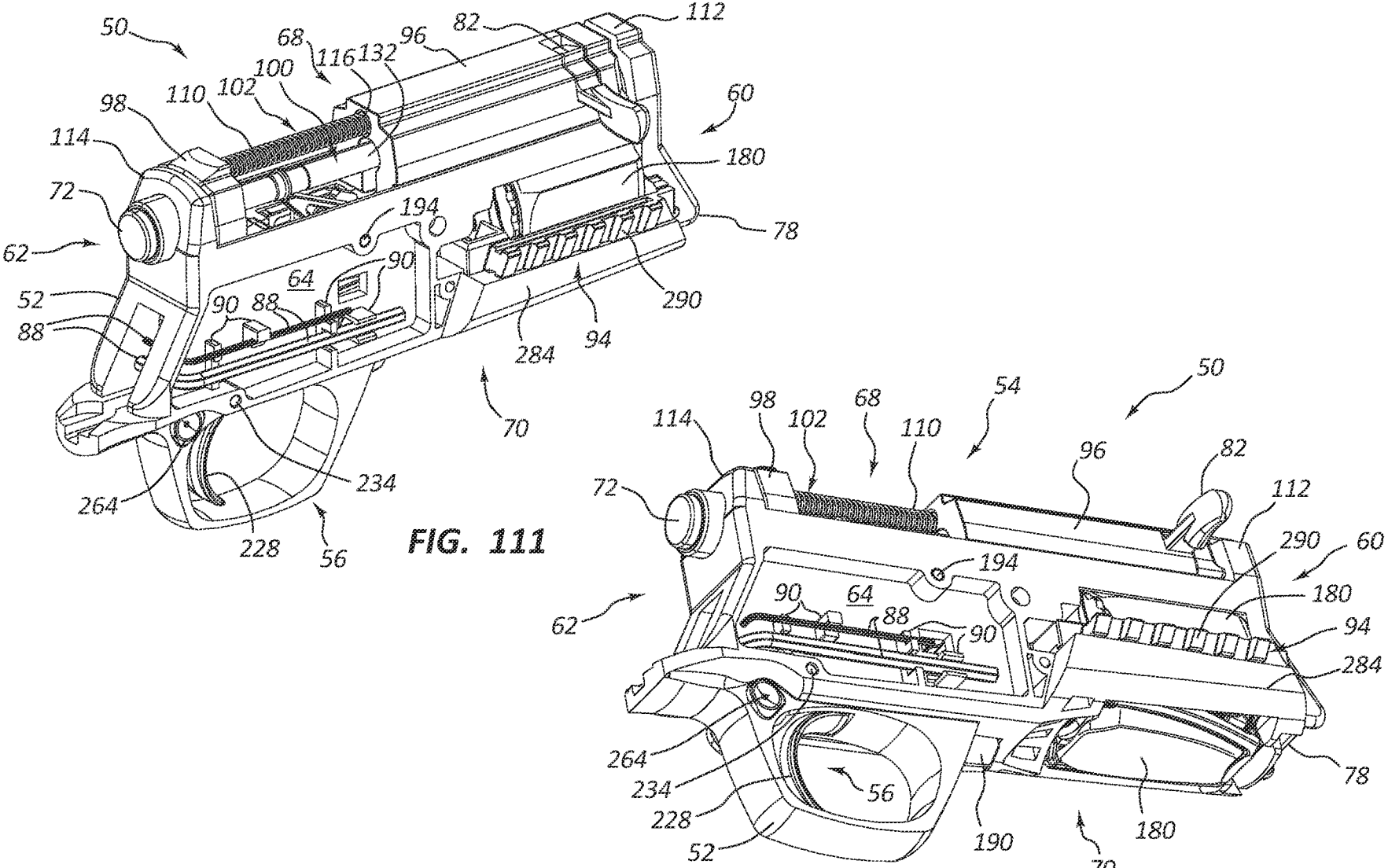
Figure 114:
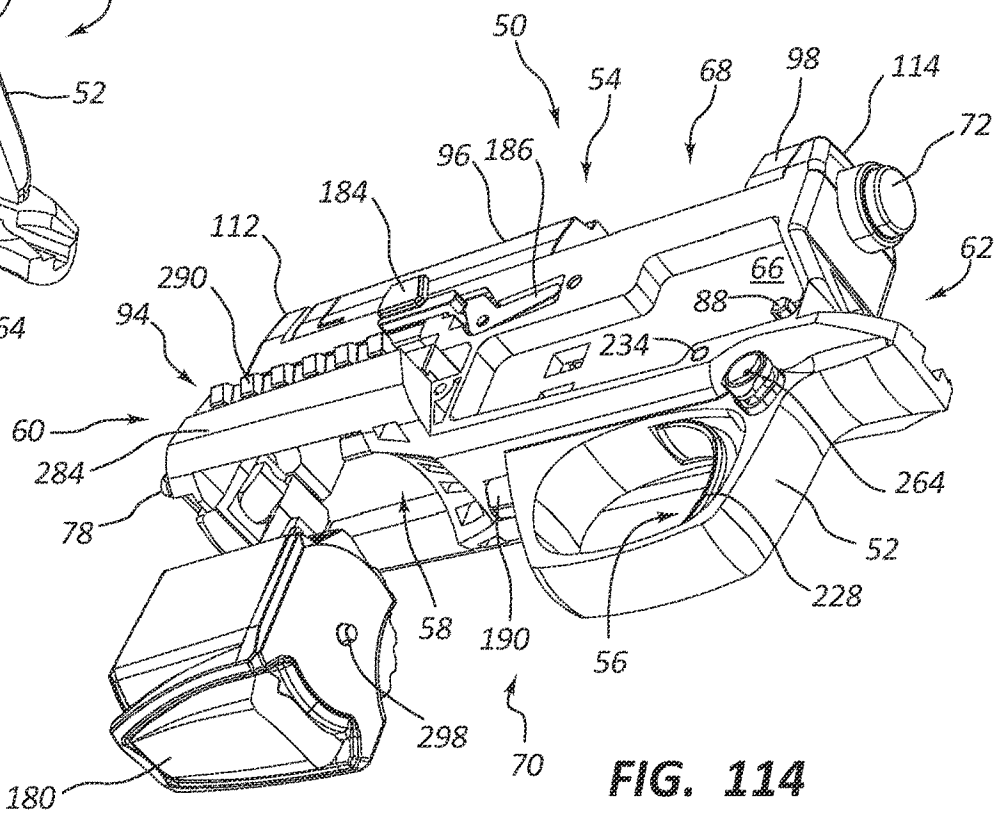
FIGS. 113-116 are perspective views of the rotary magazine in FIGS. 109-112 uncoupled from the receiver. The views are from the left side of the receiver.
Figure 113:
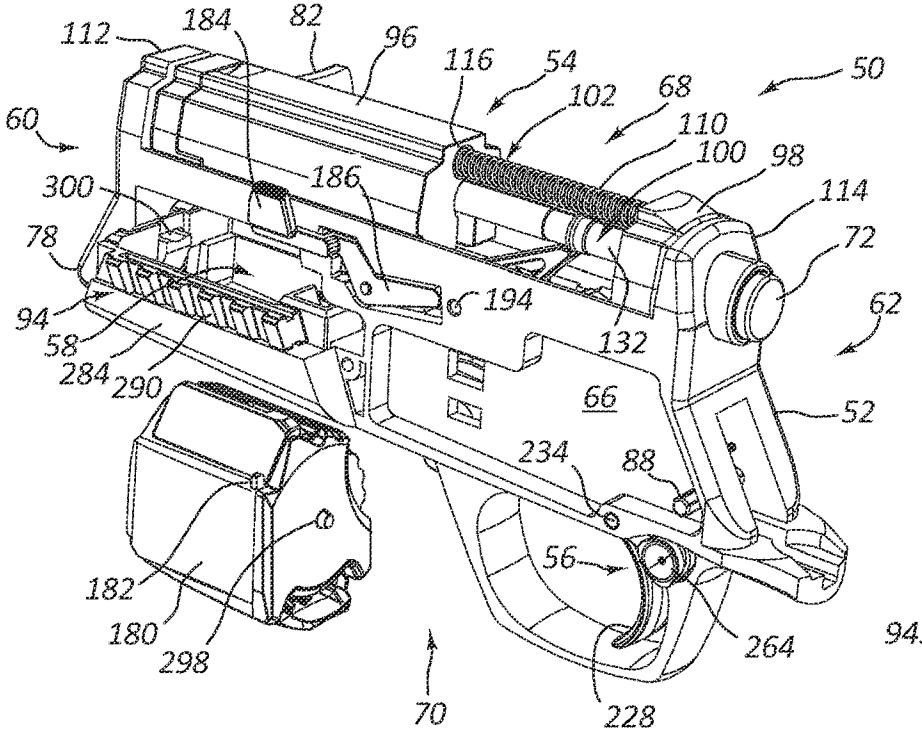
Figure 116:
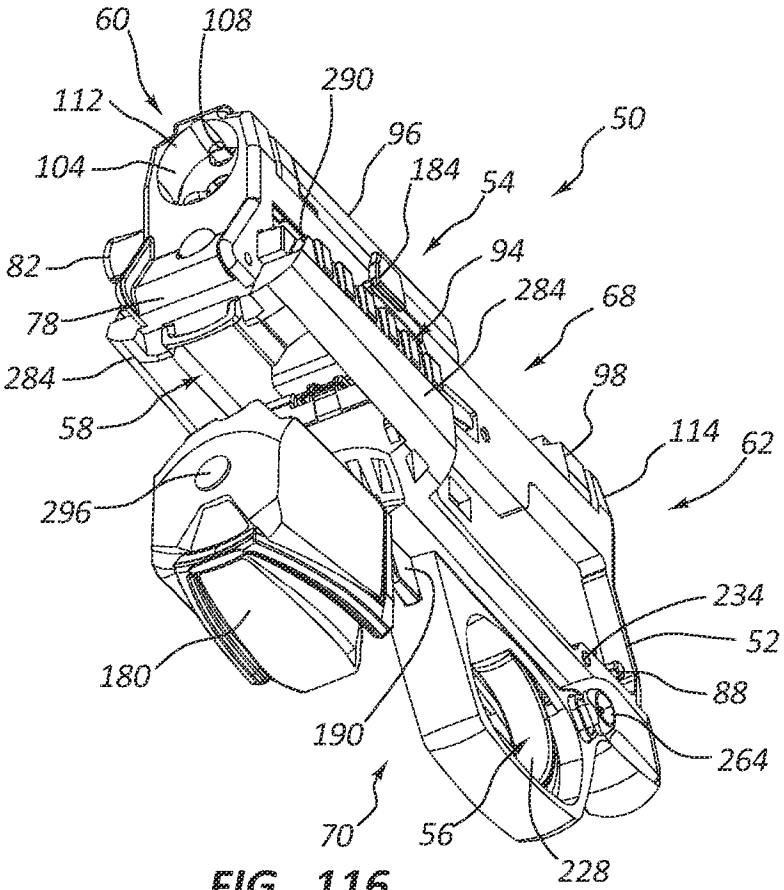
Figure 115:
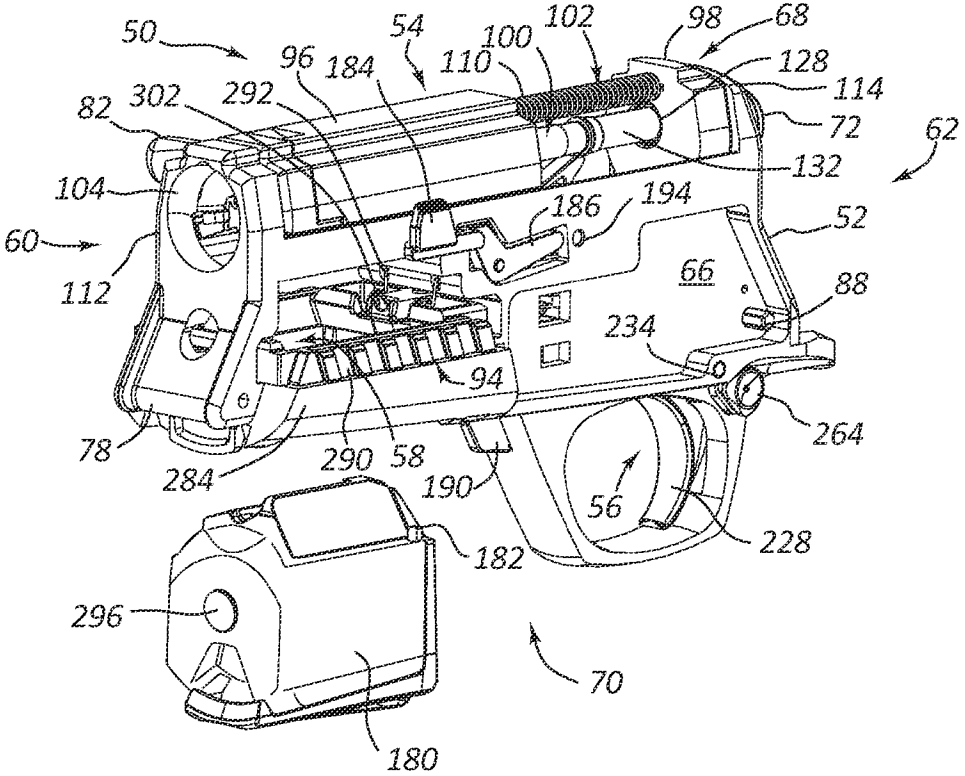

FIGS. 105-106 show the safety 264 oriented so that the first side 274 extends outward from the left side 26 of the firearm 10 and the second side 276 extends outward from the right side 24 of the firearm 10. FIGS. 107-108 show the safety 264 oriented so that the first side 274 extends outward from the right side 24 and the second side 276 extends outward from the left side 26.

The safety 264 can have a variety of configurations that make it reversible. In some embodiments, the safety 264 has three sides. Two of the sides each include the recess 270 and the projection 272 while the third side includes a notch or recess 280 and a surface 282. When the notch 280 is positioned behind the trigger 228, the user can pull the trigger 228 backward and fire the firearm 10. When the surface 282 is positioned behind the trigger 228, it blocks the user from pulling the trigger 228 backward.

The notch 280 is always positioned behind the trigger 228 when the first side 274 of the safety 264 extends outward from the firearm 10 regardless of which side 24, 26 it protrudes from. This is shown in FIGS. 105-108 where the first side 274 of the safety 264 extends outward from both sides 24, 26 of the firearm 10 and the notch 280 is always positioned behind the trigger 228. Likewise, the surface 282 is always positioned behind the trigger 228 when the second side 276 of the safety 264 extends outward from the firearm 10 regardless of which side 24, 26 it protrudes from.

Magazine

The firearm 10 can use any suitable magazine having any configuration. In general, the magazine is used to store and feed cartridges into the firearm 10. Some examples of suitable magazines include detachable or fixed magazines. Other examples includes tubular magazines, box magazines, rotary magazines, helical magazines, and the like. Numerous types and configurations of magazines can be used.

In some embodiments, the firearm 10 includes the magazine 180, which is a detachable rotary magazine that fits in the magazine cavity 58 of the receiver 50. The magazine 180 can be used with a wide variety of cartridge calibers and can hold any of a number of cartridges. In some embodiments, the magazine 180 is configured to hold rimfire cartridges such as .22 Long Rifle cartridges. In other embodiments, the magazine 180 can hold at least five cartridges, at least seven cartridges, or at least ten cartridges.

The magazine 180 can extend outward from the bottom 30 of the firearm 10 or be positioned at least approximately flush with the bottom 30. The embodiments that extend outward from the bottom 30 typically hold more cartridges than those that are flush with the bottom 30.

In some embodiments, the magazine 180 is configured to fit and operate in a Ruger 10/22. For example, the magazine 180 can include similar dimensions and mounting hardware as the Ruger 10/22 magazine. Although the magazine 180 differs from the standard 10-round Ruger 10/22 magazine in many ways, it is similar enough to be used seamlessly with the Ruger 10/22.

The use of a rotary magazine such as the magazine 180 can substantially increase the width of the firearm 10 in the area adjacent to the magazine 180. In some embodiments, the width can be reduced by eliminating the stock 12 from covering all or a portion of the magazine cavity 58 on the right side 24 and/or the left side 26 of the firearm 10. In these embodiments, the receiver 50 forms the exterior surface in these areas on the sides 24, 26 of the firearm 10 as shown in FIGS. 1-6.

In some embodiments, the frame 52 includes opposing side walls 284 on the right side 64 and the left side 66 of the receiver 50 (FIGS. 109-112). The side walls 284 at least partially define the magazine cavity 58. The bottom 30 of the stock 12 includes a cavity 286 configured to receive the receiver 50 (FIG. 9). The sides 24, 26 of the stock 12 include recesses 288 through which the side walls 284 of the frame 52 are at least partially exposed (FIGS. 7-9). Preferably, the side walls 284 are shaped to blend in seamlessly with the shape of the stock 12 in the manner shown in FIGS. 1-6.

It should be appreciated that the firearm 10 can be modified in a number of ways. For example, the stock 12 can fully cover the areas to the side of the magazine cavity 58. Also, the side walls 284 can be eliminated so that the stock 12 forms the sides of the magazine cavity 58. Numerous modifications can be made to the firearm 10, the magazine cavity 58, and the magazine 180.

The magazine coupling mechanism 94 generally includes the components that hold the magazine 180 to the firearm 10. The magazine coupling mechanism 94 is used to couple the magazine 180 to the receiver 50 and decouple the magazine 180 from the receiver 50. FIGS. 109-112 show the magazine 180 coupled to the receiver 50. FIGS. 113-116 show the magazine 180 released and separated from the receiver 50. It should be appreciated that the magazine coupling mechanism 94 can have any suitable configuration.

In some embodiments, the magazine coupling mechanism 94 includes a slide 290 and a spring 292. The magazine coupling mechanism 94 can move between a first position or extended position where the slide 290 holds the magazine 180 in the magazine cavity 58 and a second or retracted position where the slide 290 releases the magazine 180 from the magazine cavity 58. For example, the slide 290 can move or slide forward and backward in a direction that is parallel to the lengthwise direction of the firearm 10 to move the magazine coupling mechanism 94 between the first position and the second position.

Figure 117:
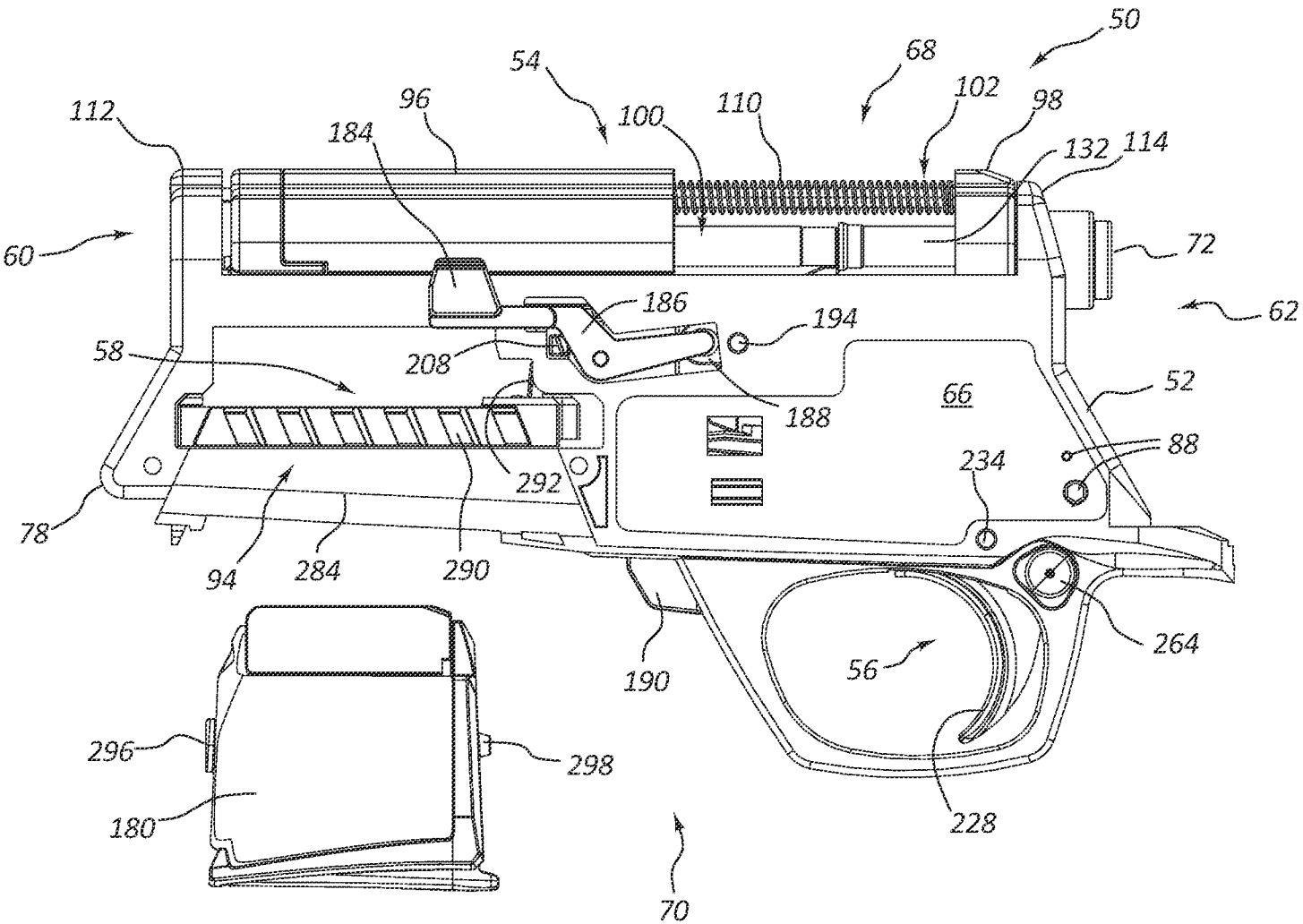
FIG. 117 is a left side view of the rotary magazine uncoupled from the receiver and the magazine coupling mechanism in a forward or coupled position.
Figure 119:
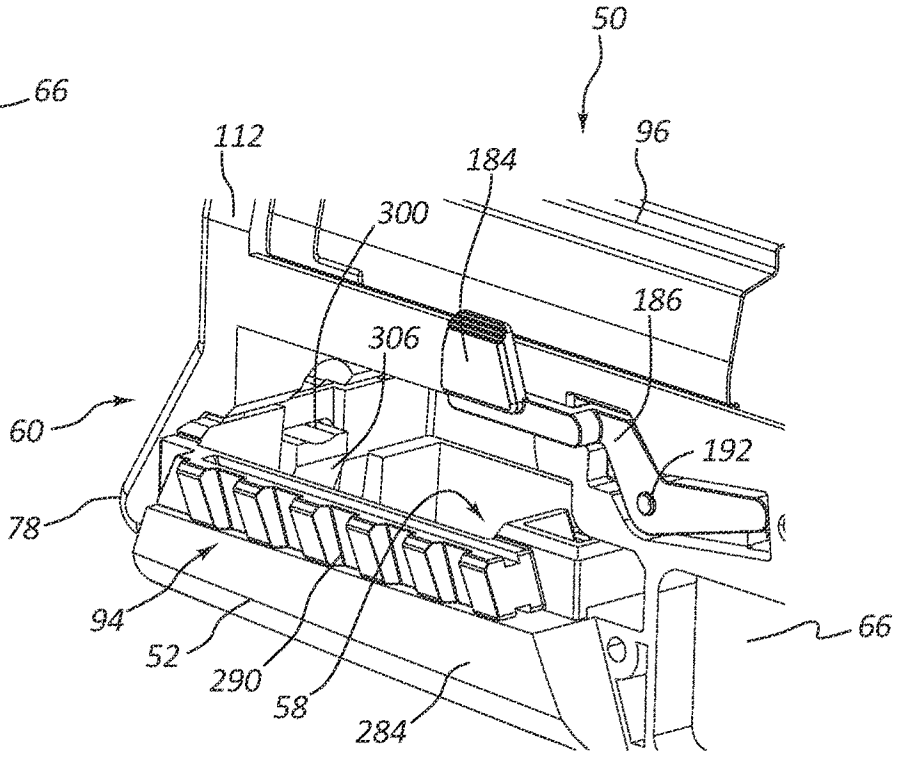
FIGS. 118-119 are perspective views of the receiver showing the front and back of the magazine coupling mechanism, respectively, in the forward position. The views are from the left side of the receiver.
Figure 118:
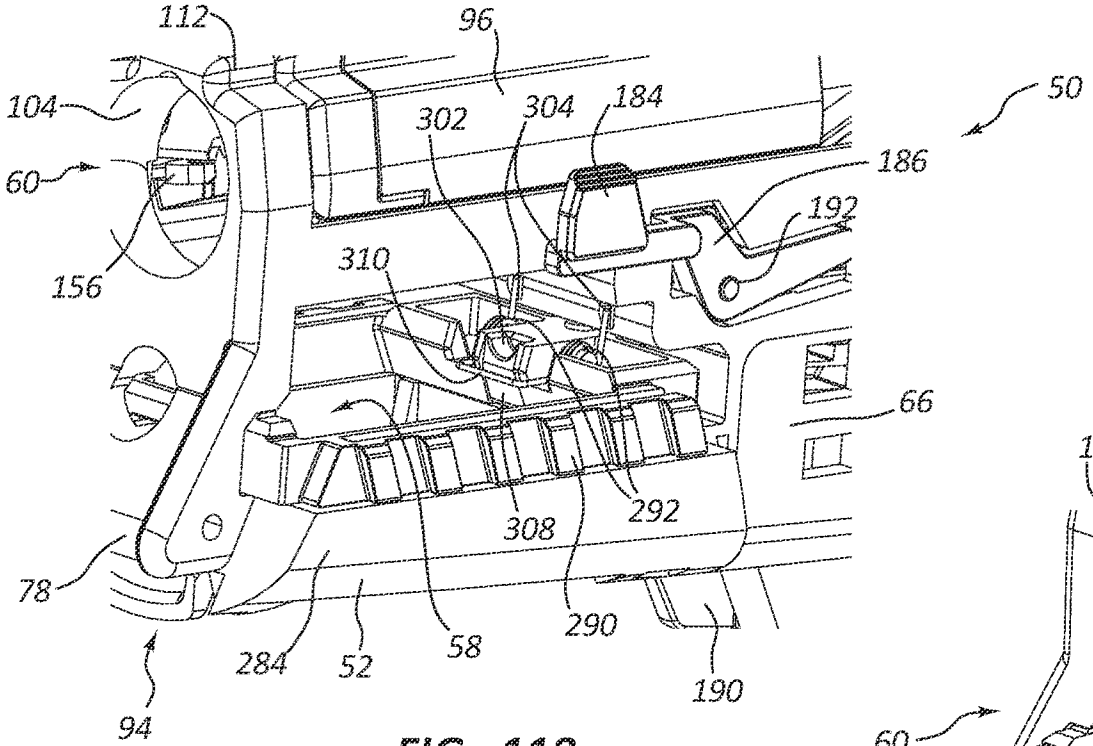
Figure 122:
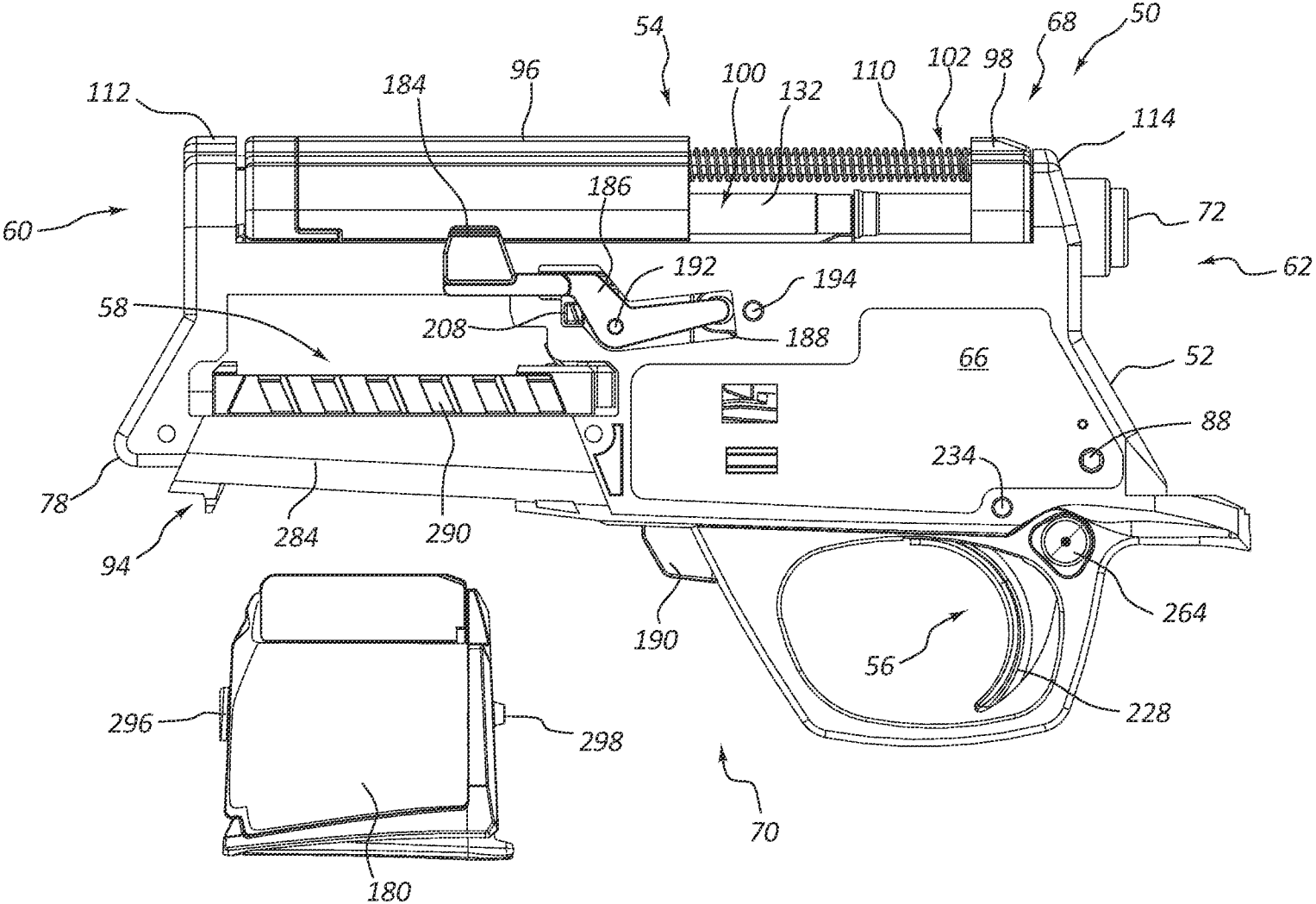
FIG. 122 is a left side view of the receiver with the magazine coupling mechanism in a retracted or uncoupled position.
Figure 124:
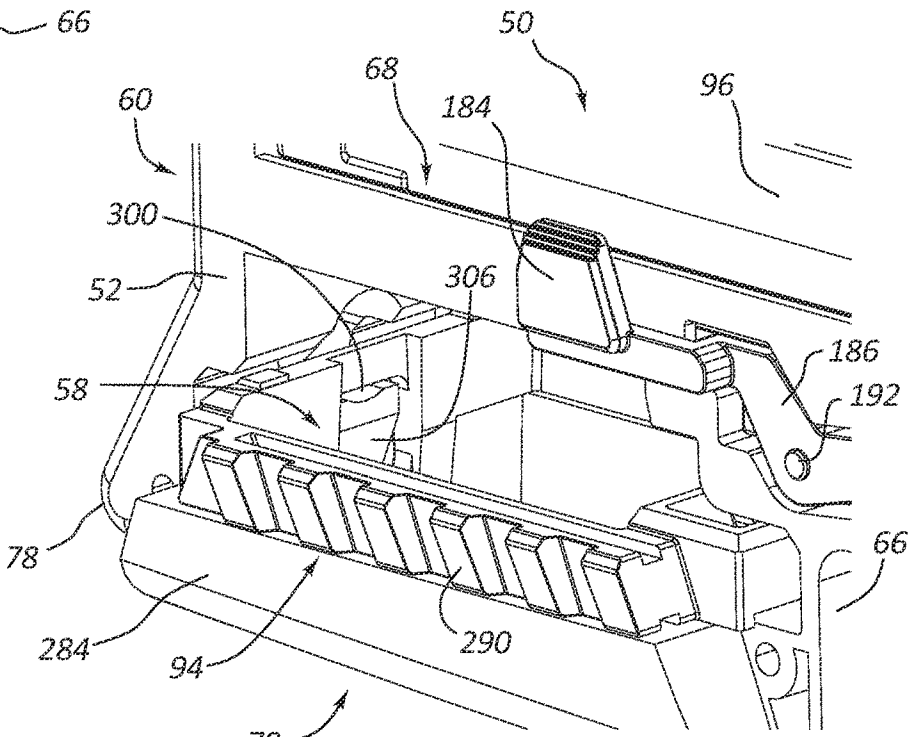
FIGS. 123-124 are perspective views of the receiver showing the front and back of the magazine coupling mechanism, respectively, in the retracted position. The views are from the left side of the receiver.
Figure 123:
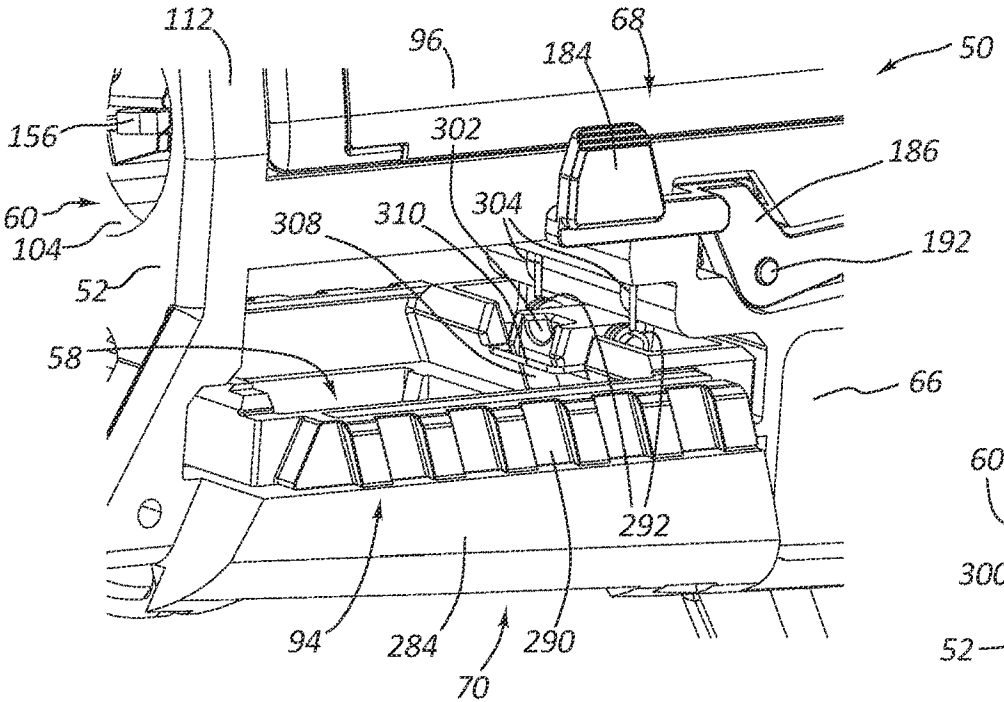

In some embodiments, the magazine coupling mechanism 94 is in the first position when the slide 290 is forward as shown in FIGS. 117-119. The magazine coupling mechanism 94 is in the second position when the slide 290 is moved backward as shown in FIGS. 122-124. The magazine coupling mechanism 94 moves from the first position to the second position when the slide 290 moves from the forward position to the backward position. Likewise, the magazine coupling mechanism 94 moves from the second position to the first position when the slide 290 moves from the backward position to the forward position.

Figure 121:
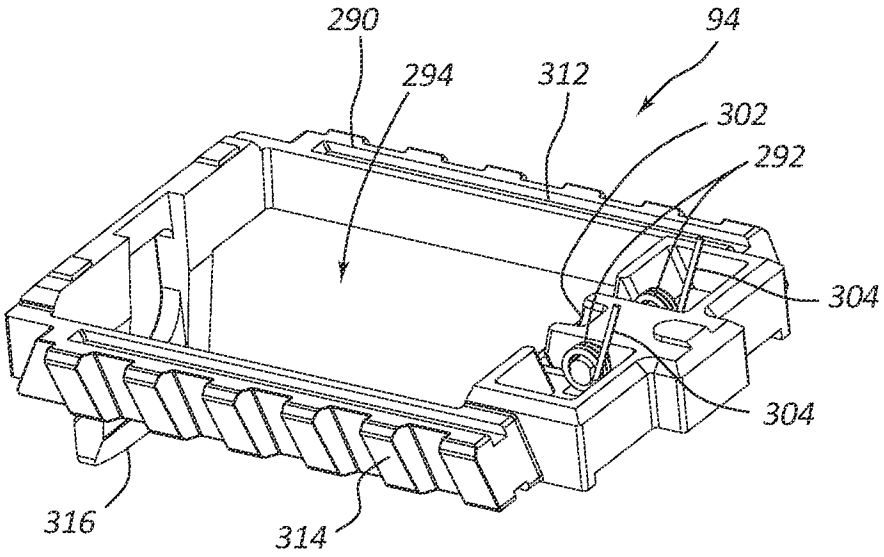
FIGS. 120-121 are perspective views of the magazine coupling mechanism separated from the receiver.
Figure 120:
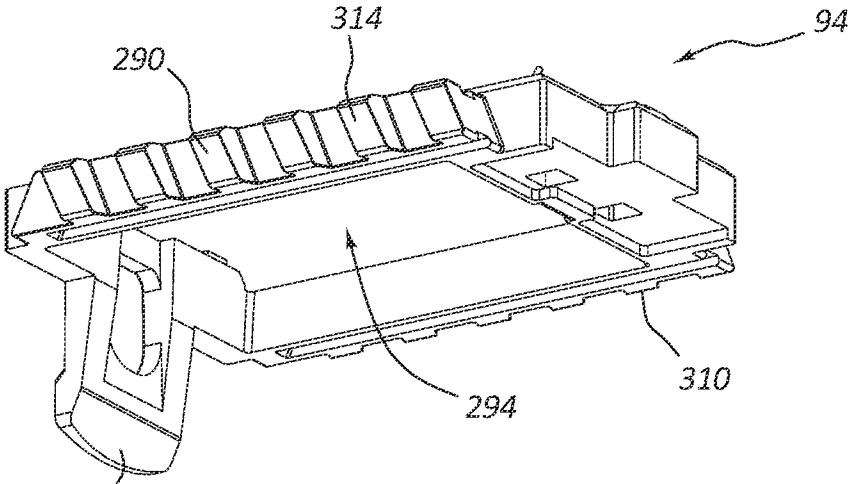

The slide 290 has a rectangular shape with a hole 294 in the center sized to receive the magazine 180 (FIGS. 120-121). The slide 290 fits in the frame 52 of the receiver 50 and forms at least part of the magazine cavity 58. The magazine 180 includes projections or protuberances 296, 298 extending outward from a front or first side and a back or second side of the magazine 180, respectively. The projections 296, 298 are sized to fit in corresponding recesses 300, 302, respectively, in the magazine cavity 58 (FIGS. 118-119). The recess 300 is part of the frame 52. The recess 302 is part of the slide 290. The magazine 180 is inserted into the magazine cavity 58 until the projections 296, 298 are securely seated in the recesses 300, 302, respectively.

The spring 292 can bias the slide 290 from the backward position to the forward position. As shown in FIG. 118, the spring 292 includes ends 304 that contact the frame 52 and bias the slide 290 towards the forward position. In some embodiments, the spring 292 can also bias the magazine 180 outward from the firearm 10 when the magazine coupling mechanism 94 is in the second position.

When the magazine 180 is inserted into the magazine cavity 58, the projection 296 on the front of the magazine 180 contacts and slides upward on a ramp or surface 306 located in the front of the magazine cavity 58 (FIGS. 119 and 124). The ramp 306 is a fixed component of the frame 52 and is provided to make it easier to guide the magazine 180 into the magazine cavity 58.

The projection 298 on the back of the magazine 180 contacts and slides upward on a ramp or surface 308 on the back of the slide 290, which is located in the back of the magazine cavity 58 (FIGS. 118 and 123). The upward movement of the projection 298 against the ramp 308 forces the slide 290 to move backward and compresses the spring 292. As the projection 298 moves upward, it catches the intermediate section 310 of the spring 292 (FIGS. 118 and 123). The force of the spring 292 biases the magazine 180 downward and outward from the magazine cavity 58.

When the magazine 180 is inserted far enough into the magazine cavity 58 for the projections 296, 298 to reach the recesses 300, 302, respectively, then the slide 290 is biased forward by the spring 292, which causes the magazine 180 to also move forward so that the projection 296 is positioned in the recess 300. The magazine 180 is now securely coupled to the firearm 10 and the slide 290 is in the position shown in FIGS. 117-119.

The magazine 180 can be released by moving the slide 290 backward to the position shown in FIGS. 122-124. In this position, the projections 296, 298 are no longer in the recesses 300, 302, respectively. The intermediate section 310 of the spring 292 pushes downward on the projection 298, which biases the magazine 180 downward and outward from the magazine cavity 58.

The magazine coupling mechanism 94 can be actuated in a number of different ways. In some embodiments, the magazine coupling mechanism 94 can be actuated from one or more of the sides 24, 26 of the firearm 10. In other embodiments, the magazine coupling mechanism 94 can be actuated from the bottom 30 of the firearm 10. In the embodiments shown in FIGS. 117-124, the magazine coupling mechanism 94 can be actuated from both the sides 24, 26 and the bottom 30 of the firearm 10. It should be appreciated that the magazine coupling mechanism 94 can be actuated from a variety of locations on the firearm 10.

In some embodiments, the slide 290 includes a right side 312, a left side 314, and a tab 316 extending outward from the bottom (FIGS. 120-121). Referring to FIGS. 1-6, the right side 312 of the slide 290 is accessible from the right side 24 of the firearm 10, the left side 314 is accessible from the left side 26 of the firearm 10, and the tab 316 is accessible from the bottom 30 of the firearm 10.

The user can release the magazine 180 by moving any one of the sides 312, 314 or the tab 316 backward. One preferred way to release the magazine 180 is to simultaneously grip both sides 312, 314 of the slide 290, move it backward, and catch the magazine 180 in the palm of the hand as it is biased out of the magazine cavity 58 by the spring 292.

The magazine 180 can have any of a number of suitable configurations. For example, the magazine 180 can be made of one or more parts that are easily separable, preferably without using tools. The ability to easily separate the magazine 180 provides a number of advantages. For example, it makes it much easier to field strip and clean the magazine 180.

Figure 126:
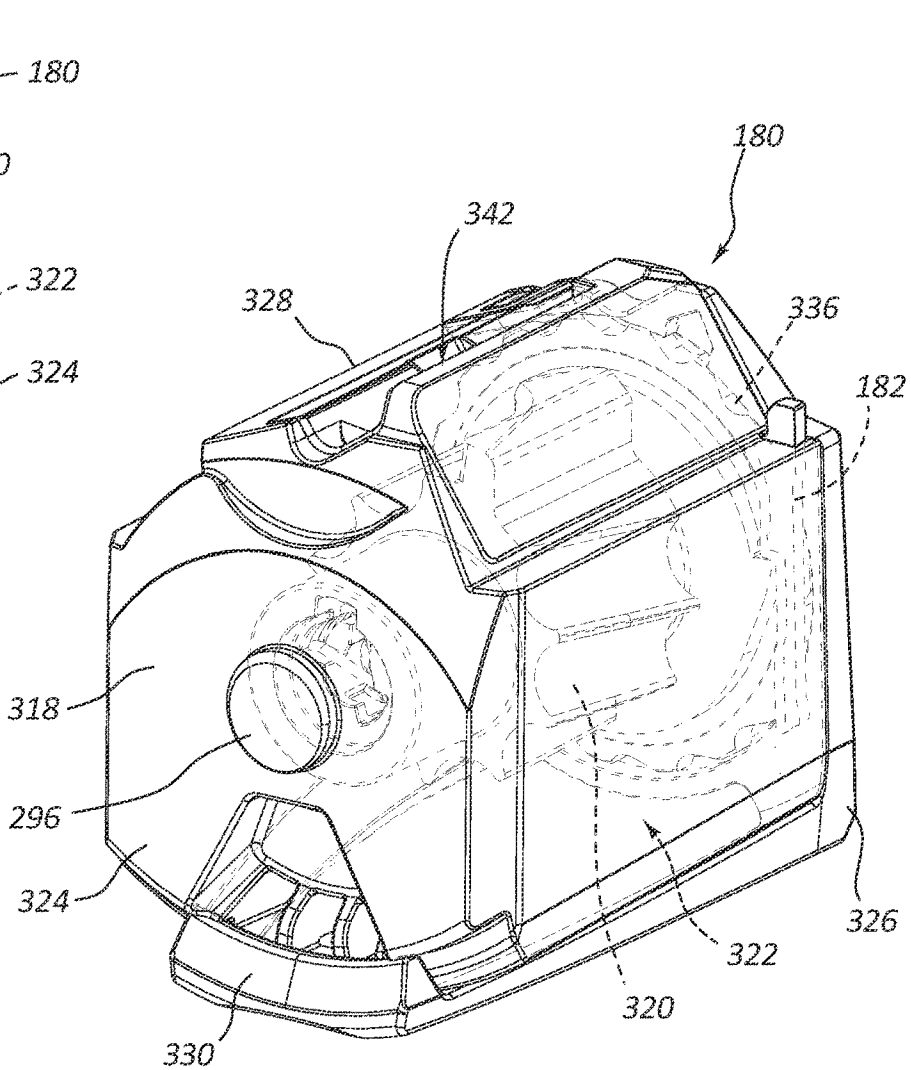
FIGS. 125-126 are perspective views of the rotary magazine from the back and the front, respectively.
Figure 125:
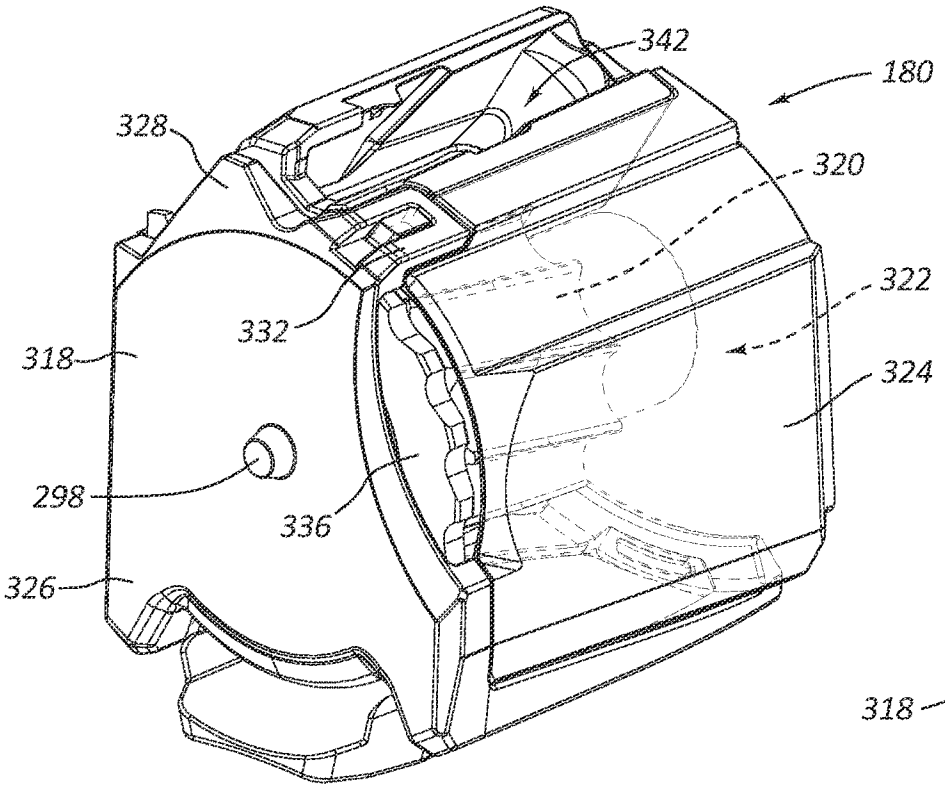
Figures 127, 128:
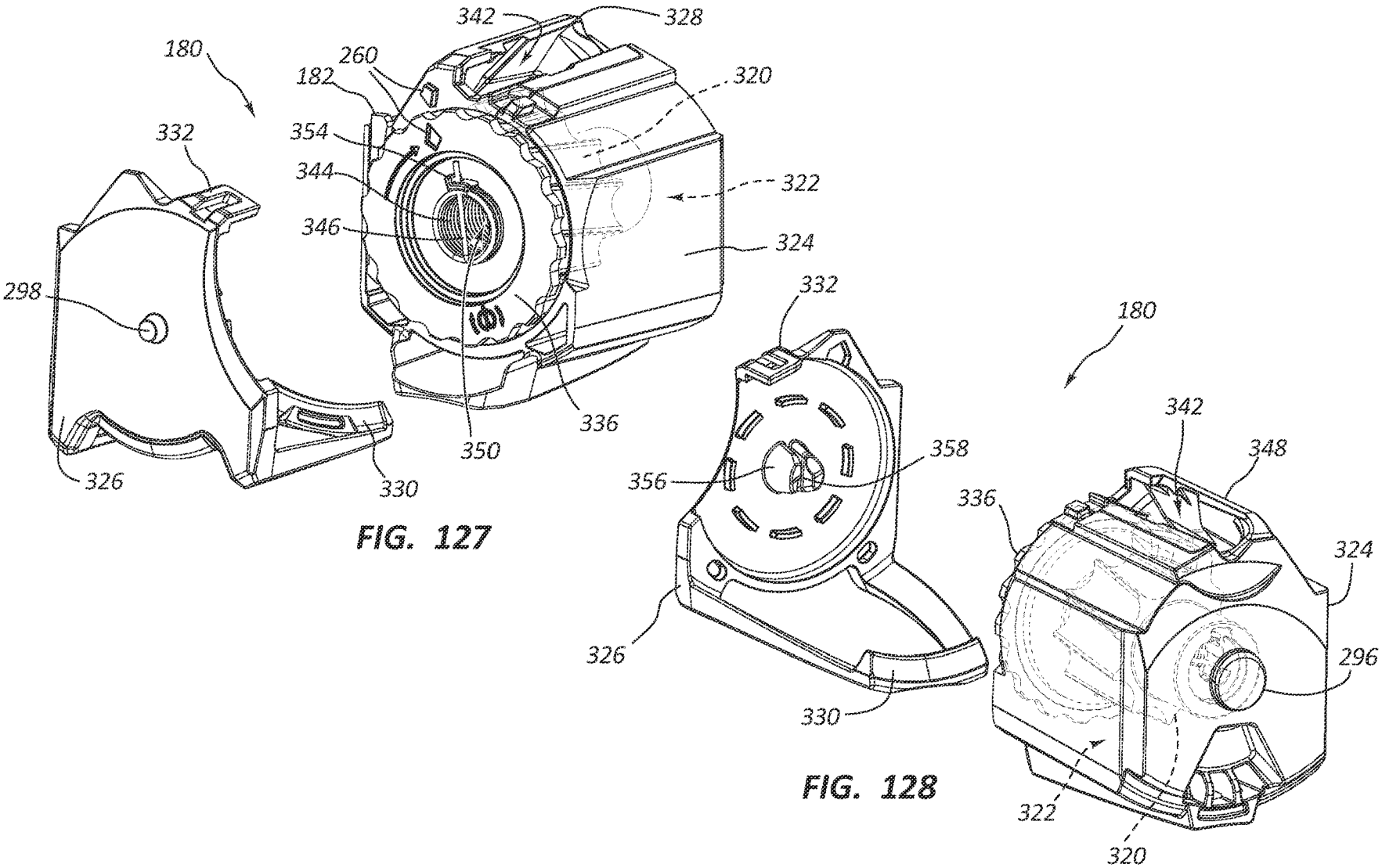
FIGS. 127-128 are perspective views of the rotary magazine with the back plate exploded from the rest of the magazine.

In some embodiments, the magazine 180 includes a housing 318 and a rotor 320. The housing 318 forms an interior cavity 322. The rotor 320 is positioned in the cavity 322 and configured to receive and hold one or more cartridges. The housing 318 moves between an assembled configuration where the housing 318 encloses the rotor 320 in the cavity 322, as shown in FIGS. 125-126, and a disassembled configuration where the housing 318 is open and the rotor 320 can be removed from the cavity 322 as shown in FIGS. 127-128.

The housing 318 can be assembled and disassembled in any suitable manner. In some embodiments, the housing 318 can be assembled and/or disassembled without using tools. In other embodiments, the housing 318 can be assembled and/or disassembled using tools such a screwdriver and/or a hex wrench.

In some embodiments, the housing 318 includes a main body or first housing component 324, a back plate or second housing component 326, and a feed collar 328. The main body 324 and the back plate 326 are coupled together to form the cavity 322. The main body 324 and the back plate 326 are coupled together using a first fastener 330 and a second fastener 332. The first fastener 330 is located on the bottom of the front side of the magazine 180 and the second fastener 332 is located on the top near the back side of the magazine 180.

The fasteners 330, 332 can be any suitable type of fastener. In one embodiment, the fasteners 330, 332 are readily releasable fasteners. In another embodiment, the fasteners 330, 332 are hook and catch type fasteners. For example, the back plate 326 includes the hook and the main body 324 includes the corresponding catch as shown in FIGS. 125-128. The fasteners 330, 332 can be coupled together and uncoupled by flexing the hook over the corresponding catch. In some other embodiments, the fasteners 330, 332 can be released without using tools.

The rotor 320 can have any suitable configuration. In general, the rotor 320 is positioned in the cavity 322 and is configured to move cartridges through the magazine 180. The rotor 320 rotates inside the cavity 322 as cartridges are inserted and removed. The rotor 320 can include recesses or grooves 334 that are each sized to receive a cartridge.

The rotor 320 can be used to extend the tab 182 upward and actuate the bolt stop mechanism 92 when the magazine 180 is empty. The rotor 320 can do this in any number of ways. In some embodiments, the rotor 320 includes a protrusion or notch 338 that pushes upward on a corresponding protrusion or notch 340 on the tab 182 when the last cartridge exits the magazine 180.

Figure 135:
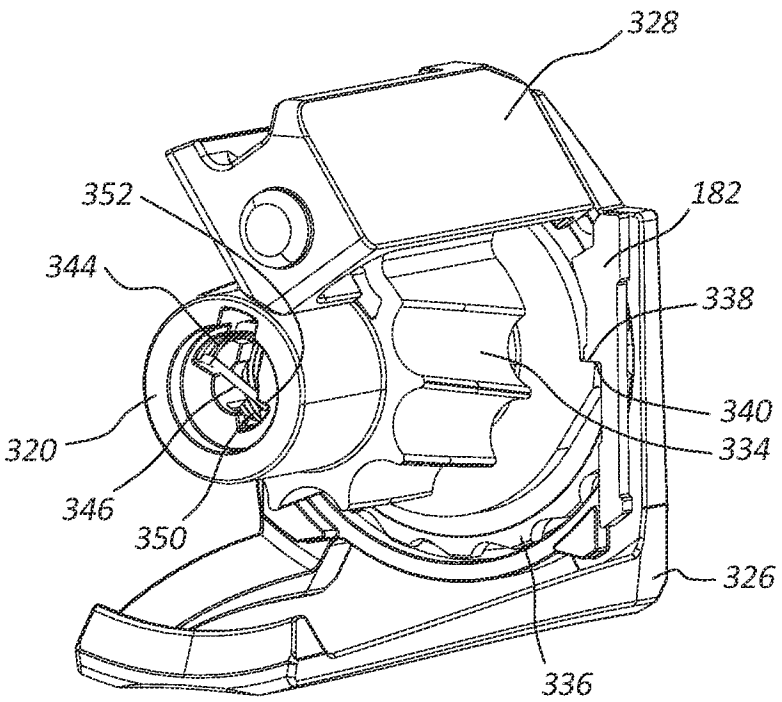
FIGS. 134-135 are perspective views of the rotary magazine with the main body removed.

FIG. 135 shows the approximate position of the rotor 320 when one cartridge is left in the magazine 180. The tab 182 is retracted in the housing 318 and the protrusions 338, 340 are positioned adjacent to each other. FIG. 136 shows the position of the rotor 320 after the last cartridge exits the magazine 180. The rotor 320 rotates causing the protrusion 338 to push upward on the protrusion 340 and extend the tab 182 outward from the top of the housing 318. In this way, the rotational motion of the rotor 320 is translated to the linear motion of the tab 182.

In some embodiments, the magazine 180 includes a load assist feature that makes it easier to load the cartridges. The load assist feature can be provided in any of a number of ways. For example, in some embodiments, the rotor 320 includes a wheel 336 that extends through the housing 318 as shown in FIG. 125. The wheel 336 can be used to manually rotate the rotor 320 and reduce the amount of force required to insert each successive cartridge into the magazine 180.

The feed collar 328 defines a feed opening 342 for the magazine 180. In general, the feed opening 342 is where the cartridges are inserted into and exit from the magazine 180. The feed collar 328 can be made out of the same material or a different material than the rest of the magazine 180. In some embodiments, the feed collar 328 is made of metal and the rest of the housing 318 is made of plastic. In other embodiments, all of the components that form the housing 318 are made of the same material such as plastic or metal.

The rotor 320 includes a spring 344 that exerts a biasing force on the rotor 320, which rotates the rotor 320 relative to the housing 318 and pushes the cartridges through the housing 318 to the feed opening 342. The spring 344 can be any suitable spring. In some embodiments, the spring 344 is a torsion spring that is twisted or wound to exert torque on the rotor 320.

In some embodiments, the rotor 320 can be removed from the housing 318 without releasing the force in the spring 344. This makes is possible to easily disassemble the magazine 180 without worrying about parts flying off or winding the spring 344 the correct number of times when the magazine 180 is reassembled.

Figure 132:
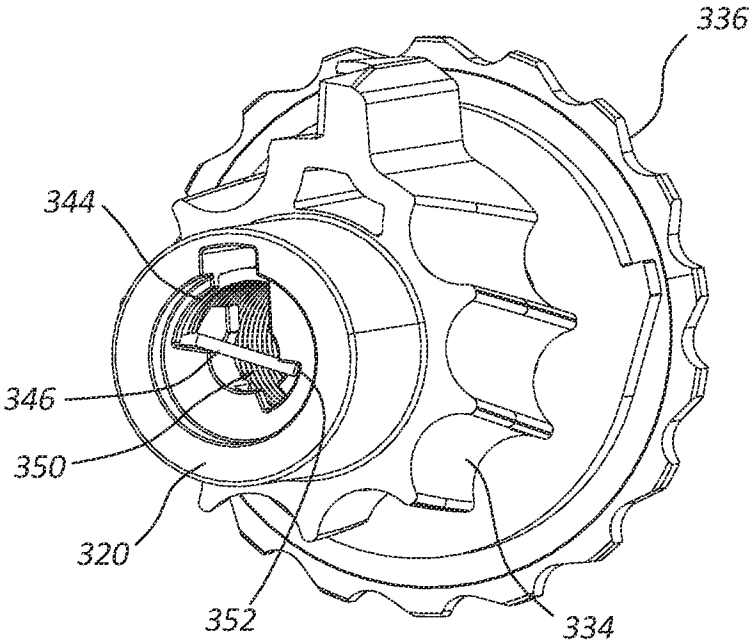
Figure 134:
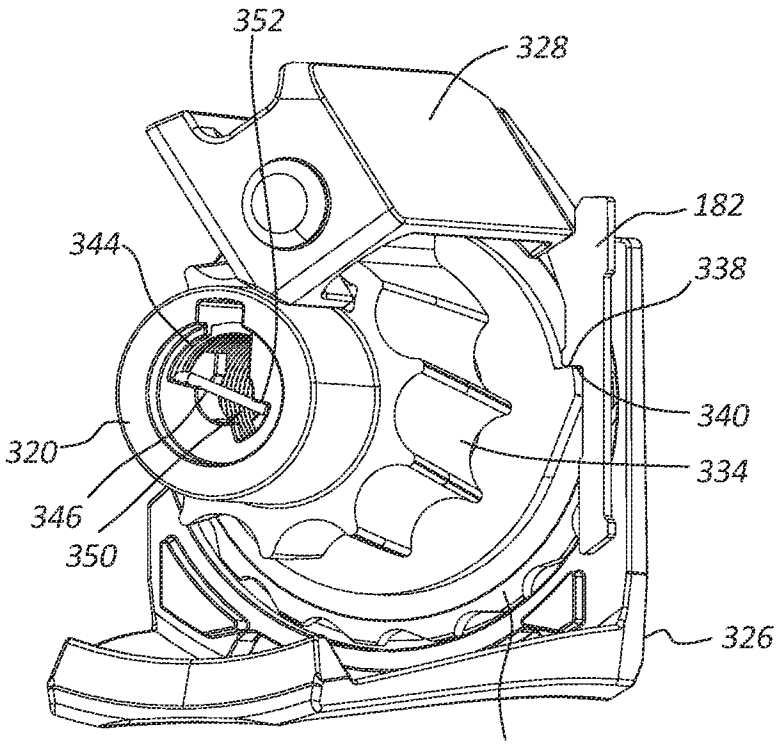

This can be accomplished in a variety of ways. In some embodiments, the spring 344 includes a first end 346 and a second end 348. The first end 346 is coupled to the back plate 326 when the housing 318 is assembled and is coupled to the rotor 320 when the housing 318 is disassembled. The second end 348 is coupled to the rotor 320 as shown in FIGS. 132 and 134-135. The ability to couple the first end 346 to the rotor 320 when the housing 318 is disassembled makes it possible to store the torque produced by the spring 344 in the rotor 320.

The spring 344 is positioned lengthwise inside a cavity 350 in the center of the rotor 320. The first end 346 is bent and extends crosswise over the cavity 350 on the back end of the rotor 320 in the manner shown in FIGS. 127, 129, and 131. Notably, the first end 346 extends completely across the cavity 350 so that the tip of the first end 346 contacts the back surface of the rotor 320 and prevents the first end 346 from being pushed into the cavity 350.

The second end 348 of the spring 344 is coupled to the front end of the rotor 320 in the manner shown in FIGS. 130, 132, and 134-135. The second end 348 is also bent and extends crosswise over the cavity 350. It is held in place by a catch 352 at the front end of the rotor 320.

Figure 129:
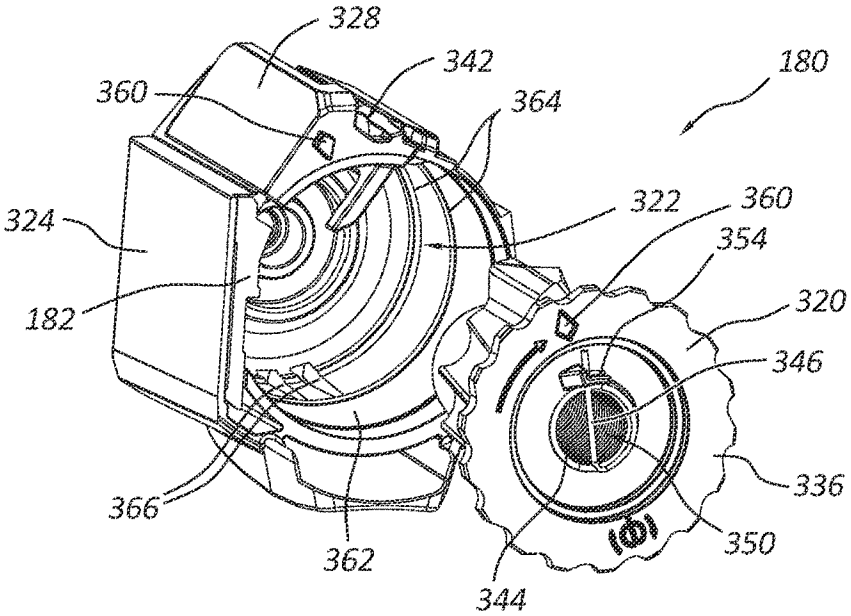
FIGS. 129-130 are perspective views of the rotary magazine with the rotor exploded from the main body of the magazine.
Figure 130:
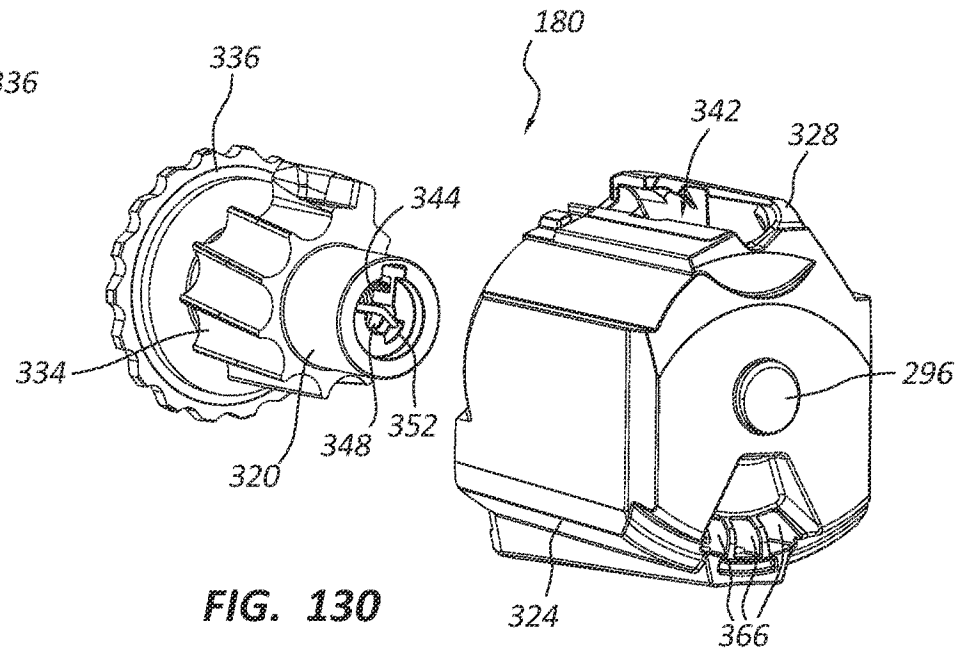
Figure 131:
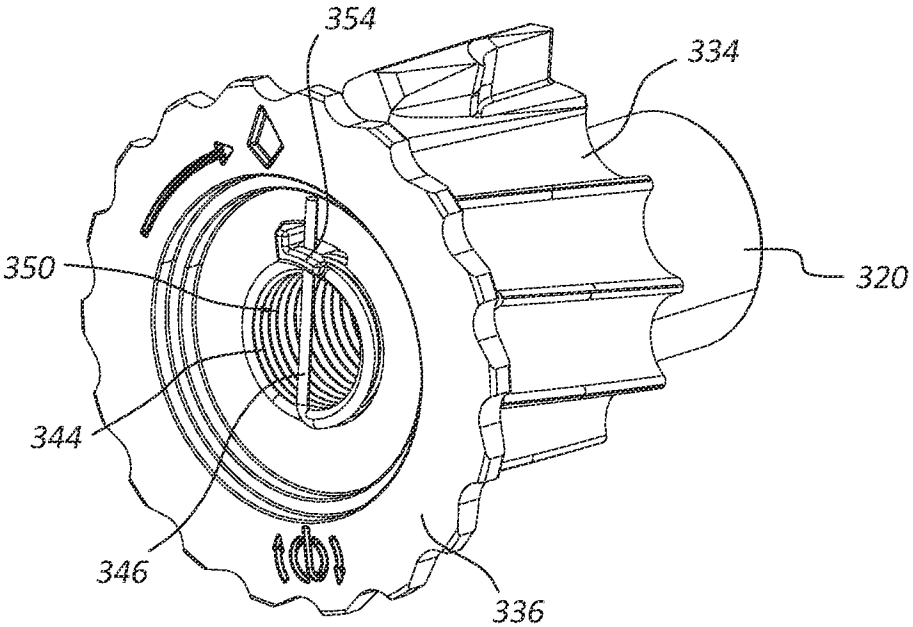
FIGS. 131-132 are perspective views of the rotor from the back and the front, respectively.

The spring 344 is initially wound by inserting the spring 344 into the cavity 350 and coupling the second end 348 to the catch 352. The first end 346 of the spring 344 is wound until it has sufficient torque to rotate the rotor 320 inside the housing 318. This is typically only done once by the manufacturer because the rotor 320 or the back plate 326 captures the torque from then on. Once the spring 344 is wound, the first end 346 is coupled to the catch 354 on the back of the rotor 320 as shown in FIGS. 127, 129, and 131. The energy of the spring 344 is completely captured by the rotor 320.

The housing 318 is assembled by inserting the rotor 320 into the main body 324 and coupling the main body 324 to the back plate 326. The back plate 326 includes a catch 356 having a slot 358 configured to receive the first end 346 of the spring 344 in the manner shown in FIGS. 127-128. The first end 346 of the spring 344 is aligned with the slot 358 by rotating the rotor 320 in the main body 324 until markings 360 on the rotor 320 and the main body 324 line up in the manner shown in FIG. 127. When the rotor 320 is in this position, the back plate 326 is coupled to the main body 324 and the first end 346 of the spring 344 enters the slot 358.

The first end 346 of the spring 344 is sandwiched between the back plate 326 and the back surface of the rotor 320. This prevents the first end 346 from combing out of the slot 358 during operation of the magazine 180.

Referring to FIG. 127, the back of the rotor 320, which includes the catch 354, moves counter-clockwise when cartridges are inserted into the magazine 180. This causes the catch 354 to move away from the first end 346 of the spring 344, which is held in place by the catch 356 on the inside of the back plate 326.

The housing 318 can be disassembled by reversing the above steps. The magazine 180 is unloaded so that the first end 346 of the spring 344 is positioned in the catch 354. The back plate 326 is removed and the first end 346 of the spring 344 is held in place by the catch 354 on the rotor 320. The housing 318 is reassembled by lining up the rotor 320 in the manner described above and coupling the back plate 326 back to the main body 324. This can be repeated indefinitely without releasing the energy in the spring 344.

It should be appreciated that the magazine 180 can have a number of other configurations. For example, in some embodiments, the magazine 180 can be configured to release the energy in the spring 344 when the back plate 326 is removed. In this embodiment, the catch 354 can be eliminated so that removing the back plate 326 releases the energy in the spring 344. Numerous other embodiments are also possible.

Figure 133:
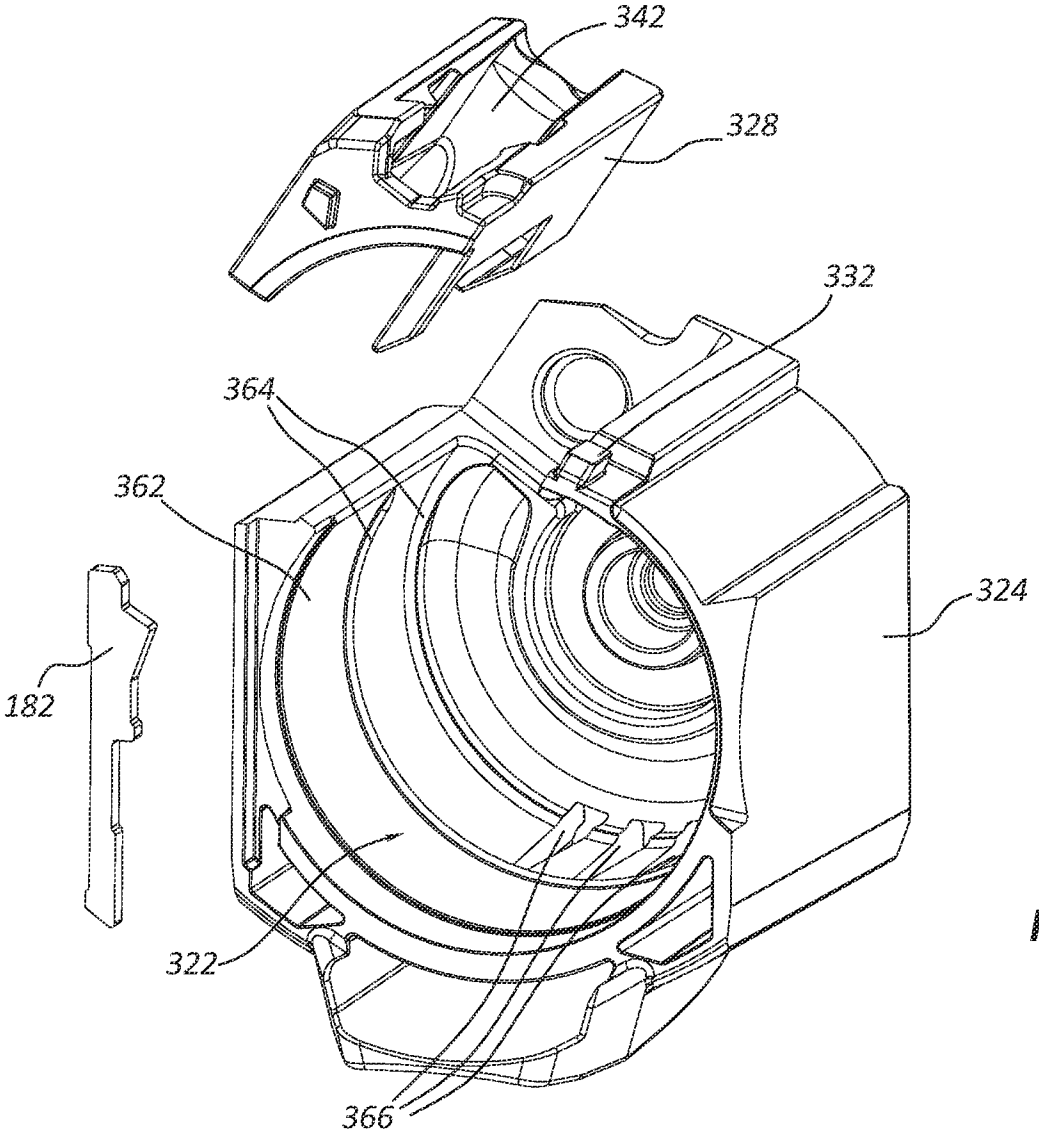
FIG. 133 is an exploded perspective view of the main body, the tab, and the feed lips of the rotary magazine.

In some embodiments, the interior surface 362 of the housing 318 includes one or more ridges 364 as shown in FIGS. 129 and 133. The cartridges contact and ride on the ridges 364 as they move through the housing 318. The ridges 364 keep the cartridges spaced apart from the interior surface 362 to prevent it from getting dirty or otherwise marred.

The ridges 364 are especially useful when used in connection with rimfire cartridges such as the .22 Long Rifle. The rim makes it difficult for rimfire cartridges to slide smoothly along a flat surface. The rim causes the cartridges to be oriented at an angle relative to the surface so that the only parts that touch are the rim and the bullet. This makes moving the cartridges through the magazine problematic. Also, the bullets are often coated with wax, which can easily rub off on the surface.

The ridges 364 hold the cartridges parallel to the interior surface 362 so that they can move smoothly through the magazine 180. In some embodiments, the ridges 364 are positioned so that they do not contact the bullets. Instead, they only contact the casings of the cartridges. This helps reduce the amount of wax that rubs off the bullets as they move through the magazine 180.

In some embodiments, the magazine 180 can have openings 366 in the bottom of the housing 318 through which debris and other foreign matter can exit the housing 318. The openings 366 provide a passive way to continually remove debris from the interior cavity 322 without taking the magazine 180 apart.

Illustrative Embodiments

Reference is made in the following to several illustrative embodiments of the disclosed subject matter. The following embodiments illustrate only a few selected embodiments that may include one or more of the various features, characteristics, and advantages of the disclosed subject matter. Accordingly, the following embodiments should not be considered as being comprehensive of all the possible embodiments.

In one embodiment, a firearm comprises: a housing; and a receiver coupled to the housing; wherein the receiver moves between a first position where the receiver is coupled to the housing and a second position where the receiver is uncoupled from the housing by rotating away from the housing. The receiver can move from the first position to the second position by rotating downward from the housing. The housing can include a front end and the receiver rotates at a location that is adjacent to the front end of the housing. The housing can include a back end and the receiver is held in the first position by a fastener located adjacent to the back end of the housing. The fastener can include a readily releasable fastener. The receiver can include a trigger mechanism. The receiver can include a slide assembly. The receiver can include a bolt. The receiver can be configured to be coupled to a magazine. The receiver can include a cavity configured to receive and hold the magazine. The receiver can be coupled to an underside of the housing. The housing can include a cavity that receives and holds a portion of the receiver when the receiver is in the first position. The firearm can comprise a stock coupled to the housing. The firearm can comprise a barrel coupled to the housing. The firearm can comprise a sighting device coupled to the top of the housing.

In another embodiment, a firearm comprises a barrel; a housing including a front end where the housing is coupled to the barrel, the housing including a back end positioned opposite the front end; and a receiver coupled to the housing, the receiver moving between a first position where the receiver is coupled to the housing and a second position where the receiver is uncoupled from the housing; wherein the receiver rotates on an axis that is adjacent to the front end of the housing as the receiver moves between the first position and the second position; and wherein the receiver is held in the first position by a fastener located adjacent to the back end of the housing. The axis can be at least approximately perpendicular to a lengthwise direction of the housing. The axis can be at least approximately horizontal. The front end of the housing can include a recess configured to receive a corresponding projection on a front end of the receiver; wherein the projection rotates in the recess as the receiver moves between the first position and the second position. The fastener can include a readily releasable fastener. The fastener can include a push-button that extends through a hole in the housing. The push-button can move between an extended position where the receiver is held in the first position and a retracted position where the receiver can move to second position.

In another embodiment, a firearm comprises: a housing; a receiver coupled to the housing, the receiver moving between a first position where the receiver is coupled to the housing and a second position where the receiver is uncoupled from the housing; and a fastener movable between an extended position where the receiver is held in the first position and a retracted position where the receiver can move to the second position. The fastener can include a readily releasable fastener. The fastener can include a push-button that extends through a hole in the housing. The fastener can be biased towards the extended position. The fastener can move between the extended position and the retracted position in a direction that is at least approximately parallel to a lengthwise direction of the housing. The fastener can be a captive component of the receiver. The fastener can only move between the extended position and the retracted position when the receiver is in the first position.

In another embodiment, a firearm comprises: a housing; a receiver coupled to the housing, the receiver including a bolt and a spring that biases the bolt to a closed position, the receiver moving between a first position where the receiver is coupled to the housing and a second position where the receiver is uncoupled from the housing; and a fastener movable between an extended position where the receiver is held in the first position and a retracted position where the receiver can move to the second position; wherein the fastener is biased towards the extended position by the spring. The spring can bias the bolt one direction and biases the fastener an opposite direction. The bolt, the spring, and the fastener can be captive components of the receiver.

In another embodiment, a firearm comprises: a barrel; a stock; and a receiver; wherein the barrel, stock, and the receiver are coupled together to render the firearm operational; and wherein the receiver can be uncoupled from the firearm without moving the barrel or the stock. The receiver can be coupled to the rest of the firearm without moving the barrel or the stock. The receiver can be uncoupled from the firearm without removing the barrel. The receiver can be uncoupled from the firearm without removing the stock. The firearm can comprise a housing configured to receive and hold the receiver, the receiver being coupled to the housing, wherein the receiver can be uncoupled from the firearm without moving the barrel, the stock, or the housing. The firearm can comprise a housing configured to receive and hold the receiver, the receiver being coupled to the housing, wherein the receiver can be uncoupled from the firearm without removing the barrel, the stock, or the housing. The receiver can be uncoupled from the firearm without using tools.

In another embodiment, a firearm comprises: a housing; a receiver coupled to the housing; a barrel coupled to the housing; and a stock coupled to the housing; wherein the receiver can be uncoupled from the housing without moving the housing, the barrel, or the stock. The housing can define a cavity that receives and holds the receiver. The receiver can be uncoupled from the housing without using tools.

In another embodiment, a firearm comprises: a housing; and a receiver coupled to the housing, the receiver including a bolt and a cocking handle coupled to the bolt; wherein the receiver moves between a first position where the receiver is coupled to the housing and a second position where the receiver is uncoupled from the housing; and wherein the cocking handle rotates relative to the bolt as the receiver moves between the first position and the second position. The cocking handle can rotate from an at least substantially horizontal orientation to an at least substantially vertical orientation as the receiver moves from the first position to the second position. The cocking handle can rotate from an at least substantially vertical orientation to an at least substantially horizontal orientation as the receiver moves from the second position to the first position. The receiver can include a guide rod that guides reciprocal movement of the bolt, and wherein the cocking handle rotates around a lengthwise axis of the guide rod. The receiver can include a guide rod that guides reciprocal movement of the bolt, and wherein the cocking handle is coupled to the bolt using the guide rod. The receiver can rotate on a first axis as it moves between the first position and the second position and the cocking handle can rotate on a second axis as the receiver moves between the first position and the second position. The first axis and the second axis can be at least approximately perpendicular to each other.

In another embodiment, a firearm comprises: a housing including an opening; and a receiver coupled to the housing, the receiver including a cocking handle extending through the opening; wherein the receiver moves between a first position where the receiver is coupled to the housing and a second position where the receiver is uncoupled from the housing; and wherein the cocking handle rotates as the receiver moves between the first position and the second position to allow the cocking handle to pass through the opening. The housing can be positioned above the receiver when the firearm is oriented at least substantially horizontally. The opening can be a cartridge ejection port. The opening can be oblong shaped. The cocking handle can rotate upward to pass through the opening as the receiver moves from the first position to the second position. The cocking handle can move downward and backward as the receiver moves from the first position to the second position. The cocking handle can move upward and forward as the receiver moves from the second position to the first position.

In another embodiment, a firearm comprises: a receiver comprising: a trigger mechanism; a bolt; and a cavity configured to receive and hold a magazine; wherein the receiver is a self-contained unit that is detachable from the rest of the firearm. The cavity can be a magazine port. The cavity can be configured to receive a rotary magazine. The cavity can be positioned underneath the bolt. The firearm can be a rimfire firearm. The firearm can be a .22 caliber firearm.

In another embodiment, a firearm comprises: a receiver comprising: a trigger mechanism; a bolt; and a magazine; wherein the receiver is a self-contained unit that is detachable from the rest of the firearm. The magazine can be a rotary magazine. The receiver can include a magazine coupling mechanism. The receiver can include a cavity that receives and holds the magazine.

In another embodiment, a firearm comprises: a receiver comprising: a trigger mechanism; and a bolt; wherein the receiver is a self-contained unit that is detachable from the rest of the firearm; and wherein the receiver is configured to receive cartridges from underneath the bolt. The receiver can comprise a magazine including the cartridges. The receiver can be configured to eject the cartridges sideways away from the receiver.

In another embodiment, a firearm comprises: a housing including a cartridge ejection port in the side of the housing; a receiver coupled to the housing, the receiver comprising: a trigger mechanism; and a bolt; wherein the receiver is a self-contained unit that is detachable from the housing; and wherein the receiver is configured to eject cartridges through the cartridge ejection port. The firearm can comprise a cocking handle coupled to the bolt and extending outward through the cartridge ejection port. The housing can be open on the bottom to receive the receiver.

In another embodiment, a firearm comprises: a receiver comprising: a trigger mechanism; and a bolt; wherein the receiver is a self-contained unit that is detachable from the rest of the firearm; and wherein the receiver is configured to eject cartridges sideways away from the receiver.

In another embodiment, a firearm comprises: a receiver comprising: a trigger mechanism; a bolt; and a cocking handle coupled to the bolt and extending sideways outward from the bolt; wherein the receiver is a self-contained unit that is detachable from the rest of the firearm. The firearm can comprise a housing including a cartridge ejection port, the receiver being coupled to the housing, wherein the cocking handle extends outward through the cartridge ejection port. The cocking handle can extend outward from the bolt in an at least substantially horizontal direction.

In another embodiment, a firearm comprises: a receiver comprising: a trigger mechanism; and a slide assembly including a bolt; wherein the receiver is a self-contained unit that is detachable from the rest of the firearm; and wherein the slide assembly is a self-contained unit that is detachable from the receiver. The slide assembly can include a spring that biases the bolt forward. The slide assembly can include a spring that biases the bolt to a closed position. The slide assembly can include a bolt assembly, a slide base, and a guide rod, wherein the guide rod couples the bolt assembly to the slide base to form the self-contained unit.

In another embodiment, a firearm comprises: a receiver comprising: a trigger mechanism; a slide assembly; and a bolt stop mechanism; wherein the receiver is a self-contained unit that is detachable from the rest of the firearm. The bolt stop mechanism can hold the slide assembly open. The bolt stop mechanism can be manually actuated by a user to hold the slide assembly open. The firearm can comprise a magazine, wherein the bolt stop mechanism can be actuated by the magazine when the magazine is empty.

In another embodiment, a firearm comprises: a slide assembly including a bolt; wherein the slide assembly is a self-contained unit that is detachable from the rest of the firearm. The slide assembly can include a spring that biases the bolt forward. The slide assembly can include a spring that biases the bolt to a closed position. The slide assembly can include a slide base coupled to the bolt. The slide assembly can include a guide rod that guides reciprocal movement of the bolt. The slide assembly can include a cocking handle coupled to the bolt.

In another embodiment, a firearm comprises: a receiver comprising a slide assembly including a bolt: wherein the slide assembly is a self-contained unit that is detachable from the receiver. The firearm can comprise a housing, the receiver being coupled to the housing, wherein the slide assembly includes a slide base that is a fastener that holds the receiver to the housing. The firearm can comprise a housing, wherein the bolt reciprocates forward and backward and the reciprocal movement of the bolt is guided by grooves in the housing and grooves in the receiver. The receiver can include a front upright at a front end of the receiver and a back upright at a back end of the receiver, wherein the slide assembly is positioned between the front upright and the back upright.

In another embodiment, a firearm comprises: a slide assembly comprising: a bolt; a slide base; and a spring; wherein the slide assembly is a self-contained unit that is detachable from the rest of the firearm. The slide assembly can include a striker. The slide assembly can include a striker and a striker spring, the striker spring biasing the striker towards a front end of the bolt. The spring can bias the bolt and the slide base away from each other. The slide assembly can include a guide rod that couples the bolt and the slide base together to form the self-contained unit. The guide rod can extend through the spring. The slide assembly can include a cocking handle coupled to the bolt. The cocking handle can extend outward from the bolt in an at least substantially horizontal direction. The firearm can comprise a housing and a receiver coupled to the housing, the receiver including the slide assembly, wherein the slide base is a fastener that holds the receiver to the housing.

In another embodiment, a firearm comprises: a receiver comprising: a frame; and a slide assembly coupled to the frame, the slide assembly comprising a bolt and a slide base; wherein the slide assembly is a self-contained unit that is detachable from the receiver; and wherein the slide assembly moves between a first position where the slide base is coupled to the frame and a second position where the slide base is uncoupled from the frame to allow the slide assembly to be detached from the receiver. The slide assembly can include a guide rod that couples the bolt and the slide base together to form the self-contained unit. The slide assembly can include a spring that biases the bolt and the slide base away from each other.

In another embodiment, a firearm comprises: a slide assembly including a cocking handle; wherein the cocking handle is a captive component of the slide assembly. The slide assembly can be a self-contained unit that is detachable from the rest of the firearm. The slide assembly can include a bolt and the cocking handle can be coupled to the bolt. The cocking handle can be configured to not move relative to the bolt as the bolt reciprocates forward and backward in the firearm.

In another embodiment, a firearm comprises: a slide assembly including a cocking handle; wherein the slide assembly is a self-contained unit that is detachable from the rest of the firearm. The slide assembly can include a bolt and the cocking handle can be coupled to the bolt. The cocking handle can rotate relative to the bolt when the slide assembly is detached from the rest of the firearm.

In another embodiment, a firearm comprises: a slide assembly including a bolt and a cocking handle coupled to the bolt; wherein the slide assembly is a self-contained unit that is detachable from the rest of the firearm. The cocking handle can be rotatably coupled to the bolt. The slide assembly can include a guide rod extending through a hole in the bolt and a hole in the cocking handle. The slide assembly can include a guide rod coupling the cocking handle to the bolt. The bolt can include a hole and the cocking handle can include a hole, and wherein the slide assembly includes a guide rod extending through the hole in the bolt and the hole in the cocking handle.

In another embodiment, a firearm comprises a bolt that is metal injection molded. The bolt can include no more than three machine cuts. The bolt can include no more than one machine cut. The bolt can include a bolt body coupled to a bolt face and wherein the bolt body and bolt face are metal injection molded.

In another embodiment, a firearm comprises: a bolt comprising: a bolt body; and a bolt face coupled to the bolt body; wherein at least one of the bolt body or the bolt face is metal injection molded. The bolt body can be metal injection molded. The bolt face can be metal injection molded. The bolt body and the bolt face can be metal injection molded. The bolt body and/or the bolt face can include no more than three machine cuts. The bolt body and/or the bolt face can include no more than one machine cut. The bolt body can include no more than one machine cut and the bolt face can include no machine cuts. The bolt face and the bolt body can rotate between a first position where the bolt face and the bolt body are coupled together and a second position where the bolt face and the bolt body are uncoupled from each other. The bolt face can include a firing pin. The firearm can comprise a guide rod that extends through the bolt face and the bolt body when the bolt face and the bolt body are coupled together.

In another embodiment, a method comprises metal injection molding a bolt for a firearm. The method can comprise machining no more than three cuts in the bolt. The method can comprise machining no more than one cut in the bolt. The method can comprise: metal injection molding a bolt body; metal injection molding a bolt face; and coupling the bolt body and the bolt face together.

In another embodiment, a method comprises: metal injection molding a bolt body; metal injection molding a bolt face; and coupling the bolt body and the bolt face together to form a bolt for a firearm. The method can comprise machining no more than three cuts in the bolt body and/or the bolt face. The method can comprise machining no more than one cut in the bolt body and/or the bolt face. The method can comprise machining no more than one cut in the bolt body and machining no cuts in the bolt face. Coupling the bolt body and the bolt face together can comprise rotating at least one of the bolt body and the bolt face from one position where the bolt body and the bolt face are uncoupled to another position where the bolt body and the bolt face are coupled together. The method can comprise: mixing metal powder with a binder to form a feedstock; injecting the feedstock into a first mold to form the bolt body; injecting the feedstock into a second mold to form the bolt face; sintering the bolt body and the bolt face.

In another embodiment, a firearm comprises: an action including a bolt, the bolt comprising: a bolt body; and a bolt face; wherein the bolt body and the bolt face are separate components coupled together to form the bolt; and wherein the bolt body and the bolt face do not move relative to each other when a cartridge is cycled through the action. The bolt body and the bolt face can be coupled together by rotating at least one of the bolt body or the bolt face relative to the other one of the bolt body or the bolt face. The bolt body can include one or more recesses and the bolt face can include one or more lugs, wherein the one or more recesses are configured to receive the one or more lugs to hold the bolt body and the bolt face together. The bolt face can include an extractor. The bolt body can include a recess configured to hold an extractor spring. The bolt face can include a firing pin. The bolt face can include a firing pin spring. The bolt body can include a cavity configured to hold a striker and a striker spring. The bolt body and the bolt face can each include a hole configured to receive a guide rod. The guide rod can prevent the bolt body and the bolt face from being uncoupled from each other when the guide rod extends through the holes in the bolt body and the bolt face. The firearm can comprise a cocking handle coupled to the bolt that prevents the bolt body and the bolt face from moving relative to each other. The firearm can be a rimfire firearm. The firearm can be a .22 caliber firearm.

In another embodiment, a firearm comprises: a bolt including a bolt body and a bolt face; wherein the bolt body and the bolt face are separate components coupled together to form the bolt; and wherein the bolt body and the bolt face do not move relative to each other when a cartridge is cycled through the firearm.

In another embodiment, a firearm comprises: a bolt comprising: a bolt body; and a bolt face including an extractor and firing pin; wherein the bolt body and the bolt face are separate components coupled together to form the bolt; and wherein the bolt body and the bolt face do not move relative to each other when a cartridge is cycled through the firearm. The bolt body can include an extractor spring.

In another embodiment, a firearm comprises: a bolt including a bolt body and a bolt face; wherein the bolt body and the bolt face are coupled together by rotating at least one of the bolt body or the bolt face relative to the other one of the bolt body or the bolt face. The bolt body can include one or more recesses and the bolt face can include one or more lugs, wherein the one or more recesses are configured to rotatably receive the one or more lugs to hold the bolt body and the bolt face together. The bolt body and the bolt face can each include holes that align with each other when the bolt body and the bolt face are coupled together. The firearm can comprise a cocking handle coupled to the bolt that prevents the bolt body and the bolt face from rotating relative to each other.

In another embodiment, a firearm comprises: a bolt including a bolt body and a bolt face; wherein the bolt body and the bolt face move between a first position where the bolt body and the bolt face are coupled together and a second position where the bolt body and the bolt face are uncoupled from each other by rotating at least one of the bolt body or the bolt face relative to the other one of the bolt body or the bolt face. The firearm can comprise a cocking handle coupled to the bolt that holds the bolt body and the bolt face in the first position.

In another embodiment, a firearm comprises: a firing pin movable between a first position where the firing pin is retracted in a hole in a bolt face and a second position where the firing pin extends outward through the hole in the bolt face; and a striker movable between a cocked position where the striker is retracted and spaced apart from the firing pin and a fire position where the striker moves the firing pin to the second position; and wherein the firing pin is biased to the first position. The firearm can comprise a firing pin spring biasing the firing pin to the first position. The firearm can comprise a striker spring biasing the striker from the cocked position to the fire position. The firing pin can be in the first position as a cartridge is ejected from the firearm. The firearm can comprise a sear that holds the striker in the cocked position. The firearm can comprise a bolt body coupled to the bolt face, wherein the striker is at least partially positioned in a cavity in the bolt body and the firing pin and firing pin spring are positioned in a cavity in the bolt face.

In another embodiment, a firearm comprises: a firing pin; and a striker configured to push the firing pin outward through a hole in a bolt face; wherein the firing pin is biased backward into the hole in the bolt face. The firearm can comprise a firing pin spring biasing the firing pin backward into the hole in the bolt face.

In another embodiment, a firearm comprises: a trigger; a sear; and a trigger disconnector movable between a first position where the trigger is connected to the sear and a second position where the trigger is disconnected from the sear; and a slide assembly coupled to the trigger disconnector, the slide assembly moving the trigger disconnector between the first position and the second position. The firearm can comprise a housing, wherein the slide assembly includes a fastener coupling the slide assembly to the housing, and wherein the fastener moves the trigger disconnector between the first position and the second position. The fastener can move the trigger disconnector to the first position when the fastener is properly secured to the housing. The firearm can comprise a spring, wherein the slide assembly moves the spring to move the trigger disconnector between the first position and the second position. The trigger disconnector can rotate between the first position and the second position.

In another embodiment, a firearm comprises: a trigger; a sear; and a trigger disconnector movable between a first position where the trigger is connected to the sear and a second position where the trigger is disconnected from the sear; and a slide assembly coupled to the trigger disconnector; wherein the trigger disconnector is in the first position when the slide assembly is properly seated and the trigger disconnector is in the second position when the slide assembly is not properly seated.

In another embodiment, a firearm comprises: a housing; a receiver coupled to the housing, the receiver comprising: a trigger; a sear; and a trigger disconnector movable between a first position where the trigger is connected to the sear and a second position where the trigger is disconnected from the sear; wherein the trigger disconnector is in the first position when the receiver is secured to the housing and the trigger disconnector is in the second position when the receiver is not secured to the housing. The receiver can comprise a fastener holding the receiver to the housing, wherein the fastener is coupled to the trigger disconnector so that the trigger disconnector is in the first position when the fastener is secured to the housing and the trigger disconnector is in the second position when the fastener is not secured to the housing.

In another embodiment, a firearm comprises: a housing; a receiver coupled to the housing, the receiver comprising: a trigger; a sear; a trigger disconnector movable between a first position where the trigger is connected to the sear and a second position where the trigger is disconnected from the sear; and a fastener holding the receiver to the housing; wherein the fastener is coupled to the trigger disconnector so that the trigger disconnector is in the first position when the fastener is secured to the housing and the trigger disconnector is in the second position when the fastener is not secured to the housing. The fastener can be a push-button extending through a hole in the housing. The firearm can comprise a slide assembly including the slide base that is the fastener.

In another embodiment, a firearm comprises: a magazine coupling mechanism movable between a first position where the magazine coupling mechanism holds a magazine in place and a second position where the magazine coupling mechanism releases the magazine; wherein the magazine coupling mechanism includes a spring biasing the magazine coupling mechanism to the first position; and wherein the spring is configured to bias the magazine outward from the firearm when the magazine coupling mechanism is in the second position. The magazine coupling mechanism can move parallel to a lengthwise direction of the firearm as the magazine coupling mechanism moves between the first position and the second position. The magazine coupling mechanism can move forward to the first position and backward to the second position. The magazine coupling mechanism can include a hole configured to receive and surround the magazine. The magazine coupling mechanism can be configured to engage opposite sides of the magazine when the magazine coupling mechanism is in the first position. The magazine coupling mechanism can be configured to release the opposite sides of the magazine when the magazine coupling mechanism is in the second position. The magazine coupling mechanism can include recesses on opposite sides of the magazine coupling mechanism, and wherein the recesses can be configured to receive and hold projections on opposite sides of the magazine. The firearm can comprise a cavity configured to receive the magazine, wherein the magazine coupling mechanism is positioned in the cavity. The spring can bias the magazine downward from the firearm when the magazine coupling mechanism is in the second position.

In another embodiment, a firearm comprises: a magazine cavity; a magazine positioned in the magazine cavity; and a magazine coupling mechanism positioned in the cavity, the magazine coupling mechanism moving between a first position where the magazine coupling mechanism holds the magazine in place and a second position where the magazine coupling mechanism releases the magazine; wherein the magazine coupling mechanism includes a spring biasing the magazine coupling mechanism to the first position; and wherein the spring biases the magazine outward from the firearm when the magazine coupling mechanism is in the second position.

In another embodiment, a firearm comprises: a magazine coupling mechanism movable between a first position where the magazine coupling mechanism holds a magazine in place and a second position where the magazine coupling mechanism releases the magazine; wherein the magazine coupling mechanism can be moved from the first position to the second position from the side of the firearm; and wherein the firearm is a rimfire firearm. The firearm can be a .22 caliber firearm. The magazine can be a rotary magazine. The firearm can include a cavity in the bottom configured to receive the magazine. The firearm can comprise a stock that is open on the side to allow access to the magazine coupling mechanism on the side of the firearm.

In another embodiment, a firearm comprises: a magazine coupling mechanism movable between a first position where the magazine coupling mechanism holds a magazine in place and a second position where the magazine coupling mechanism releases the magazine; wherein the magazine coupling mechanism can be moved from the first position to the second position from the side of the firearm; and wherein the magazine coupling mechanism moves parallel to a lengthwise direction of the firearm as the magazine coupling mechanism moves between the first position and the second position. The magazine coupling mechanism can slide parallel to the lengthwise direction of the firearm as the magazine coupling mechanism moves between the first position and the second position. The magazine coupling mechanism can move from the first position to the second position by moving backward in a direction that is parallel to the lengthwise direction of the firearm. The magazine coupling mechanism can move from the second position to the first position by moving forward in a direction that is parallel to the lengthwise direction of the firearm.

In another embodiment, a firearm comprises: a magazine coupling mechanism movable between a first position where the magazine coupling mechanism holds a magazine in place and a second position where the magazine coupling mechanism releases the magazine; wherein the magazine coupling mechanism can be moved from the first position to the second position from the side of the firearm; and wherein the magazine coupling mechanism can be moved from the first position to the second position from the bottom of the firearm. The firearm can comprise a cavity in the bottom of the firearm configured to receive the magazine, and wherein the magazine coupling mechanism includes a release positioned adjacent to and in front of the cavity.

In another embodiment, a firearm comprises: a one-piece stock; a cavity in the bottom of the firearm configured to receive and hold a magazine; wherein the firearm has opposing sides and the stock is open on the sides. The stock can be a semi-grip stock. The firearm can be a .22 caliber firearm. The cavity in the bottom of the firearm can be configured to receive and hold a rotary magazine including at least five cartridges. The rotary magazine can include at least seven cartridges. The rotary magazine can include at least ten cartridges. The firearm can comprise a rotary magazine positioned in the cavity, wherein the rotary magazine does not protrude outward from the bottom of the firearm below the stock.

In another embodiment, a firearm comprises: a receiver defining a cavity in the bottom of the firearm configured to receive and hold a rotary magazine; wherein a portion of the receiver that defines the cavity is exposed on the side of the firearm. The receiver can include side walls positioned opposite each other that define the cavity, and wherein the side walls are exposed on opposite sides of the firearm. The rotary magazine can include at least five cartridges. The firearm can comprise a stock coupled to the receiver, wherein the stock is open on the side of the firearm where the receiver is exposed. The firearm can comprise a stock having a cavity configured to receive the receiver, wherein the stock includes recesses on the sides where the receiver is exposed.

In another embodiment, a firearm comprises: a stock; a rotary magazine positioned in a cavity in the bottom of the firearm; wherein the stock can be open on the side of the firearm where the cavity is located. The firearm can include opposite sides and the stock is open on the opposite sides of the firearm where the cavity is located. The rotary magazine can be configured to not protrude outward from the bottom of the firearm below the stock. The firearm can include opposite sides and the stock can be open on the opposite sides where the cavity is located. The firearm can comprise a receiver that defines the cavity. The receiver can include side walls positioned opposite each other that define the cavity, and wherein the side walls are exposed on opposite sides of the firearm where the stock is open. The side walls of the receiver can be flush with the surface of the stock on the opposite sides of the firearm.

In another embodiment, a firearm comprises: a breech; an action comprising: a bolt movable between a closed position where the breech is closed and an open position where the breech is open; and a bolt stop mechanism movable between a first position where the bolt can move from the open position to the closed position and a second position where the bolt is held in the open position; a magazine movable the bolt stop mechanism from the first position to the second position when the magazine is empty; wherein the magazine is a rotary magazine. The magazine can be part of the action. The magazine can be a detachable magazine. The magazine can include a tab that extends outward when the magazine is empty to move the bolt stop mechanism to the second position. The magazine can include a rotor, wherein the rotor pushes the tab upward when the magazine is empty. The bolt stop mechanism can include a manual actuator used to manually move the bolt stop mechanism from the first position to the second position. The manual actuator can be positioned on the bottom of the firearm. The action can include a bolt release used to manually move the bolt stop mechanism from the second position to the first position.

In another embodiment, a firearm comprises: a breech; a bolt movable between a closed position where the breech is closed and an open position where the breech is open; and a rotary magazine that causes the bolt to remain in the open position when the magazine is empty and when the magazine is detached from the firearm. The firearm can comprise a bolt stop mechanism movable between a first position where the bolt can move from the open position to the closed position and a second position where the bolt is held in the open position, wherein the rotary magazine moves the bolt stop mechanism to the second position and the bolt stop mechanism stays in the second position when the rotary magazine is detached from the firearm.

In another embodiment, a firearm comprises: a breech; a bolt movable between a closed position where the breech is closed and an open position where the breech is open; and a magazine that causes the bolt to remain in the open position when the magazine is empty without the magazine contacting the bolt; wherein the magazine is a detachable rotary magazine.

In another embodiment, a rotary magazine comprises: a housing; and a rotor positioned in the housing, the rotor being subjected to a biasing force that rotates the rotor; wherein the rotor prevents the biasing force from being released when the rotor is separated from the housing. The biasing force can include torque that rotates the rotor. The rotary magazine can comprise a spring that exerts the biasing force on the rotor. The spring can be a torsion spring. The biasing force can rotate the rotor relative to the housing, and wherein the rotor holds the biasing force itself when the rotor is separated from the housing.

In another embodiment, a rotary magazine comprises: a housing; and a rotor positioned in the housing, the rotor being subjected to torque that rotates the rotor; wherein the rotor prevents the torque from being released when the rotor is separated from the housing.

In another embodiment, a rotary magazine comprises: a housing; a rotor positioned in the housing; and a spring that exerts torque on the rotor; wherein the torque exerted by the spring is maintained by the rotor when the rotor is separated from the housing. The spring can be twisted and exert torque on the rotor, and wherein the rotor maintains the twisted state of the spring when the rotor is separated from the housing. The spring can be a torsion spring.

In another embodiment, a rotary magazine comprises: a housing; a rotor positioned in the housing; and a spring coupled to the rotor, the spring being in a wound state and exerting torque on the rotor; wherein the rotor holds the spring in the wound state when the rotor is separated from the housing. A first end of the spring can be coupled to the housing and a second end of the spring can be coupled to the rotor when the rotor is coupled to the housing, and wherein the first end of the spring and the second end of the spring are coupled to the rotor when the rotor is separated from the housing. The spring can be a torsion spring.

In another embodiment, a rotary magazine comprises: a housing; a rotor positioned in the housing; and a spring including a first end and a second end; wherein the first end of the spring is coupled to the housing and the second end of the spring is coupled to the rotor when the rotor and the housing are coupled together; and wherein the first end of the spring and the second end of the spring are coupled to the rotor when the rotor and the housing are separated. The spring can be in a wound state and exert torque on the rotor when the magazine is assembled. The magazine can be in an assembled state when the rotor and the housing are coupled together, and wherein the magazine is in a disassembled state when the rotor and the housing are separated.

In another embodiment, a rotary magazine comprises: a housing; a rotor positioned in the housing; and a spring including a first end and a second end; wherein the first end of the spring is coupled to the housing and the second end of the spring is coupled to the rotor when the rotary magazine is assembled; and wherein the first end of the spring and the second end of the spring are coupled to the rotor when the rotary magazine is disassembled.

In another embodiment, a rotary magazine comprises: a housing including a first side and a second side positioned opposite the first side, the first side and the second side being separable from each other; a rotor positioned in the housing; and a spring including a first end coupled to the second side of the housing and a second end coupled to the rotor, the spring being in a wound state and exerting torque on the rotor; wherein the first end of the spring is coupled to the rotor when the first side of the housing and the second side of the housing are separated. The rotor can hold the spring in the wound state when the first side of the housing and the second side of the housing are separated. The rotor can include a catch that holds the first end of the spring when the first side of the housing and the second side of the housing are separated. The rotor can include a catch that holds the second end of the spring to the rotor. The second side of the housing can include a catch that holds the first end of the spring when the first side of the housing and the second side of the housing are coupled together.

In another embodiment, a rotary magazine can be disassembled without using tools. The rotary magazine can comprise a housing that is separable into at least two parts, wherein the housing can be separated into the at least two parts without using tools. The rotary magazine can comprise a main body and a back plate coupled to the main body, wherein the back plate is coupled to the main body using a fastener that can be released without using tools. The fastener can include a hook and catch type fastening mechanism.

In another embodiment, a rotary magazine comprises: a housing movable between an assembled configuration where the housing encloses an interior cavity configured to hold cartridges and a disassembled configuration where the housing is open and the interior cavity is accessible; wherein the housing moves between assembled configuration and the disassembled configuration without using tools. The housing can comprise at least two parts, and wherein the at least two parts are coupled together when the housing is in the assembled configuration and the at least two parts are separated when the housing is in the disassembled configuration. The at least two parts can be coupled together with a fastener that can be released without using tools. The at least two parts can be coupled together with a fastener that can be released without using tools. The housing can comprise a main body and a back plate coupled to the main body, and wherein the back plate is coupled to the main body using a fastener that can be released without using tools.

In another embodiment, a rotary magazine comprises: a housing defining a cavity, the housing including a first housing component and a second housing component coupled together; and a rotor positioned in the cavity of the housing, the rotor being configured to move cartridges through the magazine; wherein the housing moves between an assembled configuration where the first housing component and the second housing component are coupled together and the rotor is enclosed in the housing and a disassembled configuration where the first housing component and the second housing component are uncoupled from each other and the rotor can be removed from the cavity in the housing; and wherein the first housing component and the second housing component are coupled together using a readily releasable fastener. The fastener can include a hook and catch type fastening mechanism. The first housing component can include the catch and the second housing component can include the hook. The first housing component can include a first side of the housing and the second housing component can include a second side of the housing, wherein the second housing component extends from the second side of the housing to the first side of the housing along the bottom of the rotary magazine.

In another embodiment, a rotary magazine comprises: a housing including an interior surface that defines a cavity configured to receive and hold cartridges; wherein the housing is configured so that the cartridges move along the interior surface of the housing; and wherein the housing includes a ridge on the interior surface that is configured to contact the cartridges as the cartridges move through the housing. The rotary magazine can be configured to hold rimfire cartridges. The rotary magazine can be configured to hold .22 caliber cartridges.

In another embodiment, a rotary magazine comprises: a housing defining a cavity configured to receive and hold cartridges; and a rotor positioned in the cavity, the rotor being configured to move the cartridges through the housing; wherein the housing includes a ridge configured to contact the cartridges as the cartridges move through the housing. The cavity can be cylindrical. The ridge can be positioned to contact a case of the cartridges. The housing can include a plurality of ridges configured to contact the cartridges as the cartridges move through the housing. The plurality of ridges can be positioned to contact a case of the cartridges.

In another embodiment, a rotary magazine comprises: a housing including an interior surface that defines a cavity configured to receive and hold cartridges; and a rotor positioned in the cavity, the rotor being configured to move the cartridges through the housing; wherein the housing includes a ridge configured to contact the cartridges as the cartridges move through the housing.

In another embodiment, a rotary magazine comprises: a housing defining a cavity configured to receive and hold cartridges; wherein the housing includes at least one opening in the bottom of the housing through which debris can exit the housing. The rotary magazine can include a feed opening through which cartridges are inserted into the magazine and through which cartridges exit the magazine. The housing can include a side and a bottom, and wherein the at least one opening is positioned adjacent to the location where the side and the bottom meet.

In another embodiment, a rotary magazine comprises: a housing defining a cavity configured to receive and hold cartridges; a rotor positioned in the cavity; the rotor being configured to move the cartridges through the housing; wherein the housing includes at least one opening in the bottom of the housing through which debris can exit the housing.

Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Readily or easily releasable joining refers to joining that can be readily, easily, and/or promptly released with little or no difficulty or effort. Difficult or hard to release joining refers to joining that is difficult, hard, or arduous to release and/or requires substantial effort to release. The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners are given below. The list is divided according to whether the fastening method and/or fastener is generally permanent, readily released, or difficult to release.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or conformant fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, and the like can be permanent, readily releasable, or difficult to release depending on the application.

Any methods described in the claims or specification should not be interpreted to require the steps to be performed in a specific order unless stated otherwise. Also, the methods should be interpreted to provide support to perform the recited steps in any order unless stated otherwise.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The drawings shall be interpreted as illustrating one or more embodiments that are drawn to scale and/or one or more embodiments that are not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any and all ranges or subranges that can be formed by such values.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

INCORPORATION BY REFERENCE

The entire contents of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 62/397,737, titled "Rimfire Rifle Apparatus," filed on 21 Sep. 2016.

The invention claimed is:

1. A receiver for a firearm, the receiver comprising:

a frame;

a trigger mechanism disposed within the frame;

a slide assembly coupled to the frame;

a cocking handle rotatably coupled to the slide assembly; and a fastener extending from the frame and configured to engage with a housing of the firearm, the receiver being removable from the firearm by disengaging the fastener from the housing, wherein:

the fastener is a button biased to remain in an extended position; and the button is depressible to remove the receiver from the housing.

2. The receiver of claim 1, wherein the button translates along a lengthwise direction of the frame.

3. The receiver of claim 1, wherein:

the slide assembly includes a guide rod; and the cocking handle is rotatably coupled to the guide rod.

4. The receiver of claim 3, wherein the cocking handle rotates less than 90 degrees about the guide rod to enable removal of the receiver.

5. The receiver of claim 1, further comprising:
a magazine cavity defined by the frame; and
a magazine disposed within the magazine cavity.

6. The receiver of claim 1, wherein the frame forms a projection disposed within a recess of the housing when the receiver is coupled to the firearm.

7. The receiver of claim 6, wherein the receiver rotates about an axis of rotation defined by the projection when the receiver is removed from the firearm.

8. A firearm comprising:
a barrel;
a stock;
a housing including:
a first end coupled to the barrel; and
a second end coupled to the stock; and
a receiver removably coupled to the housing, the receiver moving between a first position coupled to the housing and a second position uncoupled from the housing;
wherein the receiver rotates on an axis that is adjacent to the first end of the housing as the receiver moves between the first position and the second position; and
wherein the barrel, the housing, and the stock remain coupled when the receiver moves from the first position to the second position.

9. The firearm of claim 8, wherein the receiver is held in the first position by a fastener extending from the receiver to the second end of the housing.

10. The firearm of claim 8, wherein the receiver comprises at least one of a slide assembly, a trigger mechanism, and a cocking handle.

11. The firearm of claim 10, wherein:
the housing defines an opening;
the slide assembly includes a cocking handle that extends through the opening when the receiver is in the first position; and
the cocking handle rotates when the receiver moves from the first position to the second position.

12. The firearm of claim 11, wherein the opening is oblong.

13. The firearm of claim 8, wherein:
the receiver forms a recess; and
the housing defines a protrusion that is received within the recess while the receiver is in the first position.

14. The firearm of claim 8, wherein a hand-tool is coupled to the receiver.

15. The firearm of claim 8, wherein the housing defines a cavity that receives at least a portion of the receiver when the receiver is in the first position.

16. A firearm comprising:
a barrel;
a stock;
a housing positioned between the barrel and the stock; and
a receiver at least partially positioned within the housing, the receiver comprising:
a frame;
a trigger mechanism disposed within the frame;
a slide assembly coupled to the frame; and
a cocking handle rotatably coupled to the slide assembly; and
a fastener extending from the frame and configured to engage with the housing, the receiver being removable from the housing by disengaging the fastener from the housing, wherein:
the fastener is biased in an extended position relative to the receiver;
the fastener includes a push-button that extends through a hole in the housing; and
a spring biases the fastener in a first direction and biases a bolt of the slide assembly in a second direction.

17. The firearm of claim 16, wherein:
the frame forms a projection that is disposed within a recess of the housing when the receiver is coupled to the firearm;
the receiver rotates about an axis of rotation defined by the projection when the receiver is removed from the housing; and
the projection extends perpendicular to a lengthwise direction of the firearm.

* * * * *